US008277296B2

(12) United States Patent
Okada

(10) Patent No.: US 8,277,296 B2
(45) Date of Patent: Oct. 2, 2012

(54) HORSE RACE GAMING MACHINE

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 797 days.

(21) Appl. No.: 12/403,807

(22) Filed: Mar. 13, 2009

(65) Prior Publication Data

US 2009/0239599 A1 Sep. 24, 2009

Related U.S. Application Data

(60) Provisional application No. 61/036,203, filed on Mar. 13, 2008, provisional application No. 61/036,212, filed on Mar. 13, 2008, provisional application No. 61/036,554, filed on Mar. 14, 2008, provisional application No. 61/036,564, filed on Mar. 14, 2008, provisional application No. 61/037,070, filed on Mar. 17, 2008.

(51) Int. Cl.
*A63F 9/24* (2006.01)

(52) U.S. Cl. ..... 463/6; 463/27; 463/28; 463/31; 463/37; 463/42; 463/43

(58) Field of Classification Search ..... None
See application file for complete search history.

(56) References Cited

U.S. PATENT DOCUMENTS 4,199,147 A 4/1980 Stansberry
4,322,612 A * 3/1982 Lange ..... 463/28
4,874,177 A 10/1989 Girardin
5,411,258 A * 5/1995 Wilson et al. ..... 463/6
6,120,376 A * 9/2000 Cherry ..... 463/16
6,139,430 A * 10/2000 Huard et al. ..... 463/16
6,210,275 B1 * 4/2001 Olsen ..... 463/16
6,358,150 B1 * 3/2002 Mir et al. ..... 463/28
6,406,369 B1 * 6/2002 Baerlocher et al. ..... 463/20
6,450,887 B1 * 9/2002 Mir et al. ..... 463/42
6,695,701 B2 * 2/2004 Aronson et al. ..... 463/28
6,780,110 B2 * 8/2004 Baerlocher et al. ..... 463/20
6,848,991 B2 * 2/2005 Kusuda ..... 463/6
6,875,104 B2 * 4/2005 Hara ..... 463/6
7,070,499 B2 * 7/2006 Ocampo ..... 463/6
7,582,013 B2 * 9/2009 Asher et al. ..... 463/25
7,742,972 B2 * 6/2010 Lange et al. ..... 705/37
7,883,411 B2 * 2/2011 Vlazny et al. ..... 463/28
7,942,735 B2 * 5/2011 Meyer et al. ..... 463/25
8,062,111 B2 * 11/2011 Aronson et al. ..... 463/6
2003/0119570 A1 * 6/2003 Maroun ..... 463/6
2003/0199315 A1 * 10/2003 Downes P.E. ..... 463/28
(Continued)

*Primary Examiner* — David E Graybill
(74) *Attorney, Agent, or Firm* — NDQ&M Watchstone LLP

(57) ABSTRACT

In the horse race gaming machine 60001, orders of arrival in racing games are stored for each of the player's racehorses. If the player's racehorses, in consecutive racing games equal to or more than a predetermined number of times including a result of this racing game, have finished consecutively in a place equal to or lower than a predetermined place (S60602: YES), a part of total BET amount specified by the player for this racing game is refunded to the player (S60603). Otherwise, a part or all of insurance is paid to the player in accordance with the predetermined number. Incidentally, to have a player's racehorse run in this racing game, there may be a case that the player is required to pay an entry point given to the player in accordance with BET amount specified by the player. By the player's specifying a side bet, the player's racehorse is able to be made a race entry in any of the racing games.

8 Claims, 130 Drawing Sheets

U.S. PATENT DOCUMENTS

2003/0232651 A1* 12/2003 Huard et al. ..... 463/42
2004/0235542 A1* 11/2004 Stronach et al. ..... 463/6
2006/0246990 A1* 11/2006 Downes ..... 463/16
2007/0026940 A1* 2/2007 Cannella ..... 463/28
2007/0087804 A1* 4/2007 Knowles et al. ..... 463/16
2007/0087825 A1* 4/2007 Hart et al. ..... 463/28
2008/0102916 A1* 5/2008 Kovacs et al. ..... 463/16
2008/0182662 A1* 7/2008 Yoshizawa ..... 463/31
2009/0227361 A1* 9/2009 Wright et al. ..... 463/25
2009/0291725 A1* 11/2009 Ishida ..... 463/6

* cited by examiner

| ENTRY-POSSIBLE RACE | MAXIMUM ENTRY | REMAINING ENTRY |
|---|---|---|
| ○○○ RACE | 16 | 14 |
| ○○△ RACE | 10 | 5 |
| ○△○ RACE | 16 | 2 |
| △○○ RACE | 12 | 11 |
| △△○ RACE | 8 | 7 |
| △○△ RACE | 10 | 0 |
| △△△ RACE | 16 | 1 |

| RACEHORSE | CHARACTER ID |
|---|---|
|  | RACEHORSE 001 |
|  | RACEHORSE 002 |
|  | RACEHORSE 003 |
| ⋮ | ⋮ |

| CHARACTER ID | PLAYER ID |
|---|---|
| RACEHORSE 001 | PLAYER 05102 |
| RACEHORSE 002 | — |
| RACEHORSE 003 | PLAYER 0031 |
| ⋮ | ⋮ |

FIG. 16

| △△○ RACE | |
|---|---|
| 1 | RACEHORSE 325 |
| 2 | |
| 3 | |
| 4 | |
| 5 | |
| 6 | |
| 7 | |
| 8 | |

FIG. 22

| PLAYER ID | PLAYER 05671 | |
|---|---|---|
| RACEHORSE ID | RACEHORSE 313 | RACEHORSE 671 |
| RACE N | 9 | 10 |
| RACE N-1 | — | 15 |
| RACE N-2 | 3 | 11 |
| RACE N-3 | 2 | 10 |
| RACE N-4 | 15 | 2 |
| RACE N-5 | 13 | — |
| ⋮ | ⋮ | ⋮ |

FIG. 23

| CONSECUTIVE NUMBER OF TIMES | INSURANCE |
|---|---|
| ~7 | 10% |
| 6 | 5% |
| 5 | 4% |
| 4 | 3% |
| 3 | 2% |

| RACEHORSE | CHARACTER ID |
|---|---|
|  | RACEHORSE 001 |
|  | RACEHORSE 002 |
|  | RACEHORSE 003 |
| ⋮ | ⋮ |

| CHARACTER ID | PLAYER ID |
|---|---|
| RACEHORSE 001 | PLAYER 05102 |
| RACEHORSE 002 | — |
| RACEHORSE 003 | PLAYER 0031 |
| ⋮ | ⋮ |

FIG. 44

| △△○ RACE | |
|---|---|
| 1 | RACEHORSE 325 |
| 2 | |
| 3 | |
| 4 | |
| 5 | |
| 6 | |
| 7 | |
| 8 | |

FIG. 49

| STATION NUMBER | PLAYER ID |
|---|---|
| 1 | PLAYER 0937 |
| 2 | PLAYER 0005 |
| 3 | — |
| 4 | PLAYER 0812 0051 |
| ⋮ | ⋮ |

FIG. 50

| △△○ RACE | | |
|---|---|---|
| HORSE NUMBER | CHARACTER ID | PLAYER ID |
| 1 | RACEHORSE 003 | PLAYER 0005 |
| 2 | RACEHORSE 007 | PLAYER 0812 |
| 3 | RACEHORSE 019 | — |
| ⋮ | ⋮ | ⋮ |

FIG. 51

| △△○ RACE | | | |
|---|---|---|---|
| ORDER OF FINISH | CHARACTER ID | PLAYER ID | BASE PAYOUT |
| 1 | RACEHORSE 913 | PLAYER 0937 | 100 |
| 2 | RACEHORSE 003 | PLAYER 0005 | 50 |
| 3 | RACEHORSE 019 | — | 40 |
| ⋮ | ⋮ | ⋮ | ⋮ |

| RACEHORSE | CHARACTER ID |
|---|---|
|  | RACEHORSE 001 |
|  | RACEHORSE 002 |
|  | RACEHORSE 003 |
| ⋮ | ⋮ |

| CHARACTER ID | PLAYER ID |
|---|---|
| RACEHORSE 001 | PLAYER 05102 |
| RACEHORSE 002 | — |
| RACEHORSE 003 | PLAYER 0031 |
| ⋮ | ⋮ |

FIG. 72

| △△○ RACE | |
|---|---|
| 1 | RACEHORSE 325 |
| 2 | |
| 3 | |
| 4 | |
| 5 | |
| 6 | |
| 7 | |
| 8 | |

| STATION NUMBER | PLAYER ID |
|---|---|
| 1 | PLAYER 0937 |
| 2 | PLAYER 0005 |
| 3 | — |
| 4 | PLAYER 0812 0051 |
| ⋮ | ⋮ |

| △△○ RACE | | |
|---|---|---|
| HORSE NUMBER | CHARACTER ID | PLAYER ID |
| 1 | RACEHORSE 003 | PLAYER 0005 |
| 2 | RACEHORSE 007 | PLAYER 0812 |
| 3 | RACEHORSE 019 | — |
| ⋮ | ⋮ | ⋮ |

| RACING GAME | RANDOM NUMBER |
|---|---|
| REGULAR RACING GAME | 0~200 |
| SPECIAL RACING GAME | 201~255 |

| △△○ RACE | |
|---|---|
| STATION NUMBER | PAYOUT AMOUNT |
| 1 | 153 |
| 2 | 72 |
| 3 | — |
| 4 | 5 |
| ⋮ | ⋮ |

| RACEHORSE | CHARACTER ID |
|---|---|
|  | RACEHORSE 001 |
|  | RACEHORSE 002 |
|  | RACEHORSE 003 |
| ⋮ | ⋮ |

| CHARACTER ID | PLAYER ID |
|---|---|
| RACEHORSE 001 | PLAYER 05102 |
| RACEHORSE 002 | — |
| RACEHORSE 003 | PLAYER 0031 |
| ⋮ | ⋮ |

FIG. 105

| △△○ RACE | |
|---|---|
| 1 | RACEHORSE 325 |
| 2 | |
| 3 | |
| 4 | |
| 5 | |
| 6 | |
| 7 | |
| 8 | |

FIG. 110

| PREDETERMINED NUMBER | HOLDING |
|---|---|
| 10 | DONE |
| 20 | NOT YET |
| 30 | NOT YET |
| 40 | NOT YET |
| 50 | NOT YET |

FIG. 111

| RACE NAME | HOST NAME |
|---|---|
| ○○□△ RACE | PLAYER 0713 |
| △△△□ RACE | — |
| □△○△ RACE | — |
| ⋮ | ⋮ |

| ENTRY-POSSIBLE RACE | MAXIMUM ENTRY | REMAINING ENTRY |
|---|---|---|
| ○○○ RACE | 16 | 14 |
| ○○△ RACE | 10 | 5 |
| ○△○ RACE | 16 | 2 |
| △○○ RACE | 12 | 11 |
| △△○ RACE | 8 | 7 |
| △○△ RACE | 10 | 0 |
| △△△ RACE | 16 | 1 |

| RACEHORSE | CHARACTER ID |
| --- | --- |
|  | RACEHORSE 001 |
|  | RACEHORSE 002 |
|  | RACEHORSE 003 |
| ⋮ | ⋮ |

| CHARACTER ID | PLAYER ID |
|---|---|
| RACEHORSE 001 | PLAYER 05102 |
| RACEHORSE 002 | — |
| RACEHORSE 003 | PLAYER 0031 |
| ⋮ | ⋮ |

FIG. 134

| △△○ RACE | |
|---|---|
| 1 | RACEHORSE 325 |
| 2 | |
| 3 | |
| 4 | |
| 5 | |
| 6 | |
| 7 | |
| 8 | |

FIG. 140

| STATION NUMBER | PLAYER ID |
|---|---|
| 1 | PLAYER 0937 |
| 2 | PLAYER 0005 |
| 3 | — |
| 4 | PLAYER 0812 0051 |
| ⋮ | ⋮ |

FIG. 141

| PLAYER 0005 | | |
|---|---|---|
| RACE NUMBER | PRIZE | MAINTENANCE COST |
| 1 | 50 | 0 |
| 2 | 0 | 0 |
| 3 | 100 | 10 |
| 4 | 20 | 30 |
| 5 | 0 | 0 |
| | • | |

⋮

FIG. 142

| RANKING | TOTAL EARNING | JACKPOT PRIZE |
|---|---|---|
| S | ~1000 | 20% |
| A | 999~500 | 5% |
| B | 499~100 | 1% |

HORSE RACE GAMING MACHINE

CROSS-REFERENCE TO RELATED APPLICATIONS

This application is based upon and claims a priority from the U.S. Provisional Patent Application No. 61/036,203 filed on Mar. 13, 2008, the U.S. Provisional Patent Application No. 61/036,212 filed on Mar. 13, 2008, the U.S. Provisional Patent Application No. 61/036,554 filed on Mar. 14, 2008, the U.S. Provisional Patent Application No. 61/036,564 filed on Mar. 14, 2008 and the U.S. Provisional Patent Application No. 61/037,070 filed on Mar. 17, 2008, the entire contents of which are incorporated herein by reference.

BACKGROUND

1. Field of the Invention

The present invention relates to a horse race gaming machine for executing racing games.

2. Description of Related Art

Conventionally, as one of gaming machines, there has been a horse race gaming machine for executing racing games, as described in U.S. Pat. No. 4,874,177 or U.S. Pat. No. 4,199,147, etc.

In this respect, in the gaming machines, there are a number of models that award a player with a different prize (e.g., jackpot) from that to be awarded to him/her in a main game. Therefore, also in a horse race gaming machine, if a different prize from that awarded to players in a racing game could be awarded to the players, it would be possible to excite them.

Needless to say, racing games to be played on a horse race gaming machine are created based on horse racing. Thus, racing games include such different components as not only a winning horse, order of arrival, but also past performance of racehorses, earnings of racehorse owners, etc.

In other words, even in addition to an original racing game in which a prize is awarded to players who guessed right a winning horse or order of arrival, if a horse race gaming machine was configured to award players a prize related to that racing game, it could also excite the players.

However, if another bet is required to achieve the state in which a prize related to a racing game is awarded to players, many of the players may give up a prize related to a racing game if there is no merit or fun to the player.

SUMMARY

The present invention is made in light of the above, and it is the first object of the present invention to provide a novel, unprecedented horse race gaming machine which is configured in such a manner that, when a prize related to a result of a racing game is awarded to a player in addition to a prize to be awarded to the player who guesses right a result of a racing game, a part of another bet is refunded to the player, even if such bet is required.

The present invention is made in light of the above, and it is the second object of the present invention to provide a novel, unprecedented horse race gaming machine by configuring it so that players can be awarded a prize related to a result of a racing game, in addition to a prize to be awarded to players who guessed right a result of a racing game.

The present invention is made in light of the above, and it is the third object of the present invention to provide a novel, unprecedented horse race gaming machine by configuring it so that players can be awarded a right based on a result of a racing game, in addition to a prize to be awarded to players who guessed right a result of a racing game.

To achieve the first object of the present invention, there is provided a horse race gaming machine comprising: a plurality of racing games constituting a horse racing game; a plurality of stations each provided with: a bet amount specifying device with which a player specifies a bet amount for any of a plurality of racehorses which are run in a current racing game; and an input device with which a player inputs information used for progressing the horse racing game; and a processor which is programmed, for progressing the horse racing game by controlling the plurality of stations, to execute processes of: (1) determining whether or not a player has become an owner of any one of the racehorses based on an input made by the player using the input device; and (2) in the station at which the player who is determined to have become an owner of any one of the racehorses is playing: (2-1) determining whether or not the racehorses whose owner is the player, in consecutive racing games equal to or more than a predetermined number of times including the current racing game, have finished consecutively in a place equal to or lower than a predetermined place; and (2-2) refunding, from a credit amount corresponding to total bet amount for the current racing game specified by the player with the bet amount specifying device, to the player, a credit amount corresponding to the number of times of consecutive racing games in which the racehorses whose owner is the player have finished consecutively in a place equal to or lower than the predetermined place, if it is determined that the racehorses whose owner is the player, in consecutive racing games equal to or more than the predetermined number of times including the current racing game, have finished consecutively in a place equal to or lower than the predetermined place.

Furthermore, according to another aspect of the present invention, there is provided a horse race gaming machine comprising: a plurality of racing games constituting a horse racing game; a plurality of stations each provided with: a bet amount specifying device with which a player specifies a bet amount for any of a plurality of racehorses which are run in a current racing game; and an input device with which a player inputs information used for progressing the horse racing game; an insurance in which a credit amount corresponding to a part of total bet amount for the current racing game specified by the player with the bet amount specifying device is accumulated; and a processor which is programmed, for progressing the horse racing game by controlling the plurality of stations, to execute processes of: (1) determining whether or not a player has become an owner of any one of the racehorses based on an input made by the player using the input device; and (2) in the station at which the player who is determined to have become an owner of any one of the racehorses is playing: (2-1) determining whether or not the racehorses whose owner is the player, in consecutive racing games equal to or more than a predetermined number of times including the current racing game, have finished consecutively in a place equal to or lower than a predetermined place; and (2-2) refunding, from the insurance, to the player, a credit amount corresponding to the number of times of consecutive racing games in which the racehorses whose owner is the player have finished consecutively in a place equal to or lower than the predetermined place, if it is determined that the racehorses whose owner is the player, in consecutive racing games equal to or more than the predetermined number of times including the current racing game, have finished consecutively in a place equal to or lower than the predetermined place.

To achieve the second object of the present invention, there is provided a horse race gaming machine comprising: a plurality of racing games constituting a horse racing game; a plurality of stations each provided with: a bet amount specifying device with which a player specifies a bet amount for any of a plurality of racehorses which are run in a current racing game; and an input device with which a player inputs information used for progress of the horse racing game; and a processor which is programmed, for executing a side game, with which a racing game in which a payout is awarded to a player is accompanied, based on a bet amount specified by the player through an input with the bet amount specifying device and a racing game result of the racehorse for which the bet amount is specified, to execute processes of: (1) identifying the racehorse whose owner is a player based on an input made by the player using the input device; (2) calculating number of the racehorses whose owner is a player playing at any one of the plurality of stations among the racehorses which are going to run in the current racing game, based on a result of the identification; (3) ranking the player who is an owner of one of the racehorses in accordance with an order of arrival of the respective racehorses in the current racing game if it is determined that the calculated number of the racehorses is equal to or more than a predetermined number; and (4) awarding respective payout which depended on the respective ranks which are set at the ranking to each of the players.

Furthermore, according to another aspect of the present invention, there is provided a horse race gaming machine comprising: a plurality of racing games constituting a horse racing game; a plurality of stations each provided with: a bet amount specifying device with which a player specifies a bet amount for any of a plurality of racehorses which are run in a current racing game; a side bet amount specifying device with which a player specifies a side bet amount for the current racing game; an input device with which a player inputs information used for progress of the horse racing game; and a sub monitor which displays gaming information concerning the horse racing game; an entry limit limiting number of racehorses which can run in each racing game; and a processor which is programmed, for executing a side game, with which a racing game in which a payout is awarded to a player is accompanied, based on a bet amount specified by the player through an input with the bet amount specifying device and a racing game result of the racehorse for which the bet amount is specified, to execute in each of the stations processes of: (1) determining whether or not a player has become an owner of any one of the racehorses based on an input made by the player using the input device; (2) in the station at which the player who is determined to have become an owner of any one of the racehorses is playing: (2-1) displaying on the sub monitor a message encouraging the player to make a race entry of the racehorse, whose owner is the player, in the current racing game; and (2-2) making a race entry of the racehorse, whose owner is the player, in the current racing game, on condition that, before the current racing game is started, the player has specified a side bet amount for the current racing game with the side bet amount specifying device; (3) executing the current racing game if the entry limit is filled up with a race entry of the racehorse whose owner is a player playing at any one of the plurality of stations; (4) ranking the player who is an owner of one of the racehorses in accordance with an order of arrival of the respective racehorses in the current racing game; (5) calculating a payout amount based on both the rank set at the ranking and the side bet amount specified for the current racing game with the side bet amount specifying device by the player who is ranked; and (6) awarding the calculated payout amount to the player.

To achieve the third object of the present invention, there is provided a horse race gaming machine comprising: a plurality of racing games constituting a horse racing game; a plurality of stations each provided with: an input device with which a player inputs information used for progress of the horse racing game; and a sub monitor which displays gaming information concerning the horse racing game; and a processor which is programmed, for progressing the horse racing game by controlling the plurality of stations, to execute processes of: (1) executing a special game racing for a right to become an owner of any one of racehorses; and (2) in the station at which a player who is an owner of the racehorse which finishes in a first place in the special racing game is playing: (2-1) displaying on the sub monitor a plurality of the racehorses which can be subjects of the right; (2-2) identifying the racehorse which is the subject of the right based on an input made by the player using the input device; and (2-3) setting the player to an owner of the identified racehorse.

Furthermore, according to another aspect of the present invention, there is provided a horse race gaming machine comprising: a plurality of racing games constituting a horse racing game; a plurality of stations each provided with: a side bet amount specifying device with which a player specifies a side bet amount for the racing game; an input device with which a player inputs information used for progress of the horse racing game; and a sub monitor which displays gaming information concerning the horse racing game; an entry limit limiting number of racehorses which can run in each racing game; and a processor which is programmed, for progressing the horse racing game by controlling the plurality of stations, to execute processes of: (1) determining whether or not a player has become an owner of any one of the racehorses based on an input made by the player using the input device; (2) in the station at which the player who is determined to have become an owner of any one of the racehorses is playing: (2-1) displaying on the sub monitor a message encouraging the player to make a race entry of the racehorse, whose owner is the player, in a special racing game for a right to become an owner of any one of the racehorses; and (2-2) making a race entry of the racehorse, whose owner is the player, in the special racing game, on condition that, before the special racing game is started, the player has specified a side bet amount for the special racing game with the side bet amount specifying device; (3) executing the special racing game if the entry limit is filled up with a race entry of the racehorse whose owner is a player playing at any one of the plurality of stations; and (4) in the station at which a player who is an owner of the racehorse which finishes in a first place in the special racing game is playing: (4-1) displaying on the sub monitor a plurality of the racehorses which can be subjects of the right; (4-2) identifying the racehorse which is the subject of the right based on an input made by the player using the input device; and (4-3) setting the player to an owner of the identified racehorse.

Furthermore, according to another aspect of the present invention, there is provided a horse race gaming machine comprising: a plurality of racing games constituting a horse racing game; a plurality of stations each provided with: a bet amount specifying device with which a player specifies a bet amount for any of the plurality of racehorses which are run in the racing game; an input device with which a player inputs information used for progress of the horse racing game; and a sub monitor which displays gaming information concerning the horse racing game; and a processor which is programmed, for progressing the horse racing game by controlling the plurality of stations, to execute processes of: (1) executing a special game racing for a right to become an owner of any one of the racehorses; (2) identifying a player to whom highest payout is awarded in the special racing game, based on a result of the special racing game and a bet amount specified for any of the plurality of racehorses which are run in the special racing game through an input with the bet amount specifying device; and (3) in the station at which the identified player who is playing: (3-1) displaying on the sub monitor a plurality of the racehorses which can be subjects of the right; (3-2) identifying the racehorse which is the subject of the right based on an input made by the player using the input device; and (3-3) setting the player to an owner of the identified racehorse.

Furthermore, according to another aspect of the present invention, there is provided a horse race gaming machine comprising: a plurality of racing games constituting a horse racing game; a plurality of stations each provided with an input device with which a player inputs information used for progress of the horse racing game; a plurality of predetermined numbers which are different from each other; and a processor which is programmed, for progressing the horse racing game by controlling the plurality of stations, to execute processes of: (1) determining whether or not a player has become an owner of any of racehorses which can run in each of the racing games based on an input made by the player using the input device; (2) identifying a racehorse whose owner is the player if it is determined that the player has become the owner of any of the racehorses which can run in each of the racing games; (3) counting number of the identified racehorse; (4) executing a special racing game to which the player is a host if the counted number has reached any one of the predetermined numbers; and (5) awarding a special payout for the special racing game having been executed and a result payout based on a racing result of the special racing game to the player who is the special racing game's host.

Furthermore, according to another aspect of the present invention, there is provided a horse race gaming machine comprising: a plurality of racing games constituting a horse racing game; a plurality of stations each provided with an input device with which a player inputs information used for progress of the horse racing game; a plurality of predetermined numbers which are different from each other; and a processor which is programmed, for progressing the horse racing game by controlling the plurality of stations, to execute processes of: (1) determining whether or not a player has become an owner of any of racehorses which can run in each of the racing games based on an input made by the player using the input device; (2) identifying a racehorse whose owner is the player if it is determined that the player has become the owner of any of the racehorses which can run in each of the racing games; (3) counting number of the identified racehorse; (4) having the player execute as a host a special racing game in which only the racehorse whose owner is the player can run, if the counted number has reached any one of the predetermined numbers; and (5) awarding a special payout for the special racing game having been executed and a result payout based on a racing result of the special racing game to the player who is the special racing game's host.

To achieve the second object of the present invention, there is provided a horse race gaming machine comprising: a plurality of racing games constituting a horse racing game; a plurality of stations each provided with an input device with which a player inputs information used for progress of the horse racing game; a plurality of ranks which rates a total earning of a player; and a processor which is programmed, for progressing the horse racing game by controlling the plurality of stations, after every predetermined number of executions of the racing games, to execute processes of: (1) calculating an all prize amount earned by a player who is an owner of any of a plurality of racehorses having a possibility of running in any of the racing games, through making each of the racehorse whose owner is the player run in each of the racing game; (2) calculating an all maintenance cost spent to each of the racehorse whose owner is the player; (3) calculating a total earning of the player based on the all prize amount calculated and the all maintenance cost calculated; (4) specifying a rank corresponding to the total earning calculated, among the plurality of ranks; and (5) awarding the player a privilege in accordance with the rank specified.

Furthermore, according to another aspect of the present invention, there is provided a horse race gaming machine comprising: a plurality of racing games constituting a horse racing game; a plurality of stations each provided with: a bet amount specifying device with which a player specifies a bet amount for any of a plurality of racehorses which are run in the racing game; and an input device with which a player inputs information used for progress of the horse racing game; a plurality of ranks which rates a total earning of a player; a jackpot prize to which a part of a bet amount specified by the player using the bet amount specifying device is included; and a processor which is programmed, for progressing the horse racing game by controlling the plurality of stations, after every predetermined number of executions of the racing games, to execute processes of: (1) calculating an all prize amount earned by a player who is an owner of any of a plurality of racehorses through making each of the racehorse whose owner is the player run in each of the racing game; (2) calculating an all maintenance cost spent to each of the racehorse whose owner is the player; (3) calculating a total earning of the player based on the all prize amount calculated and the all maintenance cost calculated; (4) specifying a rank corresponding to the total earning calculated, among the plurality of ranks; and (5) awarding the player a prize, which divided from the jackpot, in accordance with the rank specified.

To achieve the first object, the second object and the third object of the present invention, there is provided a horse race gaming machine comprising: a plurality of racing games constituting a horse racing game; a plurality of stations each provided; and a processor which is programmed, for progressing the horse racing game by controlling the plurality of stations, to execute processes of: (1) executing a game racing; and (2) in the station at which a player who is an owner of racehorse is playing, awarding the player one of a prize and a right that are related to the racehorse whose owner is the player.

BRIEF DESCRIPTION OF THE DRAWINGS

FIG. 16 is a view showing one example of a data table;

FIG. 22 is a view showing one example of a data table;

FIG. 23 is a flow chart diagram showing one example of game operations in the horse race gaming machine;

FIG. 44 is a view showing one example of a data table;

FIG. 49 is a view showing one example of a data table;

FIG. 50 is a view showing one example of a data table;

FIG. 51 is a view showing one example of a data table;

FIG. 72 is a view showing one example of a data table;

FIG. 105 is a view showing one example of a data table;

FIG. 110 is a view showing one example of a data table;

FIG. 111 is a view showing one example of a data table;

FIG. 120 is a perspective view of the horse race gaming machine;

FIG. 121 is a perspective view of a station;

FIG. 122 is a block diagram of a racing game unit;

FIG. 123 is a block diagram of the station;

FIG. 124 is a front view showing one example of a regular BET image displayed on a sub monitor;

FIG. 125 is a front view showing one example of the regular BET image displayed on the sub monitor;

FIG. 126 is a front view showing one example of a high BET image displayed on the sub monitor;

FIG. 127 is a front view showing one example of an owner image displayed on the sub monitor;

FIG. 128 is a front view showing one example of the owner image displayed on the sub monitor;

FIG. 129 is a front view showing one example of an entry-possible race image displayed on the sub monitor;

FIG. 130 is a front view showing one example of the entry-possible race image displayed on the sub monitor;

FIG. 131 is a view showing one example of a data table;

Figures 132, 133:
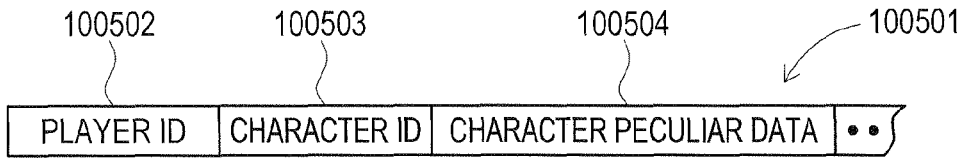
Figure 135:
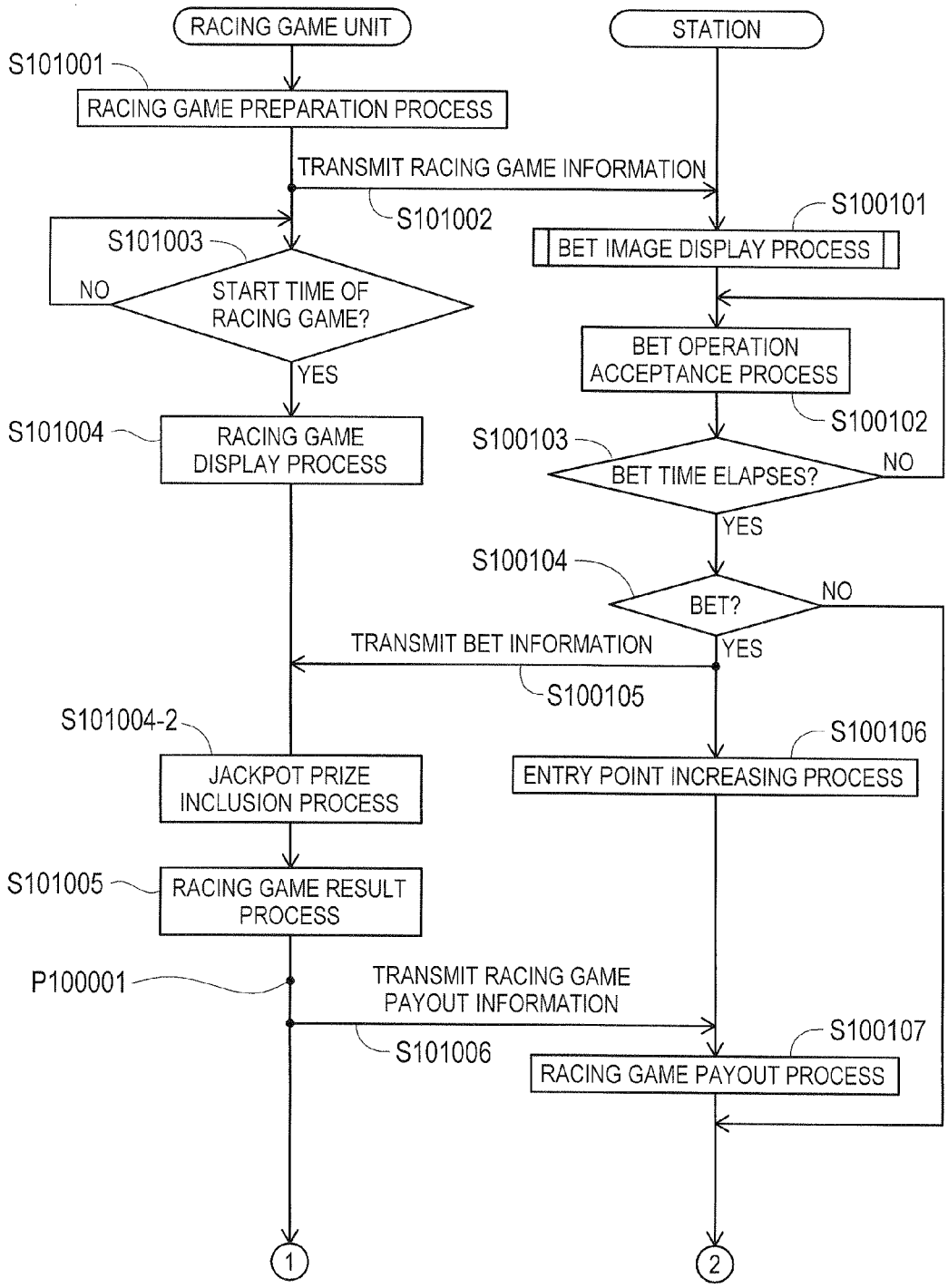
Figure 136:
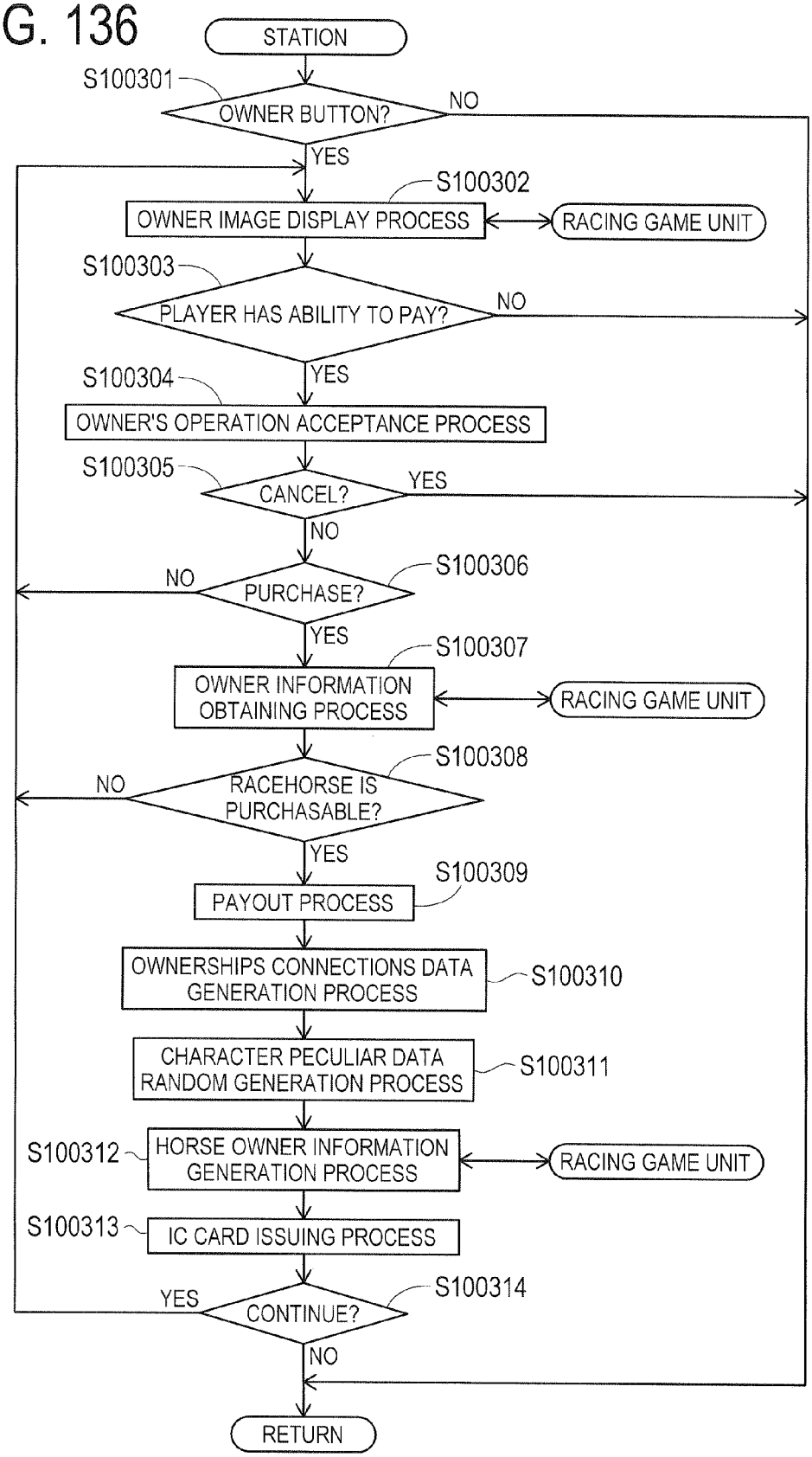
Figure 137:
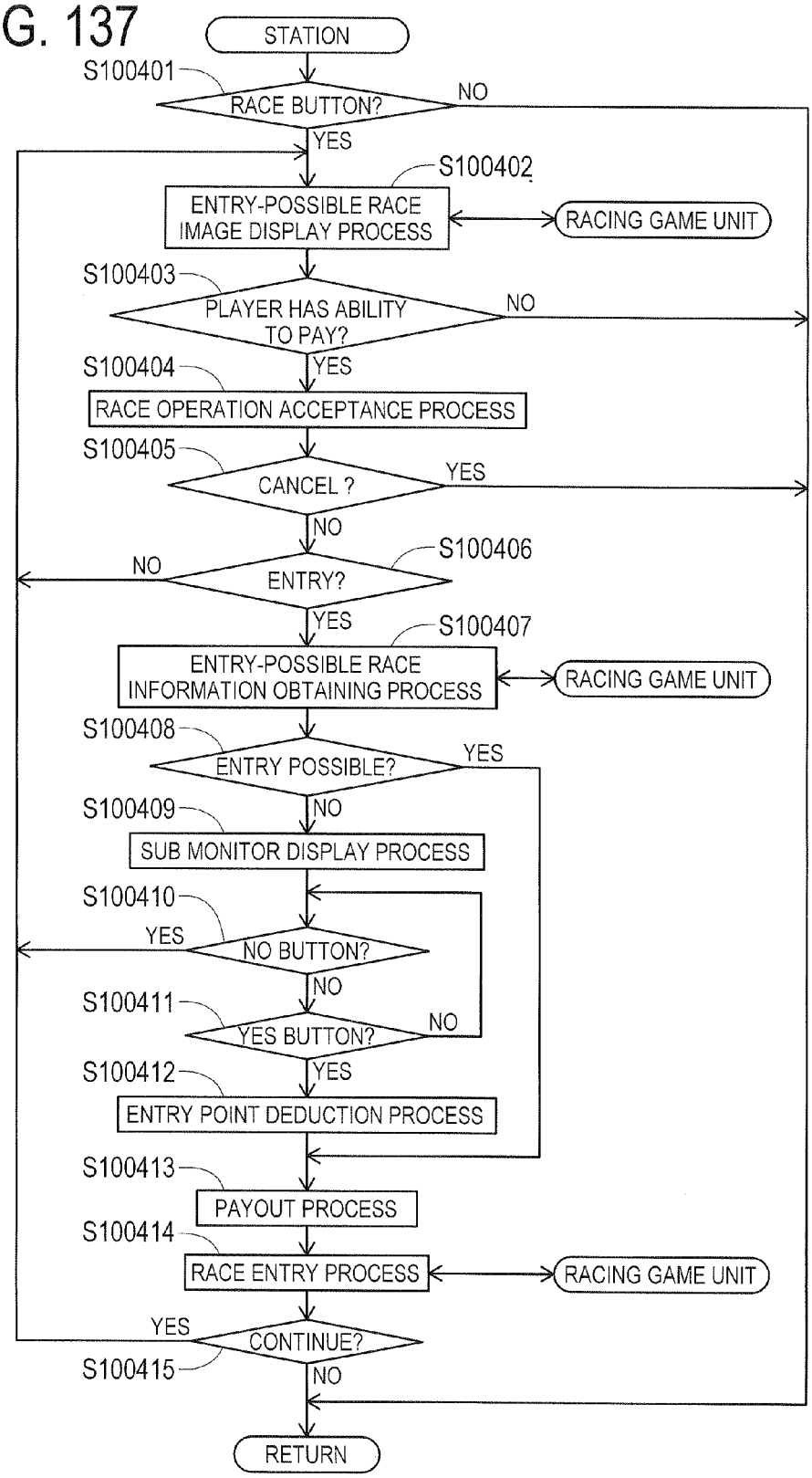
Figure 138:
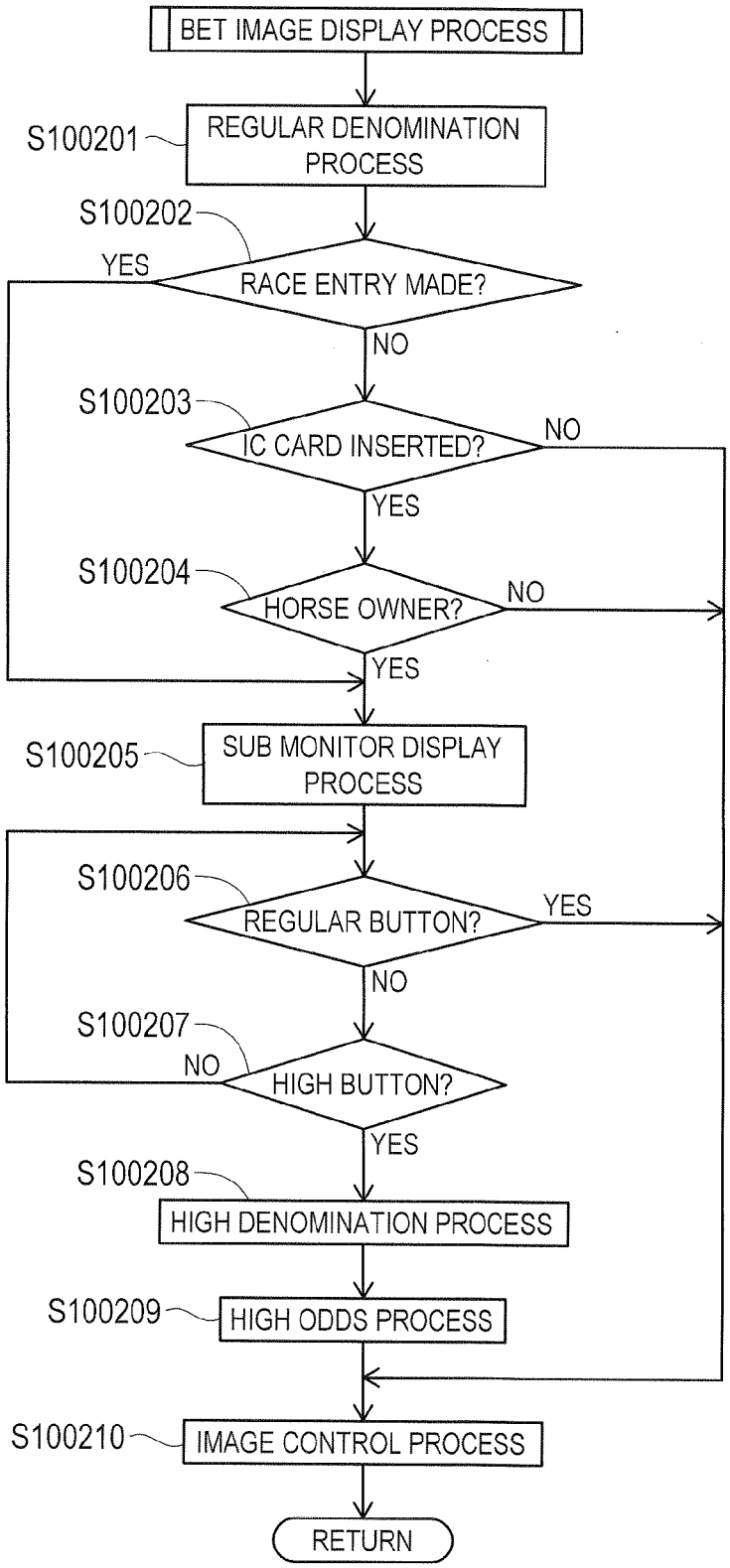
Figure 139:
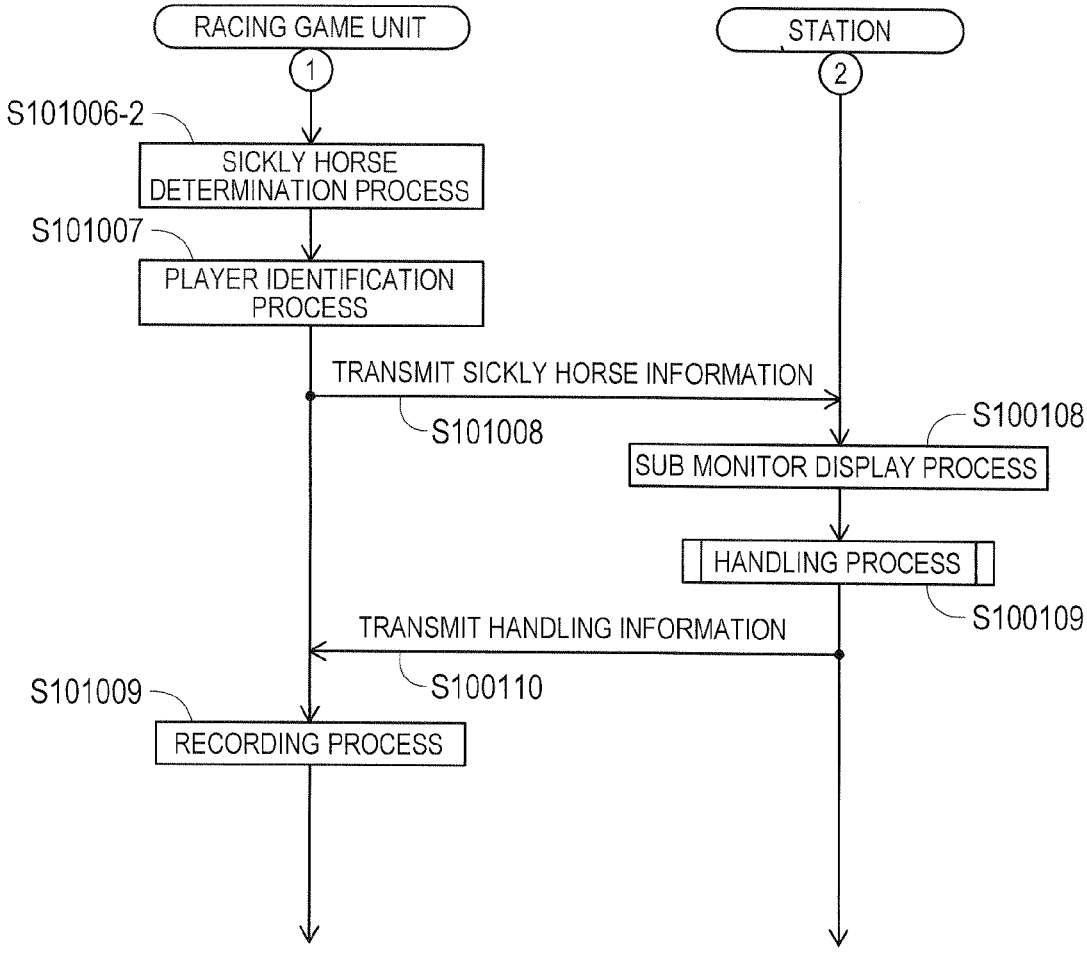
Figure 143:
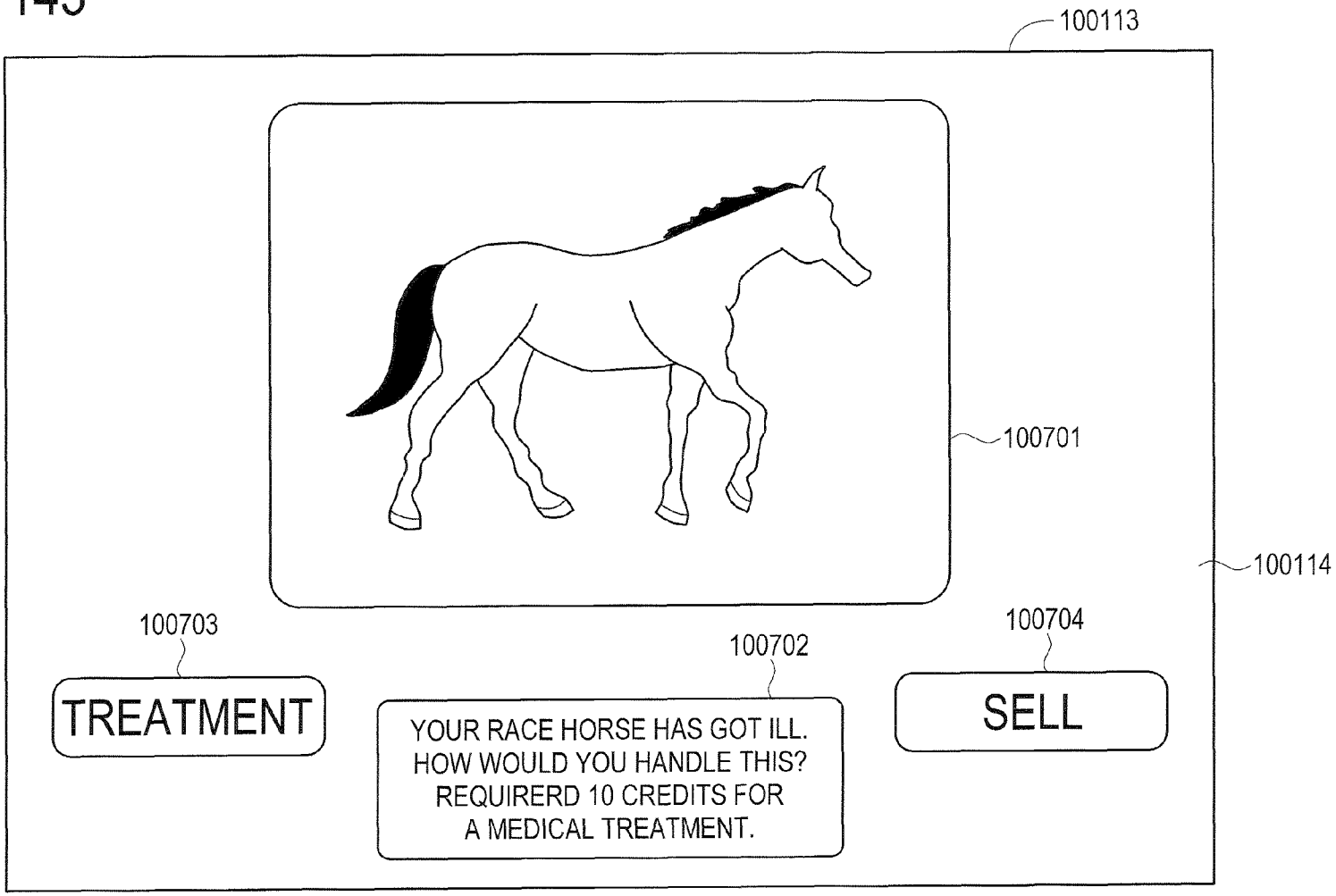
Figure 144:
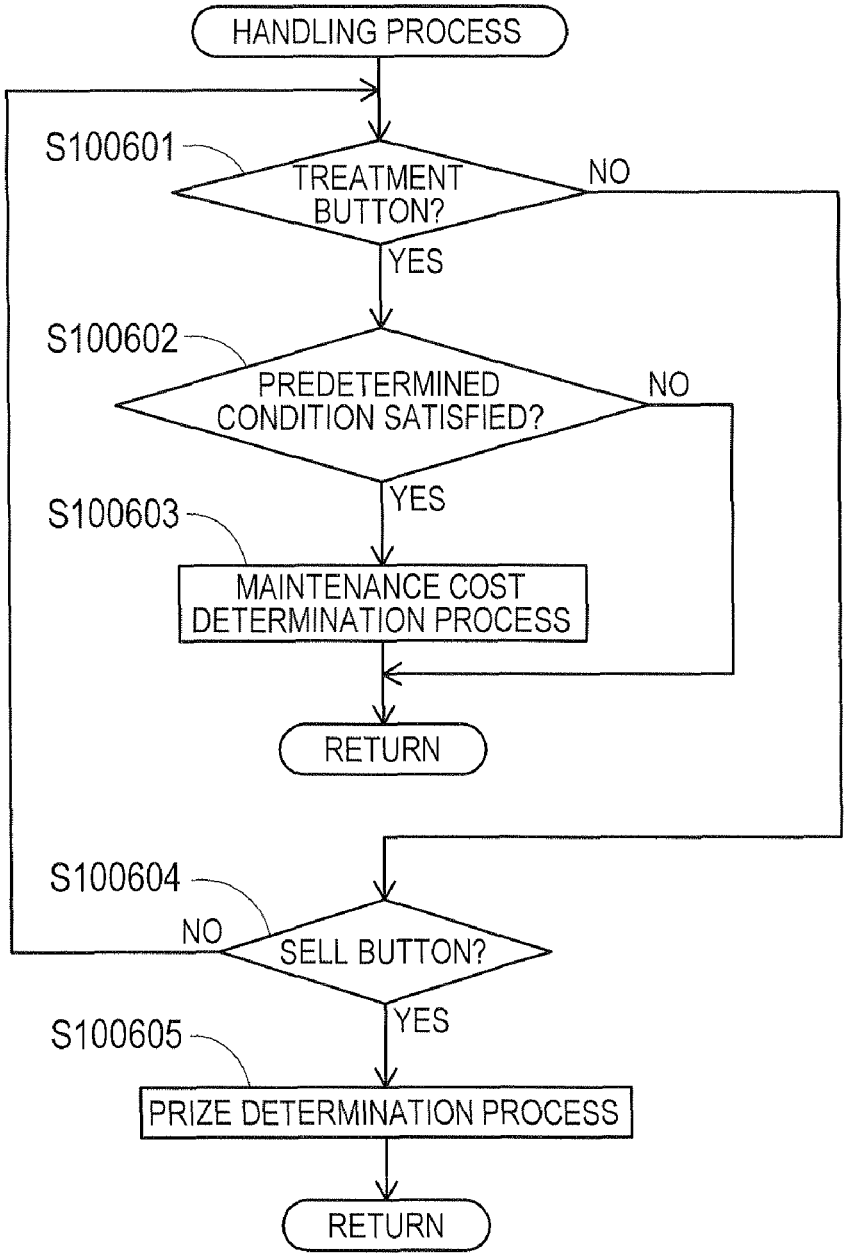

FIG. 132 is a view showing one example of a data table;

FIG. 133 is a view showing one example of horse owner information;

FIG. 134 is a view showing one example of a data table;

FIG. 135 is a flow chart diagram showing one example of game operations in the horse race gaming machine;

FIG. 136 is a flow chart diagram showing one example of an owner process;

FIG. 137 is a flow chart diagram showing one example of an entry process;

FIG. 138 is a flow chart diagram showing one example of game operations in the horse race gaming machine;

FIG. 139 is a flow chart diagram showing one example of game operations in the horse race gaming machine;

FIG. 140 is a view showing one example of a data table;

FIG. 141 is a view showing one example of a database;

FIG. 142 is a view showing one example of a data table;

FIG. 143 is a front view showing one example of a handling image displayed on the sub monitor; and FIG. 144 is a flow chart diagram showing one example of game operations in the horse race gaming machine.

DETAILED DESCRIPTION

1-1. Characteristics of a Horse Race Gaming Machine (the First Embodiment)

In the following, a description is made on the first embodiment of the present invention with reference to drawings.

Figure 2:
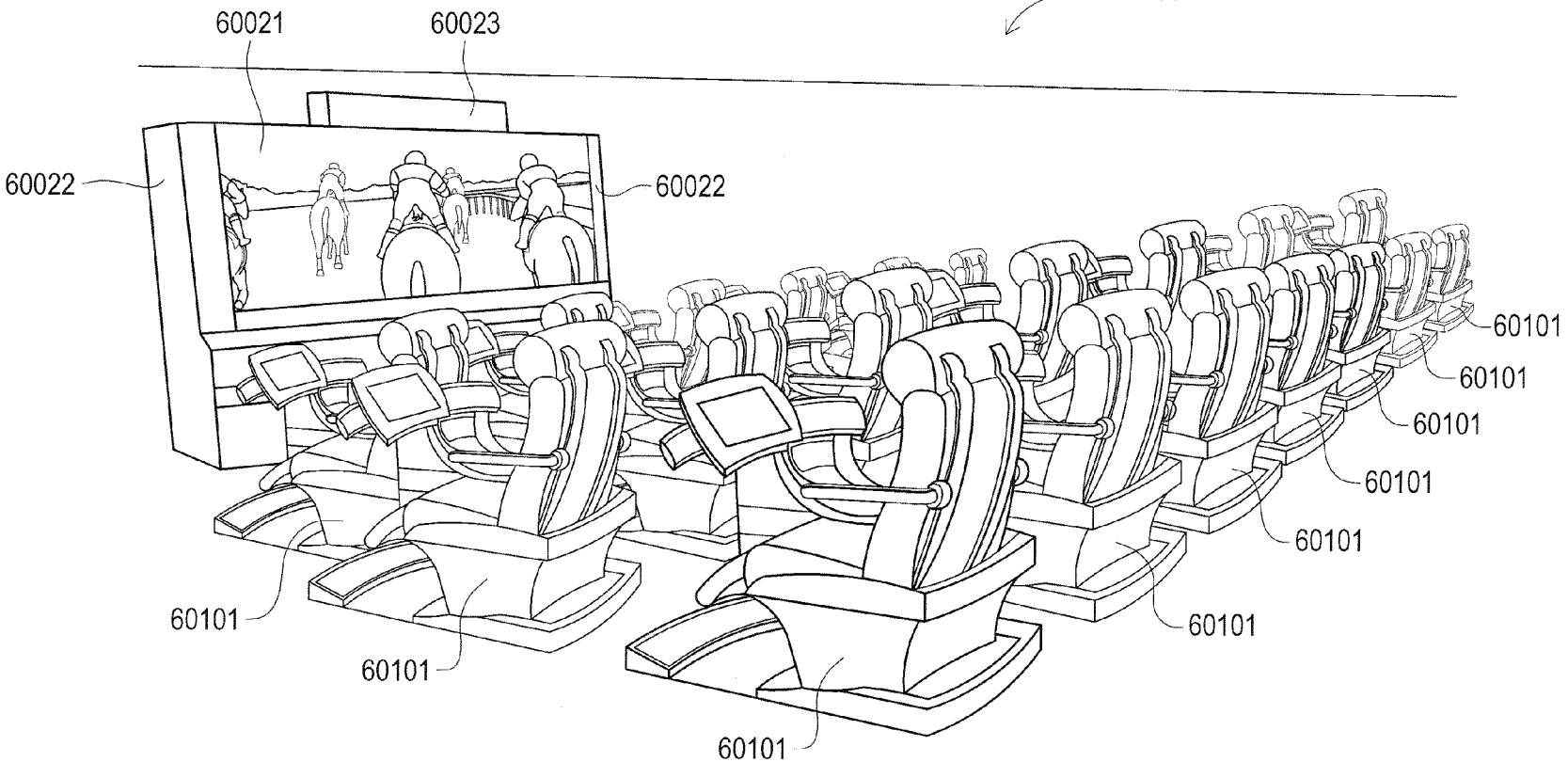
FIG. 2 is a perspective view of the horse race gaming machine.
Figure 3:
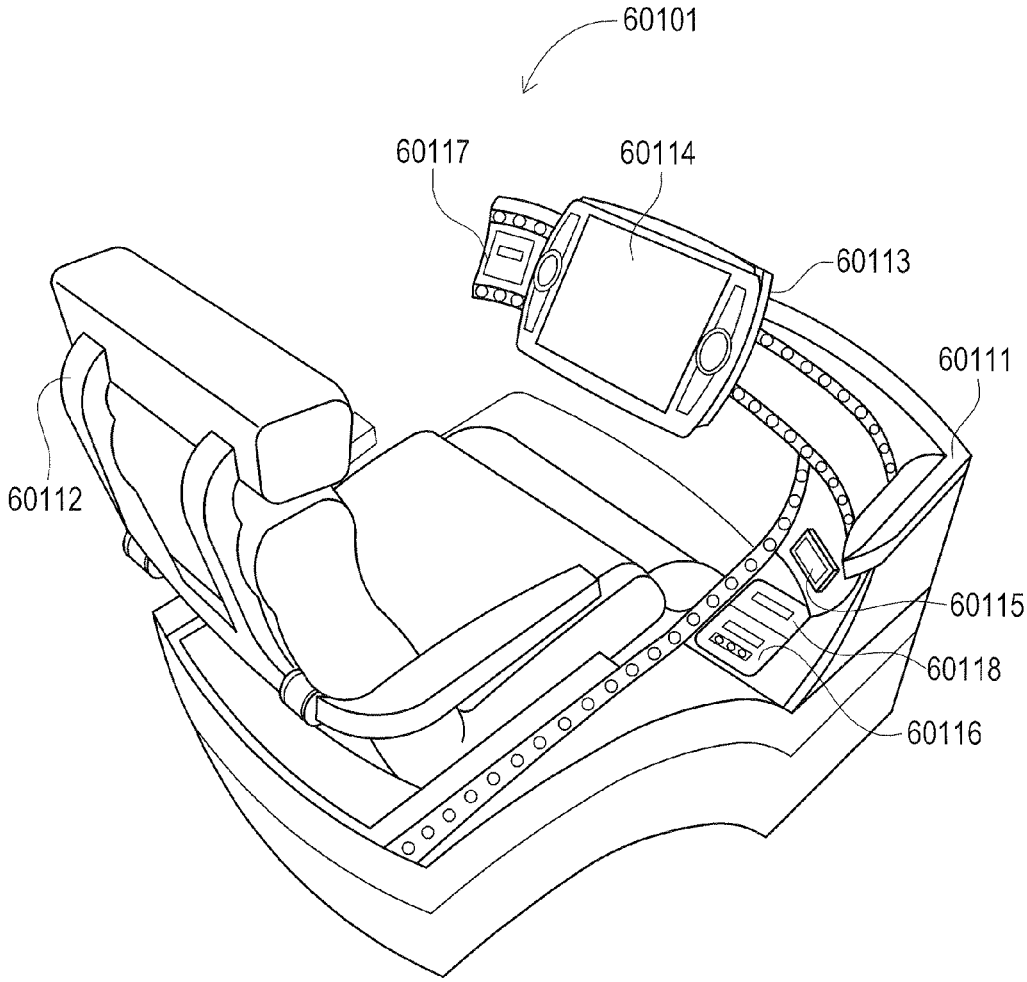
FIG. 3 is a perspective view of a station.

FIG. 2 is a perspective view of a horse race gaming machine 60001 that is one embodiment of the present invention. As shown in FIG. 2, the horse race gaming machine 60001 of this embodiment has a main monitor 60021 and a plurality of stations 60101. The main monitor 60021 displays images of a horse racing game. Players being seated at the respective stations 60101 can respectively participate in this horse racing game. The players being seated at the respective stations 60101 participate in this horse racing game by forecasting a result of each racing game of the horse racing game and performing BET operations. Namely, a horse racing game is constituted of a number of racing games that are intermittently executed in a sequential manner. In addition, the player is able to make a side bet for this racing game. FIG. 3 is a perspective view of the station 60101. A sub monitor 60113 or a touch panel 60114 that each station 60101 is provided with is used to perform BET operations.

In this respect, in the horse race gaming machine 60001 of this embodiment, BETting on racing game result can be performed before or during the racing game.

Figure 1:
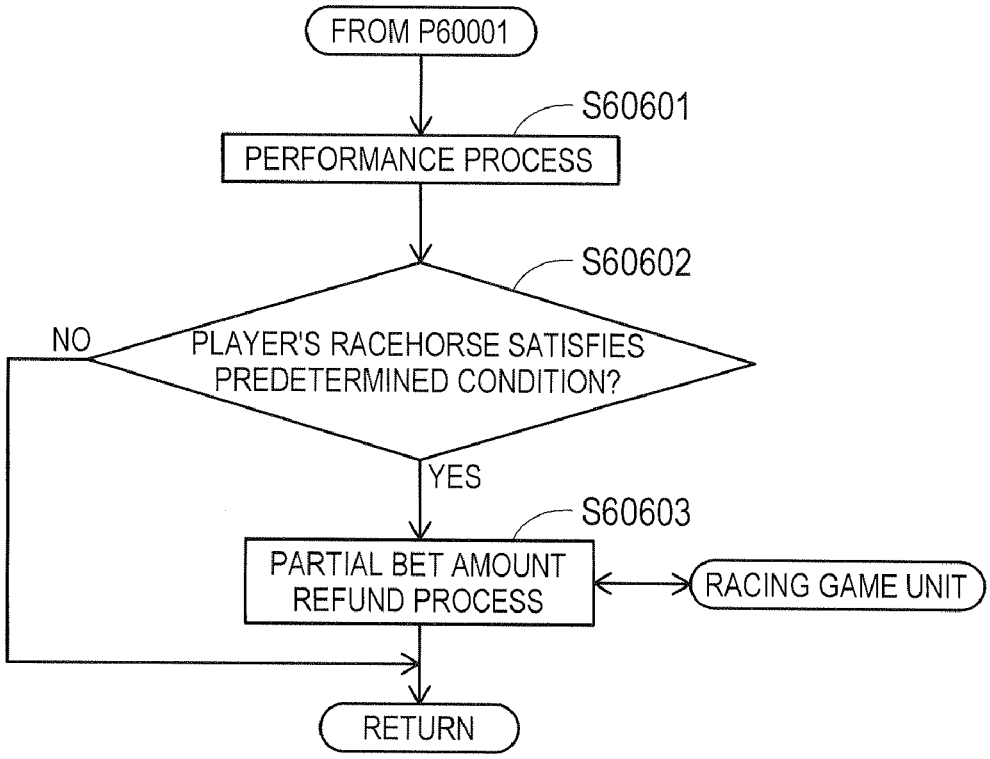
FIG. 1 is a view showing characteristics of a horse race gaming machine of one embodiment of the present invention and a flow chart diagram showing one example of game operations in the horse race gaming machine.

FIG. 1 is a view showing characteristics of the horse race gaming machine 60001 of this embodiment and a flow chart diagram showing one example of game operations in the horse race gaming machine 60001. In the horse race gaming machine 60001 of this embodiment, orders of arrival in racing games are stored for each of the player's racehorses (S60601). In this time, if the player's racehorses, in consecutive racing games equal to or more than a predetermined number of times including a result of this racing game, have finished consecutively in a place equal to or lower than a predetermined place (S60602: YES), a part of total BET amount specified by the player for this racing game is refunded to the player (S60603).

Figure 25:
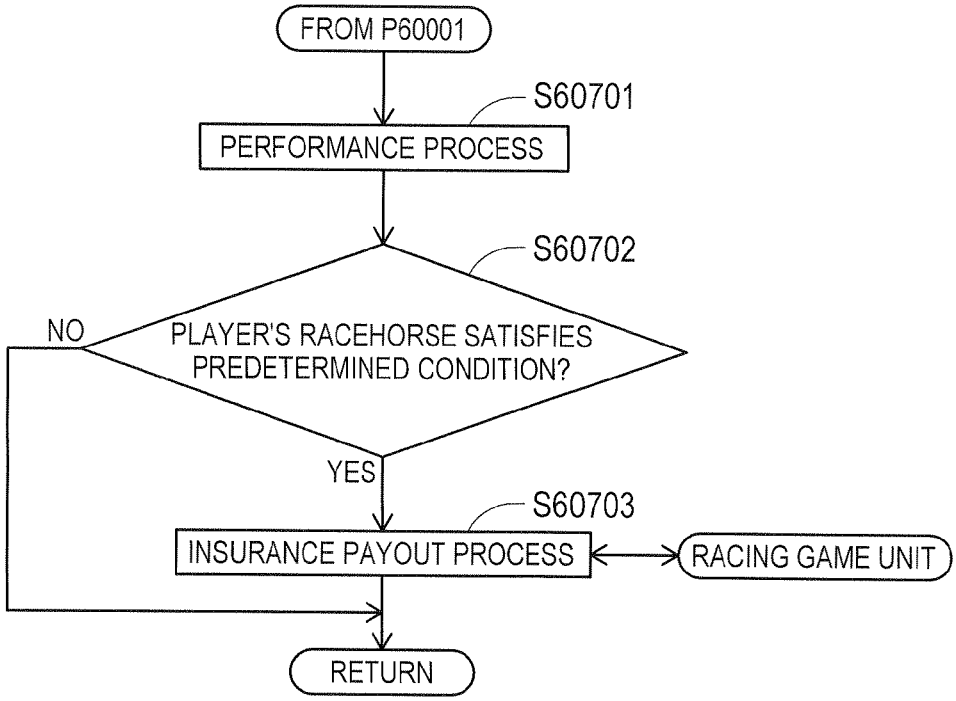
FIG. 25 is a flow chart diagram showing one example of game operations in the horse race gaming machine.

Otherwise, if the player's racehorses, in consecutive racing games equal to or more than a predetermined number of times including a result of this racing game, have finished consecutively in a place equal to or lower than a predetermined place, a part or all of insurance is paid to the player in accordance with the predetermined number (FIG. 25 below).

Incidentally, to have a player's racehorse run in this racing game, there may be a case that the player is required to pay an entry point (S60106 in FIG. 17 below) given to the player in accordance with BET amount specified by the player (S60412, S60414 in FIG. 19 below). In addition, by the player's specifying a side bet (S60501: YES in FIG. 23 below), the player's racehorse is able to be made a race entry in any of the racing games (FIG. 23 below).

1-2. Appearance of a Horse Race Gaming Machine (the First Embodiment)

As shown in FIG. 2, the horse race gaming machine 60001 of this embodiment has the main monitor 60021, speakers 60022, a display device 60023, the plurality of stations 60101, etc. The main monitor 60021 displays images of a horse racing game, etc. The speakers 60022 output sound of a horse racing game, etc. The display device 60023 displays information about games in general.

As shown in FIG. 3, in each station 60101, a cabinet 60111 is provided with a chair 60112, the sub monitor 60113, the touch panel 60114, a bill identifying device 60115, a ticket printer 60116, an IC card issuing device 60117, a reader/writer 60118, etc. A player sits on the chair 60112. The sub monitor 60113 displays BET images described later, etc. The touch panel 60114 is provided on the screen of the sub monitor 60113. When the player performs the BET operations utilizing the regular BET image described later or the high BET image described later or the player performs specific operations utilizing an owner image described later or an entry-possible race image described later, the touch panel 60114 is used.

The bill identifying device 60115 not only identifies whether or not a bill is appropriate but also receives legitimate bills into the cabinet 60111. Then, bills inserted into the cabinet 60111 are converted into the number of coins, and the credit amount that corresponds to the converted number of coins is added as the player's own credit amount. The bill identifying device 60115 is also configured to be capable of reading bar coded tickets described later.

The ticket printer 60116 is a printer that prints on a ticket a bar code representative of coded data such as a player's own credit amount, date, identification number of the station 60101, etc. and outputs it as a bar coded ticket. A player can have the outputted bar coded ticket read by other station 60101 and play at this other station 60101, or use it for any procedure in predetermined places in a game arcade.

The IC card issuing device 60117 is a device that issues an IC card 60119 (refer to FIG. 5 below) on which horse owner information 60501 (refer to FIG. 15 below) is stored. The IC card 60119 (refer to FIG. 5 below) is inserted into the reader/writer 60118.

1-3. Example of Configuration of a Racing Game Unit (the First Embodiment)

Figure 4:
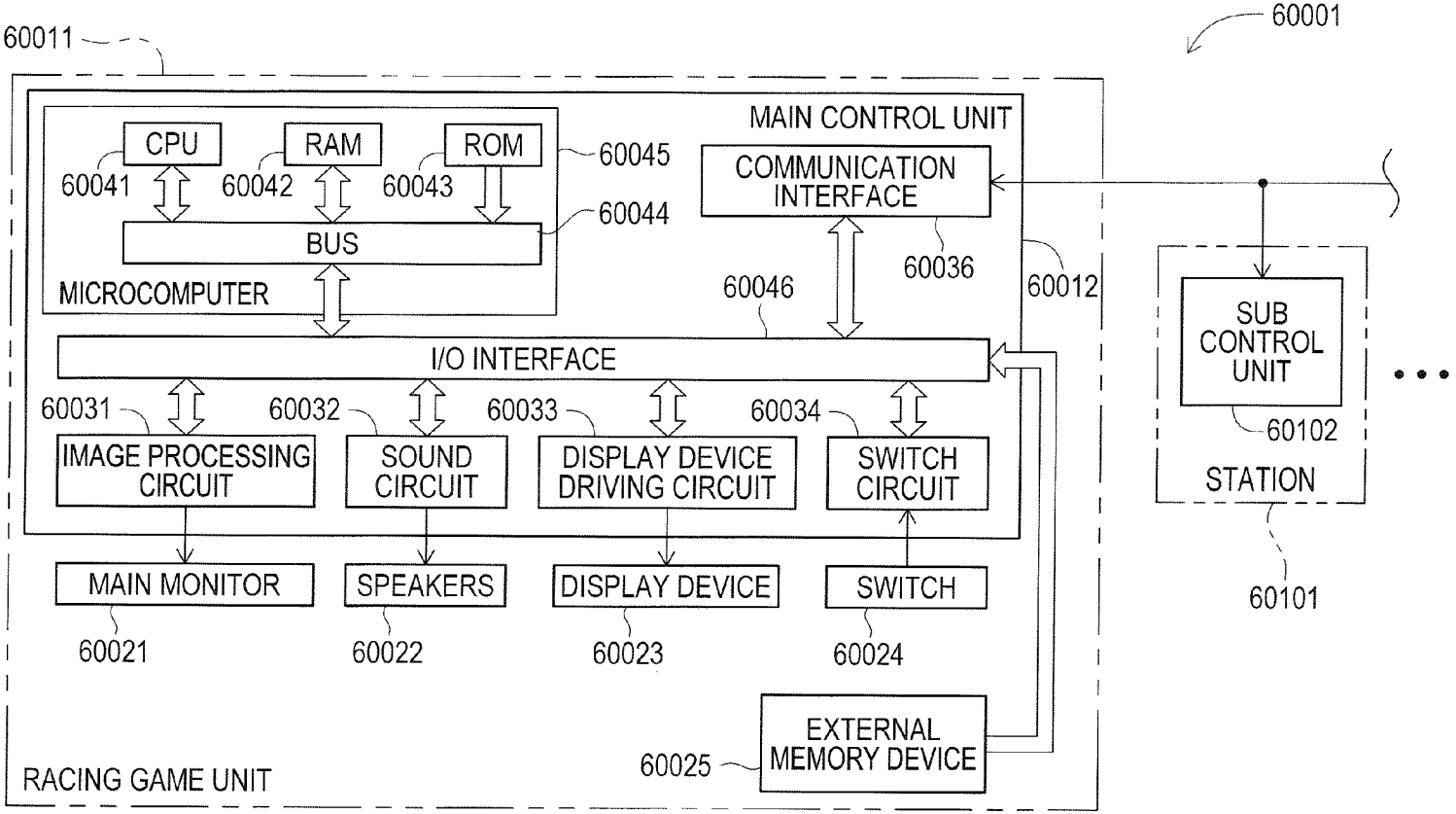
FIG. 4 is a block diagram of a racing game unit.

A racing game unit is an opposite concept of each station 60101 and constitutes a core of the horse race gaming machine 60001 of this embodiment. FIG. 4 is a block diagram of a racing game unit 60011. As shown in FIG. 4, the racing game unit 60011 is composed of a main control unit 60012, the main monitor 60021, the speakers 60022, the display device 60023, a switch 60024, an external memory device 60025, etc. The main control unit 60012 and external memory device 60025 are provided separately from the main monitor 60021, the speakers 60022, or the display device 60023. Although the switch 60024 is annexed to the main control unit 60021, it may be provided individually.

The main control unit 60012 is generally composed of a microcomputer 60045 as the kernel comprising a CPU 60041, a RAM 60042, a ROM 60043 and a bus 60044 for transferring data mutually between these elements. The RAM 60042 and the ROM 60043 are connected to the CPU 60041 via the bus 60044. The RAM 60042 is a memory for temporarily storing a variety of data which have been operated in the CPU 60041. The ROM 60043 stores various types of programs, data tables or the like for executing necessary processes to control the horse race gaming machine 60001.

An image processing circuit 60031 is connected to the microcomputer 60045 via an I/O interface 60046. The image processing circuit 60031 is connected to the main monitor 60021 and controls driving of the main monitor 60021.

The image processing circuit 60031 is composed of a program ROM, an image ROM, an image control CPU, a work RAM, a VDP (video display processor), and a video RAM, etc. And in the program ROM, an image control program related to display on the main monitor 60021, and various selection tables are stored. And, in the image ROM, dot data to form images and the like, for example dot data to form images displayed on the main monitor 60021, are stored. And, based on parameters set by the microcomputer 60045, the image control CPU determines the images displayed on the main monitor 60021 among the dot data stored beforehand in the image ROM, according to the image control program stored beforehand in the program ROM. And, the work RAM works as a temporary memory when the image control program is executed in the image control CPU. And the VDP forms image data corresponding to display contents determined by the image control CPU. And the VDP outputs the image data formed thereby to the main monitor 60021. And the video RAM works as a temporary memory when the images are formed by the VDP.

A sound circuit 60032 is connected to the microcomputer 60045 via the I/O interface 60046. The speakers 60022 are connected to the sound circuit 60032 and are arranged on both lateral sides of the main monitor 60021. The speakers 60022 output various types of effect sound, BGM, etc. when various types of effect are performed, by being subjected to output control by the sound circuit 60032 based on a drive signal from the CPU 60041.

A display device driving circuit 60033 is connected to the microcomputer 60045 via the I/O interface 60046. The display device 60023 is connected to the display device driving circuit 60033. The display device 60023 is disposed on the upper side of the main monitor 60021 and displays information about games in general, by being subjected to display control by the display device driving circuit 60033 based on a drive signal from the CPU 60041.

A switch circuit 60034 is connected to the microcomputer 60045 via the I/O interface 60046. The switch 60024 is connected to the switch circuit 60034 and is arranged in the lower part of the main monitor 60021. The switch 60024 inputs an instruction by an operator's setting operation into the CPU 60041 based on a switch signal from the switch circuit 60034.

The external memory device 60025 is connected to the microcomputer 60045 via the I/O interface 60046. The external memory device 60025 is arranged in the periphery of the main monitor 60021 and has capability similar to the image ROM in the image processing circuit 60031, by storing dot data for forming images, such as dot data for forming images on the main monitor 60021. Thus, when determining any image to be displayed on the main monitor 60021, the image control CPU in the image processing circuit 60031 adds the dot data stored in advance in the external memory device 60025 to a target of the determination.

A communication interface 60036 is connected to the microcomputer 60045 via the I/O interface 60046. A sub control unit 60102 of each station 60101 is connected to the communication interface 60036. This enables bidirectional communication between the CPU 60041 and each station 60101. The CPU 60041 can receive and transmit a command, request and data from/to each station 60101 via the communication interface 60036. Therefore, in the horse race gaming machine 60001, the main control unit 60012 controls progress of the horse racing game in cooperation with each station 60101.

1-4. Example of Configuration of a Station (the First Embodiment)

Figure 5:
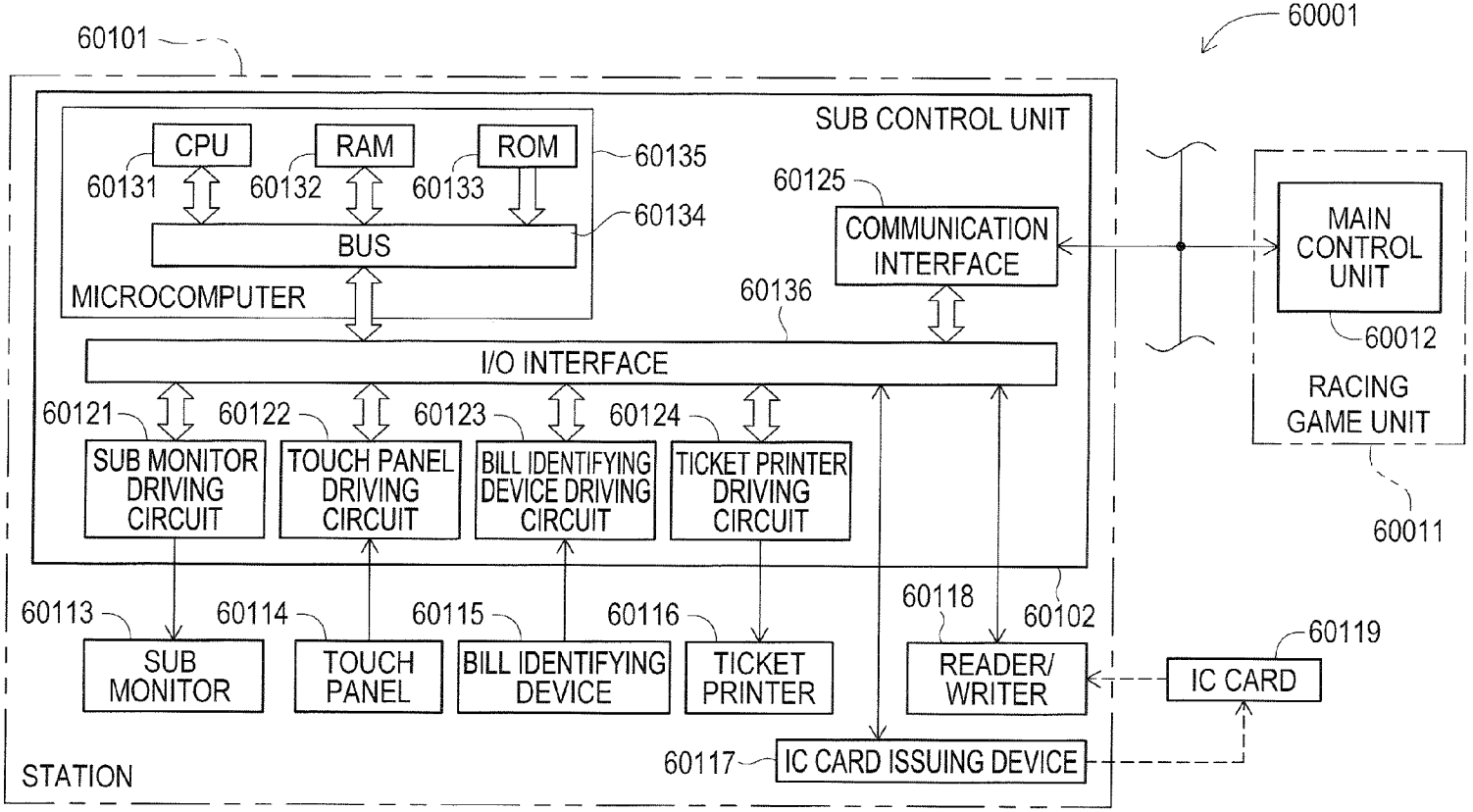
FIG. 5 is a block diagram of the station.

FIG. 5 is a block diagram of a station 60101. As shown in FIG. 5, the station 60101 is composed of the sub control unit 60102, the sub monitor 60113, the touch panel 60114, the bill identifying device 60115, the ticket printer 60116, the IC card issuing device 60117, the reader/writer 60118, etc.

The sub control unit 60102 is generally composed of a microcomputer 60135 as the kernel comprising a CPU 60131, a RAM 60132, a ROM 60133 and a bus 60134 for transferring data mutually between these elements. The RAM 60132 and the ROM 60133 are connected to the CPU 60131 via the bus 60134. The RAM 60132 is a memory for temporarily storing a variety of data which have been operated in the CPU 60131. The ROM 60133 stores various types of programs, data tables or the like for executing necessary processes to control the horse race gaming machine 60001.

A sub monitor driving circuit 60121 is connected to the microcomputer 60135 via an I/O interface 60136. The sub monitor 60113 is connected to the sub monitor driving circuit 60121. The sub monitor driving circuit 60121 controls driving of the sub monitor 60113 based on a drive signal from the aforementioned racing game unit 60011. The sub monitor driving circuit 60121 has also similar configuration and capabilities to the image processing circuit 60031 as shown in FIG. 4 above, and controls driving of the sub monitor 60113 so that the regular BET image, the high BET image, the owner image or the entry-possible race image described later are displayed.

A touch panel driving circuit 60122 is connected to the microcomputer 60135 via the I/O interface 60136. The touch panel 60114 is connected to the touch panel driving circuit 60122 and is arranged on the screen of the sub monitor 60113. The touch panel 60114 inputs an instruction into the CPU 60131 through touch operation of a player (touch position), based on a coordinate signal from the touch panel driving circuit 60122.

A bill identifying driving circuit 60123 is connected to the microcomputer 60135 via the I/O interface 60136. The bill identifying device 60115 is connected to the bill identifying driving circuit 60123. The bill identifying device 60115 identifies whether or not a bill or a bar coded ticket is appropriate. When receiving a legitimate bill, the bill identifying device 60115 inputs a value of the bill into the CPU 60131 based on an identification signal from the bill identifying driving circuit 60123. In addition, when receiving a legitimate bar coded ticket, the bill identifying device 60115 inputs a credit amount, etc. recorded on the bar coded ticket into the CPU 60131 based on an identification signal from the bill identifying driving circuit 60123.

A ticket printer driving circuit 60124 is connected to the microcomputer 60135 via the I/O interface 60136. The ticket printer 60116 is connected to the ticket printer driving circuit 60124. The ticket printer 60116 prints on a ticket a bar code representative of coded data such as owned credit amount, etc., stored in the RAM 60132, and outputs it as a bar coded ticket, by being subjected to output control by the ticket printer driving circuit 60124 based on a drive signal to be outputted from the CPU 60131.

The IC card issuing device 60117 is connected to the microcomputer 60135 via the I/O interface 60136. With an output controlled based on a drive signal to be outputted from a CPU 60131, the IC card issuing device 60117 issues an IC card 60119 that stores data such as horse owner information 60501 (refer to FIG. 15 below), etc.

The reader/writer 60118 is connected to the microcomputer 60135 via the I/O interface 60136. With a drive controlled based on a drive signal to be outputted from the CPU 60131, the reader/writer 60118 inputs information read from an IC card 60119 into CPU 60131 or stores various types of information such as horse owner information 60501 (refer to FIG. 15 below) into an IC card 60119.

A communication interface 60125 is connected to the microcomputer 60135 via the I/O interface 60136. The main control unit 60012 of the racing game unit 60011 is connected to the communication interface 60125. This enables bidirectional communication between the CPU 60131 and the racing game unit 60011. The CPU 60131 can receive and transmit a command, request and data from/to the racing game unit 60011 via the communication interface 60125. Therefore, in the horse race gaming machine 60001, the sub control unit 60102 controls progress of the horse racing game in cooperation with the racing game unit 60011.

1-5. Example of Game Operations of a Horse Race Gaming Machine (the First Embodiment)

Figure 17:
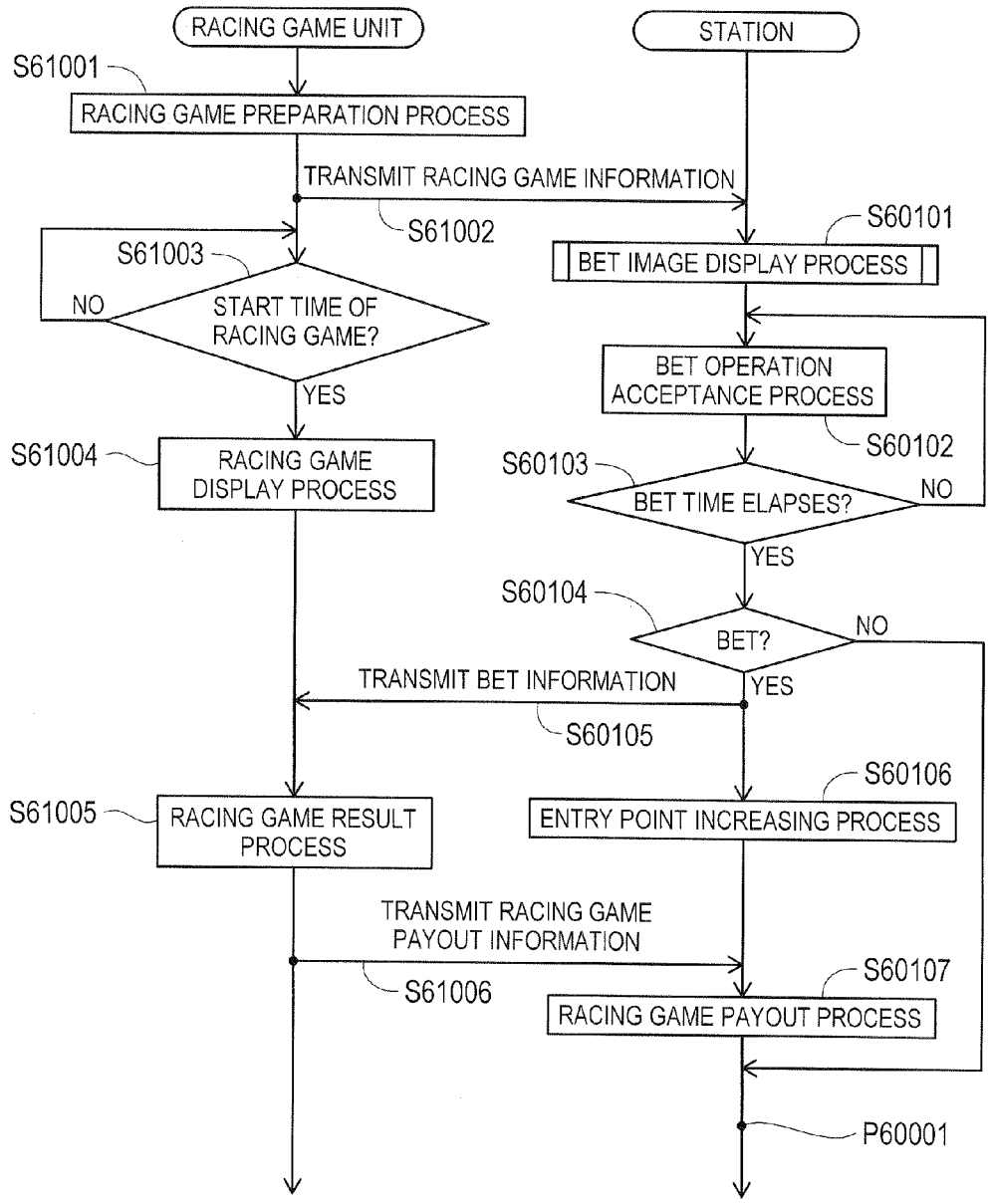
FIG. 17 is a flow chart diagram showing one example of game operations in the horse race gaming machine.

In the following, a description is made on an example of game operations of the horse race gaming machine 60001 of this embodiment. FIG. 17 is a flow chart diagram showing one example of game operations in the horse race gaming machine 60001 of this embodiment. It is to be noted that respective stations 60101 perform similar game operations respectively in cooperation with the racing game unit 60011. In order to avoid any complication, however, only one station 60101 is shown in FIG. 17.

The racing game unit 60011 performs respective operations from S61001 to S61006.

First, in S61001, the main control unit 60012 executes a racing game preparation process. In this process, for this racing game which constitutes a horse racing game, the CPU 60041 determines a track, starter horse, start time, etc, and reads data on them from the ROM 60043.

In S61002, the main control unit 60012 transmits racing game information. In this transmission, the CPU 60041 transmits respective data on the track, starter horse, start time, etc. of this racing game to each station 60101, as racing game information.

In S61003, the main control unit 60012 determines whether or not the present time is race start time of the racing game. In this determination, the CPU 60041 checks time until the time to start this racing game is reached (S61003: NO).

The CPU 60041 may also determine whether or not the present time is the time to start this racing game, by timing an interval from the last racing game.

When the time to start this racing game is reached (S61003: YES), the process proceeds to S61004 and the main control unit 60012 executes a racing game display process. In this process, based on the determination in S61001 above, the CPU 60041 not only displays race images of this racing game on the main monitor 60021 but also outputs sound of this racing game from the speakers 60022.

In S61005, the main control unit 60012 executes a racing game result process. In this process, the CPU 60041 calculates a payout amount of the respective stations 60101, based on the racing game result in S61004 above and BET information transmitted by the respective stations 60101 in S60105 below, etc.

In S61006, the main control unit 60012 transmits racing game payout information. In this transmission, the CPU 60041 transmits to the respective corresponding stations 60101 respective payout amounts, etc. in S61005 above, as racing game payout information.

In this time, the main control unit 60012 adds the racing gamerace result in S61004 above to the racing game payout information. The racing gamerace result is included in the racing game payout information in a data format in which order of arrival, times, etc. are associated with each of the character IDs of the racehorses.

Thereafter, similar processes are also repeated in the next racing game.

Meanwhile, in the respective stations 60101, respective operations of S60101 to S60107 are performed.

Figure 20:
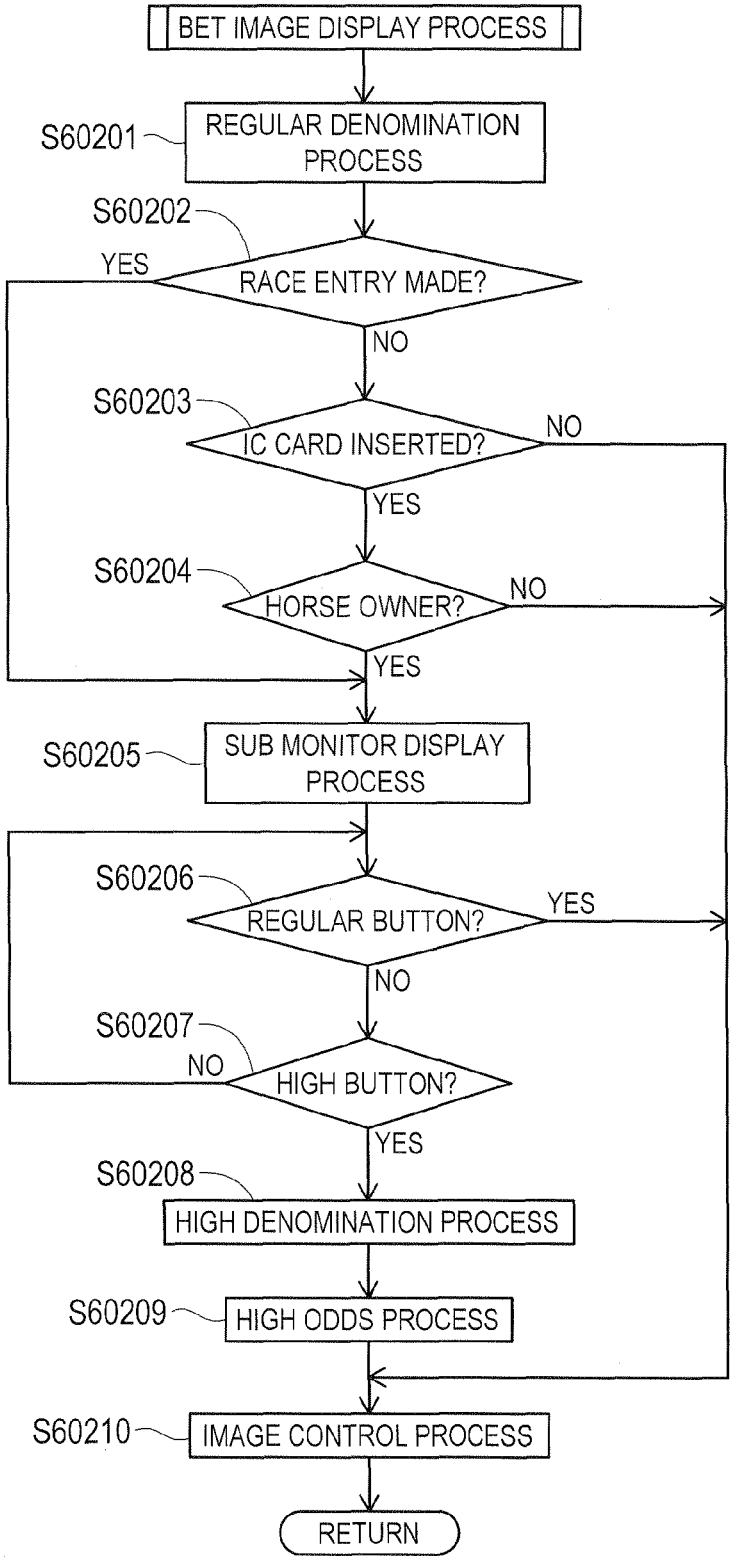
FIG. 20 is a flow chart diagram showing one example of game operations in the horse race gaming machine.

First, in S60101, the sub control unit 60102 executes a BET image display process. The respective stations 60101 execute the BET image display process based on the flow chart of FIG. 20.

Figure 6:
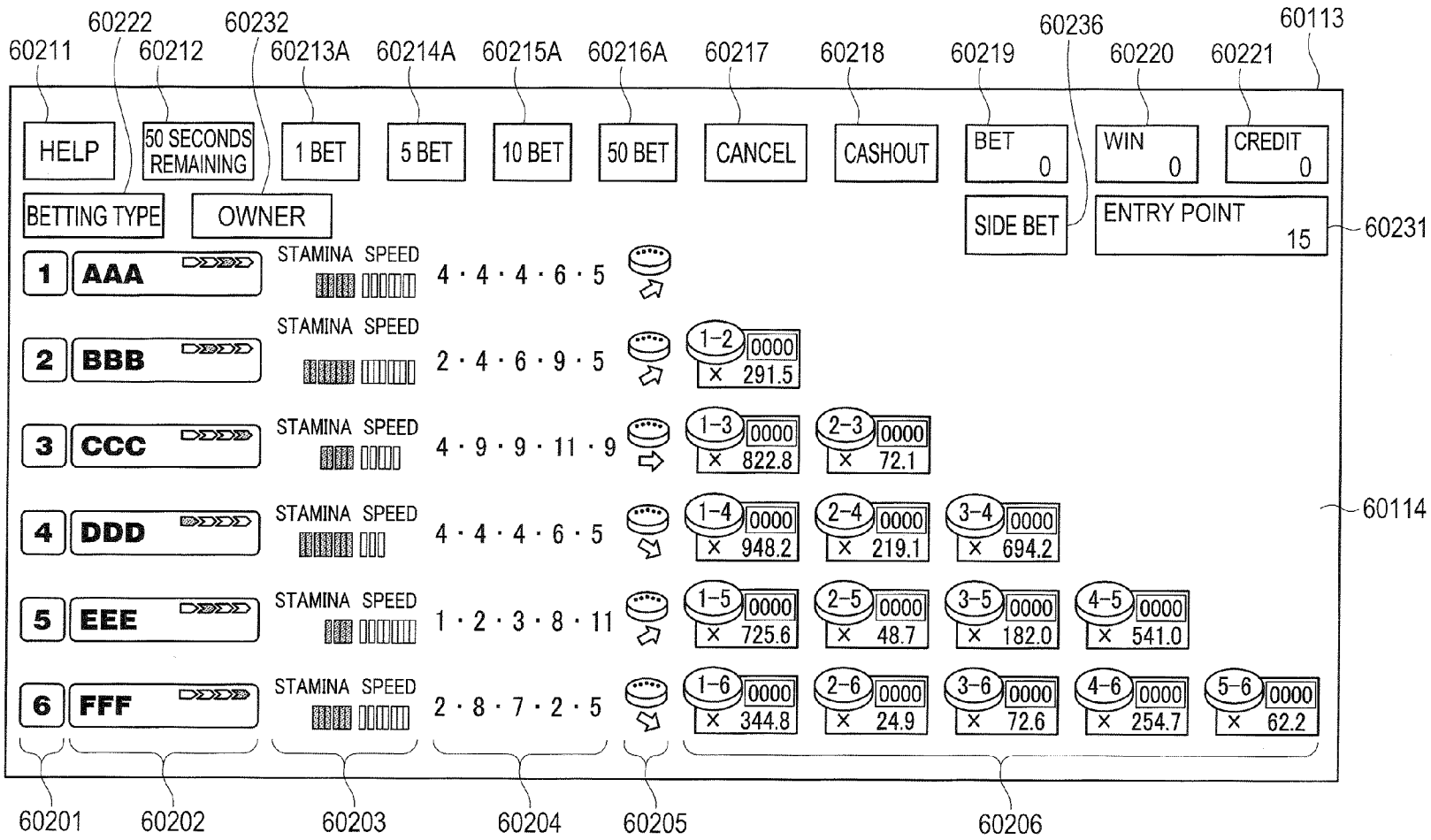
FIG. 6 is a front view showing one example of a regular BET image displayed on a sub monitor.

First, in S60201, the sub control unit 60102 executes a regular denomination process. In this process, the CPU 60131 displays a regular BET image of this racing game on the sub monitor 60113, based on the data related to the racing game information transmitted by the racing game unit 60011 in S61002 above. FIG. 6 shows one example of the regular BET image displayed on the sub monitor 60113.

As shown in FIG. 6, in a regular BET image displayed on the screen of the sub monitor 60113 covered by the light transmissive colorless touch panel 60114 are provided a horse number display area 60201, a horse name display area 60202, a basic power display area 60203 that displays speed and stamina by a bar graph, a performance display area 60204 that displays orders of arrival in last five races, a brief comment display area 60205 that displays the condition of this racing game by an arrow, a betting ticket purchase button display area 60206 where a betting ticket purchase button of a quinella-type bet in which a player randomly picks a combination of horse numbers that will finish in the first place and in the second place in order to win, odds or BET amounts are displayed together, etc.

In addition, in the regular BET image are provided a help button 60211, a time display area 60212, a 1 BET button 60213A, a 5 BET button 60214A, a 10 BET button 60215A, a 50 BET button 60216A, a cancel button 60217, a CASH-OUT button 60218, a BET amount display area 60219, a payout amount display area 60220, a credit amount display area 60221, a betting ticket type switch button 60222, an owner button 60232, an entry point display area 60231, a side bet button 60236, etc.

The help button 60211 is a button that a player touches to display a method of BET operation, etc. on the sub monitor 60113. The time display area 60212 displays BET time in terms of the remaining time. The 1 BET button 60213A is a button that a player touches to set so that "1" is added to the present BET amount. The 5 BET button 60214A is a button that a player touches to set so that "5" is added to the present BET amount. The 10 BET button 60215A is a button that a player touches to set so that "10" is added to the present BET amount. The 50 BET button 60216A is a button that a player touches to set so that "50" is added to the present BET amount. Accordingly, the denomination of the regular BET image is "1". In other words, the minimum bet amount that a player can specify in the regular BET image is "1".

The cancel button 60217 is a button that a player touches to cancel the setting of addition to the BET amount. The CASH-OUT button 60218 is a button that a player touches to be paid out the number of coins corresponding to a player's own credit amount in bar coded tickets printed by the ticket printer 60116. The BET amount display area 60219 displays the total BET amount that a player sets for this racing game. The payout amount display area 60220 displays a payout amount of this racing game. The credit amount display area 60221 displays a player's own credit amount.

Touching any of the betting ticket purchase buttons within the betting ticket purchase button display area 60206 after touching any of the respective BET buttons 60213A, 60214A, 60215A, and 60216A, a player can perform the BET operation of the quinella-type bet. For example, if a player touches the betting ticket purchase button for "1-2" in the betting ticket purchase button display area 60206 after touching the 10 BET button 60215A, the player can set addition of "10" to the present BET amount for a combination of No. 1 and No. 2, as a combination of horse numbers that the player forecasts will finish in the first or second places in no particular order. The present BET amount for respective combinations of horse numbers are displayed next to the betting ticket purchase buttons corresponding to the respective combinations.

Although the regular BET image shown in FIG. 6 is for the quinella-type bet, such respective types of betting as win, place, bracket quinella, quinella place, exacta, trio, trifecta, etc. are also available, and every time a player touches the betting ticket type switch button 60222, the regular BET image changes to a regular BET image of a different type.

Various data in the regular BET image such as horse names and odds, etc. is included in data on the racing game information transmitted by the racing game unit 60011 in S61002 above.

The owner button 60232 is a button that a player touches when he/she wants to purchase a racehorse. The entry point display area 60231 displays entry points owned by a player. The side bet button 60236 is a button that a player touches for making a side bet. It is to be noted that a BET amount of the side bet is set to "10".

Returning to FIG. 20, in S60202, the sub control unit 60102 determines whether or not a race entry has been made. In this determination, the CPU 60131 makes a determination based on the data related to race entry information stored in the RAM 60132, etc. described later. Then, if the race entry has been made (S60202: YES), the process proceeds to S60205 below. In this case (S60202: YES), the player is an owner of any racehorse. The player has also made the race entry of his/her own racehorse in any racing game. In contrast, if the race entry has not been made (S60202: NO), the process proceeds to S60203.

In S60203, the sub control unit 60102 determines whether or not an IC card 60119 is inserted into the reader/writer 60118. In this determination, the CPU 60131 makes a determination based on the data on whether or not there is an IC card 60119 transmitted by the reader/writer 60118, etc. Now if an IC card 60119 is not inserted into the reader/writer 60118 (S60203: NO), the process proceeds to S60210 below. In contrast, if an IC card 60119 is inserted into the reader/writer 60118 (S60203: YES), the process proceeds to S60204.

In S60204, the sub control unit 60102 determines whether or not a player is an owner of any racehorse. In this determination, the CPU 60131 makes a determination based on the data on horse owner information 60501 (refer to FIG. 15 below) stored in the RAM 60132 or an IC card 60119, etc. The horse owner information 60501 (refer to FIG. 15 below) stored in an IC card 60119 is read out by the reader/writer 60118 and inputted into the CPU 60131. Now, if a player is not an owner of any racehorse (S60204: NO), the process proceeds to S60210 below. In contrast, if the player is an owner of any racehorse (S60204: YES), the process proceeds to S60205.

Figure 7:
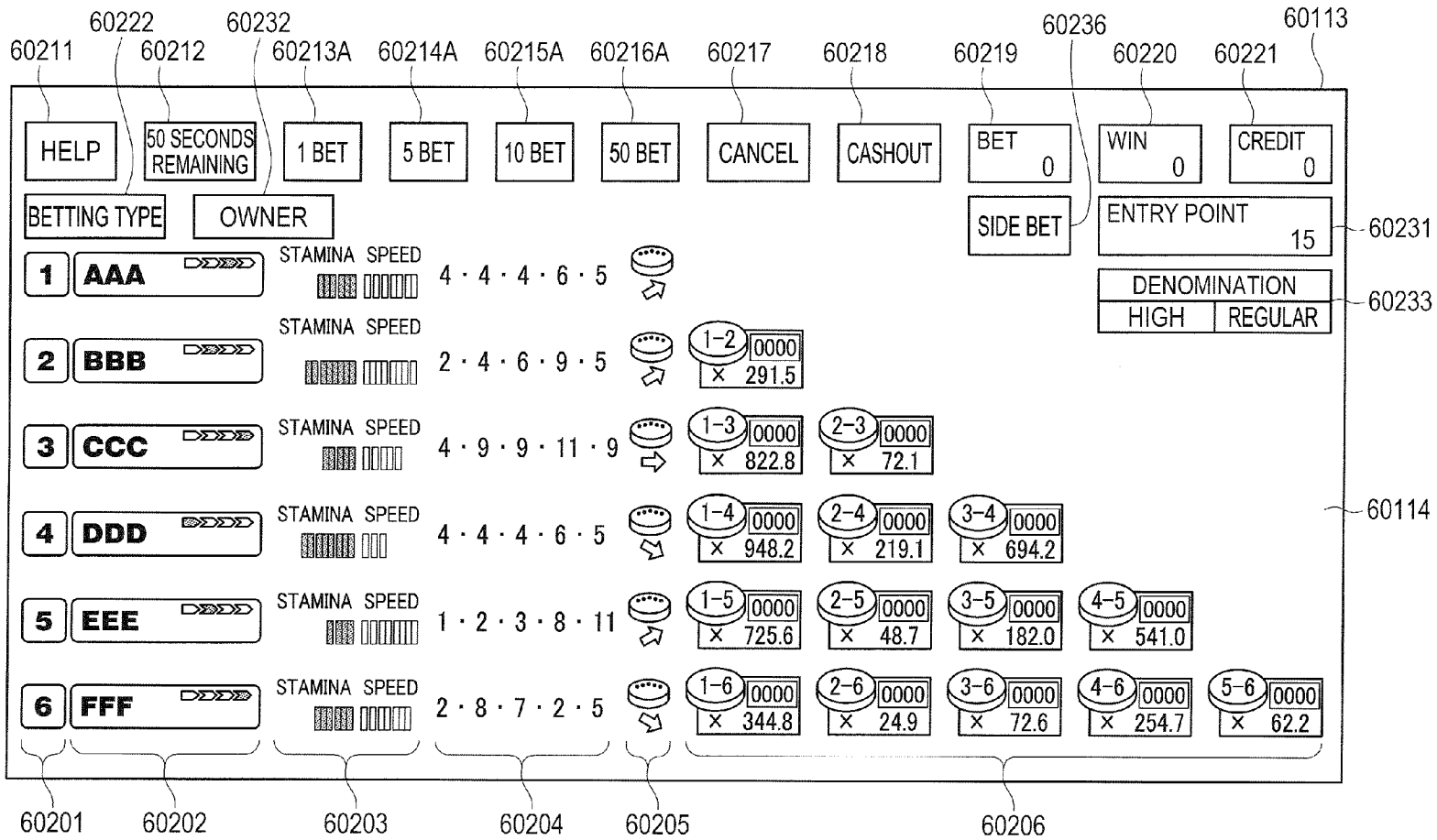
FIG. 7 is a front view showing one example of the regular BET image displayed on the sub monitor.

In S60205, the sub control unit 60102 executes a sub monitor display process. In this process, the CPU 60131 changes the regular BET image being displayed on the sub monitor 60113 to a regular BET image as shown in FIG. 7. In other words, a denomination button 60233 is synthesized and displayed on the regular BET image as shown in FIG. 6. The denomination button 60233 includes a regular button and a high button.

In S60206, the sub control unit 60102 determines whether or not a player has touched the regular button. In this determination, based on a coordinate signal from the touch panel driving circuit 60122, the CPU 60131 determines whether or not the player has touched the regular button included in the denomination button 60233. Now, if the player has touched the regular button (S60206: YES), the process proceeds to S60210 below. In contrast, if the player has not touched the regular button (S60206: NO), the process proceeds to S60207.

In S60207, the sub control unit 60102 determines whether or not the player has touched the high button. In this determination, based on a coordinate signal from the touch panel driving circuit 60122, the CPU 60131 determines whether or not the player has touched the high button included in the denomination button 60233. Now, if the player has not touched the high button (S60207: NO), the process returns to S60206 above. In contrast, if the player has touched the high button (S60207: YES), the process proceeds to S60208.

In other words, the respective determination processes of S60206 and S60207 above are repeated until the player touches either the regular button or the high button included in the denomination button 60233. However, similar to the determination process in S60103 below, the sub control unit 60102 determines whether or not the BET time has elapsed even while the respective determination processes of S60206 and S60207 above are being repeated. If the sub control unit 60102 determines that the BET time has elapsed before the player touches either the regular button or the high button included in the denomination button 60233, the process is forced to proceed to S60210 below.

Figure 8:
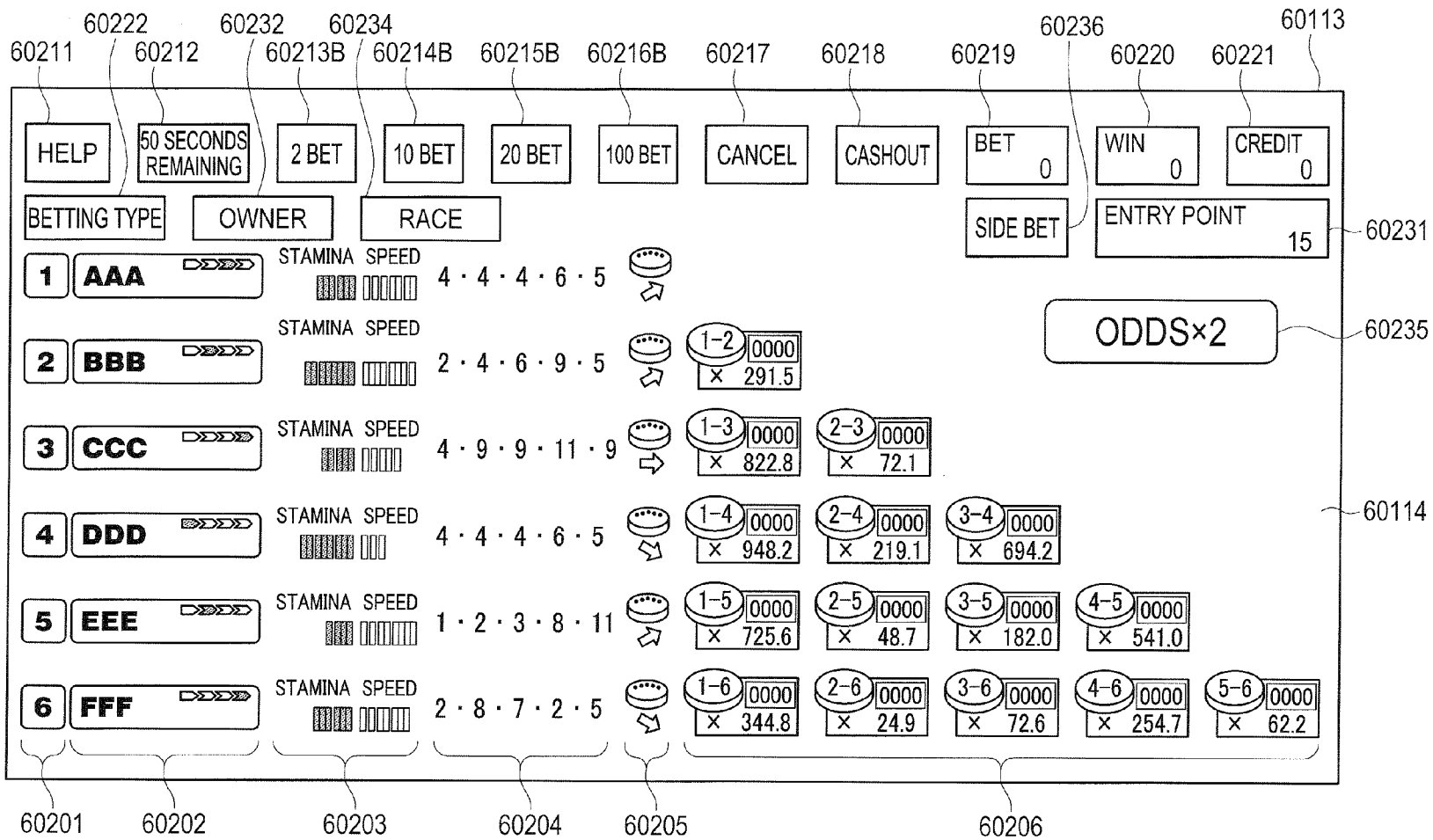
FIG. 8 is a front view showing one example of a high BET image displayed on the sub monitor.

In S60208, the sub control unit 60102 executes a high denomination process. In this process, the CPU 60131 displays a high BET image of this racing game on the sub monitor 60113. FIG. 8 shows one example of the high BET image displayed on the sub monitor 60113.

In the high BET image are provided a 2 BET button 60213B, a 10 BET button 60214B, a 20 BET button 60215B, and a 100 BET button 60216B. Thus, in the high BET image, the bet amounts of the respective BET buttons are twice as large as those in the regular BET image (refer to FIG. 6 and FIG. 7 above). Accordingly, the denomination of the high BET image is "2". In other words, the minimum bet amount that a player can specify in the high BET image is "2". In contrast, the minimum bet amount that a player can specify in the regular BET image (refer to FIG. 6 and FIG. 7 above) is "1". Accordingly, the denomination of the high BET image is twice the denomination of the regular BET image (refer to FIG. 6 and FIG. 7 above).

In addition, in the high BET image are provided a race button 60234 or a message display area 60235. The race button 60234 is a button that a player touches when he/she wishes to make a race entry of his/her own racehorse in a racing game. The message display area 60235 displays a message ("ODDS×2") indicating that odds will be twice as large as those in the regular BET image (refer to FIG. 6 and FIG. 7 above).

Except for these points, the high BET image is same as the regular BET image (refer to FIG. 6 above), and thus details thereof are omitted.

In S60209, the sub control unit 60102 executes a high odds process. In this process, the CPU 60131 stores in the RAM 60132 the data showing that the odds are doubled, in order to have it included in BET information to be transmitted to the racing game unit 60011 in S60105 below.

In S60210, the sub control unit 60102 executes an image control process. In this process, the CPU 60131 performs necessary other display controls over the regular BET image or the high BET image displayed on the sub monitor 60113. Thereafter, the process proceeds to S60102 of FIG. 6.

Returning to FIG. 17, in S60102, the sub control unit 60102 executes a BET operation acceptance process. In this process, based on a coordinate signal from the touch panel driving circuit 60122, the CPU 60131 identifies the content of the player's BET operation for this racing game and stores it in the RAM 60132. The CPU 60131 also checks time when each BET operation is performed and stores it in the RAM 60132. The CPU 60131 reflects the content of the player's BET operation in the display of the BET images of the sub monitor 60113.

In S60103, the sub control unit 60102 determines whether or not the BET time has elapsed. In this determination, the CPU 60131 checks time until the BET time has elapsed. The BET time is computed by the CPU 60131 based on the data on the racing game information transmitted by the racing game unit 60011 in S61002 above, and begins before this racing game starts and ends at predetermined timing while this racing game is in progress.

In addition, the sub control unit 60102 may determine that the BET time has elapsed, when the remaining time displayed in the time display area 60212 on the regular BET image or the high BET image of the sub monitor 60113 runs out.

Till the BET time elapses (S60103: NO), the sub control unit 60102 returns to S60102 above, and continues with the BET operation acceptance process. When the BET time has elapsed (S60103: YES), the process proceeds to S60104 and the sub control unit 60102 determines whether or not there is a BET. In this determination, the CPU 60131 determines whether or not there is a BET setting for this racing game based on what is stored in S60102 above.

Only when the sub control unit 60102 determines that there is a BET (S60104: YES), the process proceeds to S60105 and the sub control unit 60102 transmits BET information. In this transmission, the CPU 60131 transmits to the racing game unit 60011 the data on the memory content in S60209 or S60102 above, as BET information.

In S60106, the sub control unit 60102 executes an entry point increasing process. In this process, the CPU 60131 updates the player's own entry points stored in the RAM 60132, by adding points corresponding to the content of the player's BET operation on this racing game to the player's own entry points. The added entry points are equal to a certain proportion of the total BET amount the player sets for this racing game. The CPU 60131 displays the entry points after the addition in the entry point display area 60231 on the regular BET image or the high BET image of the sub monitor 60113.

In S60107, the sub control unit 60102 executes a racing game payout process. In this process, based on the data on the racing game payout information transmitted by the racing game unit 60011 in S61006 above, the CPU 60131 updates not only the player's own credit amount stored in the RAM 60132, but also the display in the payout amount display area 60220 or the credit amount display area 60221 on the regular BET image or the high BET image of the sub monitor 60113.

Further, in the respective stations 60101, the main control unit 60012 executes respective processes described in the flow chart of FIG. 1 at the time point P60001 after S60107 is executed.

First, in S60601, the sub control unit 60102 executes a performance process. In this process, the CPU 60131 stores orders of arrival in this racing game for each of player's racehorses.

Figure 21:
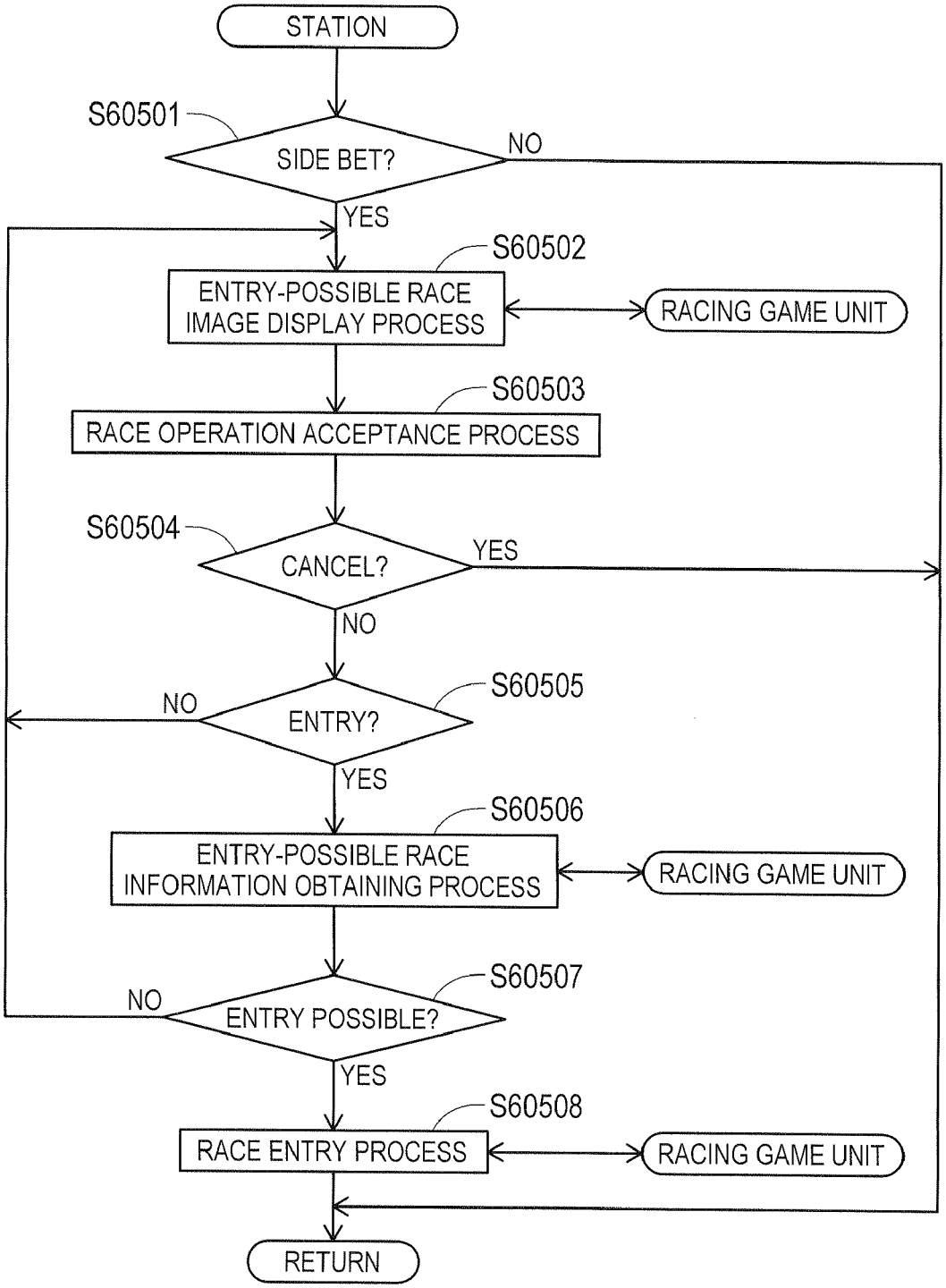
FIG. 21 is a view showing one example of a data table.

In the sub control unit 60102, to execute this process, orders of arrival in each racing games are managed with respect to each of the player's racehorses by using a spread sheet, for example, a data table shown in FIG. 21. In the data table, orders of arrival of each racing games are stored by associating the character ID of each of the player's racehorses. Such as a data table is generated for each of player IDs and stored into the RAM 60132, etc.

When storing orders of arrival in this racing games for each of player's racehorses in this process, the CPU 60131 reflects the racing game result of this racing game in the data table associated with the player by means of a spread sheet program constructed by using a character ID and a player ID, etc.

Incidentally, the racing game result of this racing game is included in the racing game payout information transmitted by the racing game unit 60011 in S61006 in FIG. 17 above. Additionally, the CPU 60131 has already identified the player ID of the player through S60202, S60203, S60204, etc. in FIG. 20 above.

In S60602, the sub control unit 60102 determines whether or not each of the player's racehorses satisfies a predetermined condition. In this determination, the CPU 60131 determines by using the data table of FIG. 21 above.

Here, this state will be more specifically explained by referring to the data table of FIG. 21 above. If the predetermined place is set to tenth and the predetermined number of times is set to three, the racehorse identified by the character ID of "RACEHORSE 671" satisfies the predetermined condition, whereas the racehorse identified by the character ID of "RACEHORSE 313" does not satisfy the predetermined condition.

It is to be noted that the "race N" indicates this racing game in the data table of FIG. 21 above. The "race N−1" indicates the last racing game. The "race N−2" indicates the last but one racing game. In the same manner, the orders of arrival in the past racing games are stored for each of the racehorses.

Incidentally, the orders of arrival of the racehorse identified by the character ID "RACEHORSE 671" are "10", "15", "11", "10", "2" . . . , starting backward from this racing game. On the other hand, the orders of arrival of the racehorse identified by the character ID "RACEHORSE 313" are "9", "3", "2", "15", "13", . . . , starting backward from this racing game. That is, the racing game in which the racehorse did not run is excluded from consideration in this process of making determination on the predetermined condition.

Now, if the player's racehorse does not satisfy the predetermined condition (S60602: NO), the game operations described in the flow chart of FIG. 1 is terminated to return to the game operations described in the flow chart of FIG. 17. In contrast, if the player's racehorse satisfies the predetermined condition (S60602: YES), the process proceeds to S60603.

In S60603, the sub control unit 60102 executes a partial bet amount refund process. In this process, the CPU 60131 refunds a part (for example, 50%) of total BET amount specified by the player for this racing game to the player. Accordingly, in the sub control unit 60102, the CPU 60131 updates not only the player's credit amount stored in the RAM 60132, but also the display in the payout amount display area 60220 or the credit amount display area 60221 on the regular BET image or high BET image of the sub monitor 60113, based on the information stored in S60102 in FIG. 17 above, so that a part (for example, 50%) of total BET amount specified by the player for this racing game is refunded to the player. Further, the CPU 60131 transmits BET amount refund information to the racing game unit 60011. In this time, the CPU 60131 adds data showing the BET amount refunded to the player and its player ID to the BET amount refund information. In the racing game unit 60011, the BET amount refund information is used for game control.

Thereafter, the game operations described in the flow chart of FIG. 1 is terminated to return to the game operations described in the flow chart of FIG. 17.

1-6. Example of Operations for Becoming a Racehorse Owner (the First Embodiment)

Figure 18:
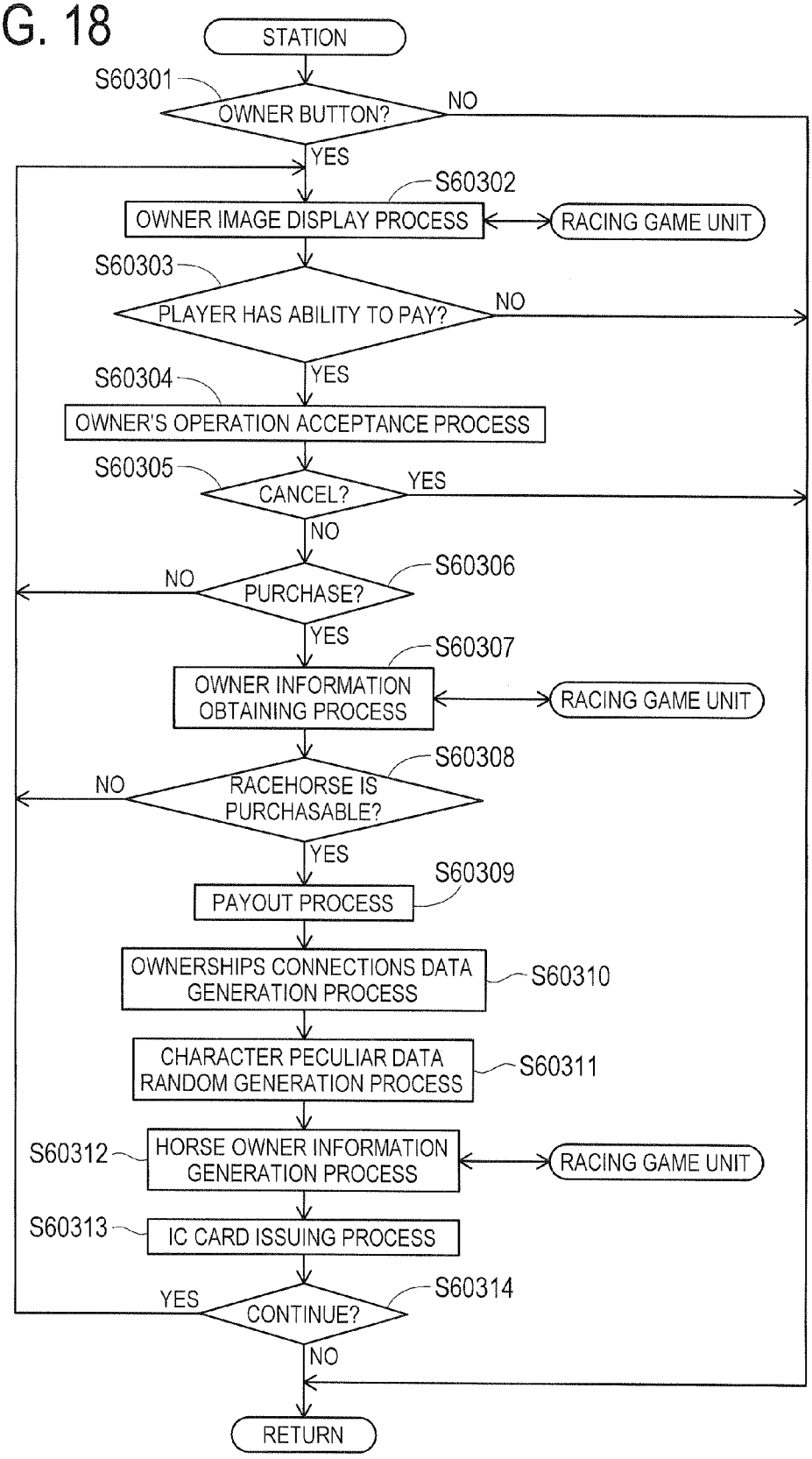
FIG. 18 is a flow chart diagram showing one example of an owner process.

In the following, an example of operations for becoming a racehorse owner in the horse race gaming machine 60001 of this embodiment is described. FIG. 18 is a flow chart diagram showing one example of an owner process.

In the respective stations 60101, triggered by a player's touching the owner button 60232 on the regular BET image or the high BET image of the sub monitor 60113, the owner process is executed based on the flow chart of FIG. 18.

First, in S60301, the sub control unit 60102 determines whether or not the player has touched the owner button 60232. In this determination, the CPU 60131 determines whether or not the player has touched the owner button 60232, based on a coordinate signal from the touch panel driving circuit 60122. Now, if the player has not touched the owner button 60232 (S60301: NO), this owner process terminates. In contrast, if the player has touched the owner button 60232 (S60301: YES), the process proceeds to S60302.

Figure 9:
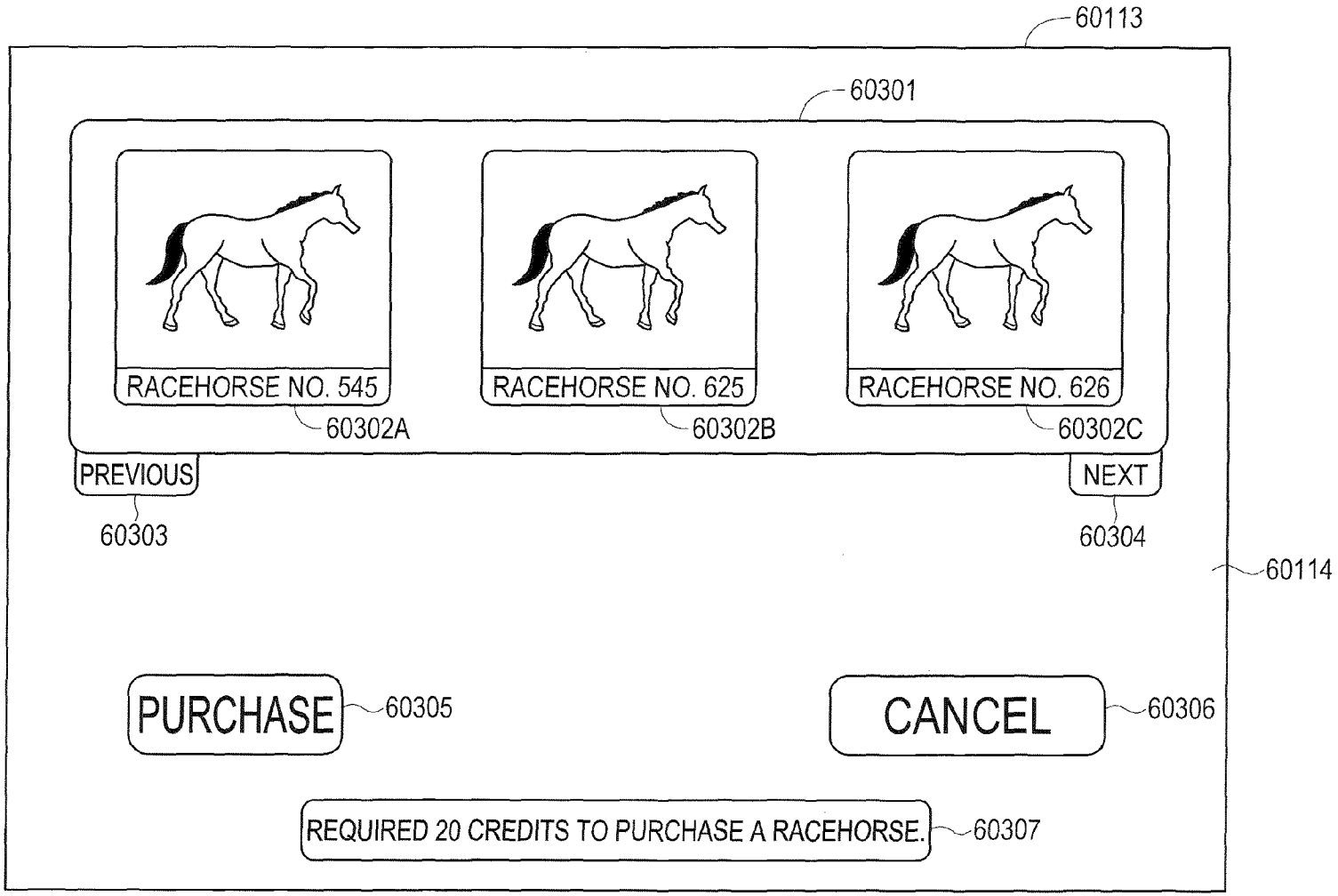
FIG. 9 is a front view showing one example of an owner image displayed on the sub monitor.

In S60302, the sub control unit 60102 executes an owner image display process. In this process, the CPU 60131 displays an owner image on the sub monitor 60113 based on the data on owner image information received through bidirectional communication with the racing game unit 60011. FIG. 9 shows one example of the owner image displayed on the sub monitor 60113.

As shown in FIG. 9, in the owner image displayed on the sub monitor 60113 covered by the light transmissive colorless touch panel 60114 are provided a racehorse page display area 60301, a previous page button 60303, a next page button 60304, a purchase button 60305, a cancel button 60306 and a message display area 60307, etc.

Three racehorse designation buttons 60302A, 60302B, and 60302C are provided in the racehorse page display area 60301. The respective racehorse designation buttons 60302A, 60302B, and 60302C display videos of racehorses that a player can purchase and their respective designation numbers. A player can designate a racehorse that he/she wishes to purchase, by touching each racehorse designation button 60302A, 60302B and 60302C.

In the racehorse page display area 60301, video of the 3 racehorses that a player can purchase is displayed. If the number of racehorses that a player can purchase is more than 3, a plurality of the racehorse page display areas 60301 will be generated. By touching the previous page button 60303 or the next page button 60304, a player can display any of the plurality of racehorse display areas 60301 on the owner image of the sub monitor 60113.

It is to be noted that the data on racehorses that a player can purchase is included in the owner image information received through bidirectional communication with the racing game unit 60011 in S60302 above.

The purchase button 60305 is a button that a player touches when determining a purchase of the designated racehorse. The cancel button 60306 is a button that a player touches when aborting a purchase of a racehorse. The message display area 60307 displays the message "REQUIRED 20 CREDITS TO PURCHASE A RACEHORSE".

In S60303, the sub control unit 60102 determines whether or not the player has the ability to pay. As shown in the message displayed in the message display area 60307, in this embodiment, 20 credits are required to purchase a racehorse. Therefore, in this determination, the CPU 60131 determines that the player has the ability to pay if the player's own credit amount stored in the RAM 60132 is not less than 20 credits. If the player has no ability to pay (S60303: NO), this owner process terminates. In contrast, if the player has the ability to pay (S60303: YES), the process proceeds to S60304.

In S60304, the sub control unit 60102 executes an owner's operation acceptance process. In this process, the CPU 60131 identifies the content of the player's BET operation in the owner image of the sub monitor 60113, based on a coordinate signal from the touch panel driving circuit 60122, and stores it in the RAM 60132. The CPU 60131 reflects the content of the player's BET operation in the display of the owner image of the sub monitor 60113.

In S60305, the sub control unit 60102 determines whether or not the player has touched the cancel button 60306. In this determination, the CPU 60131 determines whether or not the player has touched the cancel button 60306 based on a coordinate signal from the touch panel driving circuit 60122. Now, if the player has touched the cancel button 60306 (S60305: YES), this owner process terminates. In contrast, if the player has not touched the cancel button 60306 (S60305: NO), the process proceeds to S60306.

In S60306, the sub control unit 60102 determines whether or not the player has touched the purchase button 60305. In this determination, the CPU 60131 determines whether or not the player has touched the purchase button 60305 based on a coordinate signal from the touch panel driving circuit 60122. Now, if the player has not touched the purchase button 60305 (S60306: NO), the process returns to S60302 above. In contrast, if the player has touched the purchase button 60305 (S60306: YES), the process proceeds to S60307.

In S60307, the sub control unit 60102 executes an owner information obtaining process. In this process, the CPU 60131 receives owner information through bidirectional communication with the racing game unit 60011. This owner information includes data obtained as a result of causing the racing game unit 60011 to check whether or not the racehorse designated by the player is purchasable. If the racehorse is purchasable, the racing game unit 60011 puts the racehorse into purchase reserved state to prevent other player from purchasing the racehorse.

Figure 13:
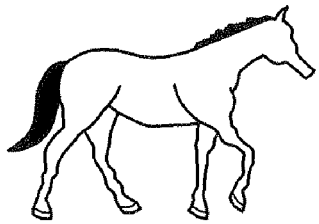
FIG. 13 is a view showing one example of a data table.
Figure 13:
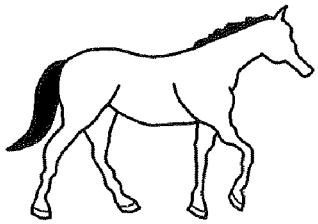
Figure 13:
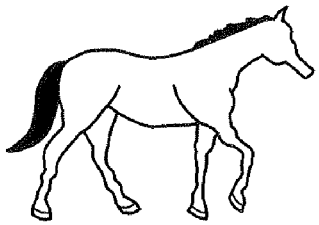

In the racing game unit 60011, the CPU 60041 controls respective racehorses by means of a character ID. For example, as per the data table shown in FIG. 13, the racehorses are associated with the character IDs. Such the table is stored in the RAM 60042 or the external memory device 60025, etc.

In addition, by associating the character IDs with player IDs, the racing game unit 60011 determines whether or not a racehorse is purchasable. For example, as per the data table shown in FIG. 14, the character IDs are associated with the player IDs. Such the data table is stored in the RAM 60042 or the external storage device 60025, etc.

By referring to an association between the character IDs and the player IDs, the racing game unit 60011 can also determine whether or not a player identified by the player ID is an owner of any racehorse. In addition, in the purchase reserved state described above, in the data table as shown in FIG. 14, for example, the racing game unit 60011 controls so that the character ID of the racehorse to be reserved can only be associated with the player ID of the player of that particular reservation.

In S60308, the sub control unit 60102 determines whether or not the racehorse designated by the player is purchasable. In this determination, the CPU 60131 makes a determination based on the data on the owner information received in S60307 above. Now, if the racehorse designated by the player is not purchasable (S60308: NO), the process returns to S60302 above. In contrast, if the racehorse designated by the player is purchasable (S60308: YES), the process proceeds to S60309.

In S60309, the sub control unit 60102 executes a payout process. In this process, by deducting credit amounts necessary for purchasing a racehorse from the player's own credit amount, the CPU 60131 updates not only the player's own credit amount stored in the RAM 60132 but also the display in the credit amount display area 60221 on the regular BET image or high BET image of the sub monitor 60113.

In S60310, the sub control unit 60102 executes an ownerships connections data generation process. In this process, the CPU 60131 generates a player ID according to predetermined rules. However, if an IC card 60119 is inserted into the reader/writer 60118, the CPU 60131 uses the player ID included in horse owner information 60501 (refer to FIG. 15 below) of the IC card 60119. In addition, the CPU 60131 links a character ID of a racehorse of the purchase object with its player ID.

In S60311, the sub control unit 60102 executes a character peculiar data random generation process. In this process, using random numbers, the CPU 60131 generates character peculiar data on characters of a racehorse of the purchase object.

Figures 14, 15:
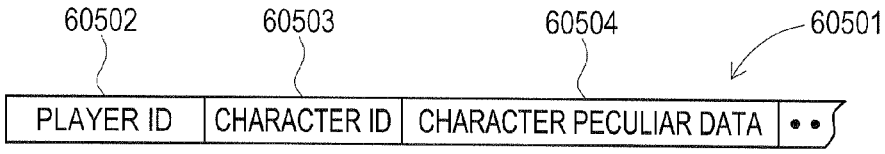
FIG. 14 is a view showing one example of a data table.
FIG. 15 is a view showing one example of horse owner information.

In S60312, the sub control unit 60102 executes a horse owner information generation process. In this process, the CPU 60131 generates horse owner information 60501 as shown in FIG. 15. In the horse owner information 60501, the character peculiar data generated in S60311 above is linked with the character ID and the player ID thereof that were linked to each other in S60310 above. In other words, the horse owner information 60501 includes the data 60502 on player ID generated in S60310 above, the data 60503 on the character ID of the racehorse of the purchase object, and the character peculiar data 60504 generated in S60311 above.

When the horse owner information 60501 is stored in the RAM 60132 by the CPU 60131, it is transmitted to the racing game unit 60011 at the same time. In the racing game unit 60011, the CPU 60041 stores the horse owner information 60501 in the RAM 60042 or the external memory device 60025, etc. In addition, in the racing game unit 60011, the CPU 60041 associates character IDs with player IDs based on the horse owner information 60501.

In S60313, the sub control unit 60102 executes an IC card issuing process. In this process, the CPU 60131 causes the IC card issuing device 60117 to issue an IC card 60119 storing the horse owner information 60501.

In S60314, the sub control unit 60102 determines whether or not to continue operation in the owner image of the sub monitor 60113. Now, if a player touches any part of the owner image within a predetermined period of time from when the IC card issuing device 60117 is caused to issue an IC card 60119, the CPU 60131 determines that the operation continues in the owner image of the sub monitor 60113. Therefore, in this determination, the CPU 60131 determines whether or not the player has touched any part of the owner image of the sub monitor 60113, based on a coordinate signal from the touch panel driving circuit 60122. Now, if the operation continues in the owner image of the sub monitor 60113 (S60314: YES), the process returns to S60302 above. In contrast, if the operation does not continue in the owner image of the sub monitor 60113 (S60314: NO), this owner process terminates.

Figure 10:
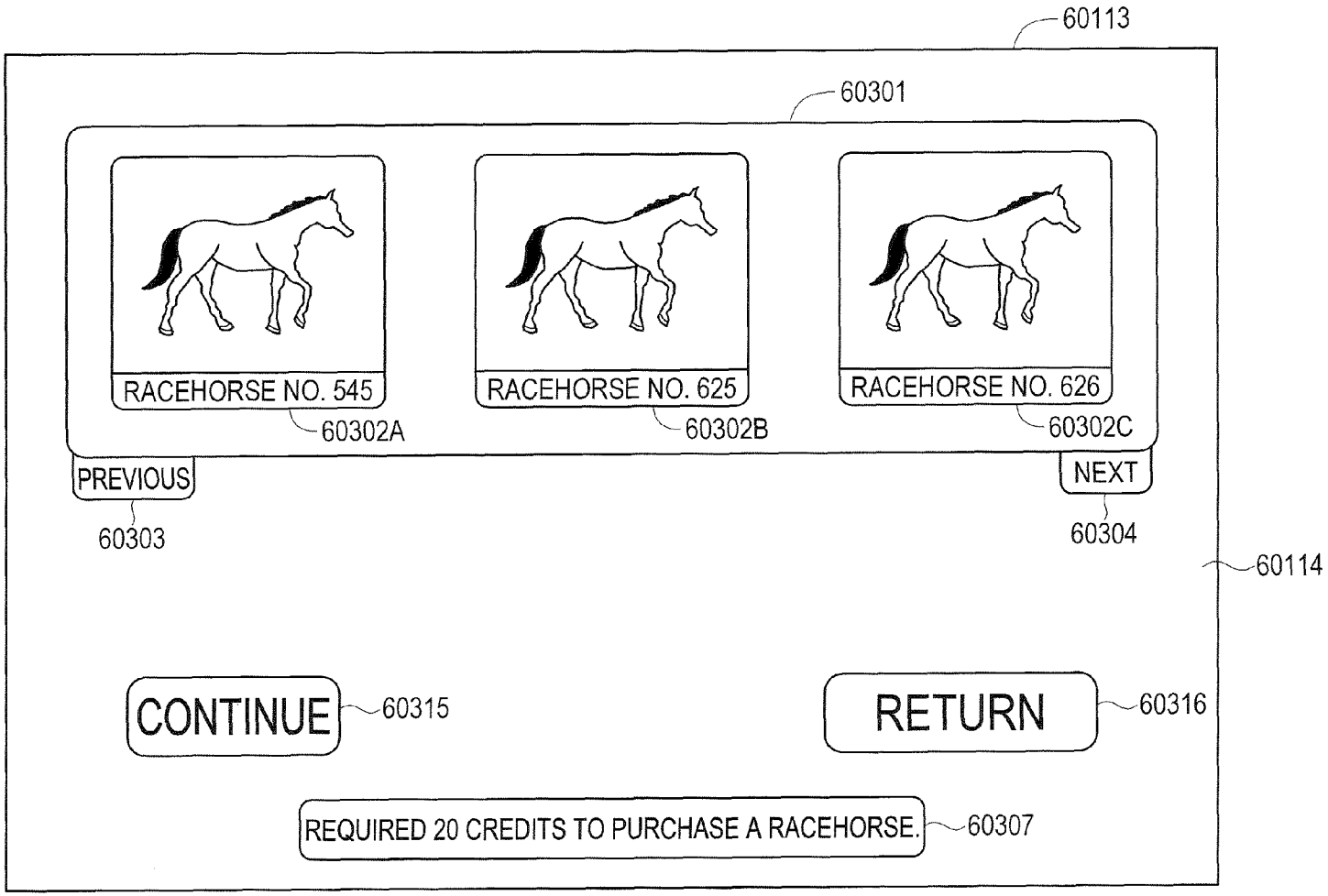
FIG. 10 is a front view showing one example of the owner image displayed on the sub monitor.

In this respect, the CPU 60131 may be such configured that the process of this S60314 is implemented, by providing a continue button 60315 or a return button 60316 in the owner image of the sub monitor 60113, as shown in FIG. 10.

When this owner process terminates, the sub monitor 60113 returns to the condition before this owner process starts. Therefore, the sub monitor 60113 displays the regular BET image above or the high BET image above.

1-7. Example of Operations for Making a Race Entry of a Player's Racehorse in a Racing Game (the First Embodiment)

In the following, the example of operations for making a race entry of a player's racehorse in a racing game in the horse race gaming machine 60001 according to this embodiment is described. FIG. 19 and FIG. 23 are flow chart diagrams showing one example of an entry process. First, one example of the entry process shown in FIG. 19 is described.

Figure 19:
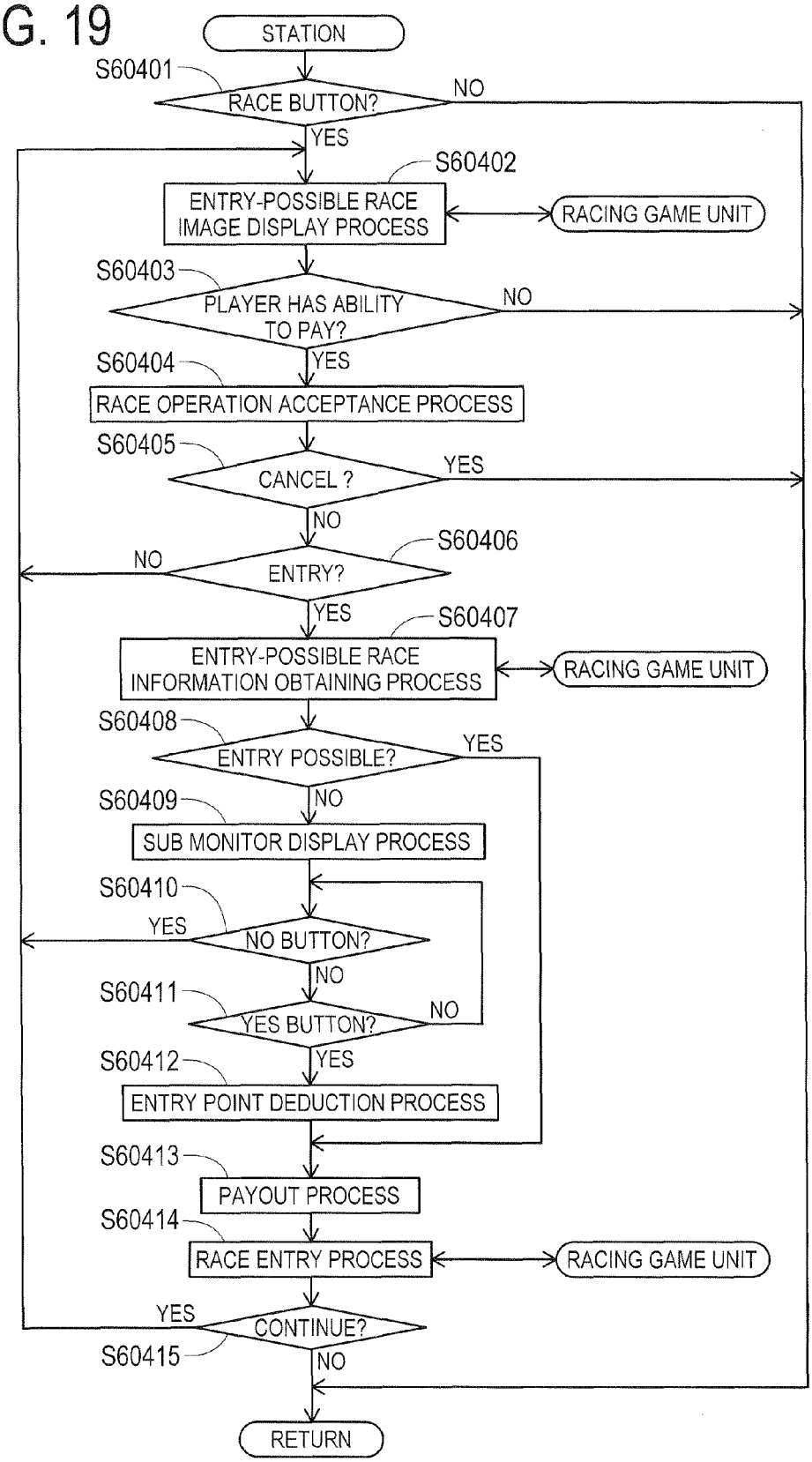
FIG. 19 is a flow chart diagram showing one example of an entry process.

In the respective stations 60101, triggered by a player's touching the race button 60234 on the high BET image of the sub monitor 60113, the entry process is executed based on the flow chart of FIG. 19.

First, in S60401, the sub control unit 60102 determines whether or not a player has touched the race button 60234. In this determination, the CPU 60131 determines whether or not the player has touched the race button 60234 based on a coordinate signal from the touch panel driving circuit 60122. Now, if the player has not touched the race button 60234 (S60401: NO), this entry process terminates. In contrast, if the player has touched the race button 60234 (S60401: YES), the process proceeds to S60402.

Figure 11:
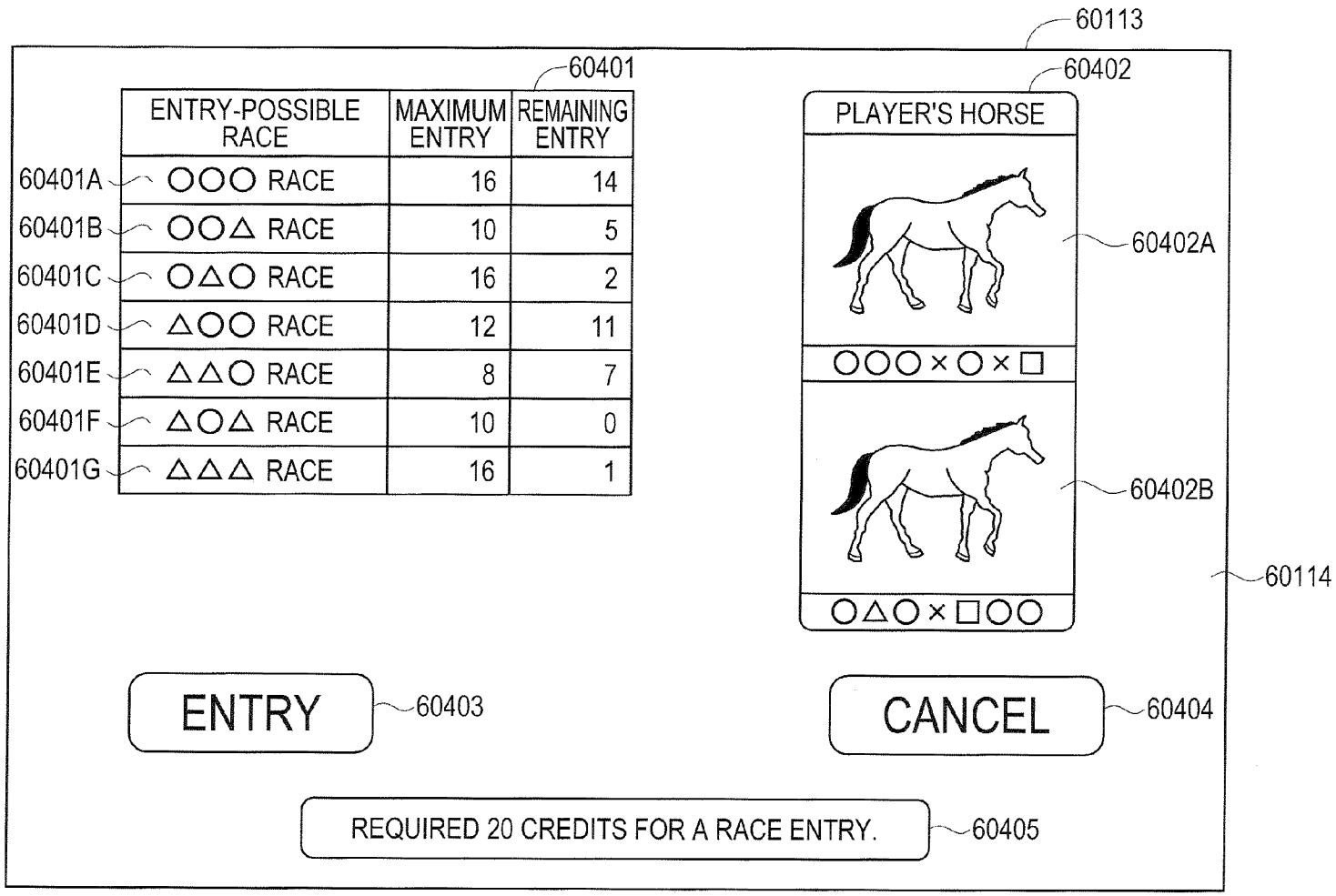
FIG. 11 is a front view showing one example of an entry-possible race image displayed on the sub monitor.
Figure 12:
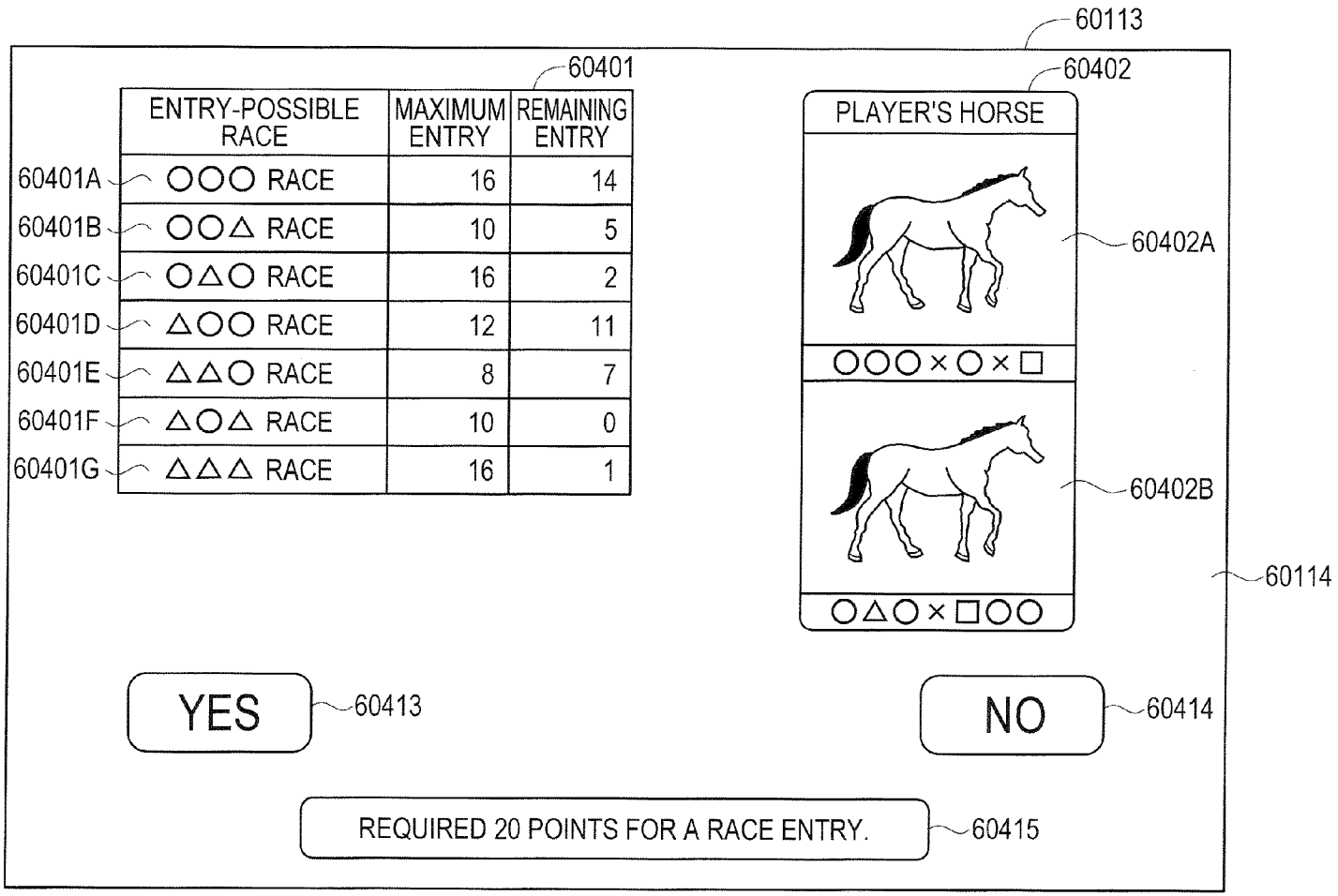
FIG. 12 is a front view showing one example of the entry-possible race image displayed on the sub monitor.

In S60402, the sub control unit 60102 executes an entry-possible race image display process. In this process, the CPU 60131 displays an entry-possible race image on the sub monitor 60113, based on the data on entry-possible race image information received through bidirectional communication with the racing game unit 60011. FIG. 11 and FIG. 12 show one example of the entry-possible race image displayed on the sub monitor 60113.

As shown in FIG. 11, in the entry-possible race image displayed on the sub monitor 60113 covered by the light transmissive colorless touch panel 60114 is provided an entry-possible race display area 60401, a player's horse display area 60402, an entry button 60403, a cancel button 60404 and a message display area 60405, etc.

In the entry-possible race display area 60401 is provided with respective columns for an entry possible race, a maximum entry, and a remaining entry. The entry possible race column displays a name of a racing game in which a race entry of a racehorse is possible. Parts where those names are displayed are used as designation buttons 60401A, 60401B, 60401C, 60401D, 60401E, 60401F, and 60401G for a player to designate a racing game. The maximum entry column displays the number of racehorses that run in a racing game. The remaining entry column displays the number of racehorses that can make a race entry in a racing game.

The player's horse display area 60402 displays racehorses whose owner is a player. Parts in which those racehorses are displayed are used as designation buttons 60402A, 60402B for a player to designate a racehorse.

The data on the entry-possible race display area 60401 or the player's horse display area 60402 is included in the entry-possible race image information received through bidirectional communication with the racing game unit 60011 in S60402 above.

The entry button 60403 is a button that a player touches when he/she wishes to make a race entry of a designated racehorse in a designated racing game. The cancel button 60404 is a button that the player touches to stop race entry. The message display area 405 displays a message "REQUIRED 20 CREDITS FOR A RACE ENTRY".

In S60403, the sub control unit 60102 determines whether or not the player has the ability to pay. As per the message displayed in the message display area 60405, in this embodiment, 20 credits are required to make a race entry of one racehorse. Therefore, in this determination, the CPU 60131 determines that the player has the ability to pay when the player's own credit amount stored in the RAM 60132 are not less than 20 credits. If the player has no ability to pay (S60403: NO), this entry process terminates. In contrast, if the player has the ability to pay (S60403: YES), the process proceeds to S60404.

In S60404, the sub control unit 60102 executes a race operation acceptance process. In this process, the CPU 60131 identifies the content of the player's operation in the entry-possible race image of the sub monitor 60113, based on a coordinate signal from the touch panel driving circuit 60122 and stores it in the RAM 60132. The CPU 60131 reflects the content of the player's operation in the display of the entry-possible race image of the sub monitor 60113.

In S60405, the sub control unit 60102 determines whether or not the player has touched the cancel button 60404. In this determination, the CPU 60131 determines whether or not the player has touched the cancel button 60404 based on a coordinate signal from the touch panel driving circuit 60122. Now, if the player has touched the cancel button 60404 (S60405: YES), this entry process terminates. In contrast, if the player has not touched the cancel button 60404 (S60405: NO), the process proceeds to S60406.

In S60406, the sub control unit 60102 determines whether or not the player has touched the entry button 60403. In this determination, the CPU 60131 determines whether or not the player has touched the entry button 60403 based on a coordinate signal from the touch panel driving circuit 60122. Now, if the player has not touched the entry button 60403 (S60406: NO), the process returns to S60402 above. In contrast, if the player has touched the entry button 60403 (S60406: YES), the process proceeds to S60407.

In S60407, the sub control unit 60102 executes an entry-possible race information obtaining process. In this process, the CPU 60131 receives entry-possible race information through bidirectional communication with the racing game unit 60011. This entry-possible race information includes data as a result of causing the racing game unit 60011 to check whether or not a racehorse designated by the player can make a race entry in a designated racing game. If the race entry is possible, the racing game unit 60011 puts that race entry into a reserved state.

In the racing game unit 60011, the CPU 60041 controls race entries of respective racing games by means of character IDs. For example, as per the data table shown in FIG. 16, a racing game and character IDs are associated. Such the data table is stored in the RAM 60042 or the external memory device 60025, etc.

In S60408, the sub control unit 60102 determines whether or not a racehorse designated by the player can make a race entry in a designated racing game. In this determination, the CPU 60131 makes a determination based on the data on the entry-possible race information received in S60407 above. Now, if the racehorse designated by the player can make a race entry in the designated racing game (S60408: YES), the process proceeds to S60413 below. In contrast, if the racehorse designated by the player cannot make a race entry in the designated racing game (S60408: NO), the process proceeds to S60409.

In this embodiment, it is possible to forcibly make a race entry in a racing game designated by a player (refer to S60414 below) on the condition that the player pays 20 points from the player's own entry points (refer to S60412 below), even though there is no longer any racehorse that can make a race entry in the racing game.

In S60409, the sub control unit 60102 executes a sub monitor display process. In this process, the CPU 60131 changes the entry-possible race image being displayed on the sub monitor 60113 to an entry-possible race image as shown in FIG. 12. In other words, instead of the entry button 60403, the cancel button 60404, and the message display area 60405 are provided a YES button 60413, a NO button 60414 and a message display area 60415.

The YES button 60413 is a button that the player touches to ensure race entry of a designated racehorse in a designated racing game. The NO button 60414 is a button that the player touches to stop race entry of a designated racehorse in a designated racing game. The message display area 60415 displays the message "REQUIRED 20 POINTS FOR A RACE ENTRY".

In S60410, the sub control unit 60102 determines whether or not the player has touched the NO button 60414. In this determination, the CPU 60131 determines whether or not the player has touched the NO button 60414 based on a coordinate signal from the touch panel driving circuit 60122. Now, if the player has touched the NO button 60414 (S60410: YES), the process returns to S60402 above. Then, the CPU 60131 causes the racing game unit 60011 to cancel the reservation of the race entry described above, by transmitting a control signal to the racing game unit 60011. In contrast, if the player has not touched the NO button 60414 (S60410: NO), the process proceeds to S60411.

In S60411, the sub control unit 60102 determines whether or not the player has touched the YES button 60413. In this determination, the CPU 60131 determines whether or not the player has touched the YES button 60413, based on a coordinate signal from the touch panel driving circuit 60122. Now, if the player has not touched the YES button 60413 (S60411: NO), the process returns to S60410 above. In contrast, if the player has touched the YES button 60413 (S60411: YES), the process proceeds to S60412.

In S60412, the sub control unit 60102 executes an entry point deduction process. In this process, by deducting from the player's own entry points the points necessary to make a race entry in a racing game, the CPU 60131 updates not only the player's own entry points stored in the RAM 60132 but also the display in the entry point display area 60231 on the high BET image of the sub monitor 60113.

In this respect, all of the player's own entry points may be deducted.

It is to be noted that the sub control unit 60102 skips a payout process of S60413 below, if this entry point deduction process is executed.

In S60413, the sub control unit 60102 executes the payout process. In this process, by deducting credit amounts necessary for making a race entry in a racing game from the player's own credit amount, the CPU 60131 updates not only the player's own credit amount stored in the RAM 60132 but also the display in the credit amount display area 60221 on the high BET image of the sub monitor 60113.

In S60414, the sub control unit 60102 executes a race entry process. In this process, when storing in the RAM 60132 race entry information including data on race entry determination, etc. (data showing player IDs or character IDs, or determinations), the CPU 60131 simultaneously transmits it to the racing game unit 60011. In the racing game unit 60011, the CPU 60041 associates a racing game with a character ID based on data on this information. In particular, if the player has paid 20 points from the player's own entry points, a race entry in the racing game is forcibly done. The racing game unit 60011 may enable this forcible race entry by increasing the number of racehorses to run the racing game, or by replacing any of the racehorses that have already been registered, with it.

In S60415, the sub control unit 60102 determines whether or not operation continues in the entry-possible race image of the sub monitor 60113. Now, if the player touches any part of the entry-possible race image of the sub monitor 60113 within a predetermined period of time from when the player touched the YES button 60413, the CPU 60131 determines that the operation continues in the entry-possible race image of the sub monitor 60113. Thus, if the operation continues in the entry-possible race image of the sub monitor 60113 (S60415: YES), the process returns to S60402 above. In contrast, if the operation does not continue in the entry-possible race image of the sub monitor 60113 (S60415: NO), this entry process terminates.

When this entry process terminates, the sub monitor 60113 returns to the condition before the entry process starts. Therefore, the sub monitor 60113 displays the high BET image above.

Next, one example of the entry process shown in FIG. 23 is described.

In each of the stations 60101, the entry process is executed in accordance with the flow chart of FIG. 23, triggered by a player's touch on the side bet button 60236 on the regular BET image or the high BET image of the sub monitor 60113.

First, in S60501, the sub control unit 60102 determines whether or not the player has touched the side bet button 60236. In this determination, the CPU 60131 determines whether or not the player has touched the side bet button 60236 based on a coordinate signal from the touch panel driving circuit 60122. Now, if the player has not touched the side bet button 60236 (S60501: NO), this entry process is terminated. In contrast, if the player has touched the side bet button 60236 (S60501: YES), the process proceeds to S60502.

In S60502, the sub control unit 60102 executes an entry-possible race image display process. In this process, the CPU 60131 displays an entry-possible race image on the sub monitor 60113, based on the data on entry-possible race image information received through bidirectional communication with the racing game unit 60011. FIG. 11 and FIG. 12 show one example of the entry-possible race image displayed on the sub monitor 60113.

In S60503, the sub control unit 60102 executes a race operation acceptance process. In this process, the CPU 60131 identifies the content of the player's operation in the entry-possible race image of the sub monitor 60113, based on a coordinate signal from the touch panel driving circuit 60122 and stores it in the RAM 60132. The CPU 60131 reflects the content of the player's operation in the display of the entry-possible race image of the sub monitor 60113.

In S60504, the sub control unit 60102 determines whether or not the player has touched the cancel button 60306. In this determination, the CPU 60131 determines whether or not the player has touched the cancel button 60306 based on a coordinate signal from the touch panel driving circuit 60122. Now, if the player has touched the cancel button 60306 (S60504: YES), this owner process terminates. In contrast, if the player has not touched the cancel button 60306 (S60504: NO), the process proceeds to S60505.

In S60505, the sub control unit 60102 determines whether or not the player has touched the entry button 60403. In this determination, the CPU 60131 determines whether or not the player has touched the entry button 60403 based on a coordinate signal from the touch panel driving circuit 60122. Now, if the player has not touch the entry button 60403 (S60505: NO), the process returns to S60502 above. In contrast, if the player has touched the entry button 60403 (S60505: YES), the process proceeds to S60506.

In S60506, the sub control unit 60102 executes an entry-possible race information obtaining process. In this process, the CPU 60131 receives entry-possible race information through bidirectional communication with the racing game unit 60011. This entry-possible race information includes data as a result of causing the racing game unit 60011 to check whether or not a racehorse designated by the player can make a race entry in a designated racing game. If the race entry is possible, the racing game unit 60011 puts that race entry into a reserved state.

In S60507, the sub control unit 60102 determines whether or not a racehorse designated by the player can make a race entry in a designated racing game. In this determination, the CPU 60131 makes a determination based on the data on the entry-possible race information received in S60506 above. Now, if the racehorse designated by the player cannot make a race entry in the designated racing game (S60507: NO), the process returns to S60502 above. In contrast, if the racehorse designated by the player can make a race entry in the designated racing game (S60507: YES), the process proceeds to S60508.

In S60508, the sub control unit 60102 executes a race entry process. In this process, when storing in the RAM 60132 race entry information including data on race entry determination, etc. (data showing player IDs or character IDs, or determinations), the CPU 60131 simultaneously transmits it to the racing game unit 60011. In the racing game unit 60011, the CPU 60041 associates a racing game with a character ID based on data on this information. Thereafter, the entry process is terminated.

When this entry process terminates, the sub monitor 60113 returns to the condition before the entry process starts. Therefore, the sub monitor 60113 displays the regular BET image above or the high BET image above.

1-8. Others (the First Embodiment)

In addition, the present invention is not limited to the above first embodiment, but various changes may be made without departing from its scope.

For example, the characteristics of the present invention can be implemented even when configuration is such that the BET operations on a racing game result are limited to those before the racing game.

In addition, if the performance point of the player's racehorse satisfies the predetermined condition (S60602: YES), a part or all of insurance may be awarded to the player. A part of total BET amount individually specified by each of the players for each of the racing games is accumulated in the insurance.

Figure 24:
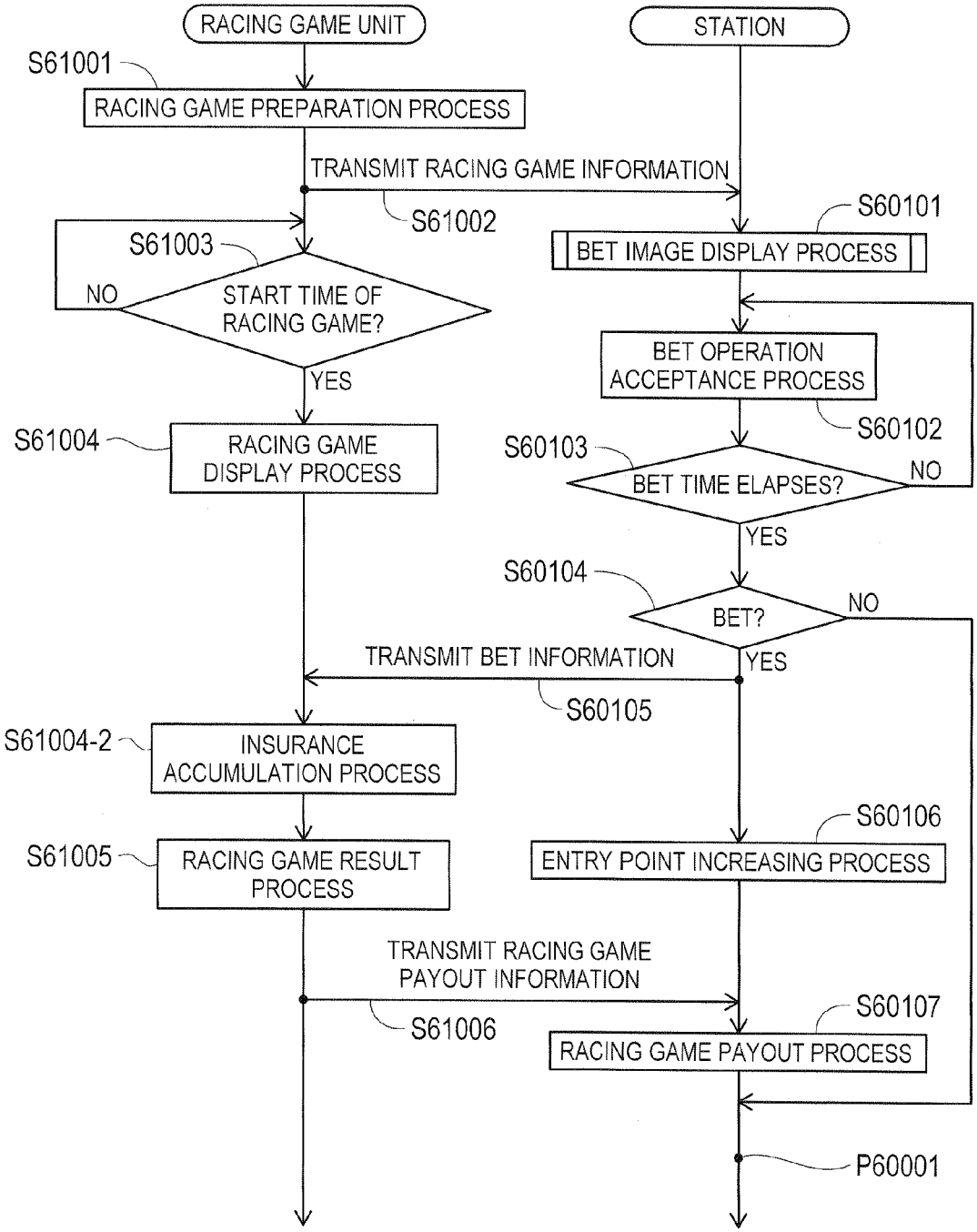
FIG. 24 is a flow chart diagram showing one example of game operations in the horse race gaming machine.

In this case, the horse race gaming machine 60001 of this embodiment is configured in such a manner that the game operations thereof are performed based on the flow chart of FIG. 24, not of FIG. 17. The flow chart of FIG. 24 is different from the flow chart of FIG. 17 only in that the process of S61004-2 is added thereto.

That is, in the racing game unit 60011, the main control unit 60012 executes an insurance accumulation process of S61004-2 before executing the racing game result display process of S61005. In this process, the CPU 60041 includes a part of total BET amount for this racing game in the insurance amount, based on the BET information received in S60105 above.

It is to be noted that the insurance amount is stored in the RAM 60042 or the external memory device 60025, etc. Thereafter, in the racing game unit 60011, the CPU 60041 adds data showing the insurance amount after the inclusion to the racing game payout information which is transmitted in S61006.

Figure 26:
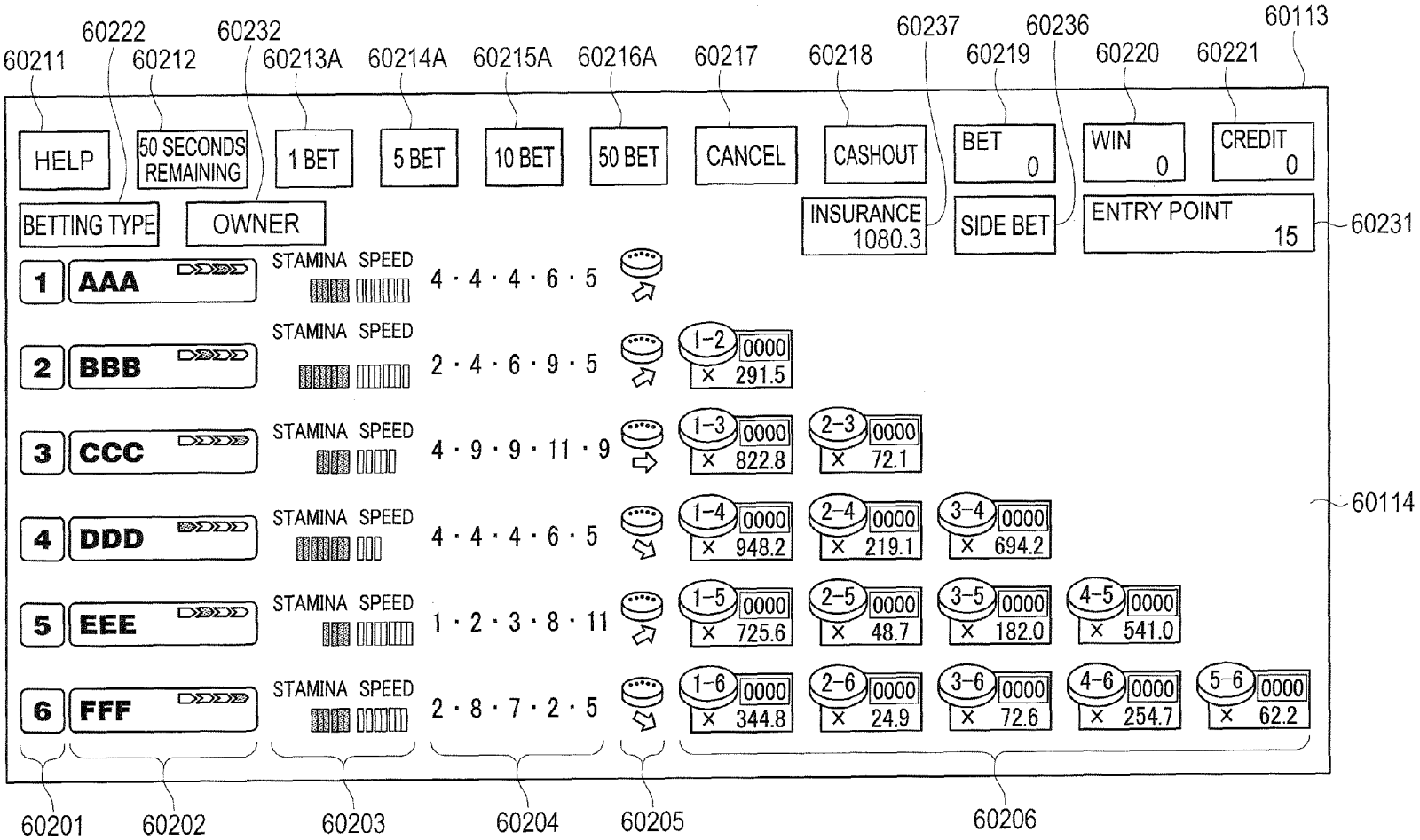
FIG. 26 is a front view showing one example of the regular BET image displayed on the sub monitor.
Figure 27:
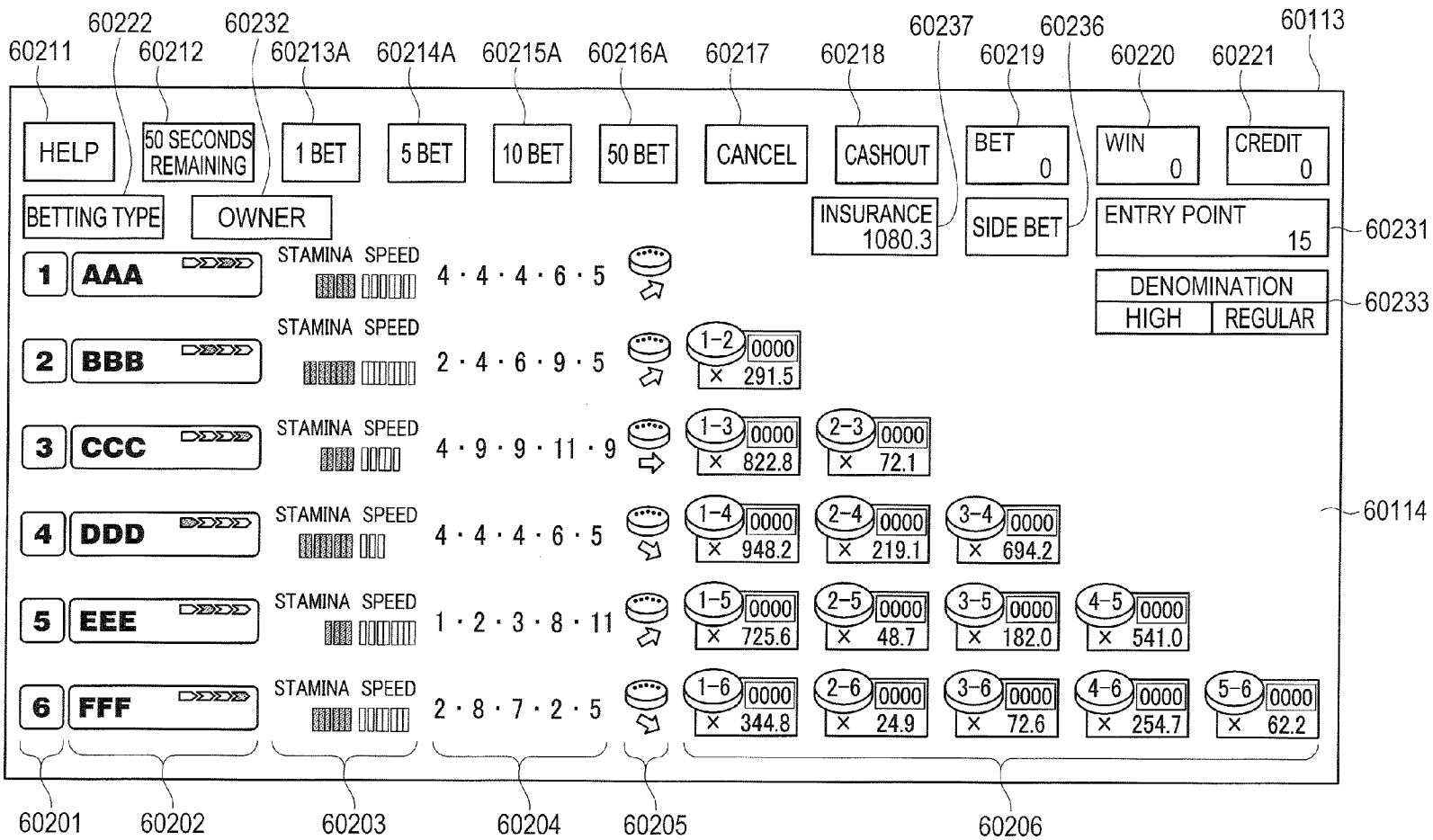
FIG. 27 is a front view showing one example of the regular BET image displayed on the sub monitor.
Figure 28:
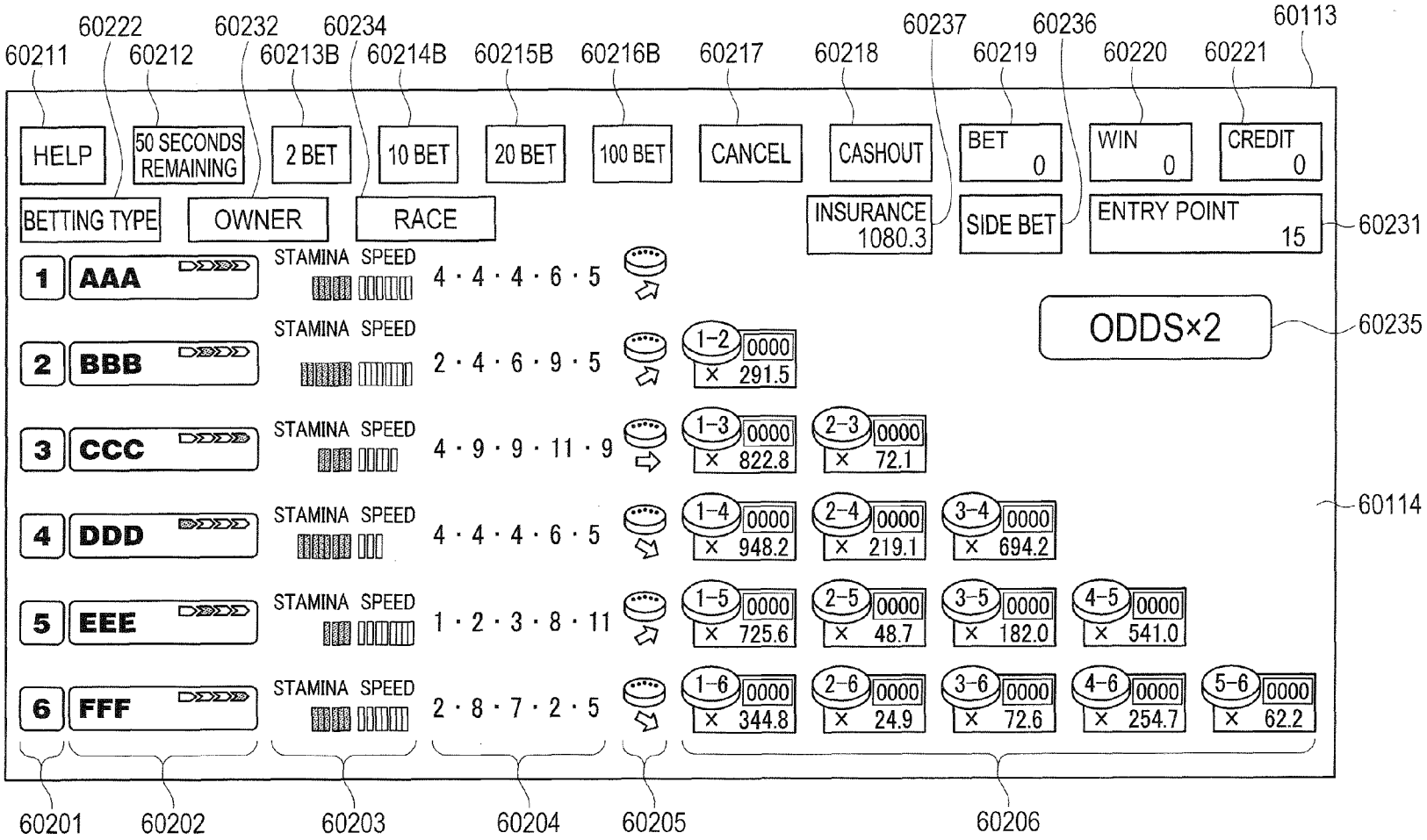
FIG. 28 is a front view showing one example of the high BET image displayed on the sub monitor.

On the other hand, in the respective stations 60101, as shown in FIG. 26 to 28, the regular BET image or the high BET image displayed on the sub monitor 60113 are additionally provided with an insurance display area 60237, so that the insurance amount after the inclusion is displayed. Further, in the sub control unit 60102, based on the data showing the insurance amount included in the racing game payout information, the CPU 60131 controls so as to update the display in the insurance display area 60237 when the regular BET image or the high BET image is displayed on the sub monitor 60113.

Further, in the respective stations 60101, it is configured that the sub control unit 60102 executes the processes described in the flow chart of FIG. 25, not of FIG. 1, at the time point P60001 after S60107 is executed.

First, in S60701, the sub control unit 60102 executes a performance process. This process is the process similar to the performance process of S60601 in FIG. 1.

In S60702, the sub control unit 60102 determines whether or not each of the player's racehorses satisfies a predetermined condition. In this determinations, the CPU 60131 determines by using, for example, a data table as shown in FIG. 22 and the data table of FIG. 21 above. The predetermined condition here means that the player's racehorses, in consecutive racing games equal to or more than the number of three times including a result of this racing game, have finished consecutively in a place equal to or lower than the tenth place. It is to be noted that the data table of FIG. 22 is stored in the ROM 60133, etc.

Now, if the player's racehorse does not satisfy the predetermined condition (S60702: NO), the game operations described in the flow chart of FIG. 25 is terminated to return to the game operations described in the flow chart of FIG. 17. In contrast, if the player's racehorse satisfies the predetermined condition (S60703: YES), the process proceeds to S60703.

In S60703, the sub control unit 60102 executes an insurance payout process. In this process, the CPU 60131 transmits percentage information to the racing game unit 60011. In this time, the CPU 60131 adds data showing the insurance's percentage corresponding to the consecutive number of times determined in S60702 above. It is to be noted that the relationships between the insurance's percentage and the consecutive number of times are defined in the data table of FIG. 22.

Meanwhile, in the racing game unit 60011, the CPU 60041 calculates an amount corresponding to the percentage showed by the data included in the percentage information, based on the insurance amount at the time of receiving the percentage information. Also, the CPU 60041 transmits in reply insurance award information including data showing the calculated amount. Incidentally, the CPU 60041 updates the insurance amount by deducting the calculated amount therefrom. Further, the CPU 60041 includes data showing the updated insurance amount in the insurance award information.

On the other hand, in the sub control unit 60102, the CPU 60131 updates not only the player's credit amount stored in the RAM 60132, but also the display in the payout amount display area 60220 or the credit amount display area 60221 on the regular BET image or high BET image of the sub monitor 60113, based on the data showing the calculated amount included in the insurance award information. Further, the CPU 60131 updates the display in the insurance display area 60237 on the regular BET image or high BET image of the sub monitor 60113, based on the data showing the insurance amount included in the insurance award information.

After that, the game operations described in the flow chart of FIG. 25 is terminated to return to the game operations described in the flow chart of FIG. 17.

2-1. Characteristics of a Horse Race Gaming Machine (the Second Embodiment)

In the following, a description is made on the second embodiment of the present invention with reference to drawings.

Figure 30:
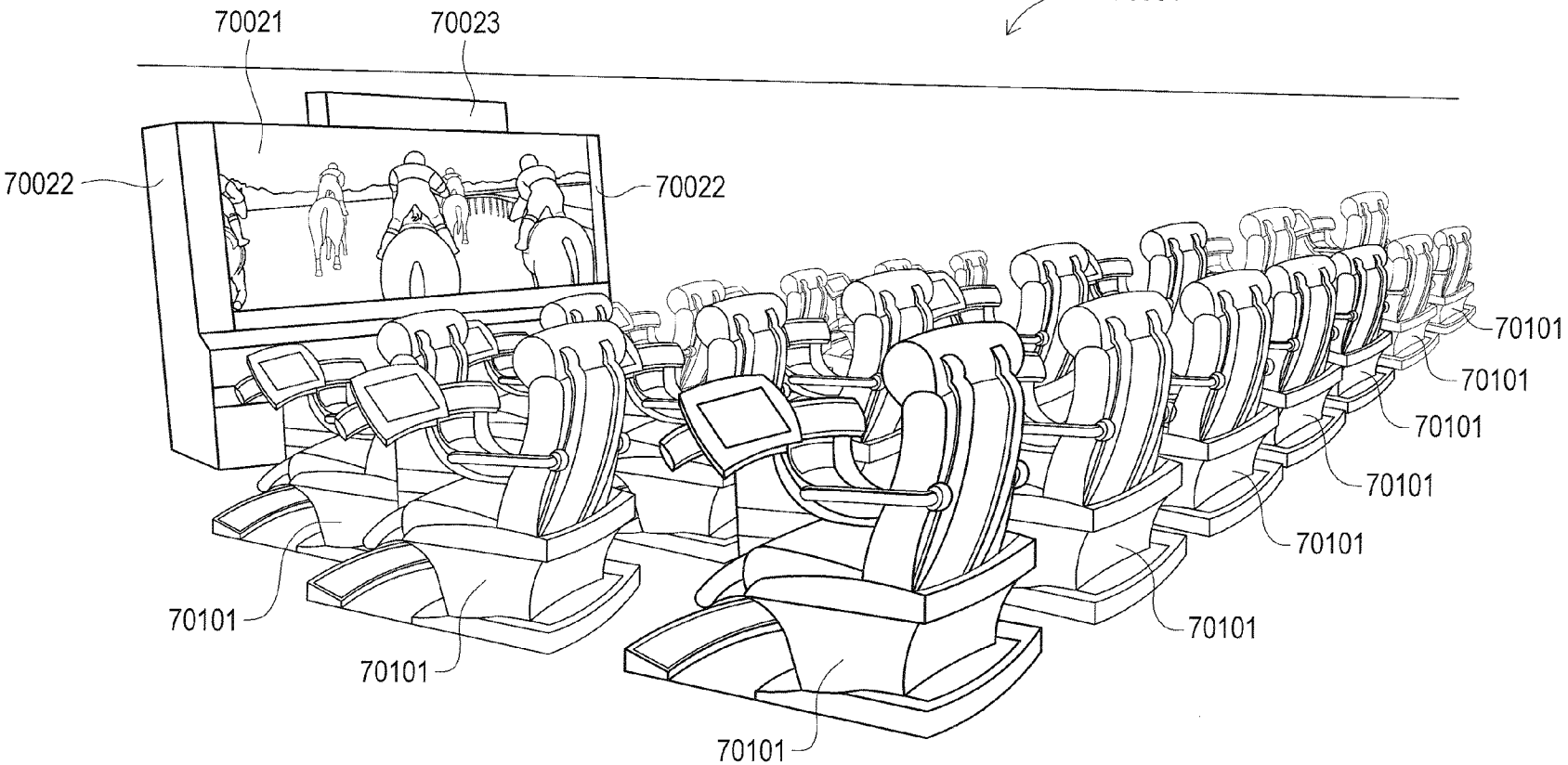
FIG. 30 is a perspective view of the horse race gaming machine.
Figure 31:
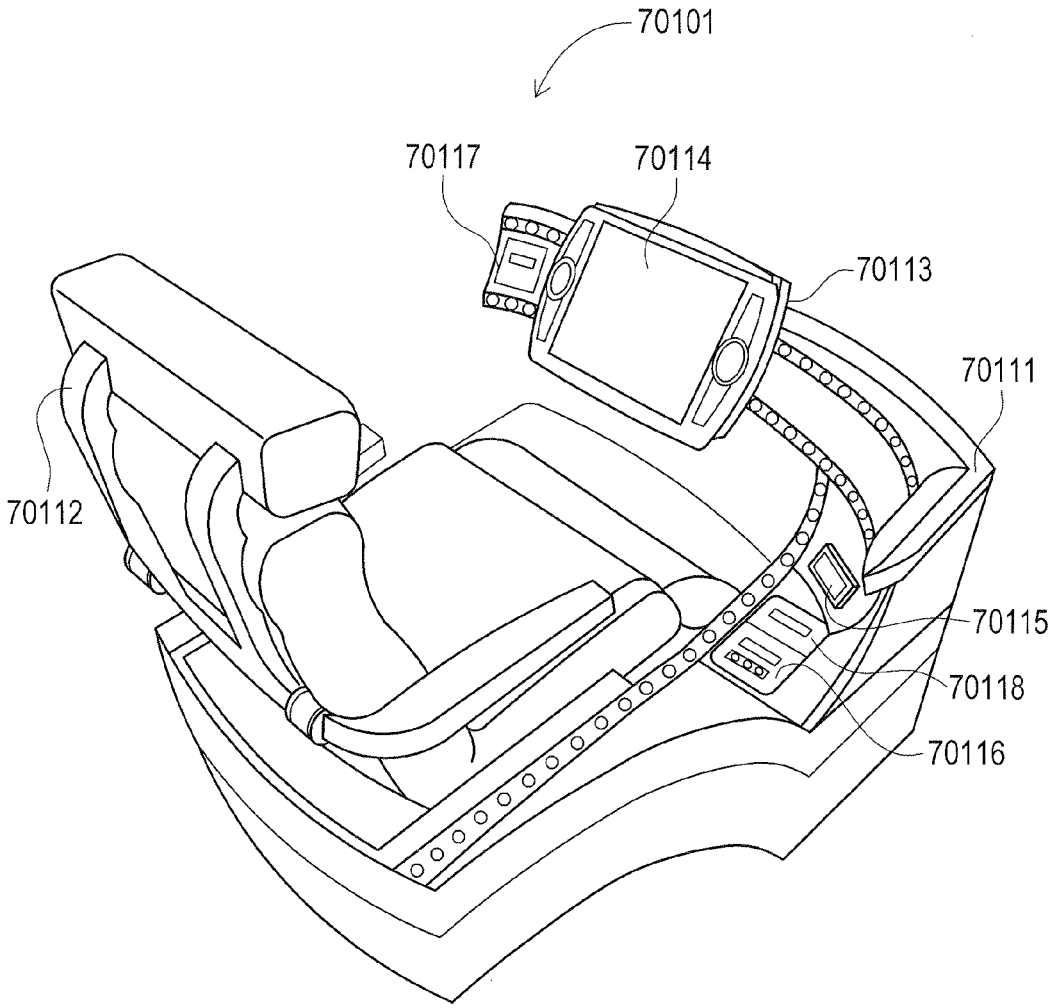
FIG. 31 is a perspective view of a station.

FIG. 30 is a perspective view of a horse race gaming machine 70001 that is one embodiment of the present invention. As shown in FIG. 30, the horse race gaming machine 70001 of this embodiment has a main monitor 70021 and a plurality of stations 70101. The main monitor 70021 displays images of a horse racing game. Players being seated at the respective stations 70101 can respectively participate in this horse racing game. The players being seated at the respective stations 70101 participate in this horse racing game by forecasting a result of each racing game of the horse racing game and performing BET operations. Namely, a horse racing game is constituted of a number of racing games that are intermittently executed in a sequential manner. In addition, the player is able to make a side bet for this racing game. FIG. 31 is a perspective view of the station 70101. A sub monitor 70113 or a touch panel 70114 that each station 70101 is provided with is used to perform BET operations.

In this respect, in the horse race gaming machine 70001 of this embodiment, BETting on racing game result can be performed before or during the racing game.

Figure 29:
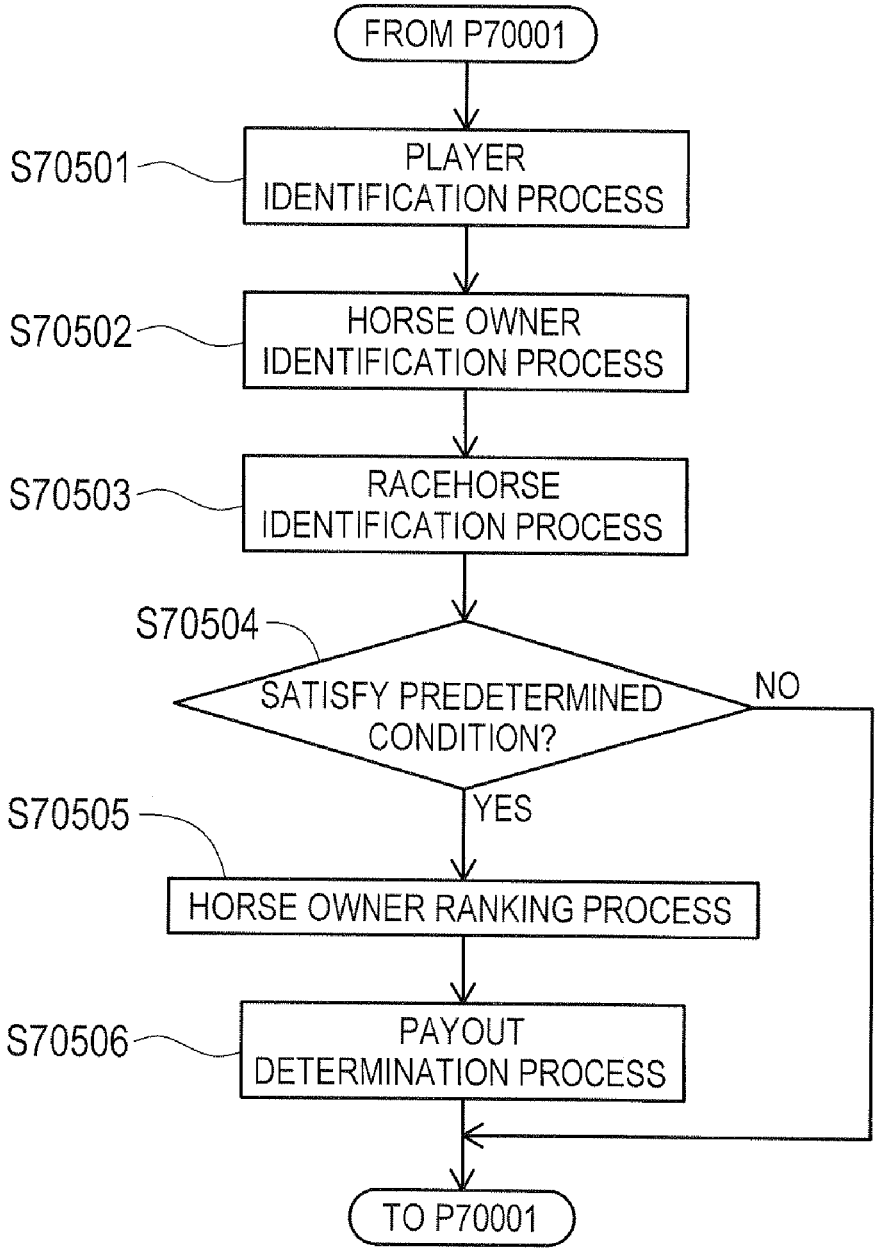
FIG. 29 is a view showing characteristics of a horse race gaming machine of the second embodiment of the present invention and a flow chart diagram showing one example of game operations in the horse race gaming machine.

FIG. 29 is a view showing characteristics of the horse race gaming machine 70001 of this embodiment and a flow chart diagram showing one example of game operations in the horse race gaming machine 70001. In the horse race gaming machine 70001 of this embodiment, if at least the predetermined number of the racehorses whose respective owners are any one of players who are playing at stations 70101 have run in this racing game (S70504: YES), this racing game is accompanied with a side game in which respective owners of those racehorses are ranked by the result of this racing game (S70505, S70506).

However, the following conditions should be satisfied in order to have a racehorse, owned by a player, run in a racing game in which such an accompanying side game is planned to be held.

(1) A player pays entry points (S70106 of FIG. 45 below) given to the player depending on the BET amount set by the player (S70605 of FIG. 53 below).

(2) The player sets a side bet (S70605-2 of FIG. 55 below).

2-2. Appearance of a Horse Race Gaming Machine (the Second Embodiment)

As shown in FIG. 30, the horse race gaming machine 70001 of this embodiment has the main monitor 70021, speakers 70022, a display device 70023, the plurality of stations 70101, etc. The main monitor 70021 displays images of a horse racing game, etc. The speakers 70022 output sound of a horse racing game, etc. The display device 70023 displays information about games in general.

As shown in FIG. 31, in each station 70101, a cabinet 70111 is provided with a chair 70112, the sub monitor 70113, the touch panel 70114, a bill identifying device 70115, a ticket printer 70116, an IC card issuing device 70117, a reader/writer 70118, etc. A player sits on the chair 70112. The sub monitor 70113 displays BET images described later, etc. The touch panel 70114 is provided on the screen of the sub monitor 70113. When the player performs the BET operations utilizing the regular BET image described later or the high BET image described later or the player performs specific operations utilizing an owner image described later or an entry-possible race image described later, the touch panel 70114 is used.

The bill identifying device 70115 not only identifies whether or not a bill is appropriate but also receives legitimate bills into the cabinet 70111. Then, bills inserted into the cabinet 70111 are converted into the number of coins, and the credit amount that corresponds to the converted number of coins is added as the player's own credit amount. The bill identifying device 70115 is also configured to be capable of reading bar coded tickets described later.

The ticket printer 70116 is a printer that prints on a ticket a bar code representative of coded data such as a player's own credit amount, date, identification number of the station 70101, etc. and outputs it as a bar coded ticket. A player can have the outputted bar coded ticket read by other station 70101 and play at this other station 70101, or use it for any procedure in predetermined places in a game arcade.

The IC card issuing device 70117 is a device that issues an IC card 70119 (refer to FIG. 33 below) on which horse owner information 70501 (refer to FIG. 43 below) is stored. The IC card 70119 (refer to FIG. 33 below) is inserted into the reader/writer 70118.

2-3. Example of Configuration of a Racing Game Unit (the Second Embodiment)

Figure 32:
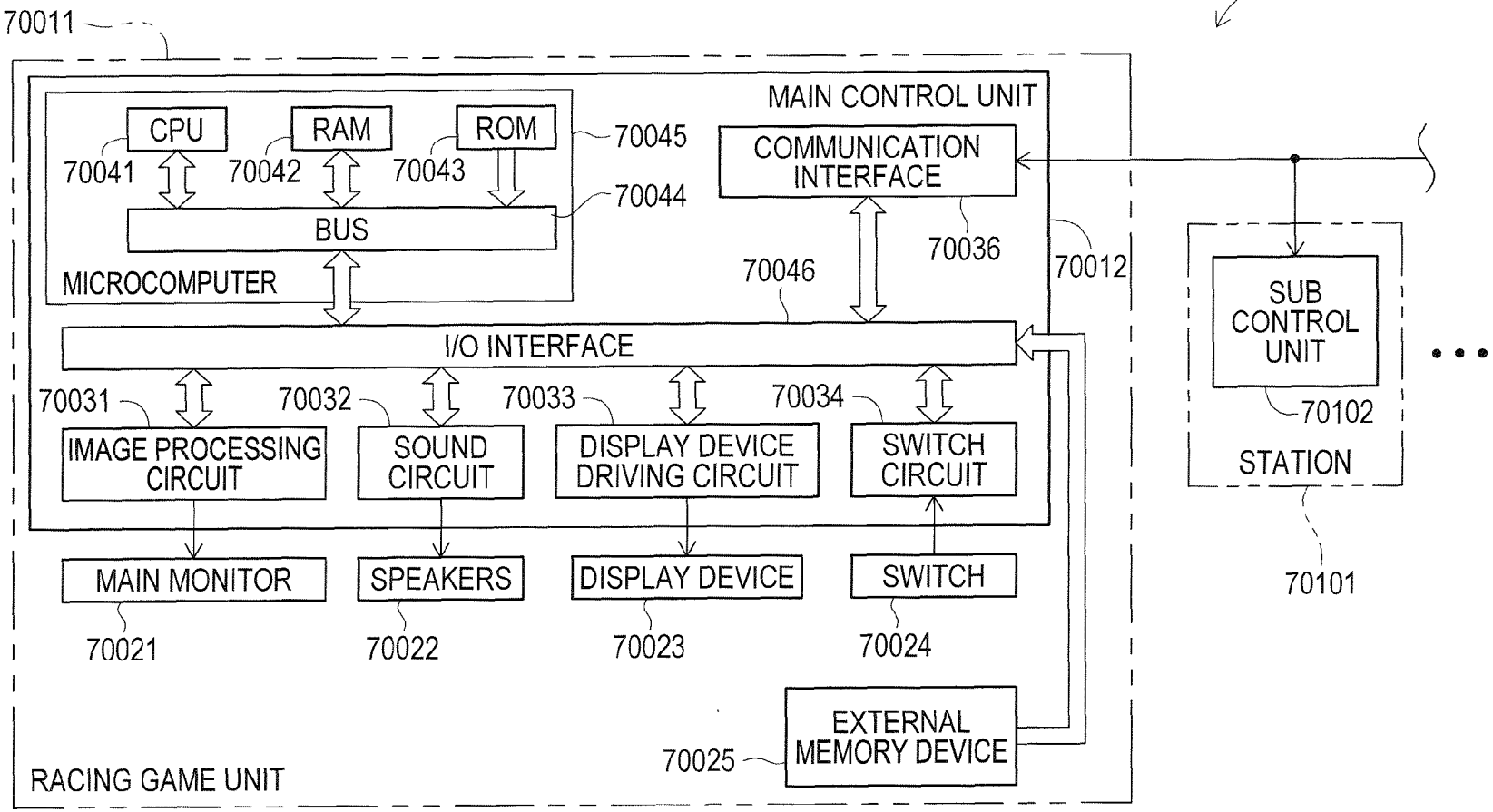
FIG. 32 is a block diagram of a racing game unit.

A racing game unit is an opposite concept of each station 70101 and constitutes a core of the horse race gaming machine 70001 of this embodiment. FIG. 32 is a block diagram of a racing game unit 70011. As shown in FIG. 32, the racing game unit 70011 is composed of a main control unit 70012, the main monitor 70021, the speakers 70022, the display device 70023, a switch 70024, an external memory device 70025, etc. The main control unit 70012 and external memory device 70025 are provided separately from the main monitor 70021, the speakers 70022, or the display device 70023. Although the switch 70024 is annexed to the main control unit 70021, it may be provided individually.

The main control unit 70012 is generally composed of a microcomputer 70045 as the kernel comprising a CPU 70041, a RAM 70042, a ROM 70043 and a bus 70044 for transferring data mutually between these elements. The RAM 70042 and the ROM 70043 are connected to the CPU 70041 via the bus 70044. The RAM 70042 is a memory for temporarily storing a variety of data which have been operated in the CPU 70041. The ROM 70043 stores various types of programs, data tables or the like for executing necessary processes to control the horse race gaming machine 70001.

An image processing circuit 70031 is connected to the microcomputer 70045 via an I/O interface 70046. The image processing circuit 70031 is connected to the main monitor 70021 and controls driving of the main monitor 70021.

The image processing circuit 70031 is composed of a program ROM, an image ROM, an image control CPU, a work RAM, a VDP (video display processor), and a video RAM, etc. And in the program ROM, an image control program related to display on the main monitor 70021, and various selection tables are stored. And, in the image ROM, dot data to form images and the like, for example dot data to form images displayed on the main monitor 70021, are stored. And, based on parameters set by the microcomputer 70045, the image control CPU determines the images displayed on the main monitor 70021 among the dot data stored beforehand in the image ROM, according to the image control program stored beforehand in the program ROM. And, the work RAM works as a temporary memory when the image control program is executed in the image control CPU. And the VDP forms image data corresponding to display contents determined by the image control CPU. And the VDP outputs the image data formed thereby to the main monitor 70021. And the video RAM works as a temporary memory when the images are formed by the VDP.

A sound circuit 70032 is connected to the microcomputer 70045 via the I/O interface 70046. The speakers 70022 are connected to the sound circuit 70032 and are arranged on both lateral sides of the main monitor 70021. The speakers 70022 output various types of effect sound, BGM, etc. when various types of effect are performed, by being subjected to output control by the sound circuit 70032 based on a drive signal from the CPU 70041.

A display device driving circuit 70033 is connected to the microcomputer 70045 via the I/O interface 70046. The display device 70023 is connected to the display device driving circuit 70033. The display device 70023 is disposed on the upper side of the main monitor 70021 and displays information about games in general, by being subjected to display control by the display device driving circuit 70033 based on a drive signal from the CPU 70041.

A switch circuit 70034 is connected to the microcomputer 70045 via the I/O interface 70046. The switch 70024 is connected to the switch circuit 70034 and is arranged in the lower part of the main monitor 70021. The switch 70024 inputs an instruction by an operator's setting operation into the CPU 70041 based on a switch signal from the switch circuit 70034.

The external memory device 70025 is connected to the microcomputer 70045 via the I/O interface 70046. The external memory device 70025 is arranged in the periphery of the main monitor 70021 and has capability similar to the image ROM in the image processing circuit 70031, by storing dot data for forming images, such as dot data for forming images on the main monitor 70021. Thus, when determining any image to be displayed on the main monitor 70021, the image control CPU in the image processing circuit 70031 adds the dot data stored in advance in the external memory device 70025 to a target of the determination.

A communication interface 70036 is connected to the microcomputer 70045 via the I/O interface 70046. A sub control unit 70102 of each station 70101 is connected to the communication interface 70036. This enables bidirectional communication between the CPU 70041 and each station 70101. The CPU 70041 can receive and transmit a command, request and data from/to each station 70101 via the communication interface 70036. Therefore, in the horse race gaming machine 70001, the main control unit 70012 controls progress of the horse racing game in cooperation with each station 70101.

2-4. Example of Configuration of a Station (the Second Embodiment)

Figure 33:
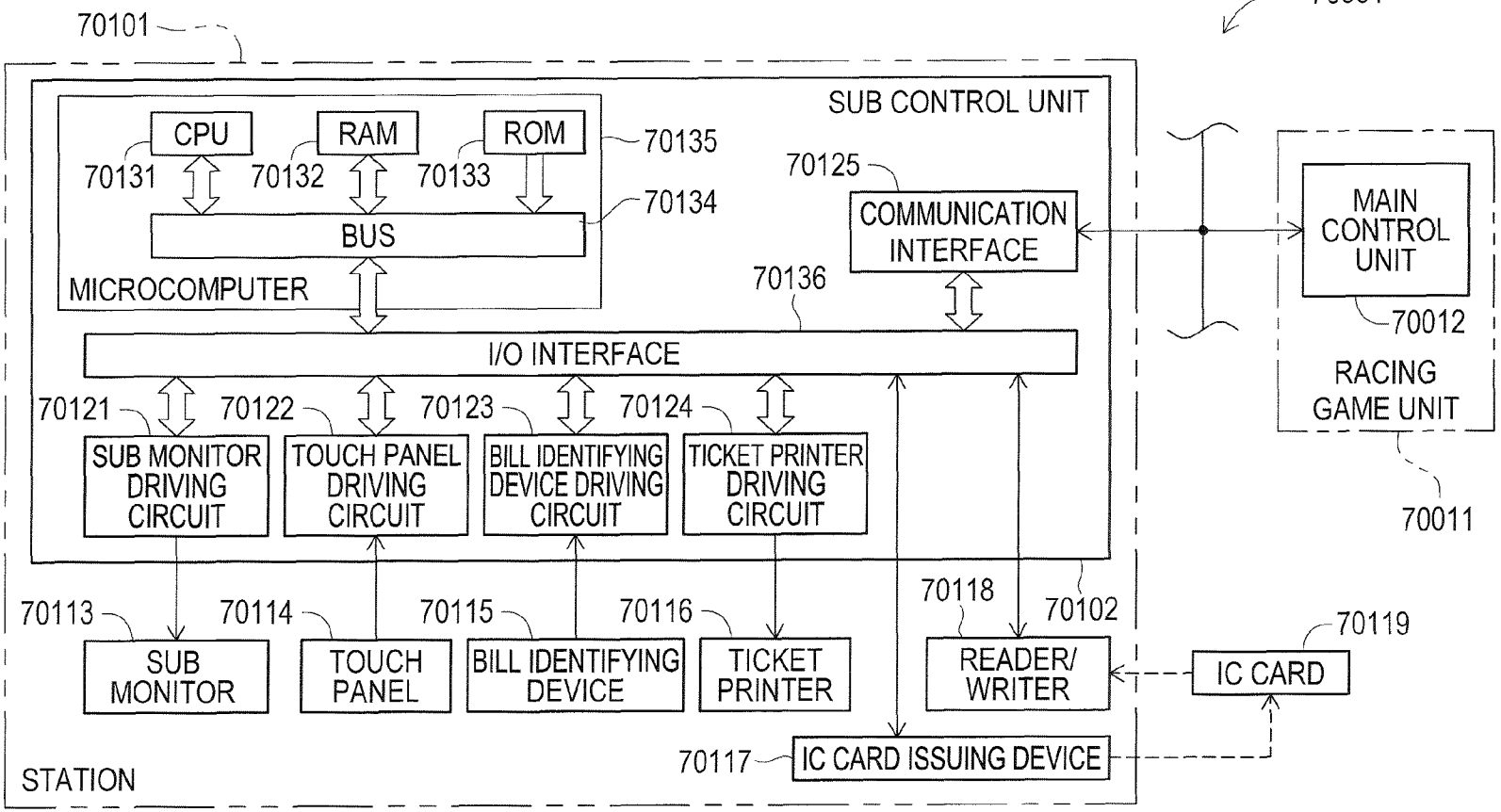
FIG. 33 is a block diagram of the station.

FIG. 33 is a block diagram of a station 70101. As shown in FIG. 33, the station 70101 is composed of the sub control unit 70102, the sub monitor 70113, the touch panel 70114, the bill identifying device 70115, the ticket printer 70116, the IC card issuing device 70117, the reader/writer 70118, etc.

The sub control unit 70102 is generally composed of a microcomputer 70135 as the kernel comprising a CPU 70131, a RAM 70132, a RAM 70132 and a bus 70134 for transferring data mutually between these elements. The RAM 70132 and the RAM 70132 are connected to the CPU 70131 via the bus 70134. The RAM 70132 is a memory for temporarily storing a variety of data which have been operated in the CPU 70131. The RAM 70132 stores various types of programs, data tables or the like for executing necessary processes to control the horse race gaming machine 70001.

A sub monitor driving circuit 70121 is connected to the microcomputer 70135 via an I/O interface 70136. The sub monitor 70113 is connected to the sub monitor driving circuit 70121. The sub monitor driving circuit 70121 controls driving of the sub monitor 70113 based on a drive signal from the aforementioned racing game unit 70011. The sub monitor driving circuit 70121 has also similar configuration and capabilities to the image processing circuit 70031 as shown in FIG. 32 above, and controls driving of the sub monitor 70113 so that the regular BET image, the high BET image, the owner image or the entry-possible race image described later are displayed.

A touch panel driving circuit 70122 is connected to the microcomputer 70135 via the I/O interface 70136. The touch panel 70114 is connected to the touch panel driving circuit 70122 and is arranged on the screen of the sub monitor 70113. The touch panel 70114 inputs an instruction into the CPU 70131 through touch operation of a player (touch position), based on a coordinate signal from the touch panel driving circuit 70122.

A bill identifying driving circuit 70123 is connected to the microcomputer 70135 via the I/O interface 70136. The bill identifying device 70115 is connected to the bill identifying driving circuit 70123. The bill identifying device 70115 identifies whether or not a bill or a bar coded ticket is appropriate. When receiving a legitimate bill, the bill identifying device 70115 inputs a value of the bill into the CPU 70131 based on an identification signal from the bill identifying driving circuit 70123. In addition, when receiving a legitimate bar coded ticket, the bill identifying device 70115 inputs a credit amount, etc. recorded on the bar coded ticket into the CPU 70131 based on an identification signal from the bill identifying driving circuit 70123.

A ticket printer driving circuit 70124 is connected to the microcomputer 70135 via the I/O interface 70136. The ticket printer 70116 is connected to the ticket printer driving circuit 70124. The ticket printer 70116 prints on a ticket a bar code representative of coded data such as owned credit amount, etc., stored in the RAM 70132, and outputs it as a bar coded ticket, by being subjected to output control by the ticket printer driving circuit 70124 based on a drive signal to be outputted from the CPU 70131.

The IC card issuing device 70117 is connected to the microcomputer 70135 via the I/O interface 70136. With an output controlled based on a drive signal to be outputted from a CPU 70131, the IC card issuing device 70117 issues an IC card 70119 that stores data such as horse owner information 70501 (refer to FIG. 43 below), etc.

The reader/writer 70118 is connected to the microcomputer 70135 via the I/O interface 70136. With a drive controlled based on a drive signal to be outputted from the CPU 70131, the reader/writer 70118 inputs information read from an IC card 70119 into CPU 70131 or stores various types of information such as horse owner information 70501 (refer to FIG. 43 below) into an IC card 70119.

A communication interface 70125 is connected to the microcomputer 70135 via the I/O interface 70136. The main control unit 70012 of the racing game unit 70011 is connected to the communication interface 70125. This enables bidirectional communication between the CPU 70131 and the racing game unit 70011. The CPU 70131 can receive and transmit a command, request and data from/to the racing game unit 70011 via the communication interface 70125. Therefore, in the horse race gaming machine 70001, the sub control unit 70102 controls progress of the horse racing game in cooperation with the racing game unit 70011.

2-5. Example of Game Operations of a Horse Race Gaming Machine (the Second Embodiment)

Figure 45:
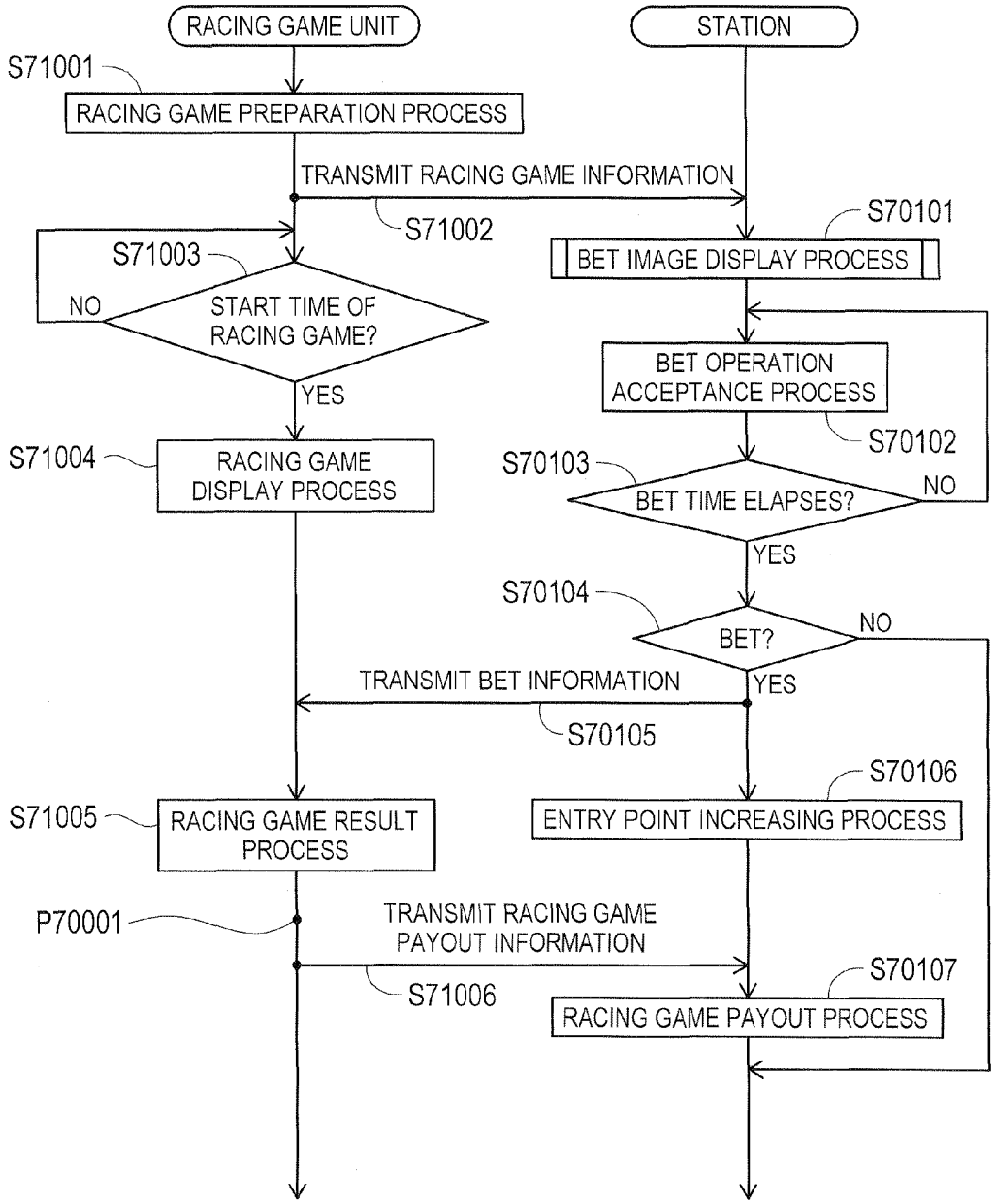
FIG. 45 is a flow chart diagram showing one example of game operations in the horse race gaming machine.

In the following, a description is made on an example of game operations of the horse race gaming machine 70001 of this embodiment. FIG. 45 is a flow chart diagram showing one example of game operations in the horse race gaming machine 70001 of this embodiment. It is to be noted that respective stations 70101 perform similar game operations respectively in cooperation with the racing game unit 70011. In order to avoid any complication, however, only one station 70101 is shown in FIG. 45.

The racing game unit 70011 performs respective operations from S71001 to S71006.

First, in S71001, the main control unit 70012 executes a racing game preparation process. In this process, for this racing game which constitutes a horse racing game, the CPU 70041 determines a track, starter horse, start time, etc, and reads data on them from the ROM 70043.

In S71002, the main control unit 70012 transmits racing game information. In this transmission, the CPU 70041 transmits respective data on the track, starter horse, start time, etc. of this racing game to each station 70101, as racing game information.

In S71003, the main control unit 70012 determines whether or not the present time is race start time of the racing game. In this determination, the CPU 70041 checks time until the time to start this racing game is reached (S71003: NO).

The CPU 70041 may also determine whether or not the present time is the time to start this racing game, by timing an interval from the last racing game.

When the time to start this racing game is reached (S71003: YES), the process proceeds to S71004 and the main control unit 70012 executes a racing game display process. In this process, based on the determination in S71001 above, the CPU 70041 not only displays race images of this racing game on the main monitor 70021 but also outputs sound of this racing game from the speakers 70022.

In S71005, the main control unit 70012 executes a racing game result process. In this process, the CPU 70041 calculates a payout amount of the respective stations 70101, based on the racing game result in S71004 above and BET information transmitted by the respective stations 70101 in S70105 below, etc.

In S71006, the main control unit 70012 transmits racing game payout information. In this transmission, the CPU 70041 transmits to the respective corresponding stations 70101 respective payout amounts, etc. in S71005 above, as racing game payout information.

Thereafter, similar processes are also repeated in the next racing game.

Meanwhile, in the respective stations 70101, respective operations of S70101 to S70107 are performed.

First, in S70101, the sub control unit 70102 executes a BET image display process. The respective stations 70101 execute the BET image display process based on the flow chart of FIG. 48.

Figure 34:
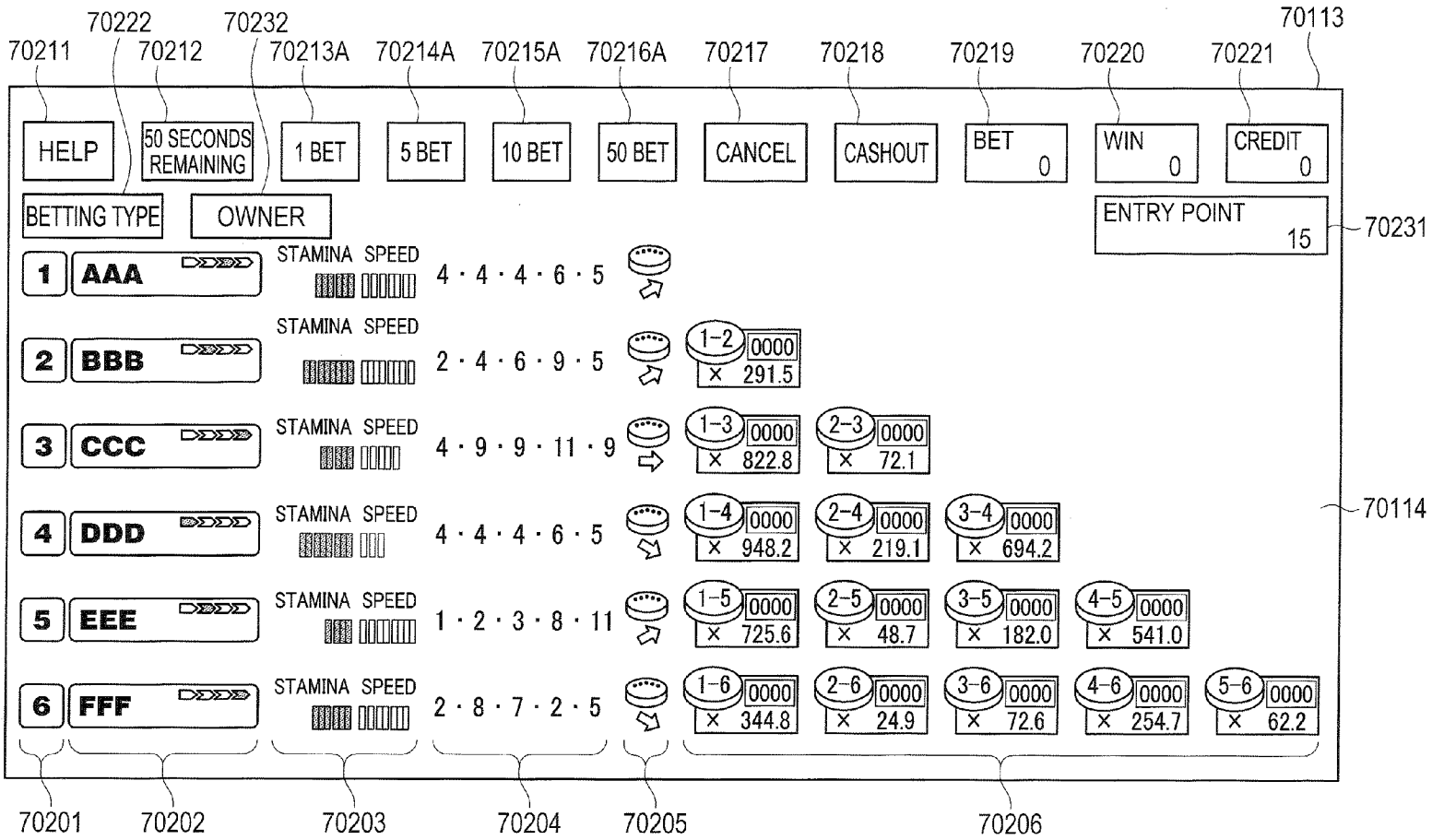
FIG. 34 is a front view showing one example of a regular BET image displayed on a sub monitor.

First, in S70201, the sub control unit 70102 executes a regular denomination process. In this process, the CPU 70131 displays a regular BET image of this racing game on the sub monitor 70113, based on the data related to the racing game information transmitted by the racing game unit 70011 in S71002 above. FIG. 34 shows one example of the regular BET image displayed on the sub monitor 70113.

As shown in FIG. 34, in a regular BET image displayed on the screen of the sub monitor 70113 covered by the light transmissive colorless touch panel 70114 are provided a horse number display area 70201, a horse name display area 70202, a basic power display area 70203 that displays speed and stamina by a bar graph, a performance display area 70204 that displays orders of arrival in last five races, a brief comment display area 70205 that displays the condition of this racing game by an arrow, a betting ticket purchase button display area 70206 where a betting ticket purchase button of a quinella-type bet in which a player randomly picks a combination of horse numbers that will finish in the first place and in the second place in order to win, odds or BET amounts are displayed together, etc.

In addition, in the regular BET image are provided a help button 70211, a time display area 70212, a 1 BET button 70213A, a 5 BET button 70214A, a 10 BET button 70215A, a 50 BET button 70216A, a cancel button 70217, a CASH-OUT button 70218, a BET amount display area 70219, a payout amount display area 70220, a credit amount display area 70221, a betting ticket type switch button 70222, an owner button 70232, an entry point display area 70231, etc.

The help button 70211 is a button that a player touches to display a method of BET operation, etc. on the sub monitor 70113. The time display area 70212 displays BET time in terms of the remaining time. The 1 BET button 70213A is a button that a player touches to set so that "1" is added to the present BET amount. The 5 BET button 70214A is a button that a player touches to set so that "5" is added to the present BET amount. The 10 BET button 70215A is a button that a player touches to set so that "10" is added to the present BET amount. The 50 BET button 70216A is a button that a player touches to set so that "50" is added to the present BET amount. Accordingly, the denomination of the regular BET image is "1". In other words, the minimum bet amount that a player can specify in the regular BET image is "1".

The cancel button 70217 is a button that a player touches to cancel the setting of addition to the BET amount. The CASH-OUT button 70218 is a button that a player touches to be paid out the number of coins corresponding to a player's own credit amount in bar coded tickets printed by the ticket printer 70116. The BET amount display area 70219 displays the total BET amount that a player sets for this racing game. The payout amount display area 70220 displays a payout amount of this racing game. The credit amount display area 70221 displays a player's own credit amount.

Touching any of the betting ticket purchase buttons within the betting ticket purchase button display area 70206 after touching any of the respective BET buttons 70213A, 70214A, 70215A, and 70216A, a player can perform the BET operation of the quinella-type bet. For example, if a player touches the betting ticket purchase button for "1-2" in the betting ticket purchase button display area 70206 after touching the 10 BET button 70215A, the player can set addition of "10" to the present BET amount for a combination of No. 1 and No. 2, as a combination of horse numbers that the player forecasts will finish in the first or second places in no particular order. The present BET amount for respective combinations of horse numbers are displayed next to the betting ticket purchase buttons corresponding to the respective combinations.

Although the regular BET image shown in FIG. 34 is for the quinella-type bet, such respective types of betting as win, place, bracket quinella, quinella place, exacta, trio, trifecta, etc. are also available, and every time a player touches the betting ticket type switch button 70222, the regular BET image changes to a regular BET image of a different type.

Various data in the regular BET image such as horse names and odds, etc. is included in data on the racing game information transmitted by the racing game unit 70011 in S71002 above.

The owner button 70232 is a button that a player touches when he/she wants to purchase a racehorse. The entry point display area 70231 displays entry points owned by a player.

Returning to FIG. 48, in S70202, the sub control unit 70102 determines whether or not a race entry has been made. In this determination, the CPU 70131 makes a determination based on the data related to race entry information stored in the RAM 70132, etc. described later. Then, if the race entry has been made (S70202: YES), the process proceeds to S70205 below. In this case (S70202: YES), the player is an owner of any racehorse. The player has also made the race entry of his/her own racehorse in any racing game. In contrast, if the race entry has not been made (S70202: NO), the process proceeds to S70203.

In S70203, the sub control unit 70102 determines whether or not an IC card 70119 is inserted into the reader/writer 70118. In this determination, the CPU 70131 makes a determination based on the data on whether or not there is an IC card 70119 transmitted by the reader/writer 70118, etc. Now if an IC card 70119 is not inserted into the reader/writer 70118 (S70203: NO), the process proceeds to S70210 below. In contrast, if an IC card 70119 is inserted into the reader/writer 70118 (S70203: YES), the process proceeds to S70204.

In S70204, the sub control unit 70102 determines whether or not a player is an owner of any racehorse. In this determination, the CPU 70131 makes a determination based on the data on horse owner information 70501 (refer to FIG. 43 below) stored in the RAM 70132 or an IC card 70119, etc. The horse owner information 70501 (refer to FIG. 43 below) stored in an IC card 70119 is read out by the reader/writer 70118 and inputted into the CPU 70131. Now, if a player is not an owner of any racehorse (S70204: NO), the process proceeds to S70210 below. In contrast, if the player is an owner of any racehorse (S70204: YES), the process proceeds to S70205.

Figure 35:
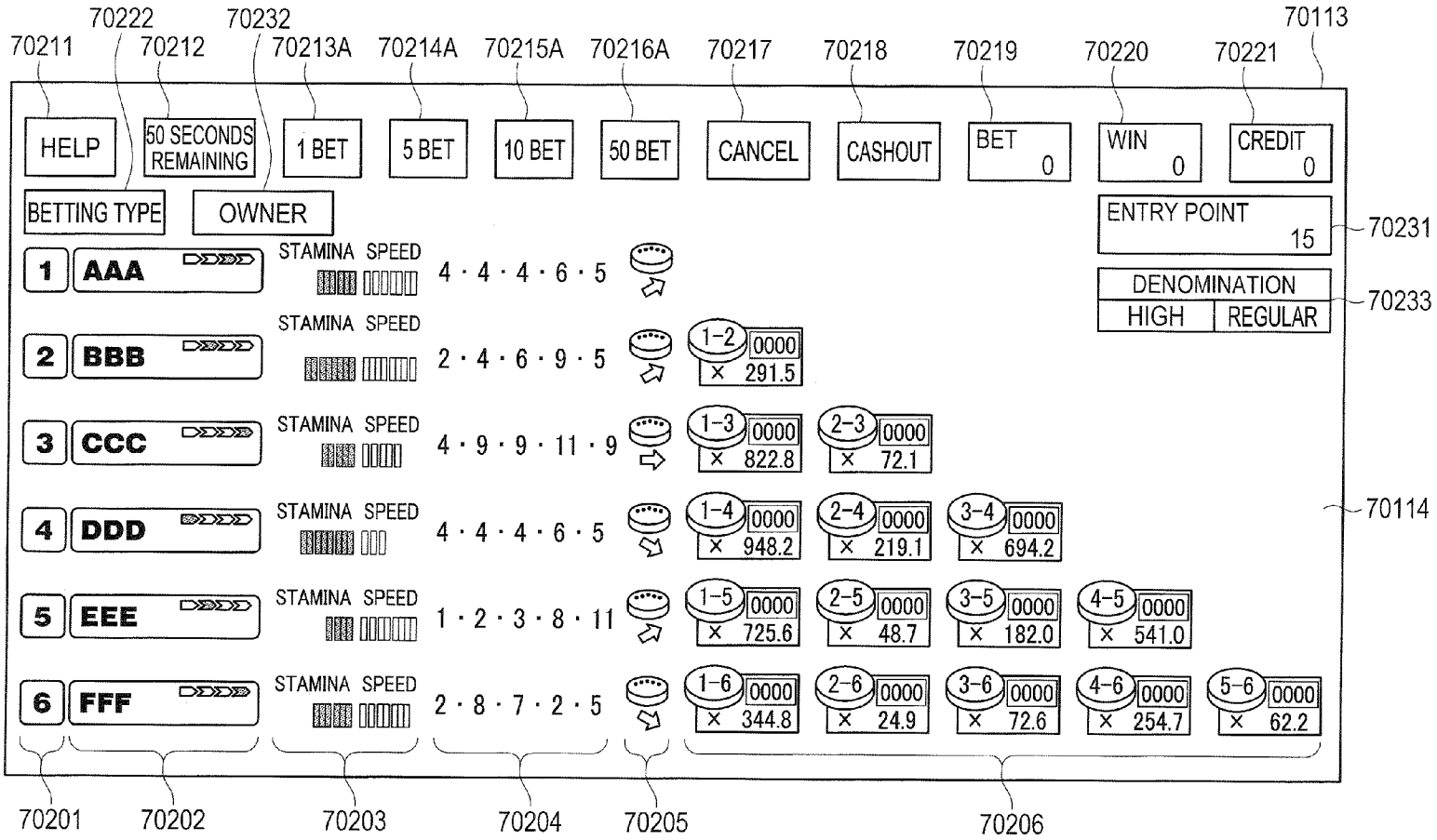
FIG. 35 is a front view showing one example of the regular BET image displayed on the sub monitor.

In S70205, the sub control unit 70102 executes a sub monitor display process. In this process, the CPU 70131 changes the regular BET image being displayed on the sub monitor 70113 to a regular BET image as shown in FIG. 35. In other words, a denomination button 70233 is synthesized and displayed on the regular BET image as shown in FIG. 34. The denomination button 70233 includes a regular button and a high button.

In S70206, the sub control unit 70102 determines whether or not a player has touched the regular button. In this determination, based on a coordinate signal from the touch panel driving circuit 70122, the CPU 70131 determines whether or not the player has touched the regular button included in the denomination button 70233. Now, if the player has touched the regular button (S70206: YES), the process proceeds to S70210 below. In contrast, if the player has not touched the regular button (S70206: NO), the process proceeds to S70207.

In S70207, the sub control unit 70102 determines whether or not the player has touched the high button. In this determination, based on a coordinate signal from the touch panel driving circuit 70122, the CPU 70131 determines whether or not the player has touched the high button included in the denomination button 70233. Now, if the player has not touched the high button (S70207: NO), the process returns to S70206 above. In contrast, if the player has touched the high button (S70207: YES), the process proceeds to S70208.

In other words, the respective determination processes of S70206 and S70207 above are repeated until the player touches either the regular button or the high button included in the denomination button 70233. However, similar to the determination process in S70103 below, the sub control unit 70102 determines whether or not the BET time has elapsed even while the respective determination processes of S70206 and S70207 above are being repeated. If the sub control unit 70102 determines that the BET time has elapsed before the player touches either the regular button or the high button included in the denomination button 70233, the process is forced to proceed to S70210 below.

Figure 36:
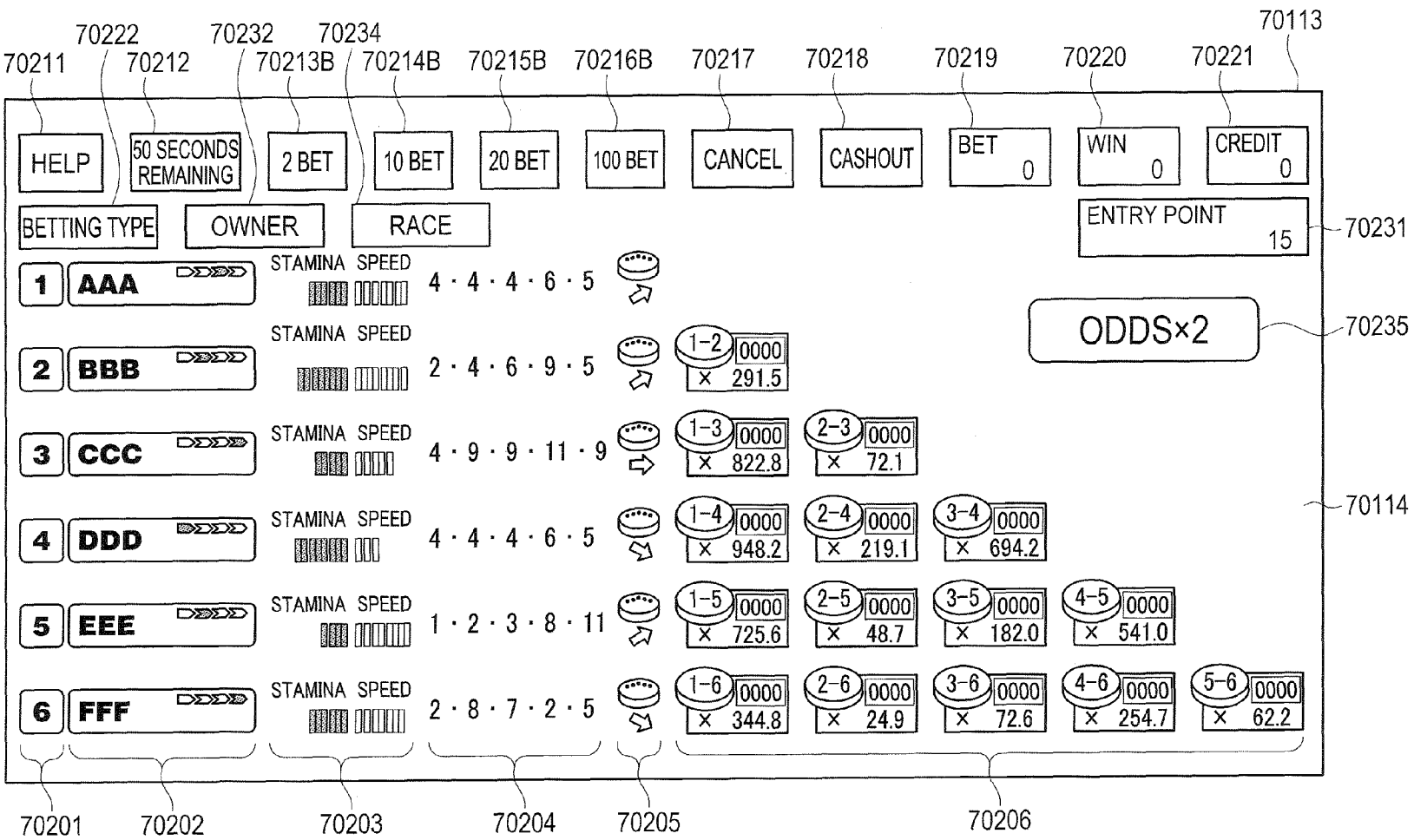
FIG. 36 is a front view showing one example of a high BET image displayed on the sub monitor.

In S70208, the sub control unit 70102 executes a high denomination process. In this process, the CPU 70131 displays a high BET image of this racing game on the sub monitor 70113. FIG. 36 shows one example of the high BET image displayed on the sub monitor 70113.

In the high BET image are provided a 2 BET button 70213B, a 10 BET button 70214B, a 20 BET button 70215B, and a 100 BET button 70216B. Thus, in the high BET image, the bet amounts of the respective BET buttons are twice as large as those in the regular BET image (refer to FIG. 34 and FIG. 35 above). Accordingly, the denomination of the high BET image is "2". In other words, the minimum bet amount that a player can specify in the high BET image is "2". In contrast, the minimum bet amount that a player can specify in the regular BET image (refer to FIG. 34 and FIG. 35 above) is "1". Accordingly, the denomination of the high BET image is twice the denomination of the regular BET image (refer to FIG. 34 and FIG. 35 above).

In addition, in the high BET image are provided a race button 70234 or a message display area 70235. The race button 70234 is a button that a player touches when he/she wishes to make a race entry of his/her own racehorse in a racing game. The message display area 70235 displays a message ("ODDS×2") indicating that odds will be twice as large as those in the regular BET image (refer to FIG. 34 and FIG. 35 above).

Except for these points, the high BET image is same as the regular BET image (refer to FIG. 34 above), and thus details thereof are omitted.

In S70209, the sub control unit 70102 executes a high odds process. In this process, the CPU 70131 stores in the RAM 70132 the data showing that the odds are doubled, in order to have it included in BET information to be transmitted to the racing game unit 70011 in S70105 below.

In S70210, the sub control unit 70102 executes an image control process. In this process, the CPU 70131 performs necessary other display controls over the regular BET image or the high BET image displayed on the sub monitor 70113. Thereafter, the process proceeds to S70102 of FIG. 34.

Returning to FIG. 45, in S70102, the sub control unit 70102 executes a BET operation acceptance process. In this process, based on a coordinate signal from the touch panel driving circuit 70122, the CPU 70131 identifies the content of the player's BET operation for this racing game and stores it in the RAM 70132. The CPU 70131 also checks time when each BET operation is performed and stores it in the RAM 70132. The CPU 70131 reflects the content of the player's BET operation in the display of the BET images of the sub monitor 70113.

In S70103, the sub control unit 70102 determines whether or not the BET time has elapsed. In this determination, the CPU 70131 checks time until the BET time has elapsed. The BET time is computed by the CPU 70131 based on the data on the racing game information transmitted by the racing game unit 70011 in S71002 above, and begins before this racing game starts and ends at predetermined timing while this racing game is in progress.

In addition, the sub control unit 70102 may determine that the BET time has elapsed, when the remaining time displayed in the time display area 70212 on the regular BET image or the high BET image of the sub monitor 70113 runs out.

Till the BET time elapses (S70103: NO), the sub control unit 70102 returns to S70102 above, and continues with the BET operation acceptance process. When the BET time has elapsed (S70103: YES), the process proceeds to S70104 and the sub control unit 70102 determines whether or not there is a BET. In this determination, the CPU 70131 determines whether or not there is a BET setting for this racing game based on what is stored in S70102 above.

Only when the sub control unit 70102 determines that there is a BET (S70104: YES), the process proceeds to S70105 and the sub control unit 70102 transmits BET information. In this transmission, the CPU 70131 transmits to the racing game unit 70011 the data on the memory content in S70209 or S70102 above, as BET information. Then, when transmitting the BET information to the racing game unit 70011, the CPU 70131 combines a player ID identified through S70202, S70203, S70204, etc. of FIG. 48 above with a No. of the station 70101 and includes them in the BET information thereof. In this respect, if the player uses more than one IC card 70119, the number of player IDs included in the BET information may also be more than one.

In S70106, the sub control unit 70102 executes an entry point increasing process. In this process, the CPU 70131 updates the player's own entry points stored in the RAM 70132, by adding points corresponding to the content of the player's BET operation on this racing game to the player's own entry points. The added entry points are equal to a certain proportion of the total BET amount the player sets for this racing game. The CPU 70131 displays the entry points after the addition in the entry point display area 70231 on the regular BET image or the high BET image of the sub monitor 70113.

In S70107, the sub control unit 70102 executes a racing game payout process. In this process, based on the data on the racing game payout information transmitted by the racing game unit 70011 in S71006 above, the CPU 70131 updates not only the player's own credit amount stored in the RAM 70132, but also the display in the payout amount display area 70220 or the credit amount display area 70221 on the regular BET image or the high BET image of the sub monitor 70113.

2-6. Example of Operations for Becoming a Racehorse Owner (the Second Embodiment)

Figure 46:
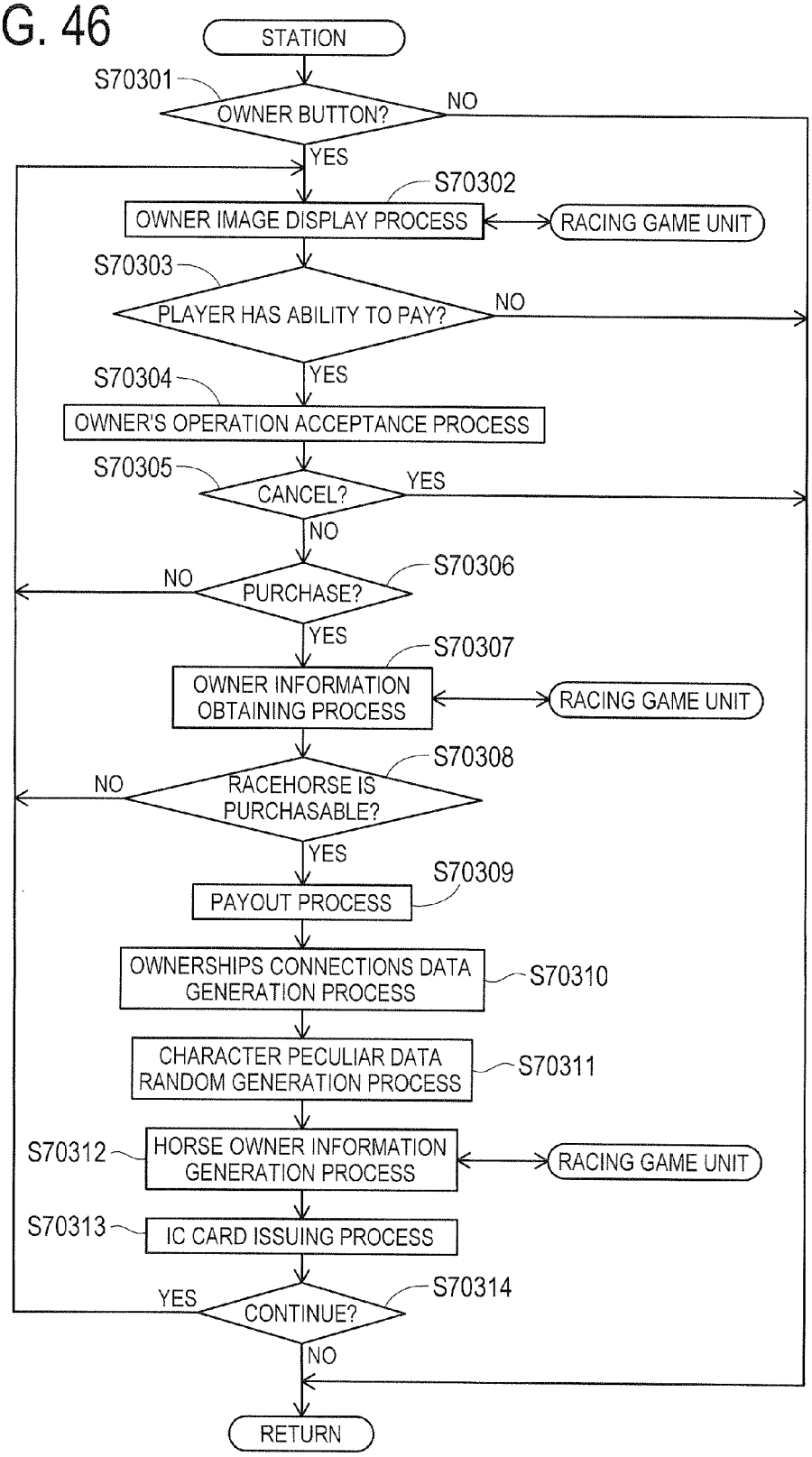
FIG. 46 is a flow chart diagram showing one example of an owner process.

In the following, an example of operations for becoming a racehorse owner in the horse race gaming machine 70001 of this embodiment is described. FIG. 46 is a flow chart diagram showing one example of an owner process.

In the respective stations 70101, triggered by a player's touching the owner button 70232 on the regular BET image or the high BET image of the sub monitor 70113, the owner process is executed based on the flow chart of FIG. 46.

First, in S70301, the sub control unit 70102 determines whether or not the player has touched the owner button 70232. In this determination, the CPU 70131 determines whether or not the player has touched the owner button 70232, based on a coordinate signal from the touch panel driving circuit 70122. Now, if the player has not touched the owner button 70232 (S70301: NO), this owner process terminates. In contrast, if the player has touched the owner button 70232 (S70301: YES), the process proceeds to S70302.

Figure 37:
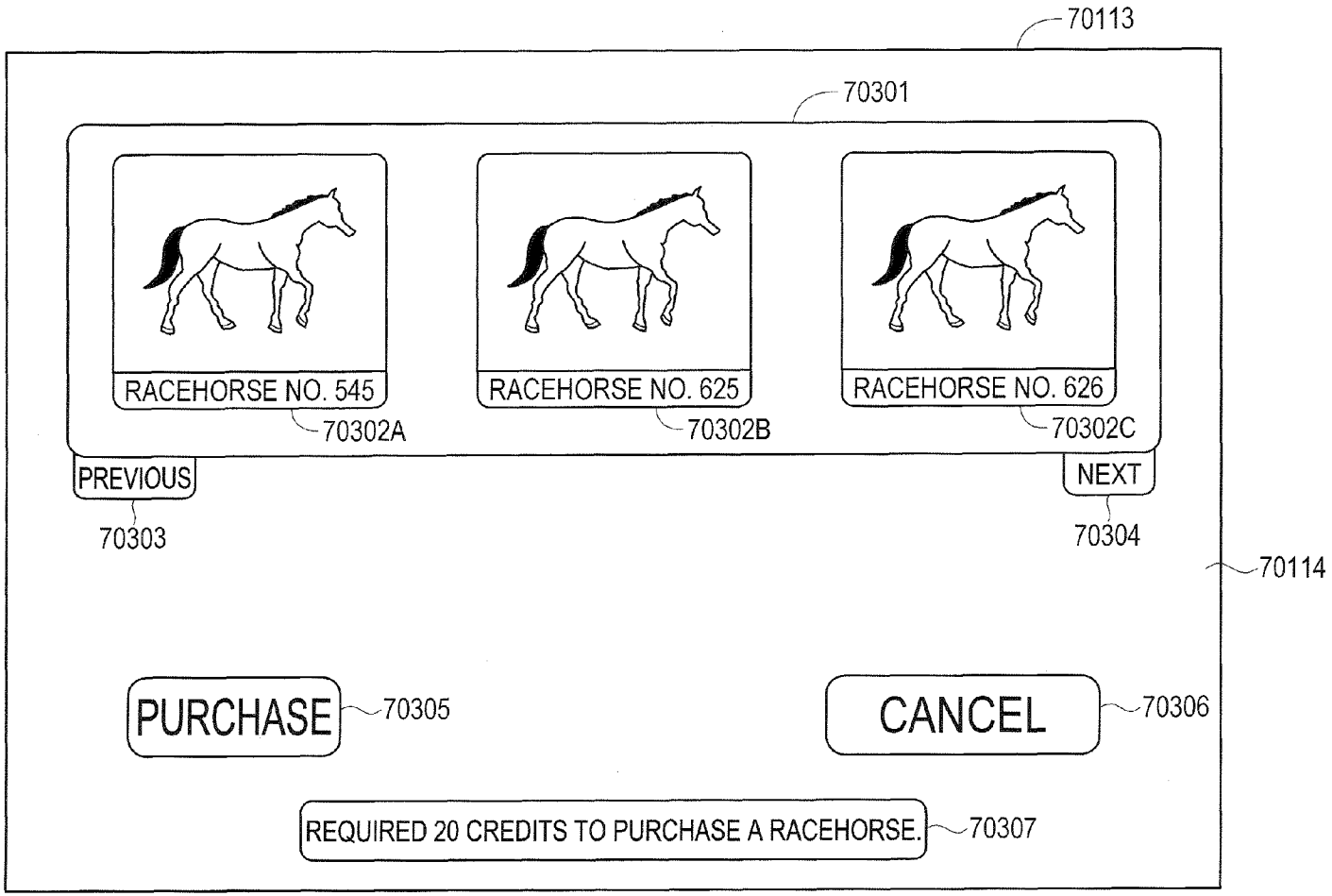
FIG. 37 is a front view showing one example of an owner image displayed on the sub monitor.

In S70302, the sub control unit 70102 executes an owner image display process. In this process, the CPU 70131 displays an owner image on the sub monitor 70113 based on the data on owner image information received through bidirectional communication with the racing game unit 70011. FIG. 37 shows one example of the owner image displayed on the sub monitor 70113.

As shown in FIG. 37, in the owner image displayed on the sub monitor 70113 covered by the light transmissive colorless touch panel 70114 are provided a racehorse page display area 70301, a previous page button 70303, a next page button 70304, a purchase button 70305, a cancel button 70306 and a message display area 70307, etc.

Three racehorse designation buttons 70302A, 70302B, and 70302C are provided in the racehorse page display area 70301. The respective racehorse designation buttons 70302A, 70302B, and 70302C display videos of racehorses that a player can purchase and their respective designation numbers. A player can designate a racehorse that he/she wishes to purchase, by touching each racehorse designation button 70302A, 70302B and 70302C.

In the racehorse page display area 70301, video of the 3 racehorses that a player can purchase is displayed. If the number of racehorses that a player can purchase is more than 3, a plurality of the racehorse page display areas 70301 will be generated. By touching the previous page button 70303 or the next page button 70304, a player can display any of the plurality of racehorse display areas 70301 on the owner image of the sub monitor 70113.

It is to be noted that the data on racehorses that a player can purchase is included in the owner image information received through bidirectional communication with the racing game unit 70011 in S70302 above.

The purchase button 70305 is a button that a player touches when determining a purchase of the designated racehorse. The cancel button 70306 is a button that a player touches when aborting a purchase of a racehorse. The message display area 70307 displays the message "REQUIRED 20 CREDITS TO PURCHASE A RACEHORSE".

In S70303, the sub control unit 70102 determines whether or not the player has the ability to pay. As shown in the message displayed in the message display area 70307, in this embodiment, 20 credits are required to purchase a racehorse. Therefore, in this determination, the CPU 70131 determines that the player has the ability to pay if the player's own credit amount stored in the RAM 70132 is not less than 20 credits. If the player has no ability to pay (S70303: NO), this owner process terminates. In contrast, if the player has the ability to pay (S70303: YES), the process proceeds to S70304.

In S70304, the sub control unit 70102 executes an owner's operation acceptance process. In this process, the CPU 70131 identifies the content of the player's BET operation in the owner image of the sub monitor 70113, based on a coordinate signal from the touch panel driving circuit 70122, and stores it in the RAM 70132. The CPU 70131 reflects the content of the player's BET operation in the display of the owner image of the sub monitor 70113.

In S70305, the sub control unit 70102 determines whether or not the player has touched the cancel button 306. In this determination, the CPU 70131 determines whether or not the player has touched the cancel button 70306 based on a coordinate signal from the touch panel driving circuit 70122. Now, if the player has touched the cancel button 70306 (S70305: YES), this owner process terminates. In contrast, if the player has not touched the cancel button 70306 (S70305: NO), the process proceeds to S70306.

In S70306, the sub control unit 70102 determines whether or not the player has touched the purchase button 70305. In this determination, the CPU 70131 determines whether or not the player has touched the purchase button 70305 based on a coordinate signal from the touch panel driving circuit 70122. Now, if the player has not touched the purchase button 70305 (S70306: NO), the process returns to S70302 above. In contrast, if the player has touched the purchase button 70305 (S70306: YES), the process proceeds to S70307.

In S70307, the sub control unit 70102 executes an owner information obtaining process. In this process, the CPU 70131 receives owner information through bidirectional communication with the racing game unit 70011. This owner information includes data obtained as a result of causing the racing game unit 70011 to check whether or not the racehorse designated by the player is purchasable. If the racehorse is purchasable, the racing game unit 70011 puts the racehorse into purchase reserved state to prevent other player from purchasing the racehorse.

Figure 41:
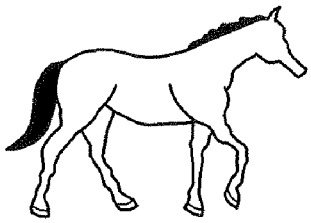
FIG. 41 is a view showing one example of a data table.
Figure 41:
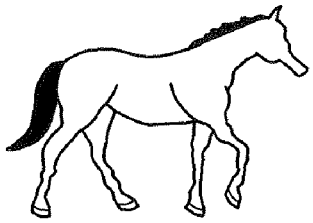
Figure 41:
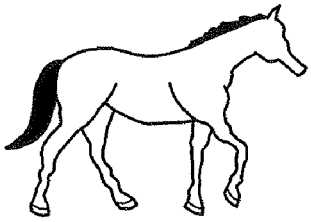

In the racing game unit 70011, the CPU 70041 controls respective racehorses by means of a character ID. For example, as per the data table shown in FIG. 41, the racehorses are associated with the character IDs. Such the table is stored in the RAM 70042 or the external memory device 70025, etc.

In addition, by associating the character IDs with player IDs, the racing game unit 70011 determines whether or not a racehorse is purchasable. For example, as per the data table shown in FIG. 42, the character IDs are associated with the player IDs. Such the table is stored in the RAM 70042 or the external storage device 70025, etc.

By referring to an association between the character IDs and the player IDs, the racing game unit 70011 can also determine whether or not a player identified by the player ID is an owner of any racehorse. In addition, in the purchase reserved state described above, in the data table as shown in FIG. 42, for example, the racing game unit 70011 controls so that the character ID of the racehorse to be reserved can only be associated with the player ID of the player of that particular reservation.

In S70308, the sub control unit 70102 determines whether or not the racehorse designated by the player is purchasable. In this determination, the CPU 70131 makes a determination based on the data on the owner information received in S70307 above. Now, if the racehorse designated by the player is not purchasable (S70308: NO), the process returns to S70302 above. In contrast, if the racehorse designated by the player is purchasable (S70308: YES), the process proceeds to S70309.

In S70309, the sub control unit 70102 executes a payout process. In this process, by deducting credit amounts necessary for purchasing a racehorse from the player's own credit amount, the CPU 70131 updates not only the player's own credit amount stored in the RAM 70132 but also the display in the credit amount display area 70221 on the regular BET image or high BET image of the sub monitor 70113.

In S70310, the sub control unit 70102 executes an ownerships connections data generation process. In this process, the CPU 70131 generates a player ID according to predetermined rules. However, if an IC card 70119 is inserted into the reader/writer 70118, the CPU 70131 uses the player ID included in horse owner information 70501 (refer to FIG. 43 below) of the IC card 70119. In addition, the CPU 70131 links a character ID of a racehorse of the purchase object with its player ID.

In S70311, the sub control unit 70102 executes a character peculiar data random generation process. In this process, using random numbers, the CPU 70131 generates character peculiar data on characters of a racehorse of the purchase object.

Figures 42, 43:
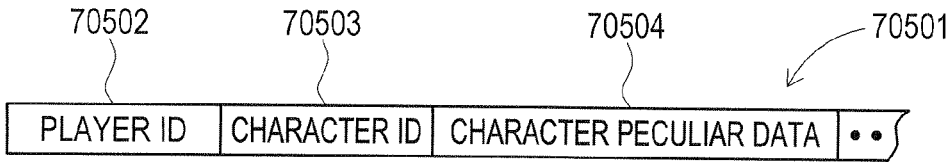
FIG. 42 is a view showing one example of a data table.
FIG. 43 is a view showing one example of horse owner information.

In S70312, the sub control unit 70102 executes a horse owner information generation process. In this process, the CPU 70131 generates horse owner information 70501 as shown in FIG. 43. In the horse owner information 70501, the character peculiar data generated in S70311 above is linked with the character ID and the player ID thereof that were linked to each other in S70310 above. In other words, the horse owner information 70501 includes the data 70502 on player ID generated in S70310 above, the data 70503 on the character ID of the racehorse of the purchase object, and the character peculiar data 70504 generated in S70311 above.

When the horse owner information 70501 is stored in the RAM 70132 by the CPU 70131, it is transmitted to the racing game unit 70011 at the same time. In the racing game unit 70011, the CPU 70041 stores the horse owner information 70501 in the RAM 70042 or the external memory device 70025, etc. In addition, in the racing game unit 70011, the CPU 70041 associates character IDs with player IDs based on the horse owner information 70501.

In S70313, the sub control unit 70102 executes an IC card issuing process. In this process, the CPU 70131 causes the IC card issuing device 70117 to issue an IC card 70119 storing the horse owner information 70501.

In S70314, the sub control unit 70102 determines whether or not to continue operation in the owner image of the sub monitor 70113. Now, if a player touches any part of the owner image within a predetermined period of time from when the IC card issuing device 70117 is caused to issue an IC card 70119, the CPU 70131 determines that the operation continues in the owner image of the sub monitor 70113. Therefore, in this determination, the CPU 70131 determines whether or not the player has touched any part of the owner image of the sub monitor 70113, based on a coordinate signal from the touch panel driving circuit 70122. Now, if the operation continues in the owner image of the sub monitor 70113 (S70314: YES), the process returns to S70302 above. In contrast, if the operation does not continue in the owner image of the sub monitor 70113 (S70314: NO), this owner process terminates.

Figure 38:
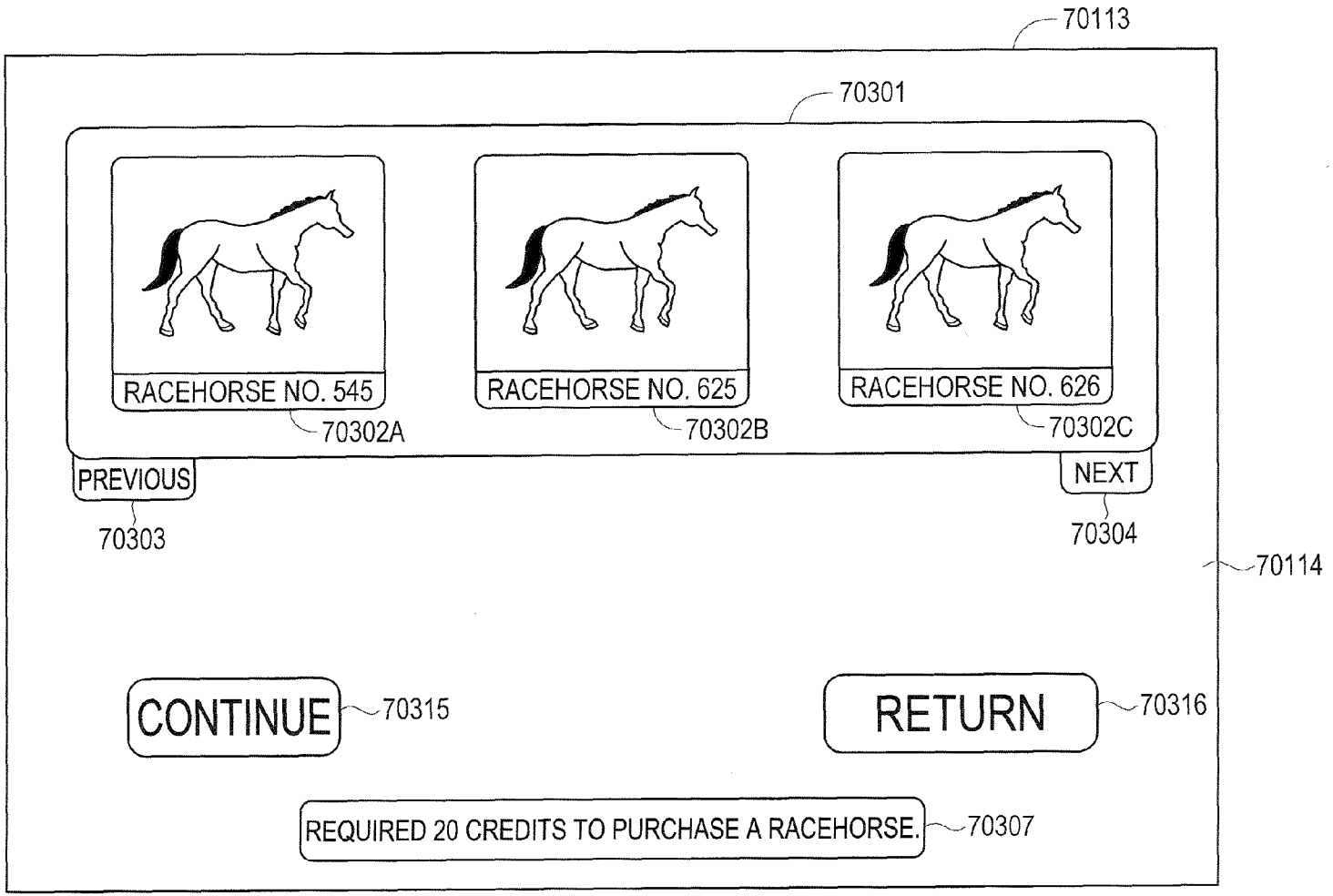
FIG. 38 is a front view showing one example of the owner image displayed on the sub monitor.

In this respect, the CPU 70131 may be such configured that the process of this S70314 is implemented, by providing a continue button 70315 or a return button 70316 in the owner image of the sub monitor 70113, as shown in FIG. 38.

When this owner process terminates, the sub monitor 70113 returns to the condition before this owner process starts. Therefore, the sub monitor 70113 displays the regular BET image above or the high BET image above.

2-7. Example of Operations for Making a Race Entry of a Player's Racehorse in a Racing Game (the Second Embodiment)

Figure 47:
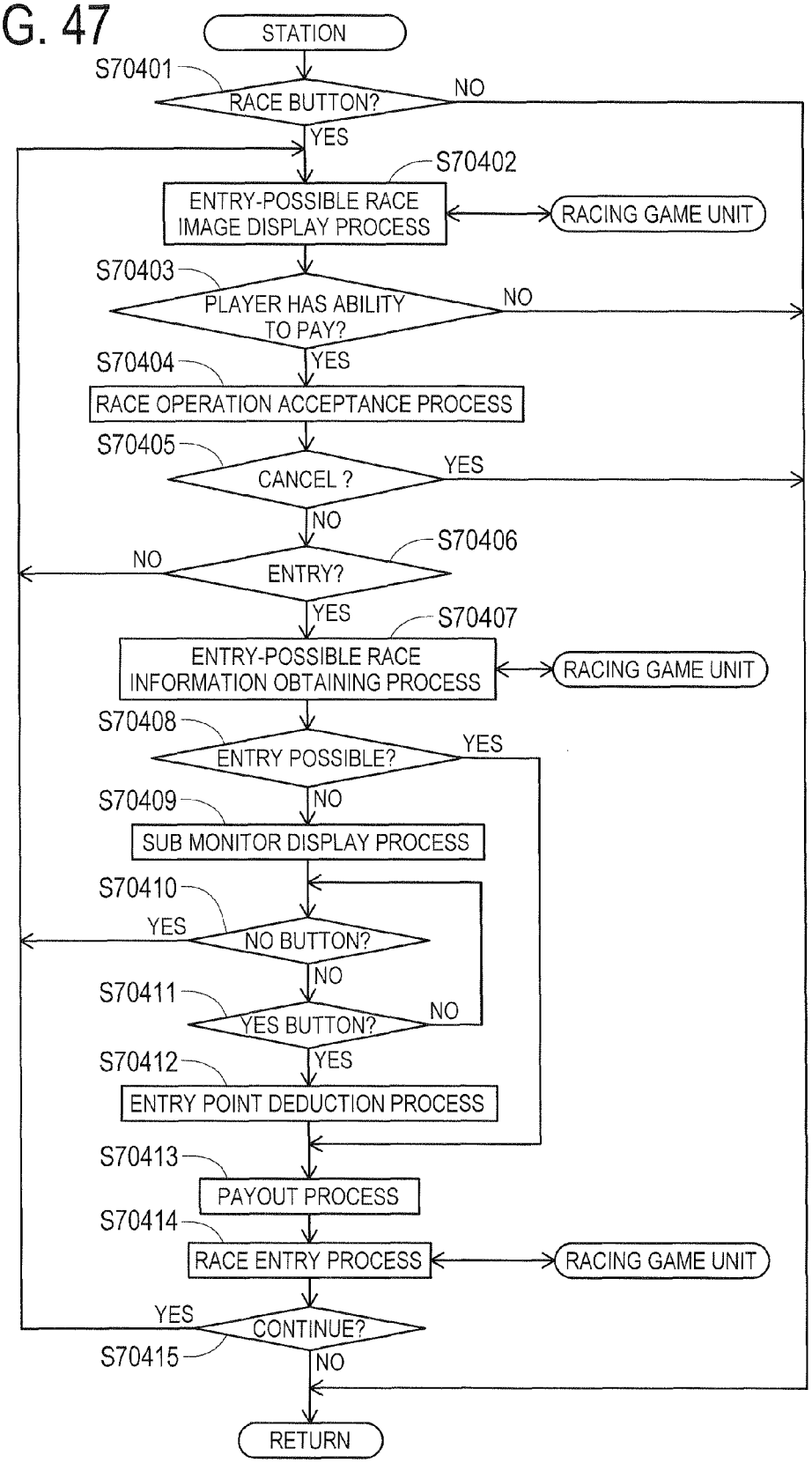
FIG. 47 is a flow chart diagram showing one example of an entry process.

In the following, the example of operations for making a race entry of a player's racehorse in a racing game in the horse race gaming machine 70001 according to this embodiment is described. FIG. 47 is a flow chart diagram showing one example of an entry process.

In the respective stations 70101, triggered by a player's touching the race button 70234 on the high BET image of the sub monitor 70113, the entry process is executed based on the flow chart of FIG. 47.

First, in S70401, the sub control unit 70102 determines whether or not a player has touched the race button 70234. In this determination, the CPU 70131 determines whether or not the player has touched the race button 70234 based on a coordinate signal from the touch panel driving circuit 70122. Now, if the player has not touched the race button 70234 (S70401: NO), this entry process terminates. In contrast, if the player has touched the race button 70234 (S70401: YES), the process proceeds to S70402.

Figure 39:
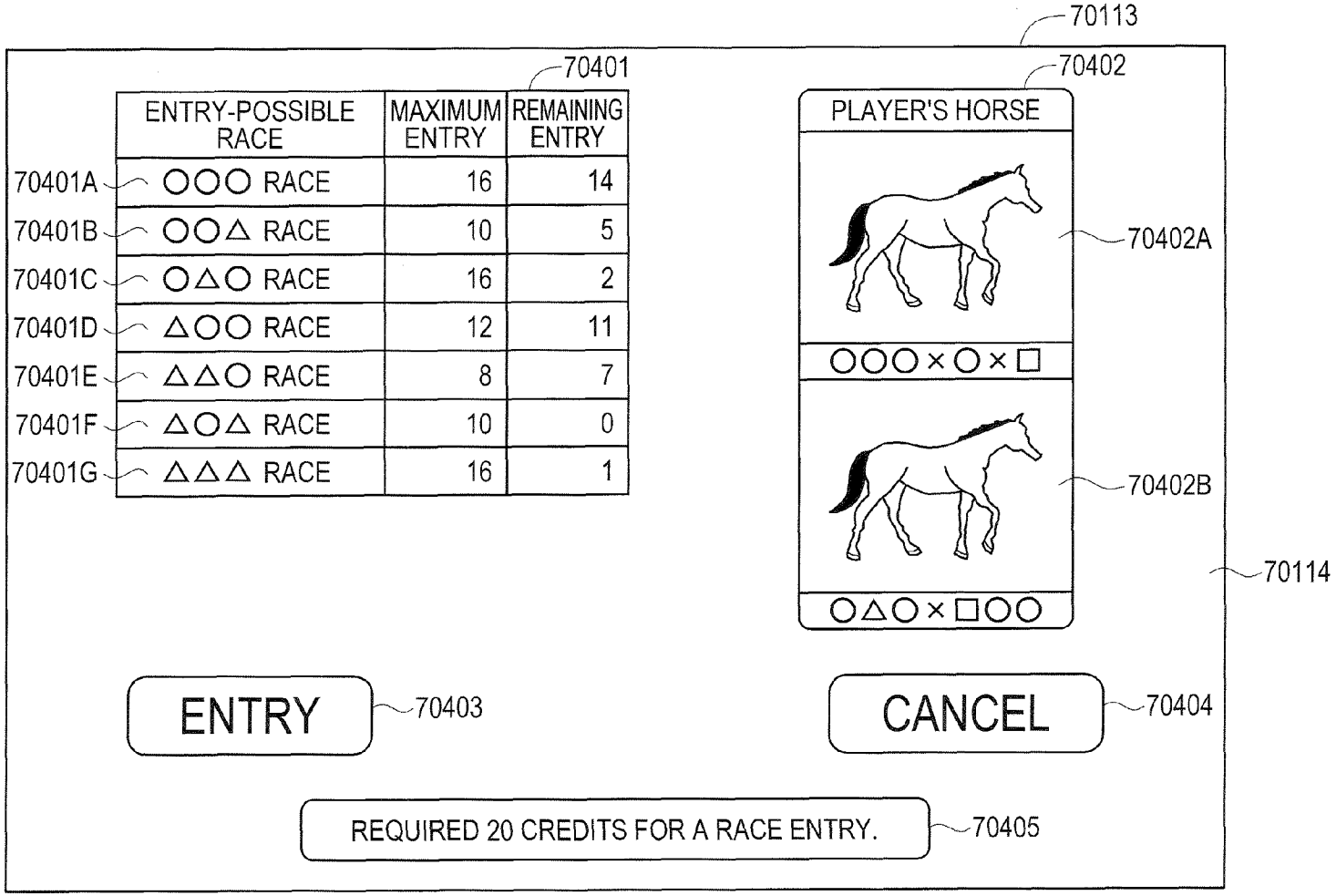
FIG. 39 is a front view showing one example of an entry-possible race image displayed on the sub monitor.
Figure 40:
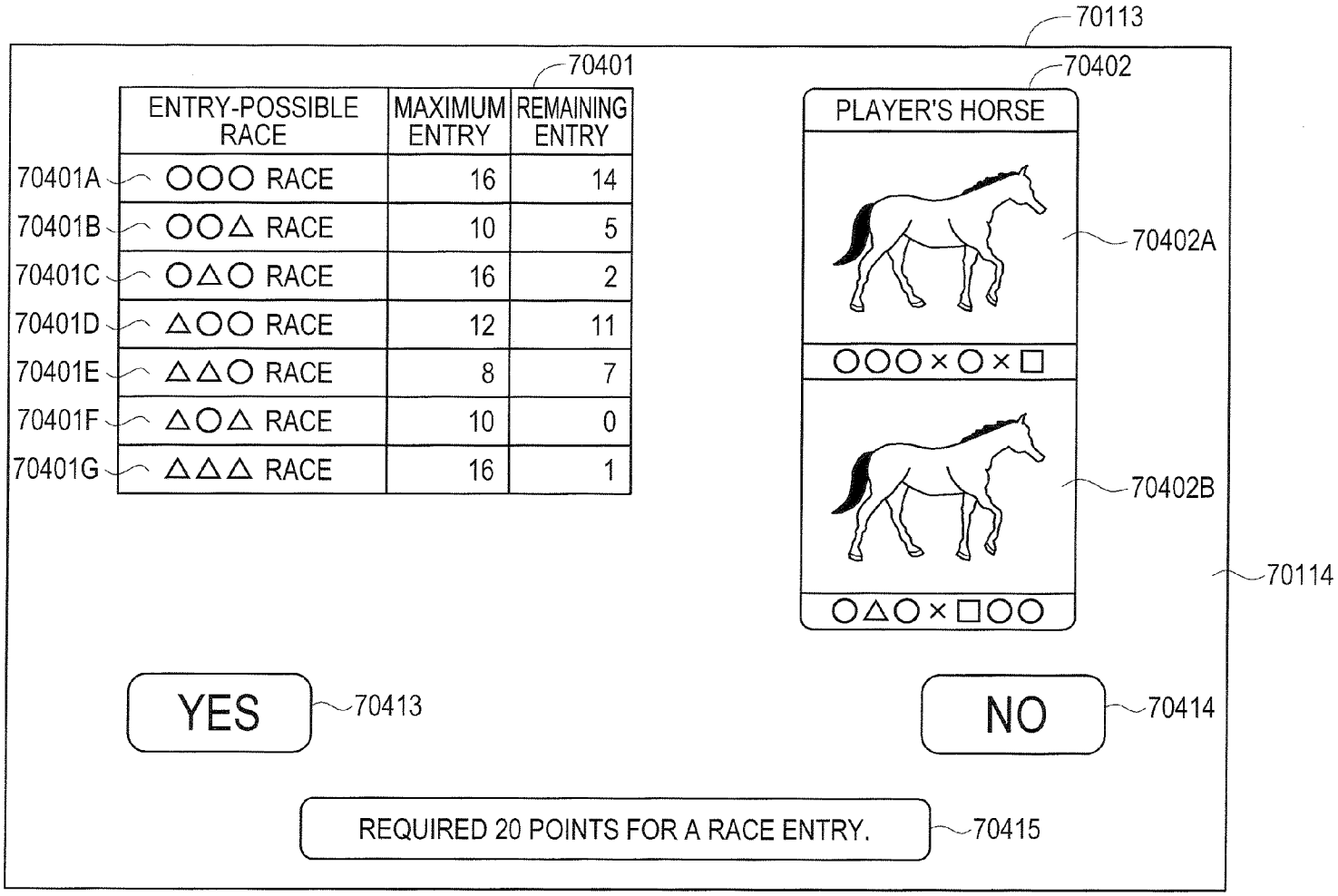
FIG. 40 is a front view showing one example of the entry-possible race image displayed on the sub monitor.

In S70402, the sub control unit 70102 executes an entry-possible race image display process. In this process, the CPU 70131 displays an entry-possible race image on the sub monitor 70113, based on the data on entry-possible race image information received through bidirectional communication with the racing game unit 70011. FIG. 39 and FIG. 40 show one example of the entry-possible race image displayed on the sub monitor 70113.

As shown in FIG. 39, in the entry-possible race image displayed on the sub monitor 70113 covered by the light transmissive colorless touch panel 70114 is provided an entry-possible race display area 70401, a player's horse display area 70402, an entry button 70403, a cancel button 70404 and a message display area 70405, etc.

In the entry-possible race display area 70401 is provided with respective columns for an entry possible race, a maximum entry, and a remaining entry. The entry possible race column displays a name of a racing game in which a race entry of a racehorse is possible. Parts where those names are displayed are used as designation buttons 70401A, 70401B, 70401C, 70401D, 70401E, 70401F, and 70401G for a player to designate a racing game. The maximum entry column displays the number of racehorses that run in a racing game. The remaining entry column displays the number of racehorses that can make a race entry in a racing game.

The player's horse display area 70402 displays racehorses whose owner is a player. Parts in which those racehorses are displayed are used as designation buttons 70402A, 70402B for a player to designate a racehorse.

The data on the entry-possible race display area 70401 or the player's horse display area 70402 is included in the entry-possible race image information received through bidirectional communication with the racing game unit 70011 in S70402 above.

The entry button 70403 is a button that a player touches when he/she wishes to make a race entry of a designated racehorse in a designated racing game. The cancel button 70404 is a button that the player touches to stop race entry. The message display area 70405 displays a message "REQUIRED 20 CREDITS FOR A RACE ENTRY".

In S70403, the sub control unit 70102 determines whether or not the player has the ability to pay. As per the message displayed in the message display area 70405, in this embodiment, 20 credits are required to make a race entry of one racehorse. Therefore, in this determination, the CPU 70131 determines that the player has the ability to pay when the player's own credit amount stored in the RAM 70132 are not less than 20 credits. If the player has no ability to pay (S70403: NO), this entry process terminates. In contrast, if the player has the ability to pay (S70403: YES), the process proceeds to S70404.

In S70404, the sub control unit 70102 executes a race operation acceptance process. In this process, the CPU 70131 identifies the content of the player's operation in the entry-possible race image of the sub monitor 70113, based on a coordinate signal from the touch panel driving circuit 70122 and stores it in the RAM 70132. The CPU 70131 reflects the content of the player's operation in the display of the entry-possible race image of the sub monitor 70113.

In S70405, the sub control unit 70102 determines whether or not the player has touched the cancel button 70404. In this determination, the CPU 70131 determines whether or not the player has touched the cancel button 70404 based on a coordinate signal from the touch panel driving circuit 70122. Now, if the player has touched the cancel button 404 (S70405: YES), this entry process terminates. In contrast, if the player has not touched the cancel button 70404 (S70405: NO), the process proceeds to S70406.

In S70406, the sub control unit 70102 determines whether or not the player has touched the entry button 70403. In this determination, the CPU 70131 determines whether or not the player has touched the entry button 70403 based on a coordinate signal from the touch panel driving circuit 70122. Now, if the player has not touched the entry button 403 (S70406: NO), the process returns to S70402 above. In contrast, if the player has touched the entry button 70403 (S70406: YES), the process proceeds to S70407.

In S70407, the sub control unit 70102 executes an entry-possible race information obtaining process. In this process, the CPU 70131 receives entry-possible race information through bidirectional communication with the racing game unit 70011. This entry-possible race information includes data as a result of causing the racing game unit 70011 to check whether or not a racehorse designated by the player can make a race entry in a designated racing game. If the race entry is possible, the racing game unit 70011 puts that race entry into a reserved state.

In the racing game unit 70011, the CPU 70041 controls race entries of respective racing games by means of character IDs. For example, as per the data table shown in FIG. 44, a racing game and character IDs are associated. Such the data table is stored in the RAM 70042 or the external memory device 25, etc.

In S70408, the sub control unit 70102 determines whether or not a racehorse designated by the player can make a race entry in a designated racing game. In this determination, the CPU 70131 makes a determination based on the data on the entry-possible race information received in S70407 above. Now, if the racehorse designated by the player can make a race entry in the designated racing game (S70408: YES), the process proceeds to S70413 below. In contrast, if the racehorse designated by the player cannot make a race entry in the designated racing game (S70408: NO), the process proceeds to S70409.

In this embodiment, it is possible to forcibly make a race entry in a racing game designated by a player (refer to S70414 below) on the condition that the player pays 20 points from the player's own entry points (refer to S70412 below), even though there is no longer any racehorse that can make a race entry in the racing game.

In S70409, the sub control unit 70102 executes a sub monitor display process. In this process, the CPU 70131 changes the entry-possible race image being displayed on the sub monitor 70113 to an entry-possible race image as shown in FIG. 40. In other words, instead of the entry button 70403, the cancel button 70404, and the message display area 70405 are provided a YES button 70413, a NO button 70414 and a message display area 70415.

The YES button 70413 is a button that the player touches to ensure race entry of a designated racehorse in a designated racing game. The NO button 70414 is a button that the player touches to stop race entry of a designated racehorse in a designated racing game. The message display area 70415 displays the message "REQUIRED 20 POINTS FOR A RACE ENTRY".

In S70410, the sub control unit 70102 determines whether or not the player has touched the NO button 70414. In this determination, the CPU 70131 determines whether or not the player has touched the NO button 70414 based on a coordinate signal from the touch panel driving circuit 70122. Now, if the player has touched the NO button 70414 (S70410: YES), the process returns to S70402 above. Then, the CPU 70131 causes the racing game unit 70011 to cancel the reservation of the race entry described above, by transmitting a control signal to the racing game unit 70011. In contrast, if the player has not touched the NO button 70414 (S70410: NO), the process proceeds to S70411.

In S70411, the sub control unit 70102 determines whether or not the player has touched the YES button 70413. In this determination, the CPU 70131 determines whether or not the player has touched the YES button 70413, based on a coordinate signal from the touch panel driving circuit 70122. Now, if the player has not touched the YES button 70413 (S70411: NO), the process returns to S70410 above. In contrast, if the player has touched the YES button 70413 (S70411: YES), the process proceeds to S70412.

In S70412, the sub control unit 70102 executes an entry point deduction process. In this process, by deducting from the player's own entry points the points necessary to make a race entry in a racing game, the CPU 70131 updates not only the player's own entry points stored in the RAM 70132 but also the display in the entry point display area 70231 on the high BET image of the sub monitor 70113.

In this respect, all of the player's own entry points may be deducted.

It is to be noted that the sub control unit 70102 skips a payout process of S70413 below, if this entry point deduction process is executed.

In S70413, the sub control unit 70102 executes the payout process. In this process, by deducting credit amounts necessary for making a race entry in a racing game from the player's own credit amount, the CPU 70131 updates not only the player's own credit amount stored in the RAM 70132 but also the display in the credit amount display area 70221 on the high BET image of the sub monitor 70113.

In S70414, the sub control unit 70102 executes a race entry process. In this process, when storing in the RAM 70132 race entry information including data on race entry determination, etc. (data showing player IDs or character IDs, or determinations), the CPU 70131 simultaneously transmits it to the racing game unit 70011. In the racing game unit 70011, the CPU 70041 associates a racing game with a character ID based on data on this information. In particular, if the player has paid 20 points from the player's own entry points, a race entry in the racing game is forcibly done. The racing game unit 70011 may enable this forcible race entry by increasing the number of racehorses to run the racing game, or by replacing any of the racehorses that have already been registered, with it.

In S70415, the sub control unit 70102 determines whether or not operation continues in the entry-possible race image of the sub monitor 70113. Now, if the player touches any part of the entry-possible race image of the sub monitor 70113 within a predetermined period of time from when the player touched the YES button 70413, the CPU 70131 determines that the operation continues in the entry-possible race image of the sub monitor 70113. Now, if the operation continues in the entry-possible race image of the sub monitor 70113 (S70415: YES), the process returns to S70402 above. In contrast, if the operation does not continue in the entry-possible race image of the sub monitor 70113 (S70415: NO), this entry process terminates.

When this entry process terminates, the sub monitor 70113 returns to the condition before the entry process starts. Therefore, the sub monitor 70113 displays the high BET image above.

2-8. A Racing Game in which a Racehorse Owner is Ranked (the Second Embodiment)

In the horse race gaming machine 70001 of this embodiment, if at least the predetermined number of the racehorses whose respective owners are any one of players who are playing at stations 70101 have run in this racing game, this racing game is accompanied with a side game in which respective owners of those racehorses are ranked by the result of this racing game.

Therefore, in the racing game unit 70011, the main control unit 70012 executes each of the processes described in the flow chart of FIG. 29 at the point P70001 between S71005 and S71006 of FIG. 45 above.

First, in S70501, the main control unit 70012 executes a player identification process. In this process, the CPU 70041 identifies a player who is playing each of the stations 70101. This identification is executed based on the BET information transmitted to the racing game unit 70011 by each of the stations 70101 in S70105 of FIG. 45 above. In this time, the CPU 70041 generates a data table as shown in FIG. 49. In the data table shown in FIG. 49, a player ID is stored corresponding to a station number. The player ID is included in the BET information transmitted to the racing game unit 70011 by each of the stations 70101 in S70105 of FIG. 45 above. Accordingly, in this process, the CPU 70041 reflects the corresponding relation between the station number and the player ID included in the BET information of this racing game to the data table of FIG. 49. Such the data table is stored in the RAM 70042 or the external memory device 70025, etc.

In S70502, the main control unit 70012 executes a horse owner identification process. In this process, the CPU 70041 identifies the player IDs of all the players who have become an owner of any of the racehorses, among the players playing at each of the stations 70101. The CPU 70041 executes the identification by comparing the data table of FIG. 42 above and the data table of FIG. 49 above through the player ID identified in S70501 above.

In S70503, the main control unit 70012 executes a racehorse identification process. In this process, the CPU 70041 identifies the character IDs of all the racehorses which have run in this racing game. The CPU 70041 executes this identification based on the data table of above FIG. 44 generated as to this racing game and the like.

After that, the CPU 70041 generates a data table as shown in FIG. 50, using the player ID identified in S70502 above and the character ID identified in S70503 above. Such the data table is stored in the RAM 70042 or the external memory device 70025, etc. The character IDs of the racehorses which have run in this racing game are stored in the data table of FIG. 50 in the order of the horse number. In addition, the player ID of a player who is an owner of a racehorse which has run in this racing game among the players playing at each of the stations 70101 is stored in the data table of FIG. 50 with relating the character ID of the racehorse.

In S70504, the main control unit 70012 determines whether or not this racing game satisfies a predetermined condition. The predetermined condition means the condition that at least the predetermined number (six, for example) of the racehorses whose respective owners are any one of players who are playing at stations have run in this racing game. In this determination, the CPU 70041 determines whether or not this racing game satisfies the predetermined condition based on the data table of FIG. 50 concerning this racing game. Now, if this racing game does not satisfy the predetermined condition (S70504: NO), the game operations described in the flow chart of FIG. 29 is terminated to return to the game operations described in the flow chart of FIG. 45. In contrast, if this racing game satisfies the predetermined condition (S70504: YES), the process proceeds to S70505.

In S70505, the main control unit 70012 executes a horse owner ranking process. In this process, the CPU 70041 generates a data table as shown in FIG. 51 by changing the order of the character IDs and the player IDs stored in the data table of FIG. 50 in accordance with the order of arrival of the racehorses in this racing game. Such the data table is stored in the RAM 70042 or the external memory device 70025, etc.

In S70506, the sub control unit 70012 executes a payout determination process. In this process, the CPU 70041 stores in the data table of FIG. 51 a base payout amount corresponding to the order of arrival of a racehorse in this racing game with relating the player ID of a player who is an owner of the racehorse. Further, each base payout amount, etc is respectively included in each racing game payout information transmitted by the CPU 70041 in S71006 above to each of the stations 70101 at which players each with the related player ID are playing. With this, each base payout amount is paid to an appropriate player. After that, the game operations described in the flow chart of FIG. 29 is terminated to return to the game operations described in the flow chart of FIG. 45.

2-9. The First Operation Example for Making a Race Entry of a Player's Racehorse in a Racing Game in which a Racehorse Owner is Ranked (the Second Embodiment)

Next, here will be described the first operation example for making a race entry of a player's racehorse in a racing game which is planned from the beginning to be accompanied with a side game in which a racehorse owner will be ranked, in the horse race gaming machine 70001 of this embodiment. FIG. 53 is a flow chart diagram showing one example of entry process.

Figure 52:
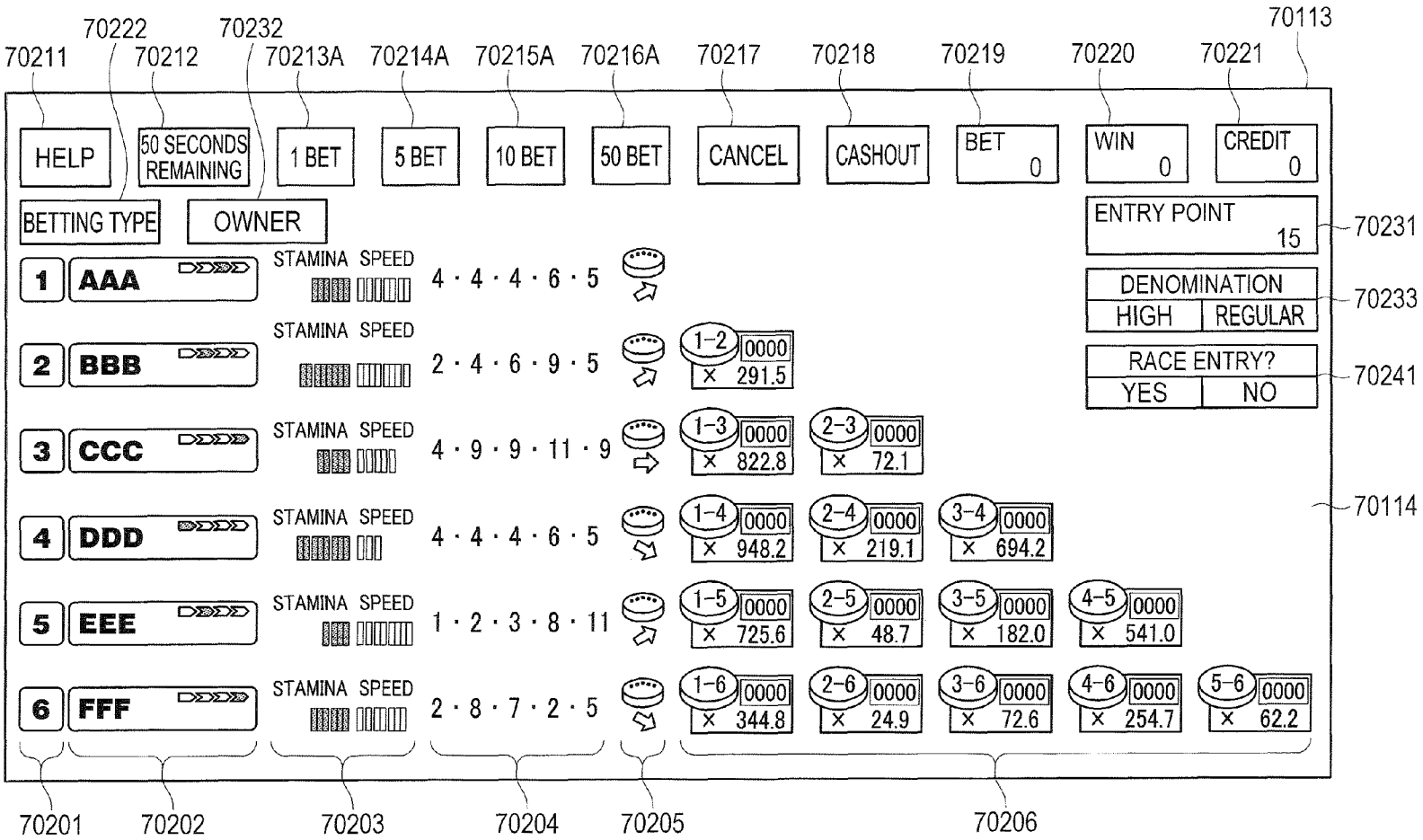
FIG. 52 is a front view showing one example of the regular BET image displayed on the sub monitor.

Incidentally, at each of the stations 70101, as shown in FIG. 52, a race entry button 70241 is additionally displayed on the regular BET image of the sub monitor 70113. The race entry button 70241 includes a YES button and a NO button. This point is the same as on the high BET image of the sub monitor 70113, not shown in figures. This display control is executed in S70201 or S70208 of FIG. 48 above.

Figure 48:
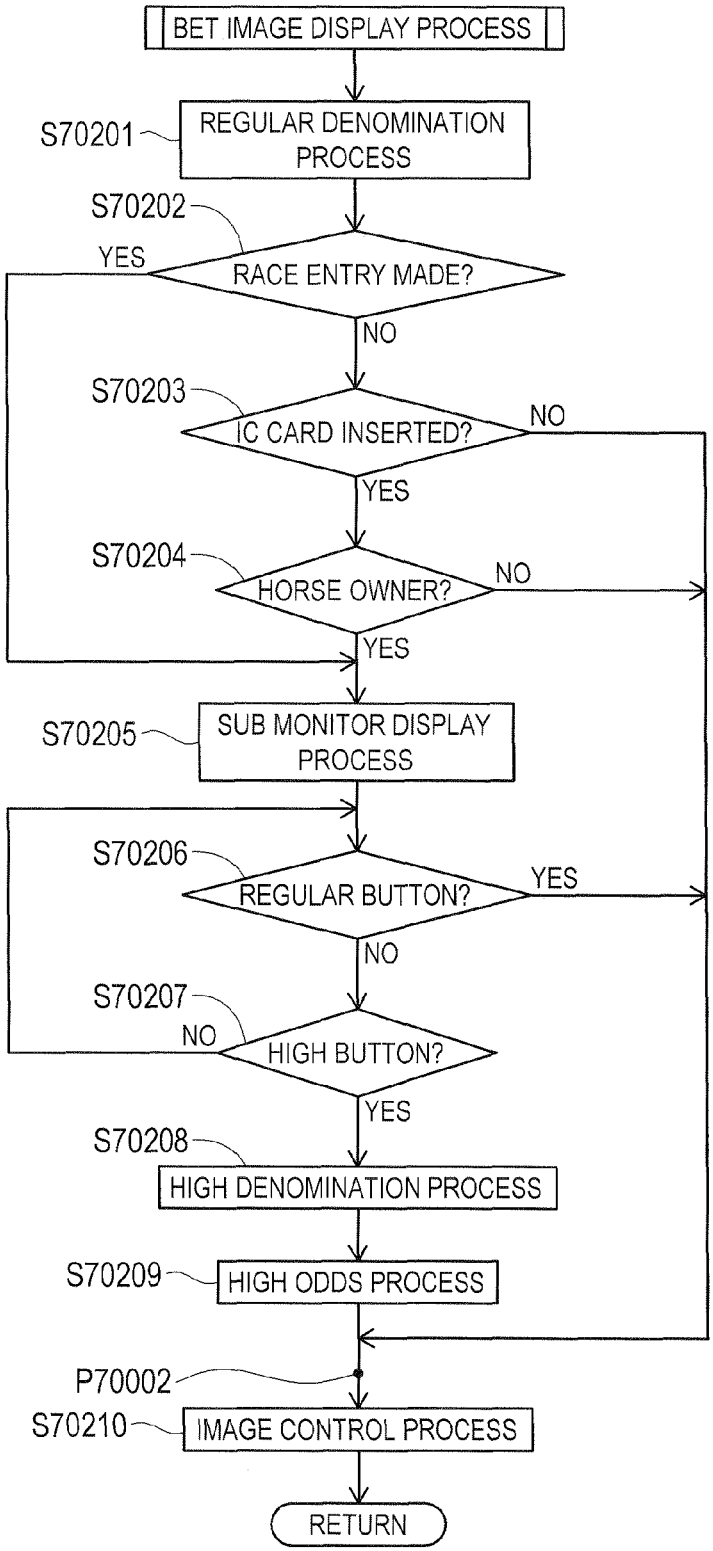
FIG. 48 is a flow chart diagram showing one example of game operations in the horse race gaming machine.
Figure 53:
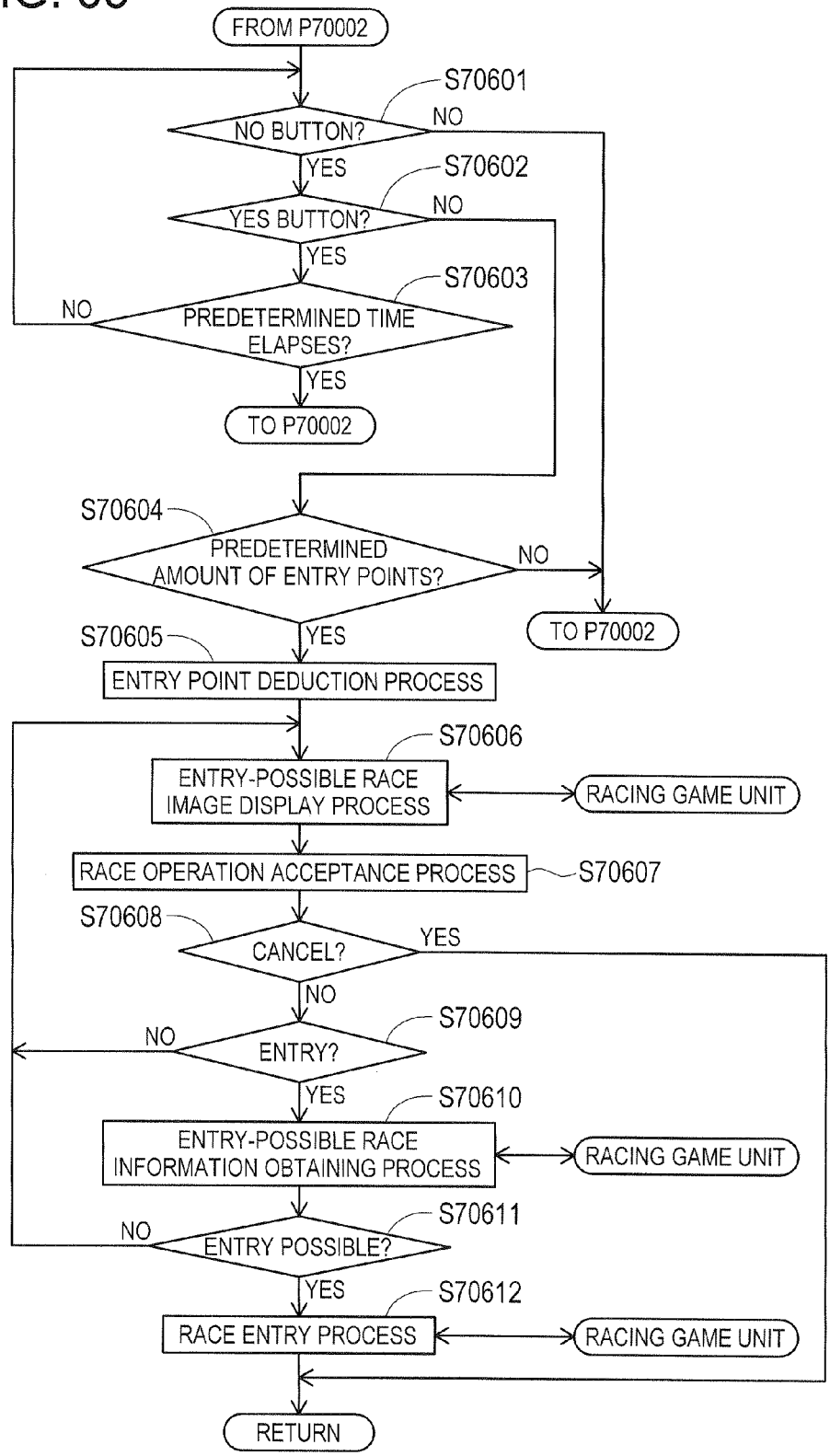
FIG. 53 is a flow chart diagram showing one example of an entry process.

First, at each of the stations 70101, the sub control unit 70102 executes respective processes described in the flow chart of FIG. 53, at the point P70002 just before S70210 of FIG. 48 above.

First, in S70601, the sub control unit 70102 determines whether or not the player has touched the NO button. In this determination, the CPU 70131 determines whether or not the player has touched the NO button included in the race entry button 70241, based on a coordinate signal from the touch panel driving circuit 70122. Now, if the player has touched the NO button (S70601: YES), this entry process is terminated to proceed to S70210 of FIG. 48 above. In contrast, if the player has not touched the NO button (S70601: NO), the process proceeds to S70602.

In S70602, the sub control unit 70102 determines whether or not the player has touched the YES button. In this determination, the CPU 70131 determines whether or not the player has touched the YES button included in the race entry button 70241, based on a coordinate signal from the touch panel driving circuit 70122. Now, if the player has touched the YES button (S70602: YES), the process proceeds to S70604 below. In contrast, if the player has not touched the YES button (S70602: NO), the process proceeds to S70603.

In S70603, the sub control unit 70102 determines whether or not a predetermined time from the point P70002 just before S70210 of FIG. 48 above has elapsed. In this determination, the CPU70131 checks the clock until the predetermined time has elapsed. Now, if the predetermined time has elapsed (S70603: YES), this entry process is terminated to proceed to S70210 of FIG. 48 above. In contrast, if the predetermined time has not elapsed (S70603: NO), the process returns to S70601 above. Namely, until the predetermined time has elapsed (S70603: YES), each determination process of S70601 through S70603 above will be repeated before the player touches any one of the YES button and the NO button included in the race entry button 70241.

In S70604, the sub control unit 70102 determines whether or not the player's own entry points are at least a predetermined amount or not. In this embodiment, as described above, it requires 20 points to make a race entry of one racehorse (refer to FIG. 40 above, etc.). Accordingly, in this determination, the CPU 70131 determines whether or not at least 20 points are stored in the RAM 70132 as the player's own entry points. Now, if the player's own entry points are less than the predetermined amount (S70604: NO), this entry process is terminated to proceed to S70210 of FIG. 48 above. In contrast, if the player's own entry points are the predetermined amount or more (S70604: YES), the process proceeds to S70605.

In S70605, the sub control unit 70102 executes an entry point deduction process. In this process, by deducting from the player's own entry points the points necessary to make a race entry in a racing game, the CPU 70131 updates not only the player's own entry points stored in the RAM 70132 but also the display in the entry point display area 70231 on the high BET image of the sub monitor 70113.

In this respect, all of the player's own entry points may be deducted.

In S70606, the sub control unit 70102 executes an entry-possible race image display process. In this process, the CPU 70131 displays the entry-possible race image on the sub monitor 70113, based on the data on entry-possible race image information received through bidirectional communication with the racing game unit 70011. However, in the racing game unit 70011, the main control unit 70012 includes to the entry-possible race image information only the information of a racing game which is planned from the beginning to be accompanied with a side game in which a racehorse owner will be ranked. FIG. 39 above and FIG. 40 above show one example of the entry-possible race image displayed on the sub monitor 70113.

In S70607, the sub control unit 70102 executes a race operation acceptance process. In this process, the CPU 70131 identifies the content of the player's operation in the entry-possible race image of the sub monitor 70113, based on a coordinate signal from the touch panel driving circuit 70122 and stores it in the RAM 70132. The CPU 70131 reflects the content of the player's operation in the display of the entry-possible race image of the sub monitor 70113.

In S70608, the sub control unit 70102 determines whether or not the player has touched the cancel button 70404. In this determination, the CPU 70131 determines whether or not the player has touched the cancel button 404 based on a coordinate signal from the touch panel driving circuit 70122. Now, if the player has touched the cancel button 70404 (S70608: YES), this entry process is terminated to proceed to S70210 of FIG. 48 above. In contrast, if the player has not touched the cancel button 70404 (S70608: NO), the process proceeds to S70609.

In S70609, the sub control unit 70102 determines whether or not the player has touched the entry button 70403. In this determination, the CPU 70131 determines whether or not the player has touched the entry button 70403 based on a coordinate signal from the touch panel driving circuit 70122. Now, if the player has not touched the entry button 70403 (S70609: NO), the process returns to S70606 above. In contrast, if the player has touched the entry button 70403 (S70609: YES), the process proceeds to S70610.

In S70610, the sub control unit 70102 executes an entry-possible race information obtaining process. In this process, the CPU 70131 receives entry-possible race information through bidirectional communication with the racing game unit 70011. This entry-possible race information includes data as a result of causing the racing game unit 70011 to check whether or not a racehorse designated by the player can make a race entry in a designated racing game. If the race entry is possible, the racing game unit 70011 puts that race entry into a reserved state.

In S70611, the sub control unit 70102 determines whether or not a racehorse designated by the player can make a race entry in a designated racing game. In this determination, the CPU 70131 makes a determination based on the data on the entry-possible race information received in S70610 above. Now, if the racehorse designated by the player cannot make a race entry in the designated racing game (S70611: NO), the process returns to S70606 above. In contrast, if the racehorse designated by the player can make a race entry in the designated racing game (S70611: YES), the process proceeds to S70612.

In S70612, the sub control unit 70102 executes a race entry process. In this process, when storing in the RAM 70132 race entry information including data on race entry determination, etc. (data showing player IDs or character IDs, or determinations), the CPU 70131 simultaneously transmits it to the racing game unit 70011. In the racing game unit 70011, the CPU 70041 associates a racing game with a character ID based on data on this information.

As above mentioned, the player can make a race entry of the player's racehorse in a racing game which is planned from the beginning to be accompanied with a side game in which a racehorse owner will be ranked, under the condition of payment of entry points.

After that, this entry process is terminated to proceed to S70210 of FIG. 48 above.

When this entry process terminates, the sub monitor 70113 returns to the condition before the entry process starts. Therefore, the sub monitor 70113 displays the regular BET image above or the high BET image above.

2-10. The Second Operation Example for Making a Race Entry of a Player's Racehorse in a Racing Game in which a Racehorse Owner is Ranked (the Second Embodiment)

Next, here will be described the second operation example for making a race entry of a player's racehorse in a racing game which is planned from the beginning to be accompanied with a side game in which a racehorse owner will be ranked, in the horse race gaming machine 70001 of this embodiment. FIG. 55 is a flow chart diagram showing one example of entry process.

Figure 54:
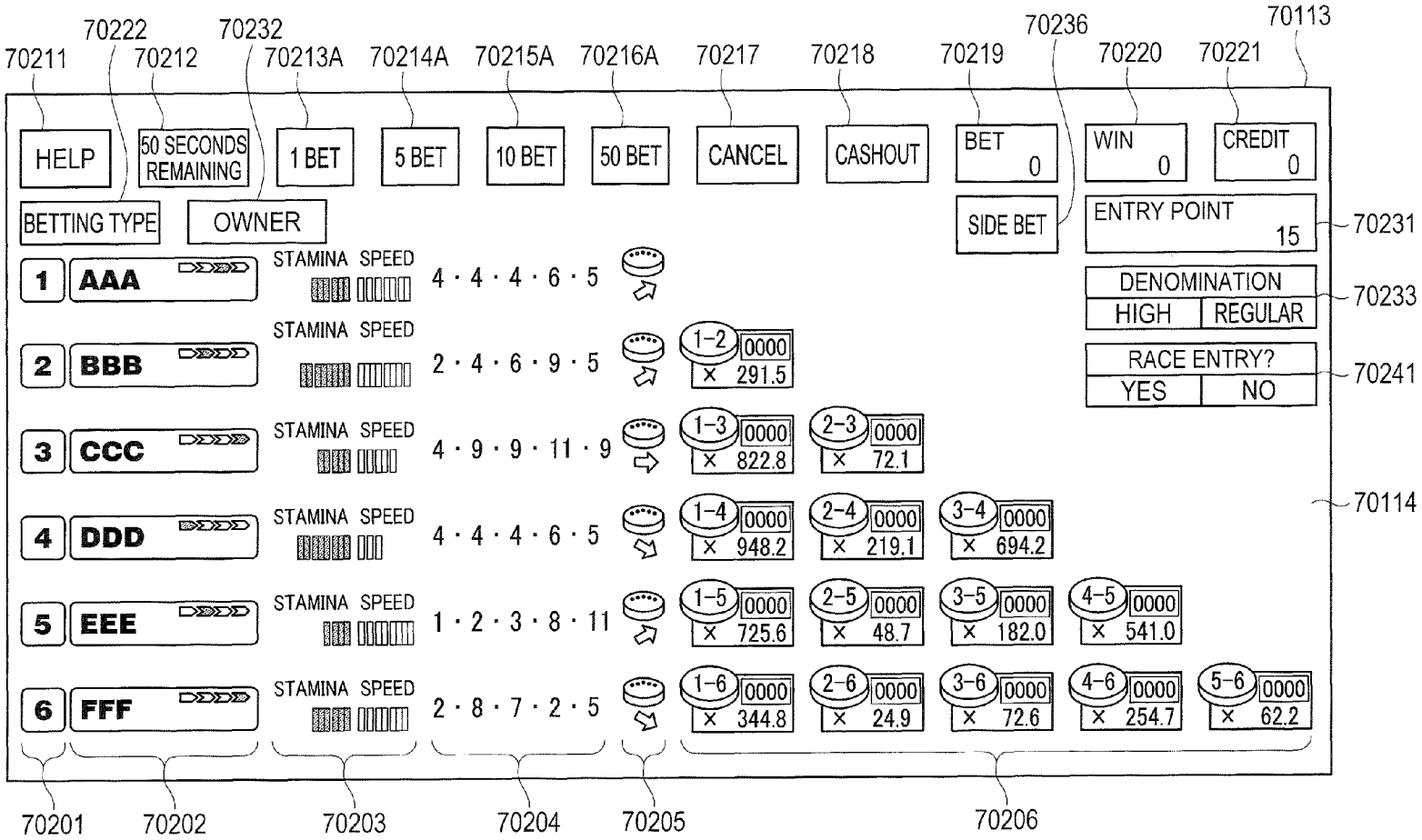
FIG. 54 is a front view showing one example of the regular BET image displayed on the sub monitor.

Incidentally, at each of the stations 70101, as shown in FIG. 54, a side bet button 70236 is additionally displayed on the regular BET image of the sub monitor 70113. This point is the same as on the high BET image of the sub monitor 70113, not shown in figures. This display control is executed in S70201 or S70208 of FIG. 48 above.

Figure 55:
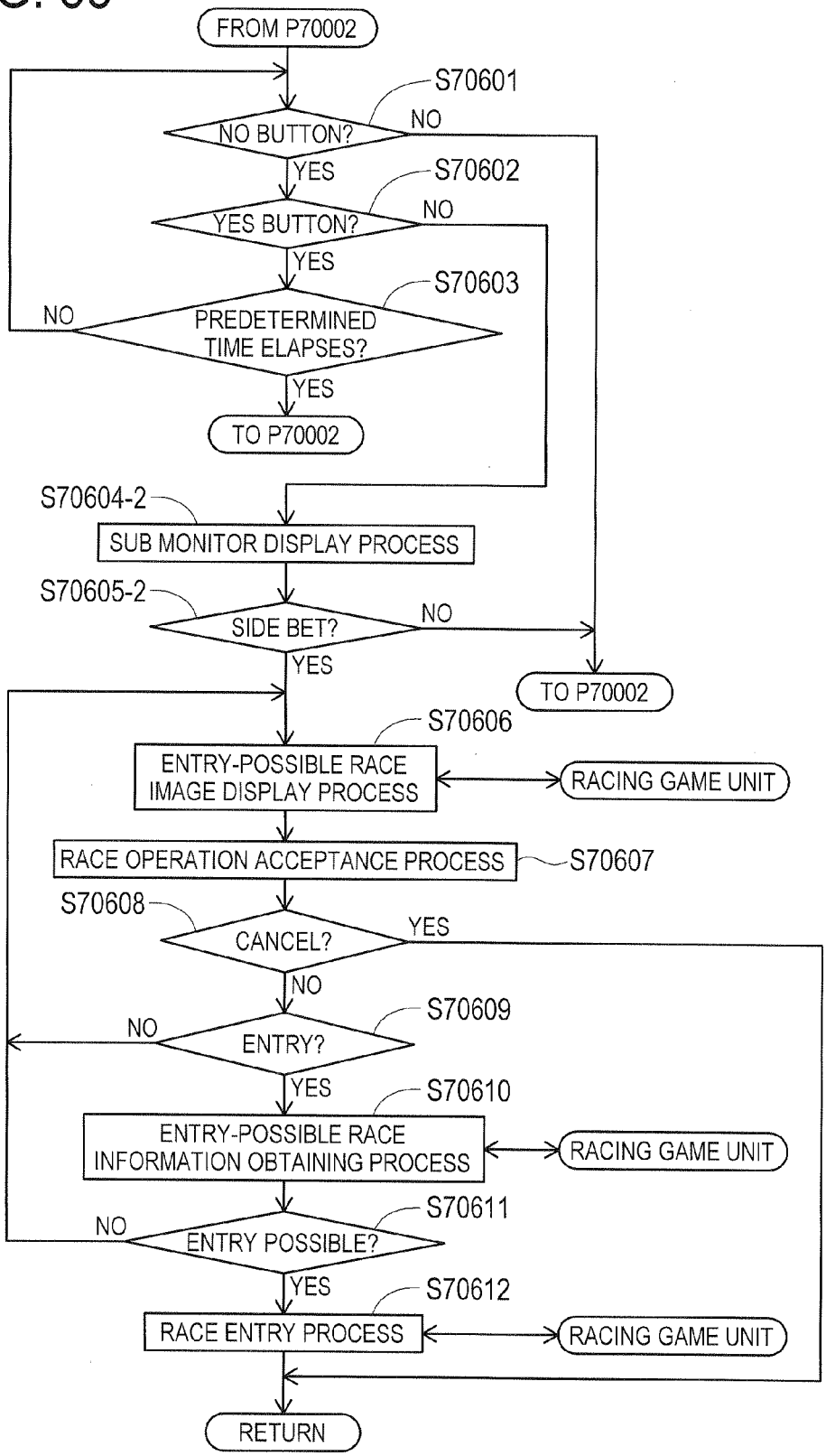
FIG. 55 is a flow chart diagram showing one example of an entry process.

First, at each of the stations 70101, the sub control unit 70102 executes respective processes described in the flow chart of FIG. 55, at the point P70002 just before S70210 of FIG. 48 above. However, respective processes described in the flow chart of FIG. 55 are the same as respective processes described in the flow chart of the above FIG. 53 except the following differences. Therefore, in FIG. 55, a process which is the same as a process described in the flow chart of FIG. 53 has the same reference numeral as the process described in the flow chart of FIG. 53. The differences only are described below.

Namely, in S70602 of FIG. 55, if the player has touched the YES button (S70602: YES), the process proceeds to S70604-2.

Figure 56:
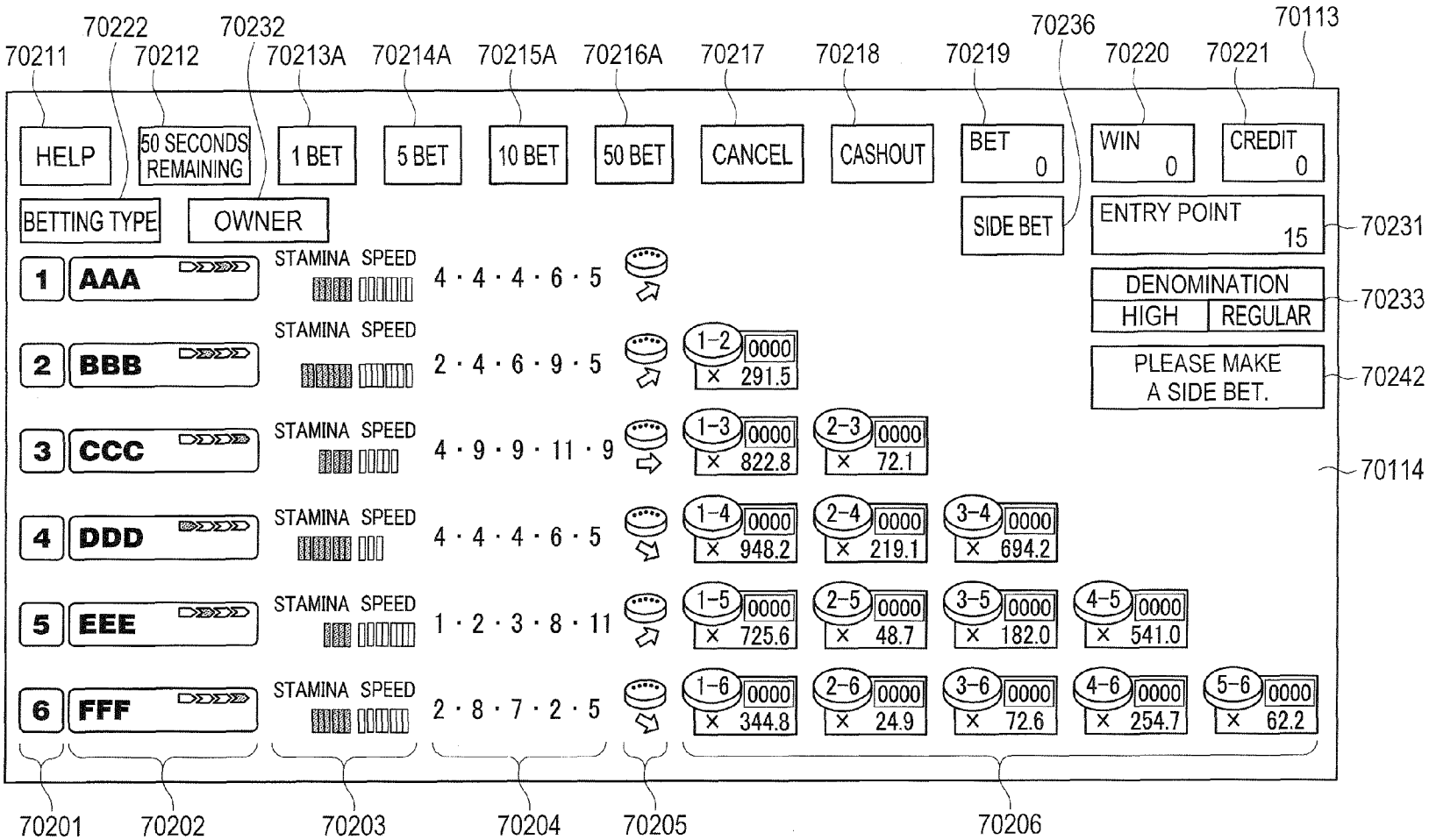
FIG. 56 is a front view showing one example of the regular BET image displayed on the sub monitor.

In S70604-2, the sub control unit 70102 executes a sub monitor display process. In this process, the CPU 70131 additionally displays a message display area 70242 as shown in FIG. 56 in the regular BET image displayed on the sub monitor 70113. The message "PLEASE MAKE A SIDE BET." is displayed in the message display area 70242. This display control is the same as in the high BET image displayed on the sub monitor 70113, not shown in figures.

In S70605-2, the sub control unit 70102 determines whether or not a side bet is made after the elapse of a predetermined time. In this determination, the CPU 70131 determines whether or not the player has touched the side bet button 236 based on a coordinate signal from the touch panel driving circuit 70122. Now, if a side bet is not made (S70605-2: NO), this entry process is terminated to proceed to S70210 of FIG. 48 above. In contrast, if a side bet is made (S70605-2: YES), the process proceeds to S70606.

As above mentioned, the player can make a race entry of the player's racehorse in a racing game which is planned from the beginning to be accompanied with a side game in which a racehorse owner will be ranked, under the condition of making a side bet. However, the base payout amount to be awarded to the player according to the game result of a side game in which a racehorse owner will be ranked is increased by multiplying the side bet amount set by the player (S70107 of FIG. 45 above).

Also, in S70606, in the racing game unit 70011, the main control unit 70012 includes to the entry-possible race image information only the information of a racing game which is planned from the beginning to be accompanied with a side game in which a racehorse owner will be ranked, as above mentioned. Here, if the CPU 70041 is configured to limit the information of a racing game which is planned from the beginning to be accompanied with a side game in which a racehorse owner will be ranked to the information of a racing game in which only a player who has made a side bet can make a race entry, it is possible to allow only racehorses which are owned by players who have made a side bet to run in a racing game which is planned from the beginning to be accompanied with a side game in which a racehorse owner will be ranked. However, if the CPU 70131 of the station 70101 adds data showing that a player has made a side bet into the information transmitted in S70606 from each of the stations 70101 to the racing game unit 70011, it can be determined whether or not the player has made a side bet.

2-11. Others (the Second Embodiment)

In addition, the present invention is not limited to the above second embodiment, but various changes may be made without departing from its scope.

For example, the characteristics of the present invention can be implemented even when configuration is such that the BET operations on a racing game result are limited to those before the racing game.

3-1. Characteristics of a Horse Race Gaming Machine (the Third Embodiment)

In the following, a description is made on the third embodiment of the present invention with reference to drawings.

Figure 58:
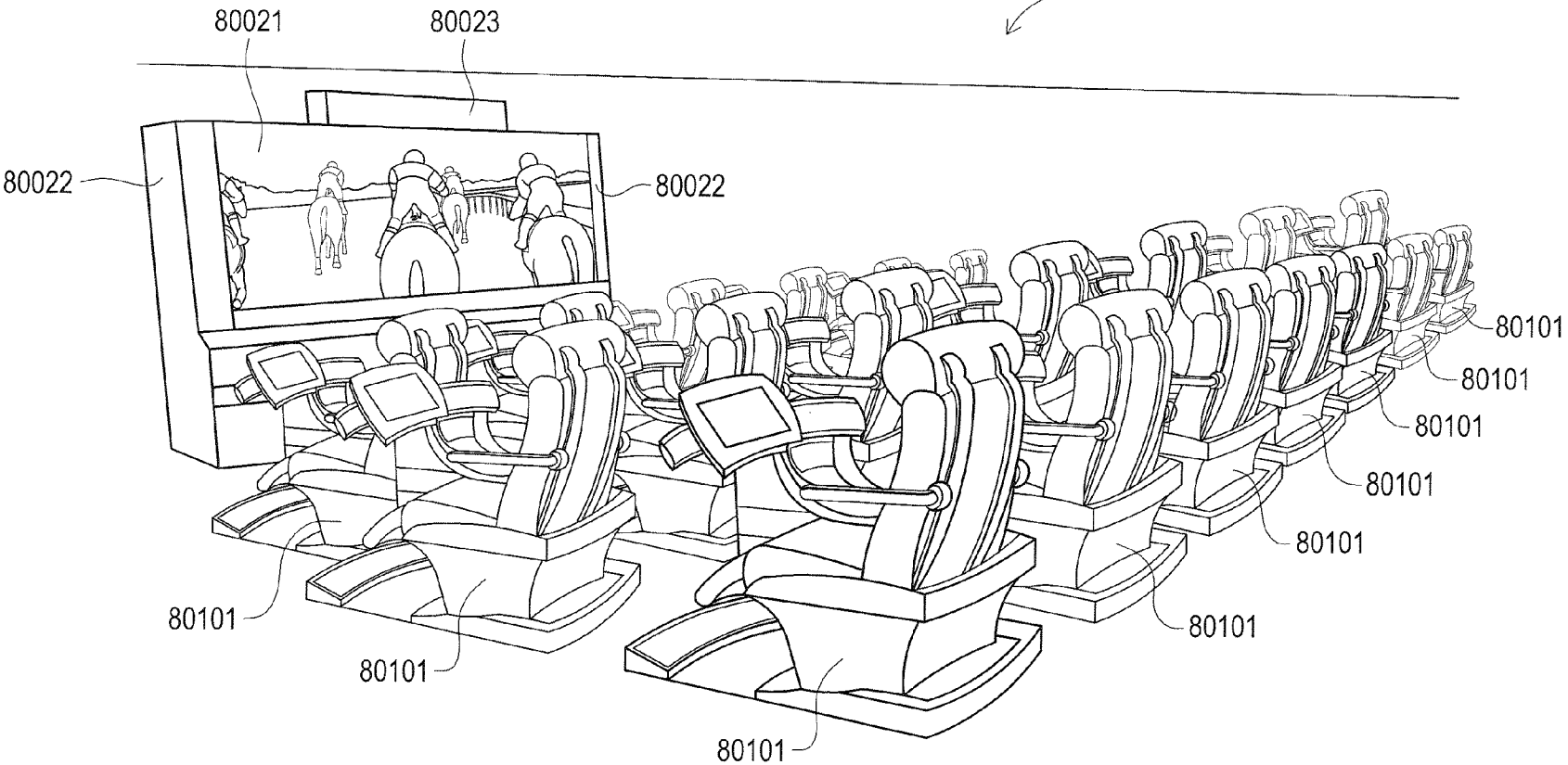
FIG. 58 is a perspective view of the horse race gaming machine.
Figure 59:
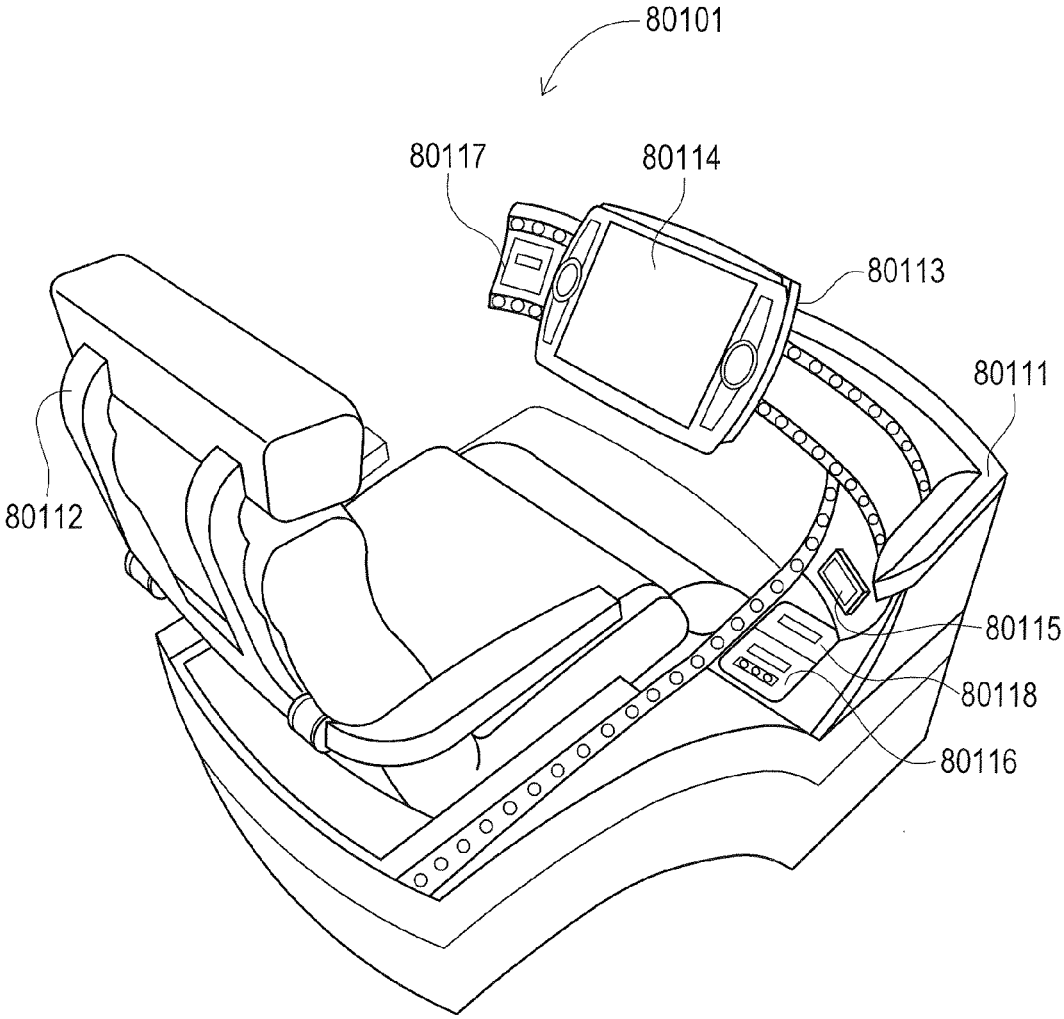
FIG. 59 is a perspective view of a station.

FIG. 58 is a perspective view of a horse race gaming machine 80001 that is one embodiment of the present invention. As shown in FIG. 58, the horse race gaming machine 80001 of this embodiment has a main monitor 80021 and a plurality of stations 80101. The main monitor 80021 displays images of a horse racing game. Players being seated at the respective stations 80101 can respectively participate in this horse racing game. The players being seated at the respective stations 80101 participate in this horse racing game by forecasting a result of each racing game of the horse racing game and performing BET operations. Namely, a horse racing game is constituted of a number of racing games that are intermittently executed in a sequential manner. In addition, the player is able to make a side bet for this racing game. FIG. 59 is a perspective view of the station 80101. A sub monitor 80113 or a touch panel 80114 that each station 80101 is provided with is used to perform BET operations.

In this respect, in the horse race gaming machine 80001 of this embodiment, BETting on racing game result can be performed before or during the racing game.

Figure 57:
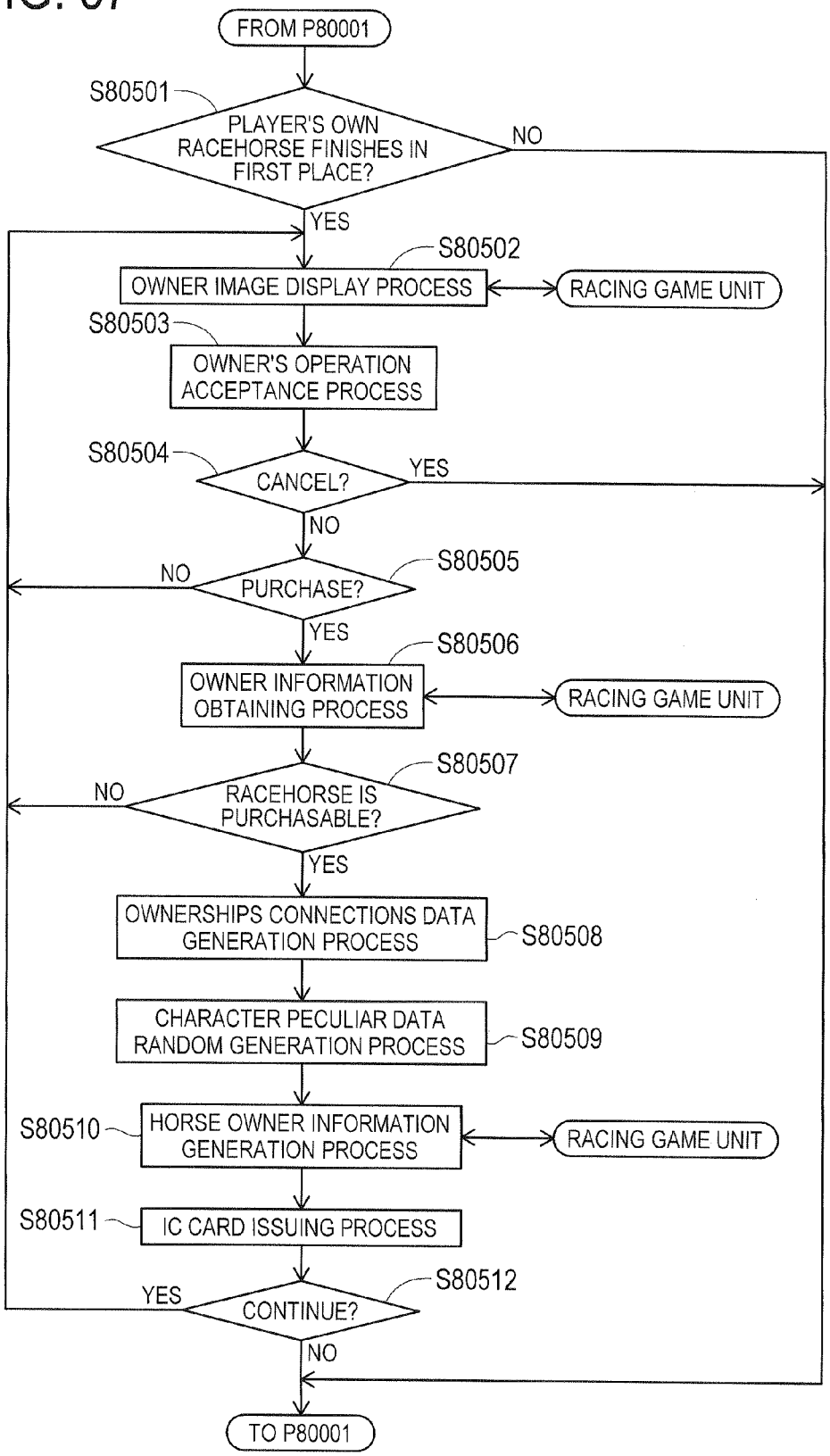
FIG. 57 is a view showing characteristics of a horse race gaming machine of the third embodiment of the present invention and a flow chart diagram showing one example of game operations in the horse race gaming machine.

FIG. 57 is a view showing characteristics of the horse race gaming machine 80001 of this embodiment and a flow chart diagram showing one example of game operations in the horse race gaming machine 80001. In the horse race gaming machine 80001 of this embodiment, if the racehorse whose owner is any one of players playing at the respective stations 80101 finishes in the first place in this racing game (S80501: YES), a right to be able to become a racehorse owner is awarded to the player who is an owner of the racehorse which finishes in the first place in this racing game (S80502 through S80512). It is possible to configure to hold such a racing game randomly (S80702: YES, in FIG. 85 below).

Furthermore, by initially setting so, it is also possible to hold such a racing game or not to hold such a racing game. In case above such initial setting has been arranged, the following conditions should be satisfied in order to have a racehorse, owned by a player, run in such a racing game.

(1) A player pays entry points (S80106 of FIG. 73 below) given to the player depending on the BET amount set by the player (S80605 of FIG. 81 below).

(2) The player sets a side bet (S80605-2 of FIG. 83 below).

3-2. Appearance of a Horse Race Gaming Machine (the Third Embodiment)

As shown in FIG. 58, the horse race gaming machine 80001 of this embodiment has the main monitor 80021, speakers 80022, a display device 80023, the plurality of stations 80101, etc. The main monitor 80021 displays images of a horse racing game, etc. The speakers 80022 output sound of a horse racing game, etc. The display device 80023 displays information about games in general.

As shown in FIG. 59, in each station 80101, a cabinet 80111 is provided with a chair 80112, the sub monitor 80113, the touch panel 80114, a bill identifying device 80115, a ticket printer 80116, an IC card issuing device 80117, a reader/writer 80118, etc. A player sits on the chair 80112. The sub monitor 80113 displays BET images described later, etc. The touch panel 80114 is provided on the screen of the sub monitor 80113. When the player performs the BET operations utilizing the regular BET image described later or the high BET image described later or the player performs specific operations utilizing an owner image described later or an entry-possible race image described later, the touch panel 80114 is used.

The bill identifying device 80115 not only identifies whether or not a bill is appropriate but also receives legitimate bills into the cabinet 80111. Then, bills inserted into the cabinet 80111 are converted into the number of coins, and the credit amount that corresponds to the converted number of coins is added as the player's own credit amount. The bill identifying device 80115 is also configured to be capable of reading bar coded tickets described later.

The ticket printer 80116 is a printer that prints on a ticket a bar code representative of coded data such as a player's own credit amount, date, identification number of the station 80101, etc. and outputs it as a bar coded ticket. A player can have the outputted bar coded ticket read by other station 80101 and play at this other station 80101, or use it for any procedure in predetermined places in a game arcade.

The IC card issuing device 80117 is a device that issues an IC card 80119 (refer to FIG. 61 below) on which horse owner information 80501 (refer to FIG. 71 below) is stored. The IC card 80119 (refer to FIG. 61 below) is inserted into the reader/writer 80118.

3-3. Example of Configuration of a Racing Game Unit (the Third Embodiment)

Figure 60:
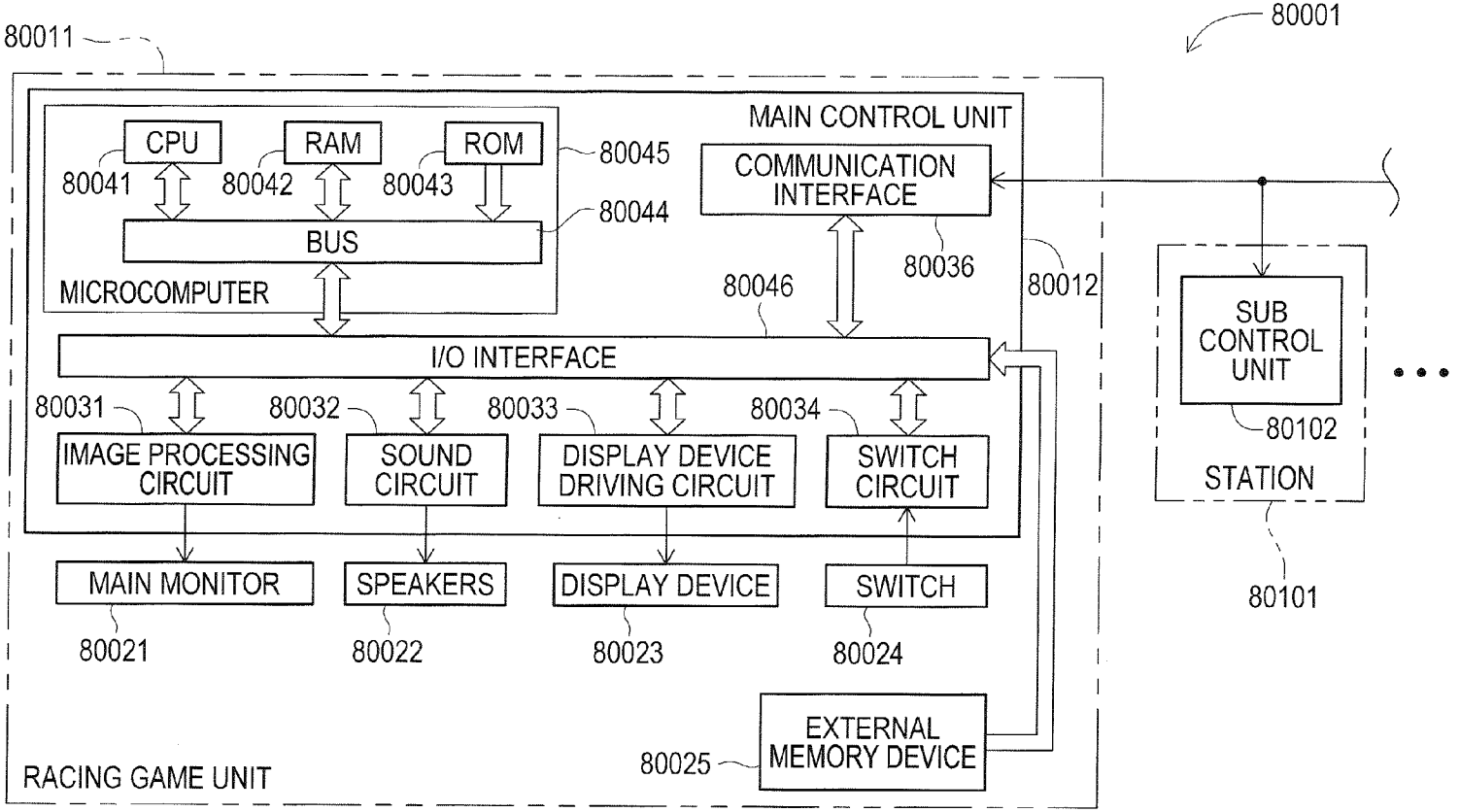
FIG. 60 is a block diagram of a racing game unit.

A racing game unit is an opposite concept of each station 80101 and constitutes a core of the horse race gaming machine 80001 of this embodiment. FIG. 60 is a block diagram of a racing game unit 80011. As shown in FIG. 60, the racing game unit 80011 is composed of a main control unit 80012, the main monitor 80021, the speakers 80022, the display device 80023, a switch 80024, an external memory device 80025, etc. The main control unit 80012 and external memory device 80025 are provided separately from the main monitor 80021, the speakers 80022, or the display device 80023. Although the switch 80024 is annexed to the main control unit 80021, it may be provided individually.

The main control unit 80012 is generally composed of a microcomputer 80045 as the kernel comprising a CPU 80041, a RAM 80042, a ROM 80043 and a bus 80044 for transferring data mutually between these elements. The RAM 80042 and the ROM 80043 are connected to the CPU 80041 via the bus 80044. The RAM 80042 is a memory for temporarily storing a variety of data which have been operated in the CPU 80041. The ROM 80043 stores various types of programs, data tables or the like for executing necessary processes to control the horse race gaming machine 80001.

An image processing circuit 80031 is connected to the microcomputer 80045 via an I/O interface 80046. The image processing circuit 80031 is connected to the main monitor 80021 and controls driving of the main monitor 80021.

The image processing circuit 80031 is composed of a program ROM, an image ROM, an image control CPU, a work RAM, a VDP (video display processor), and a video RAM, etc. And in the program ROM, an image control program related to display on the main monitor 80021, and various selection tables are stored. And, in the image ROM, dot data to form images and the like, for example dot data to form images displayed on the main monitor 80021, are stored. And, based on parameters set by the microcomputer 80045, the image control CPU determines the images displayed on the main monitor 80021 among the dot data stored beforehand in the image ROM, according to the image control program stored beforehand in the program ROM. And, the work RAM works as a temporary memory when the image control program is executed in the image control CPU. And the VDP forms image data corresponding to display contents determined by the image control CPU. And the VDP outputs the image data formed thereby to the main monitor 80021. And the video RAM works as a temporary memory when the images are formed by the VDP.

A sound circuit 80032 is connected to the microcomputer 80045 via the I/O interface 80046. The speakers 80022 are connected to the sound circuit 80032 and are arranged on both lateral sides of the main monitor 80021. The speakers 80022 output various types of effect sound, BGM, etc. when various types of effect are performed, by being subjected to output control by the sound circuit 80032 based on a drive signal from the CPU 80041.

A display device driving circuit 80033 is connected to the microcomputer 80045 via the I/O interface 80046. The display device 80023 is connected to the display device driving circuit 80033. The display device 80023 is disposed on the upper side of the main monitor 80021 and displays information about games in general, by being subjected to display control by the display device driving circuit 80033 based on a drive signal from the CPU 80041.

A switch circuit 80034 is connected to the microcomputer 80045 via the I/O interface 80046. The switch 80024 is connected to the switch circuit 80034 and is arranged in the lower part of the main monitor 80021. The switch 80024 inputs an instruction by an operator's setting operation into the CPU 80041 based on a switch signal from the switch circuit 80034.

The external memory device 80025 is connected to the microcomputer 80045 via the I/O interface 80046. The external memory device 80025 is arranged in the periphery of the main monitor 80021 and has capability similar to the image ROM in the image processing circuit 80031, by storing dot data for forming images, such as dot data for forming images on the main monitor 80021. Thus, when determining any image to be displayed on the main monitor 80021, the image control CPU in the image processing circuit 80031 adds the dot data stored in advance in the external memory device 80025 to a target of the determination.

A communication interface 80036 is connected to the microcomputer 80045 via the I/O interface 80046. A sub control unit 102 of each station 80101 is connected to the communication interface 80036. This enables bidirectional communication between the CPU 80041 and each station 80101. The CPU 80041 can receive and transmit a command, request and data from/to each station 80101 via the communication interface 80036. Therefore, in the horse race gaming machine 80001, the main control unit 80012 controls progress of the horse racing game in cooperation with each station 80101.

3-4. Example of Configuration of a Station (the Third Embodiment)

Figure 61:
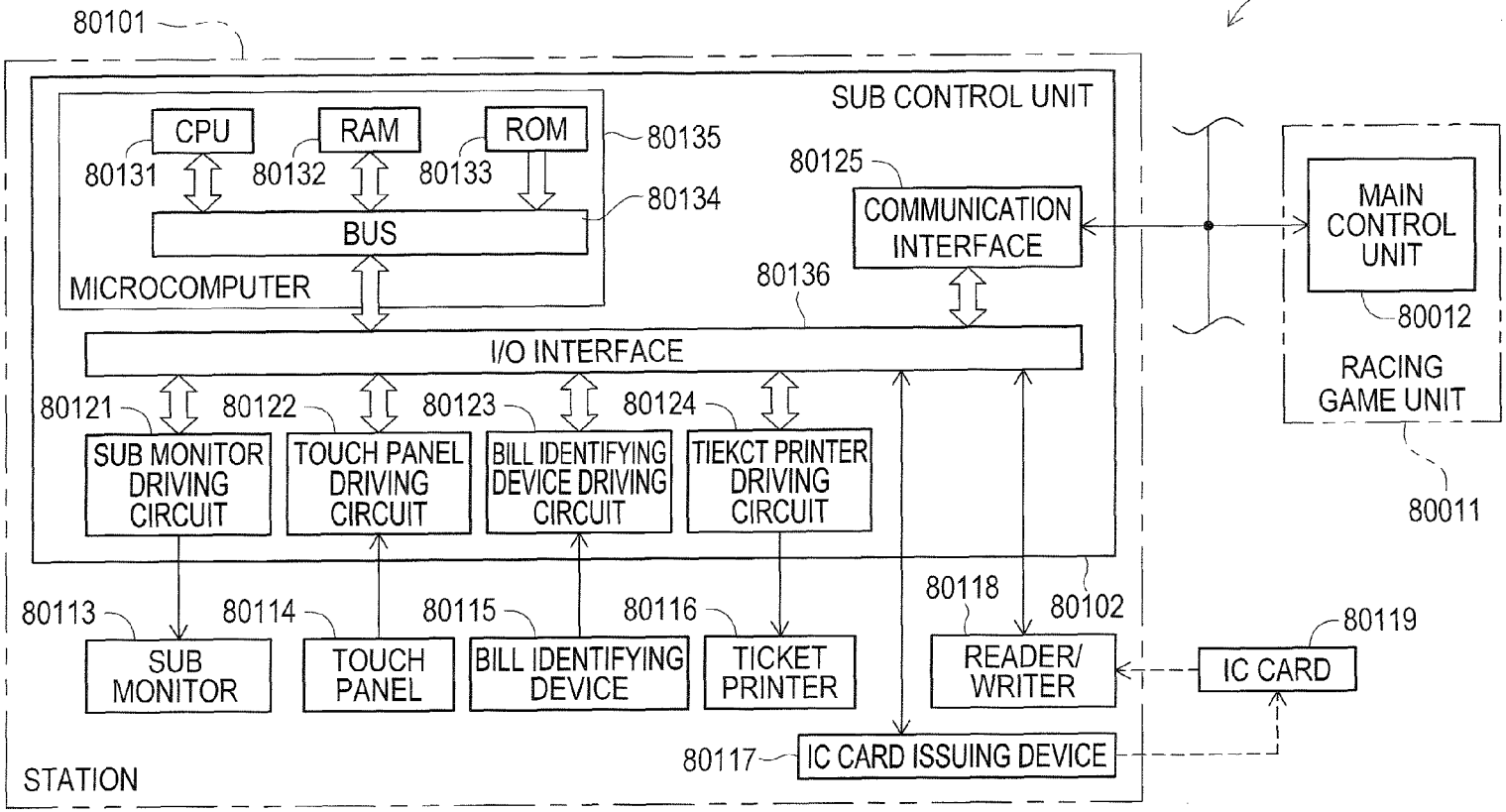
FIG. 61 is a block diagram of the station.

FIG. 61 is a block diagram of a station 80101. As shown in FIG. 61, the station 80101 is composed of the sub control unit 80102, the sub monitor 80113, the touch panel 80114, the bill identifying device 80115, the ticket printer 80116, the IC card issuing device 80117, the reader/writer 80118, etc.

The sub control unit 80102 is generally composed of a microcomputer 80135 as the kernel comprising a CPU 80131, a RAM 80132, a ROM 133 and a bus 134 for transferring data mutually between these elements. The RAM 80132 and the ROM 80133 are connected to the CPU 80131 via the bus 80134. The RAM 80132 is a memory for temporarily storing a variety of data which have been operated in the CPU 80131. The ROM 80133 stores various types of programs, data tables or the like for executing necessary processes to control the horse race gaming machine 80001.

A sub monitor driving circuit 80121 is connected to the microcomputer 135 via an I/O interface 136. The sub monitor 80113 is connected to the sub monitor driving circuit 80121. The sub monitor driving circuit 80121 controls driving of the sub monitor 80113 based on a drive signal from the aforementioned racing game unit 80011. The sub monitor driving circuit 80121 has also similar configuration and capabilities to the image processing circuit 80031 as shown in FIG. 60 above, and controls driving of the sub monitor 80113 so that the regular BET image, the high BET image, the owner image or the entry-possible race image described later are displayed.

A touch panel driving circuit 80122 is connected to the microcomputer 80135 via the I/O interface 80136. The touch panel 80114 is connected to the touch panel driving circuit 80122 and is arranged on the screen of the sub monitor 80113. The touch panel 80114 inputs an instruction into the CPU 80131 through touch operation of a player (touch position), based on a coordinate signal from the touch panel driving circuit 80122.

A bill identifying driving circuit 80123 is connected to the microcomputer 80135 via the I/O interface 80136. The bill identifying device 80115 is connected to the bill identifying driving circuit 80123. The bill identifying device 80115 identifies whether or not a bill or a bar coded ticket is appropriate. When receiving a legitimate bill, the bill identifying device 80115 inputs a value of the bill into the CPU 80131 based on an identification signal from the bill identifying driving circuit 80123. In addition, when receiving a legitimate bar coded ticket, the bill identifying device 80115 inputs a credit amount, etc. recorded on the bar coded ticket into the CPU 80131 based on an identification signal from the bill identifying driving circuit 80123.

A ticket printer driving circuit 80124 is connected to the microcomputer 80135 via the I/O interface 80136. The ticket printer 80116 is connected to the ticket printer driving circuit 80124. The ticket printer 80116 prints on a ticket a bar code representative of coded data such as owned credit amount, etc., stored in the RAM 80132, and outputs it as a bar coded ticket, by being subjected to output control by the ticket printer driving circuit 80124 based on a drive signal to be outputted from the CPU 80131.

The IC card issuing device 80117 is connected to the microcomputer 80135 via the I/O interface 80136. With an output controlled based on a drive signal to be outputted from a CPU 80131, the IC card issuing device 80117 issues an IC card 80119 that stores data such as horse owner information 80501 (refer to FIG. 71 below), etc.

The reader/writer 80118 is connected to the microcomputer 80135 via the I/O interface 80136. With a drive controlled based on a drive signal to be outputted from the CPU 80131, the reader/writer 80118 inputs information read from an IC card 80119 into CPU 80131 or stores various types of information such as horse owner information 80501 (refer to FIG. 71 below) into an IC card 80119.

A communication interface 80125 is connected to the microcomputer 80135 via the I/O interface 80136. The main control unit 80012 of the racing game unit 80011 is connected to the communication interface 80125. This enables bidirectional communication between the CPU 80131 and the racing game unit 80011. The CPU 80131 can receive and transmit a command, request and data from/to the racing game unit 80011 via the communication interface 80125. Therefore, in the horse race gaming machine 80001, the sub control unit 80102 controls progress of the horse racing game in cooperation with the racing game unit 80011.

3-5. Example of Game Operations of a Horse Race Gaming Machine (the Third Embodiment)

Figure 73:
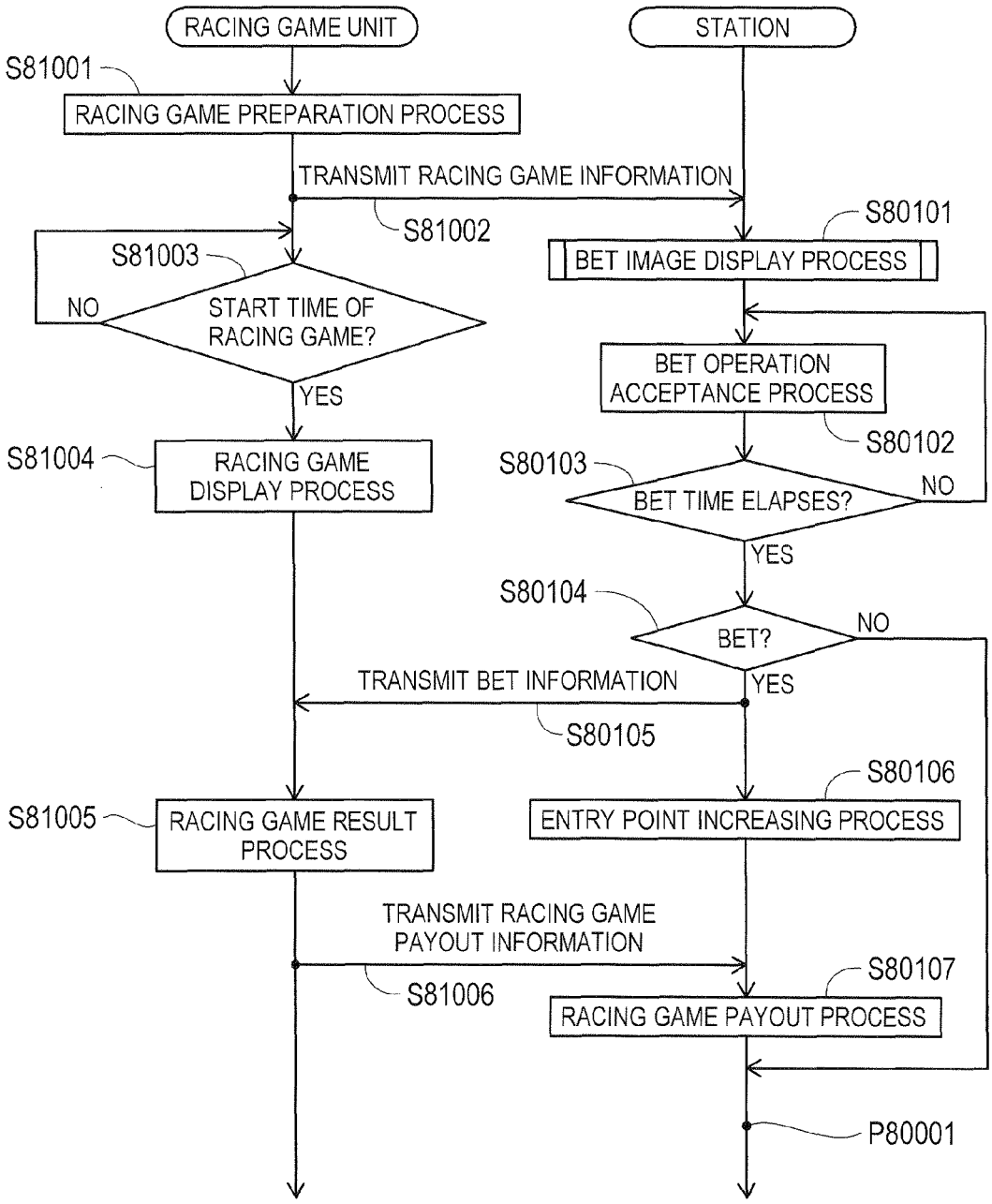
FIG. 73 is a flow chart diagram showing one example of game operations in the horse race gaming machine.

In the following, a description is made on an example of game operations of the horse race gaming machine 80001 of this embodiment. FIG. 73 is a flow chart diagram showing one example of game operations in the horse race gaming machine 80001 of this embodiment. It is to be noted that respective stations 80101 perform similar game operations respectively in cooperation with the racing game unit 80011. In order to avoid any complication, however, only one station 80101 is shown in FIG. 73.

The racing game unit 80011 performs respective operations from S81001 to S81006.

First, in S81001, the main control unit 80012 executes a racing game preparation process. In this process, for this racing game which constitutes a horse racing game, the CPU 80041 determines a track, starter horse, start time, etc, and reads data on them from the ROM 80043.

In S81002, the main control unit 80012 transmits racing game information. In this transmission, the CPU 80041 transmits respective data on the track, starter horse, start time, etc. of this racing game to each station 80101, as racing game information.

In S81003, the main control unit 80012 determines whether or not the present time is race start time of the racing game. In this determination, the CPU 80041 checks time until the time to start this racing game is reached (S81003: NO).

The CPU 80041 may also determine whether or not the present time is the time to start this racing game, by timing an interval from the last racing game.

When the time to start this racing game is reached (S81003: YES), the process proceeds to S81004 and the main control unit 80012 executes a racing game display process. In this process, based on the determination in S81001 above, the CPU 80041 not only displays race images of this racing game on the main monitor 80021 but also outputs sound of this racing game from the speakers 80022.

In S81005, the main control unit 80012 executes a racing game result process. In this process, the CPU 80041 calculates a payout amount of the respective stations 80101, based on the racing game result in S81004 above and BET information transmitted by the respective stations 80101 in S80105 below, etc.

Figure 77:
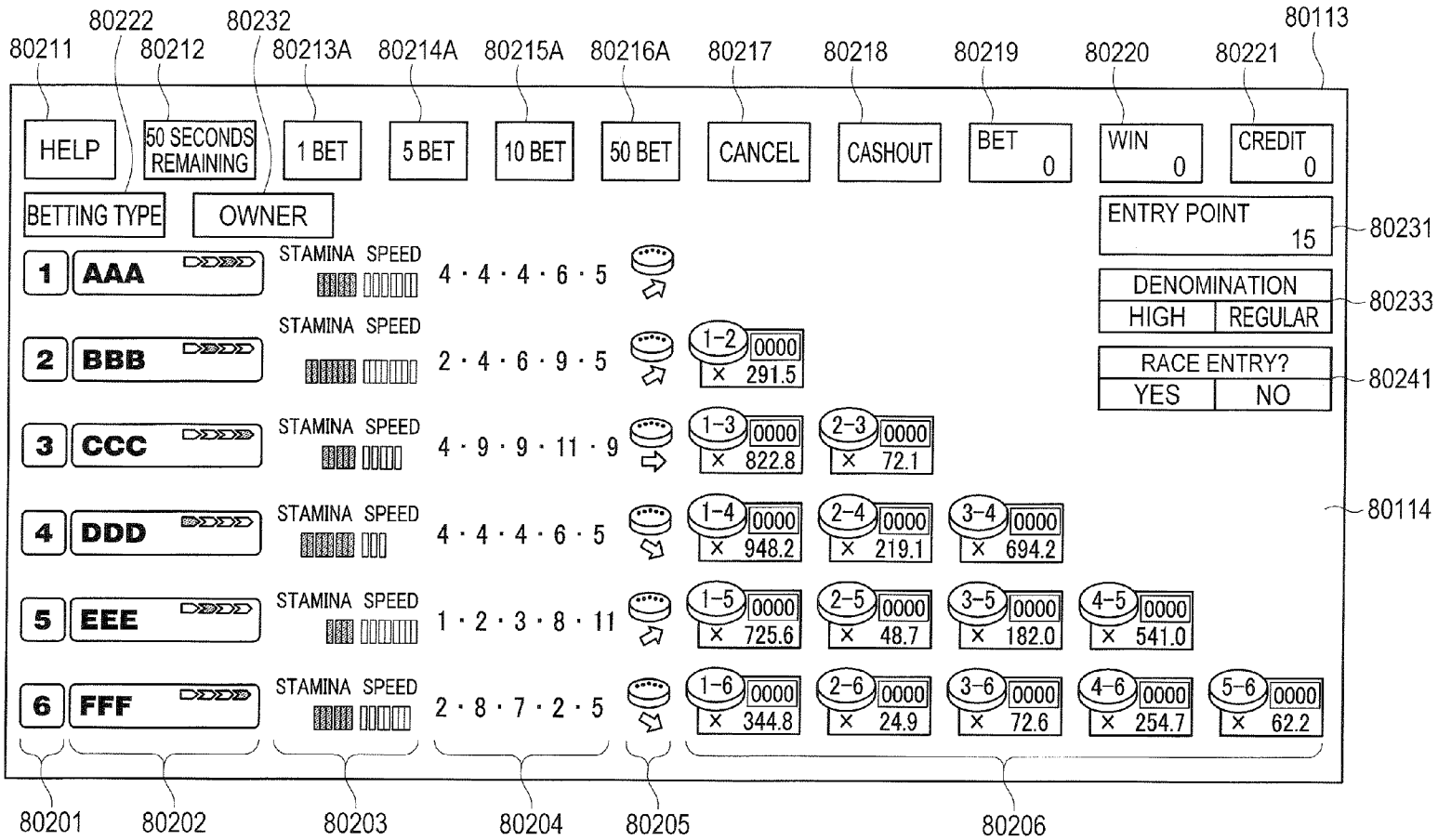
FIG. 77 is a view showing one example of a data table.

In this process, the CPU 80041 identifies a player who is playing each of the stations 80101. This identification is executed based on the BET information transmitted by each of the stations 80101 in S80105 below. In this time, the CPU 80041 generates a data table as shown in FIG. 77. In the data table shown in FIG. 77, a player ID is stored corresponding to a station number. The player ID is included in the BET information transmitted by each of the stations 80101 in S80105 below. Accordingly, in this process, the CPU 80041 reflects the corresponding relation between the station number and the player ID included in the BET information of this racing game to the data table of FIG. 77. Such the data table is stored in the RAM 80042 or the external memory device 80025, etc.

Furthermore, the CPU 80041 identifies the character IDs of all the racehorses which have run in this racing game. The CPU 80041 executes this identification based on the data table of above FIG. 72 generated as to this racing game and the like.

Figures 78, 79, 80:
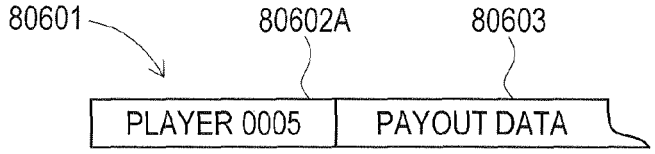
FIG. 78 is a view showing one example of a data table.
FIG. 79 is a view showing one example of racing game payout information.
FIG. 80 is a front view showing one example of the regular BET image displayed on the sub monitor.

After that, the CPU 80041 generates a data table as shown in FIG. 78, using the player ID identified and the character ID identified. Such the data table is stored in the RAM 80042 or the external memory device 80025, etc. The character IDs of the racehorses which have run in this racing game are stored in the data table of FIG. 78 in the order of the horse number. In addition, the player ID of a player who is an owner of a racehorse which has run in this racing game among the players playing at each of the stations 80101 is stored in the data table of FIG. 78 with relating the character ID of the racehorse.

In S81006, the main control unit 80012 transmits racing game payout information. In this transmission, the CPU 80041 transmits to the respective corresponding stations 80101 respective payout amounts, etc. in S81005 above, as racing game payout information.

In this time, if there is a player who is an owner of the racehorse which finishes in the first place in this racing game, the CPU 80041 includes to the racing game payout information a player ID of the player who is an owner of the racehorse which finishes in the first place in this racing game. FIG. 79 shows one example of a racing game payout information that includes a player ID. The racing game payout information 80601 shown in FIG. 79 includes data 80602A indicating a player ID, payout data 80603, and etc.

It is to be noted that the CPU 80041 can determine whether or not there is a player who is an owner of the racehorse which finishes in the first place in this racing game based on a racing game result in S81004 above and the data table of FIG. 78. Furthermore, when determining that there is a player who is an owner of the racehorse which finishes in the first place in this racing game, the CPU 80041 can identify a player ID of the player who is an owner of the racehorse which finishes in the first place in this racing game by referring to the data table of FIG. 78.

Thereafter, similar processes are also repeated in the next racing game.

Meanwhile, in the respective stations 80101, respective operations of S80101 to S80107 are performed.

First, in S80101, the sub control unit 80102 executes a BET image display process. The respective stations 80101 execute the BET image display process based on the flow chart of FIG. 76.

Figure 62:
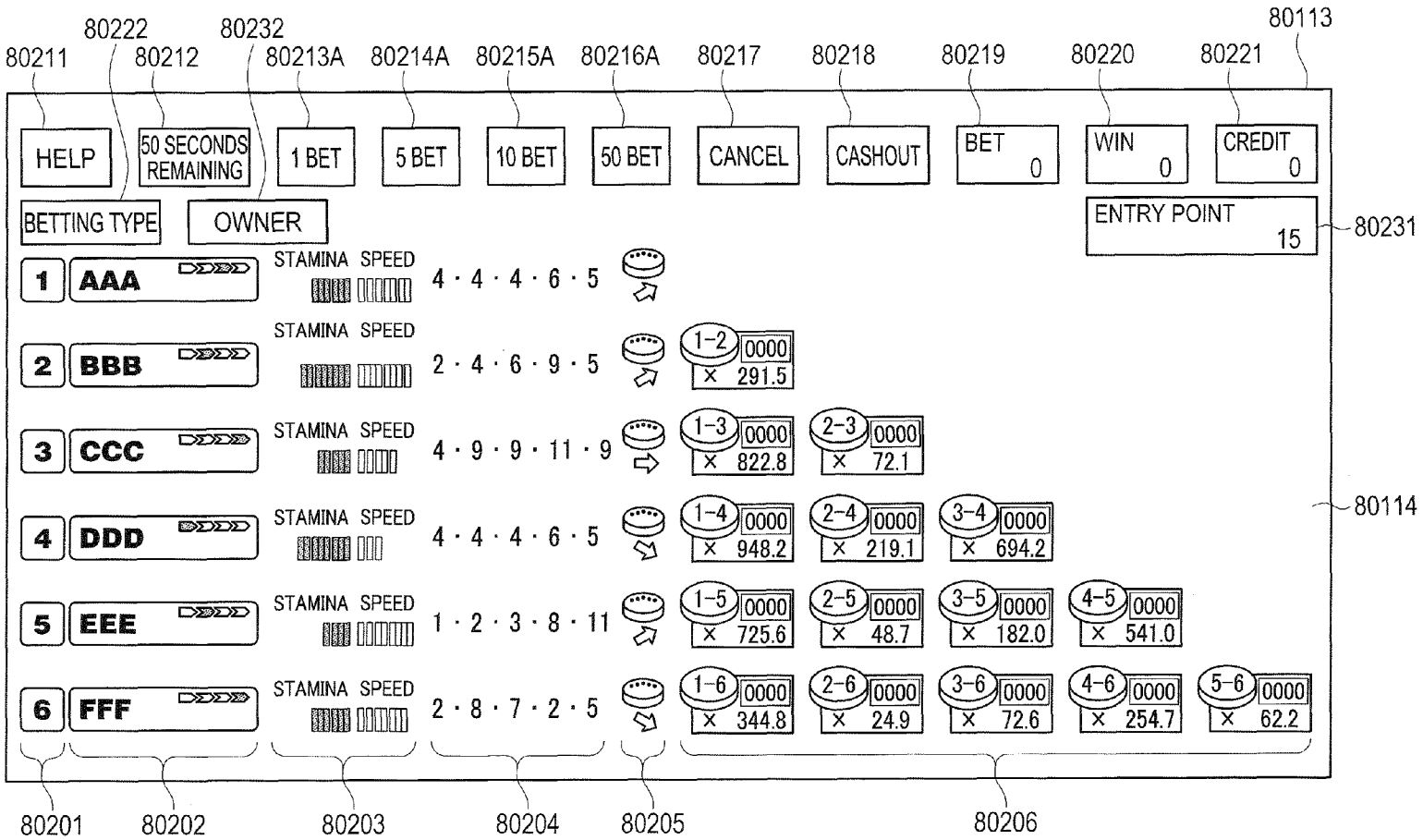
FIG. 62 is a front view showing one example of a regular BET image displayed on a sub monitor.

First, in S201, the sub control unit 80102 executes a regular denomination process. In this process, the CPU 80131 displays a regular BET image of this racing game on the sub monitor 80113, based on the data related to the racing game information transmitted by the racing game unit 80011 in S81002 above. FIG. 62 shows one example of the regular BET image displayed on the sub monitor 80113.

As shown in FIG. 62, in a regular BET image displayed on the screen of the sub monitor 80113 covered by the light transmissive colorless touch panel 80114 are provided a horse number display area 80201, a horse name display area 80202, a basic power display area 80203 that displays speed and stamina by a bar graph, a performance display area 80204 that displays orders of arrival in last five races, a brief comment display area 80205 that displays the condition of this racing game by an arrow, a betting ticket purchase button display area 80206 where a betting ticket purchase button of a quinella-type bet in which a player randomly picks a combination of horse numbers that will finish in the first place and in the second place in order to win, odds or BET amounts are displayed together, etc.

In addition, in the regular BET image are provided a help button 80211, a time display area 80212, a 1 BET button 80213A, a 5 BET button 80214A, a 10 BET button 80215A, a 50 BET button 80216A, a cancel button 80217, a CASH-OUT button 80218, a BET amount display area 80219, a payout amount display area 80220, a credit amount display area 80221, a betting ticket type switch button 80222, an owner button 80232, an entry point display area 80231, etc.

The help button 80211 is a button that a player touches to display a method of BET operation, etc. on the sub monitor 80113. The time display area 80212 displays BET time in terms of the remaining time. The 1 BET button 80213A is a button that a player touches to set so that "1" is added to the present BET amount. The 5 BET button 80214A is a button that a player touches to set so that "5" is added to the present BET amount. The 10 BET button 80215A is a button that a player touches to set so that "10" is added to the present BET amount. The 50 BET button 80216A is a button that a player touches to set so that "50" is added to the present BET amount. Accordingly, the denomination of the regular BET image is "1". In other words, the minimum bet amount that a player can specify in the regular BET image is "1".

The cancel button 80217 is a button that a player touches to cancel the setting of addition to the BET amount. The CASH-OUT button 80218 is a button that a player touches to be paid out the number of coins corresponding to a player's own credit amount in bar coded tickets printed by the ticket printer 80116. The BET amount display area 80219 displays the total BET amount that a player sets for this racing game. The payout amount display area 80220 displays a payout amount of this racing game. The credit amount display area 80221 displays a player's own credit amount.

Touching any of the betting ticket purchase buttons within the betting ticket purchase button display area 80206 after touching any of the respective BET buttons 80213A, 80214A, 80215A, and 80216A, a player can perform the BET operation of the quinella-type bet. For example, if a player touches the betting ticket purchase button for "1-2" in the betting ticket purchase button display area 80206 after touching the 10 BET button 80215A, the player can set addition of "10" to the present BET amount for a combination of No. 1 and No. 2, as a combination of horse numbers that the player forecasts will finish in the first or second places in no particular order. The present BET amount for respective combinations of horse numbers are displayed next to the betting ticket purchase buttons corresponding to the respective combinations.

Although the regular BET image shown in FIG. 62 is for the quinella-type bet, such respective types of betting as win, place, bracket quinella, quinella place, exacta, trio, trifecta, etc. are also available, and every time a player touches the betting ticket type switch button 80222, the regular BET image changes to a regular BET image of a different type.

Various data in the regular BET image such as horse names and odds, etc. is included in data on the racing game information transmitted by the racing game unit 80011 in S81002 above.

The owner button 80232 is a button that a player touches when he/she wants to purchase a racehorse. The entry point display area 80231 displays entry points owned by a player.

Returning to FIG. 76, in S80202, the sub control unit 80102 determines whether or not a race entry has been made. In this determination, the CPU 80131 makes a determination based on the data related to race entry information stored in the RAM 80132, etc. described later. Then, if the race entry has been made (S80202: YES), the process proceeds to S80205 below. In this case (S80202: YES), the player is an owner of any racehorse. The player has also made the race entry of his/her own racehorse in any racing game. In contrast, if the race entry has not been made (S80202: NO), the process proceeds to S80203.

In S80203, the sub control unit 80102 determines whether or not an IC card 80119 is inserted into the reader/writer 80118. In this determination, the CPU 80131 makes a determination based on the data on whether or not there is an IC card 80119 transmitted by the reader/writer 80118, etc. Now if an IC card 80119 is not inserted into the reader/writer 80118 (S80203: NO), the process proceeds to S80210 below. In contrast, if an IC card 80119 is inserted into the reader/writer 80118 (S80203: YES), the process proceeds to S80204.

In S80204, the sub control unit 80102 determines whether or not a player is an owner of any racehorse. In this determination, the CPU 80131 makes a determination based on the data on horse owner information 80501 (refer to FIG. 71 below) stored in the RAM 80132 or an IC card 80119, etc. The horse owner information 80501 (refer to FIG. 71 below) stored in an IC card 80119 is read out by the reader/writer 80118 and inputted into the CPU 80131. Now, if a player is not an owner of any racehorse (S80204: NO), the process proceeds to S80210 below. In contrast, if the player is an owner of any racehorse (S80204: YES), the process proceeds to S80205.

Figure 63:
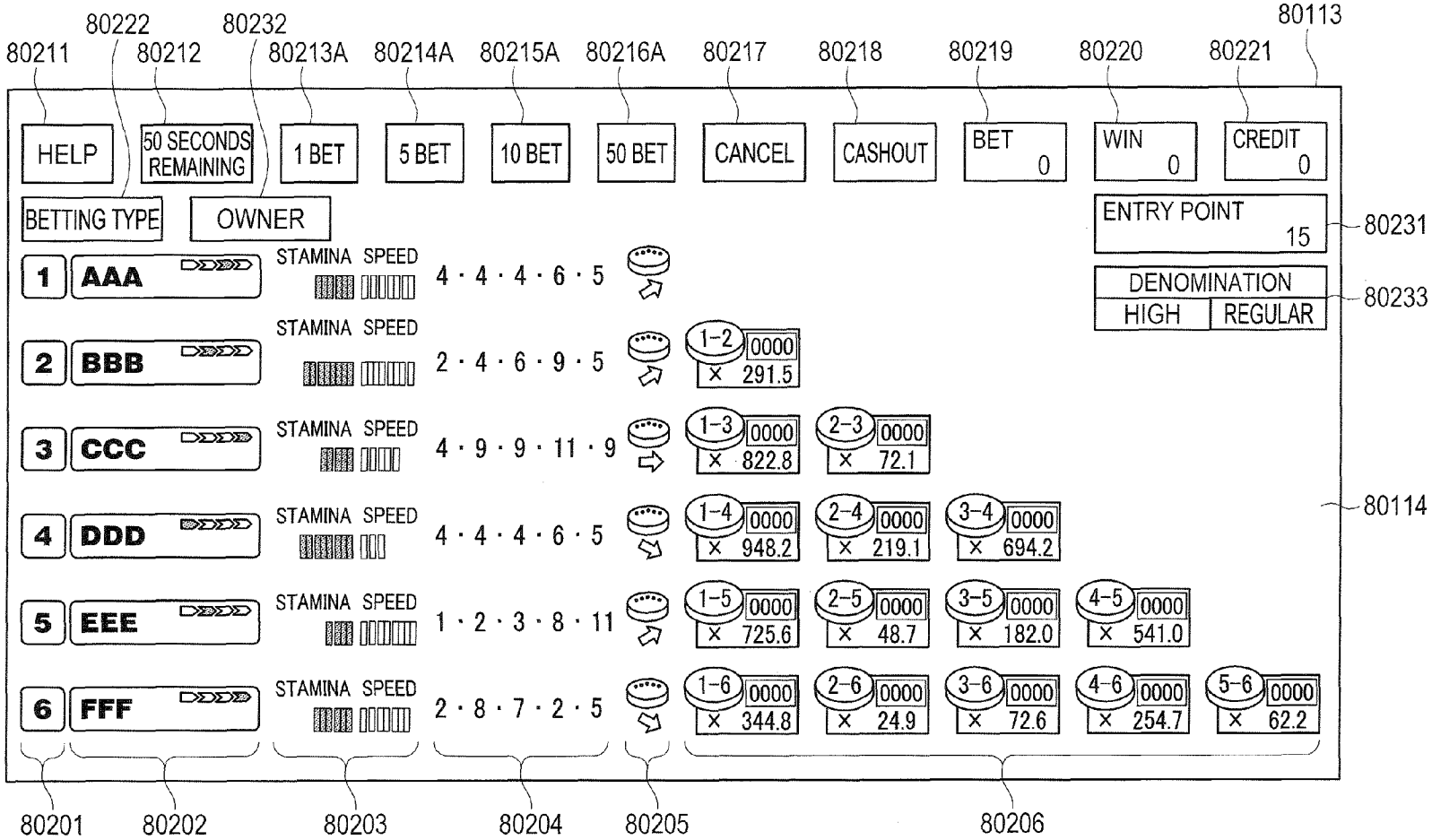
FIG. 63 is a front view showing one example of the regular BET image displayed on the sub monitor.

In S80205, the sub control unit 80102 executes a sub monitor display process. In this process, the CPU 80131 changes the regular BET image being displayed on the sub monitor 80113 to a regular BET image as shown in FIG. 63. In other words, a denomination button 80233 is synthesized and displayed on the regular BET image as shown in FIG. 62. The denomination button 80233 includes a regular button and a high button.

In S80206, the sub control unit 80102 determines whether or not a player has touched the regular button. In this determination, based on a coordinate signal from the touch panel driving circuit 80122, the CPU 80131 determines whether or not the player has touched the regular button included in the denomination button 80233. Now, if the player has touched the regular button (S80206: YES), the process proceeds to S80210 below. In contrast, if the player has not touched the regular button (S80206: NO), the process proceeds to S80207.

In S80207, the sub control unit 80102 determines whether or not the player has touched the high button. In this determination, based on a coordinate signal from the touch panel driving circuit 80122, the CPU 80131 determines whether or not the player has touched the high button included in the denomination button 80233. Now, if the player has not touched the high button (S80207: NO), the process returns to S80206 above. In contrast, if the player has touched the high button (S80207: YES), the process proceeds to S80208.

In other words, the respective determination processes of S80206 and S80207 above are repeated until the player touches either the regular button or the high button included in the denomination button 80233. However, similar to the determination process in S80103 below, the sub control unit 80102 determines whether or not the BET time has elapsed even while the respective determination processes of S80206 and S80207 above are being repeated. If the sub control unit 80102 determines that the BET time has elapsed before the player touches either the regular button or the high button included in the denomination button 80233, the process is forced to proceed to S80210 below.

Figure 64:
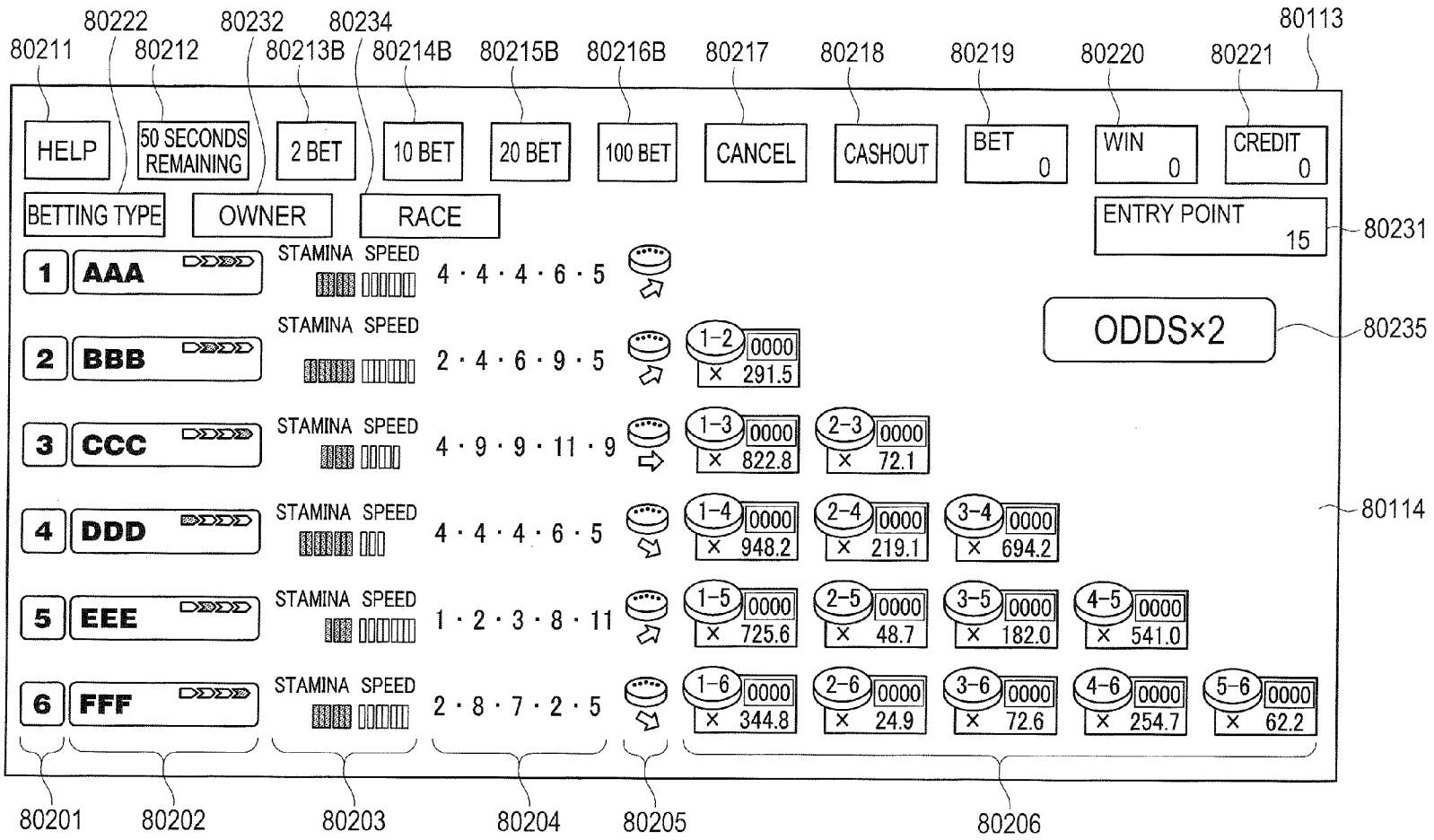
FIG. 64 is a front view showing one example of a high BET image displayed on the sub monitor.

In S80208, the sub control unit 80102 executes a high denomination process. In this process, the CPU 80131 displays a high BET image of this racing game on the sub monitor 80113. FIG. 64 shows one example of the high BET image displayed on the sub monitor 80113.

In the high BET image are provided a 2 BET button 80213B, a 10 BET button 80214B, a 20 BET button 80215B, and a 100 BET button 80216B. Thus, in the high BET image, the bet amounts of the respective BET buttons are twice as large as those in the regular BET image (refer to FIG. 62 and FIG. 63 above). Accordingly, the denomination of the high BET image is "2". In other words, the minimum bet amount that a player can specify in the high BET image is "2". In contrast, the minimum bet amount that a player can specify in the regular BET image (refer to FIG. 62 and FIG. 63 above) is "1". Accordingly, the denomination of the high BET image is twice the denomination of the regular BET image (refer to FIG. 62 and FIG. 63 above).

In addition, in the high BET image are provided a race button 80234 or a message display area 80235. The race button 80234 is a button that a player touches when he/she wishes to make a race entry of his/her own racehorse in a racing game. The message display area 80235 displays a message ("ODDS×2") indicating that odds will be twice as large as those in the regular BET image (refer to FIG. 62 and FIG. 63 above).

Except for these points, the high BET image is same as the regular BET image (refer to FIG. 62 above), and thus details thereof are omitted.

In S80209, the sub control unit 80102 executes a high odds process. In this process, the CPU 80131 stores in the RAM 80132 the data showing that the odds are doubled, in order to have it included in BET information to be transmitted to the racing game unit 80011 in S80105 below.

In S80210, the sub control unit 80102 executes an image control process. In this process, the CPU 80131 performs necessary other display controls over the regular BET image or the high BET image displayed on the sub monitor 80113. Thereafter, the process proceeds to S80102 of FIG. 62.

Returning to FIG. 73, in S80102, the sub control unit 80102 executes a BET operation acceptance process. In this process, based on a coordinate signal from the touch panel driving circuit 80122, the CPU 80131 identifies the content of the player's BET operation for this racing game and stores it in the RAM 80132. The CPU 80131 also checks time when each BET operation is performed and stores it in the RAM 80132. The CPU 80131 reflects the content of the player's BET operation in the display of the BET images of the sub monitor 80113.

In S80103, the sub control unit 80102 determines whether or not the BET time has elapsed. In this determination, the CPU 80131 checks time until the BET time has elapsed. The BET time is computed by the CPU 80131 based on the data on the racing game information transmitted by the racing game unit 80011 in S81002 above, and begins before this racing game starts and ends at predetermined timing while this racing game is in progress.

In addition, the sub control unit 80102 may determine that the BET time has elapsed, when the remaining time displayed in the time display area 80212 on the regular BET image or the high BET image of the sub monitor 80113 runs out.

Till the BET time elapses (S80103: NO), the sub control unit 80102 returns to S80102 above, and continues with the BET operation acceptance process. When the BET time has elapsed (S80103: YES), the process proceeds to S80104 and the sub control unit 80102 determines whether or not there is a BET. In this determination, the CPU 80131 determines whether or not there is a BET setting for this racing game based on what is stored in S80102 above.

Only when the sub control unit 80102 determines that there is a BET (S80104: YES), the process proceeds to S80105 and the sub control unit 80102 transmits BET information. In this transmission, the CPU 80131 transmits to the racing game unit 80011 the data on the memory content in S80209 or S80102 above, as BET information. Then, when transmitting the BET information to the racing game unit 80011, the CPU 80131 combines a player ID identified through S80202, S80203, S80204, etc. of FIG. 76 above with a No. of the station 80101 and includes them in the BET information thereof. In this respect, if the player uses more than one IC card 80119, the number of player IDs included in the BET information may also be more than one.

In S80106, the sub control unit 80102 executes an entry point increasing process. In this process, the CPU 80131 updates the player's own entry points stored in the RAM

80132, by adding points corresponding to the content of the player's BET operation on this racing game to the player's own entry points. The added entry points are equal to a certain proportion of the total BET amount the player sets for this racing game. The CPU 80131 displays the entry points after the addition in the entry point display area 80231 on the regular BET image or the high BET image of the sub monitor 80113.

In S80107, the sub control unit 80102 executes a racing game payout process. In this process, based on the data on the racing game payout information transmitted by the racing game unit 80011 in S81006 above, the CPU 80131 updates not only the player's own credit amount stored in the RAM 80132, but also the display in the payout amount display area 80220 or the credit amount display area 80221 on the regular BET image or the high BET image of the sub monitor 80113.

3-6. Example of Operations for Becoming a Racehorse Owner (the Third Embodiment)

Figure 74:
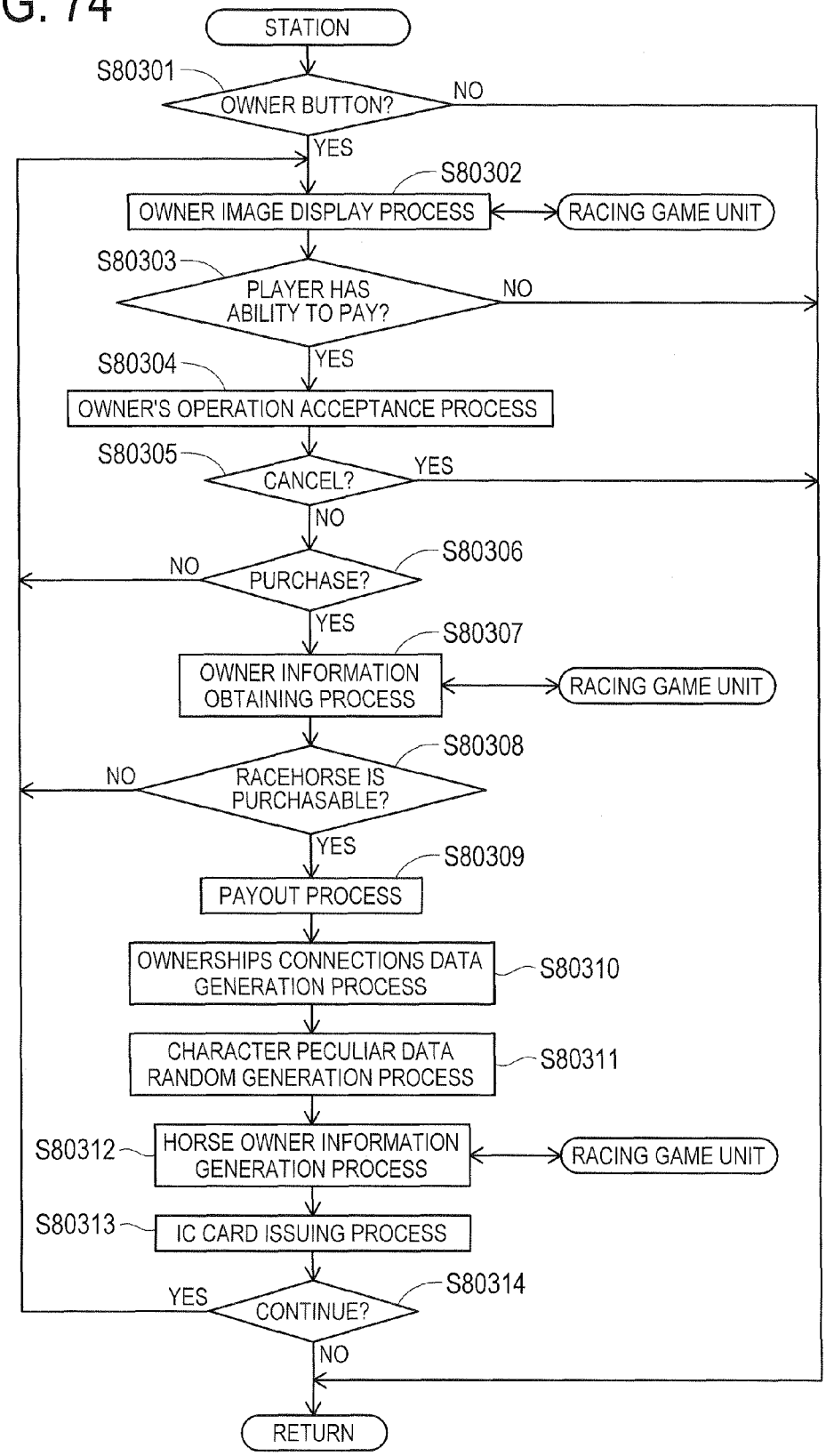
FIG. 74 is a flow chart diagram showing one example of an owner process.

In the following, an example of operations for becoming a racehorse owner in the horse race gaming machine 80001 of this embodiment is described. FIG. 74 is a flow chart diagram showing one example of an owner process.

In the respective stations 80101, triggered by a player's touching the owner button 80232 on the regular BET image or the high BET image of the sub monitor 80113, the owner process is executed based on the flow chart of FIG. 74.

First, in S80301, the sub control unit 80102 determines whether or not the player has touched the owner button 80232. In this determination, the CPU 80131 determines whether or not the player has touched the owner button 80232, based on a coordinate signal from the touch panel driving circuit 80122. Now, if the player has not touched the owner button 80232 (S80301: NO), this owner process terminates. In contrast, if the player has touched the owner button 80232 (S80301: YES), the process proceeds to S80302.

Figure 65:
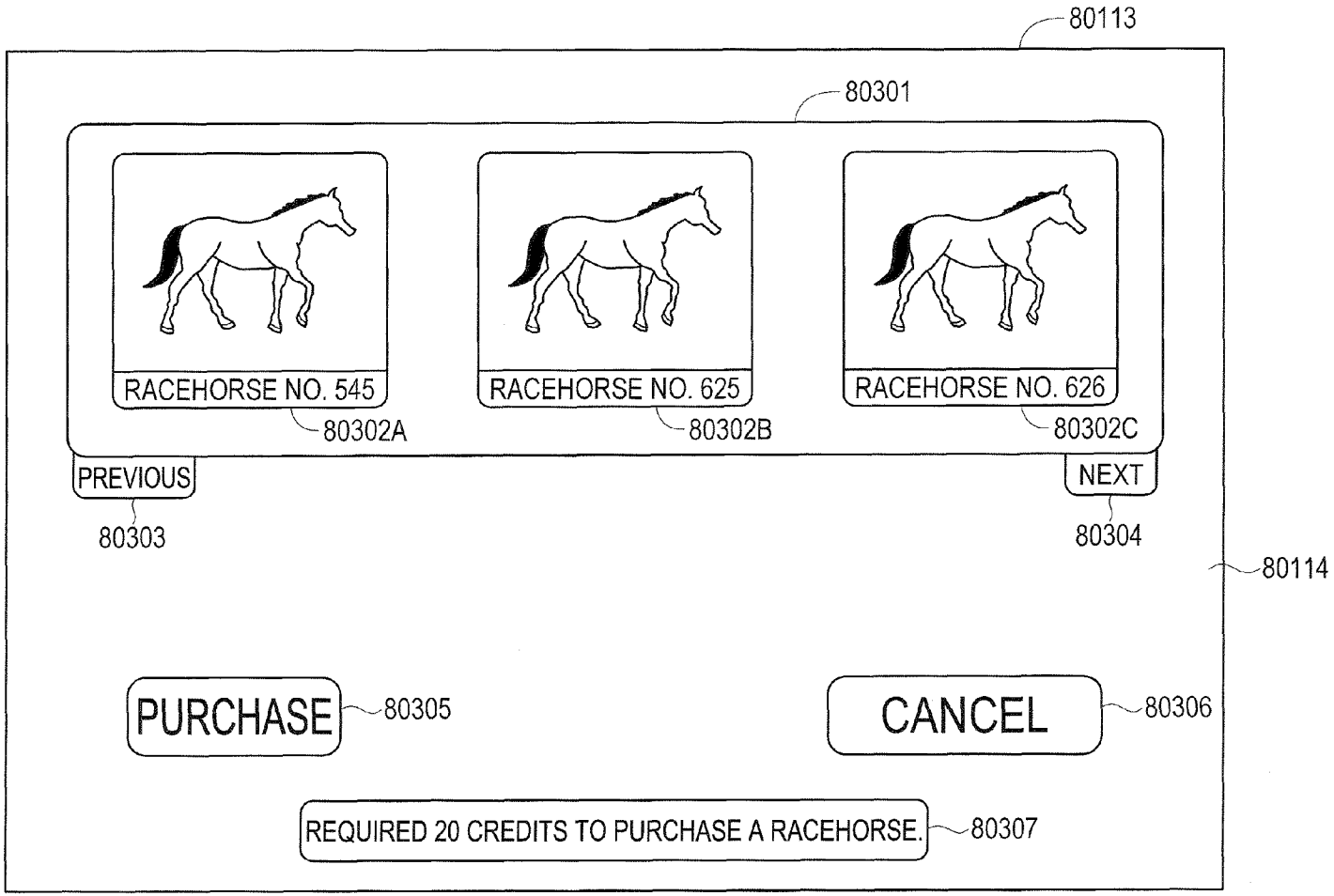
FIG. 65 is a front view showing one example of an owner image displayed on the sub monitor.

In S80302, the sub control unit 80102 executes an owner image display process. In this process, the CPU 80131 displays an owner image on the sub monitor 80113 based on the data on owner image information received through bidirectional communication with the racing game unit 80011. FIG. 65 shows one example of the owner image displayed on the sub monitor 80113.

As shown in FIG. 65, in the owner image displayed on the sub monitor 80113 covered by the light transmissive colorless touch panel 80114 are provided a racehorse page display area 80301, a previous page button 80303, a next page button 80304, a purchase button 80305, a cancel button 80306 and a message display area 80307, etc.

Three racehorse designation buttons 80302A, 80302B, and 80302C are provided in the racehorse page display area 80301. The respective racehorse designation buttons 80302A, 80302B, and 80302C display videos of racehorses that a player can purchase and their respective designation numbers. A player can designate a racehorse that he/she wishes to purchase, by touching each racehorse designation button 80302A, 80302B and 80302C.

In the racehorse page display area 80301, video of the 3 racehorses that a player can purchase is displayed. If the number of racehorses that a player can purchase is more than 3, a plurality of the racehorse page display areas 80301 will be generated. By touching the previous page button 80303 or the next page button 80304, a player can display any of the plurality of racehorse display areas 80301 on the owner image of the sub monitor 80113.

It is to be noted that the data on racehorses that a player can purchase is included in the owner image information received through bidirectional communication with the racing game unit 80011 in S80302 above.

The purchase button 80305 is a button that a player touches when determining a purchase of the designated racehorse. The cancel button 80306 is a button that a player touches when aborting a purchase of a racehorse. The message display area 80307 displays the message "REQUIRED 20 CREDITS TO PURCHASE A RACEHORSE".

In S80303, the sub control unit 80102 determines whether or not the player has the ability to pay. As shown in the message displayed in the message display area 80307, in this embodiment, 20 credits are required to purchase a racehorse. Therefore, in this determination, the CPU 80131 determines that the player has the ability to pay if the player's own credit amount stored in the RAM 80132 is not less than 20 credits. If the player has no ability to pay (S80303: NO), this owner process terminates. In contrast, if the player has the ability to pay (S80303: YES), the process proceeds to S80304.

In S80304, the sub control unit 80102 executes an owner's operation acceptance process. In this process, the CPU 80131 identifies the content of the player's BET operation in the owner image of the sub monitor 80113, based on a coordinate signal from the touch panel driving circuit 80122, and stores it in the RAM 80132. The CPU 80131 reflects the content of the player's BET operation in the display of the owner image of the sub monitor 80113.

In S80305, the sub control unit 80102 determines whether or not the player has touched the cancel button 80306. In this determination, the CPU 80131 determines whether or not the player has touched the cancel button 80306 based on a coordinate signal from the touch panel driving circuit 80122. Now, if the player has touched the cancel button 80306 (S80305: YES), this owner process terminates. In contrast, if the player has not touched the cancel button 80306 (S80305: NO), the process proceeds to S80306.

In S80306, the sub control unit 80102 determines whether or not the player has touched the purchase button 80305. In this determination, the CPU 80131 determines whether or not the player has touched the purchase button 80305 based on a coordinate signal from the touch panel driving circuit 80122. Now, if the player has not touched the purchase button 80305 (S80306: NO), the process returns to S80302 above. In contrast, if the player has touched the purchase button 80305 (S80306: YES), the process proceeds to S80307.

In S80307, the sub control unit 80102 executes an owner information obtaining process. In this process, the CPU 80131 receives owner information through bidirectional communication with the racing game unit 80011. This owner information includes data obtained as a result of causing the racing game unit 80011 to check whether or not the racehorse designated by the player is purchasable. If the racehorse is purchasable, the racing game unit 80011 puts the racehorse into purchase reserved state to prevent other player from purchasing the racehorse.

Figure 69:
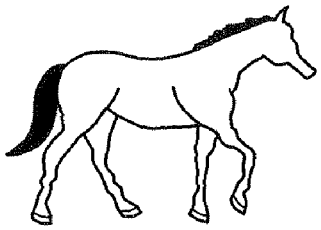
FIG. 69 is a view showing one example of a data table.
Figure 69:
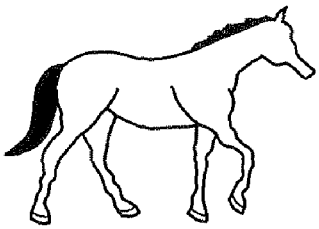
Figure 69:
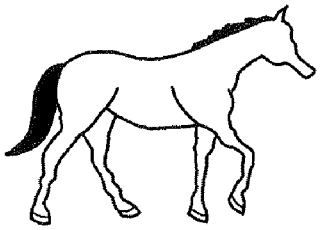

In the racing game unit 80011, the CPU 80041 controls respective racehorses by means of a character ID. For example, as per the data table shown in FIG. 69, the racehorses are associated with the character IDs. Such the table is stored in the RAM 80042 or the external memory device 80025, etc.

In addition, by associating the character IDs with player IDs, the racing game unit 80011 determines whether or not a racehorse is purchasable. For example, as per the data table shown in FIG. 70, the character IDs are associated with the player IDs. Such the table is stored in the RAM 80042 or the external storage device 80025, etc.

By referring to an association between the character IDs and the player IDs, the racing game unit 80011 can also determine whether or not a player identified by the player ID is an owner of any racehorse. In addition, in the purchase reserved state described above, in the data table as shown in FIG. 70, for example, the racing game unit 80011 controls so that the character ID of the racehorse to be reserved can only be associated with the player ID of the player of that particular reservation.

In S80308, the sub control unit 80102 determines whether or not the racehorse designated by the player is purchasable. In this determination, the CPU 80131 makes a determination based on the data on the owner information received in S80307 above. Now, if the racehorse designated by the player is not purchasable (S80308: NO), the process returns to S80302 above. In contrast, if the racehorse designated by the player is purchasable (S80308: YES), the process proceeds to S80309.

In S80309, the sub control unit 80102 executes a payout process. In this process, by deducting credit amounts necessary for purchasing a racehorse from the player's own credit amount, the CPU 80131 updates not only the player's own credit amount stored in the RAM 80132 but also the display in the credit amount display area 80221 on the regular BET image or high BET image of the sub monitor 80113.

In S80310, the sub control unit 80102 executes an ownerships connections data generation process. In this process, the CPU 80131 generates a player ID according to predetermined rules. However, if an IC card 80119 is inserted into the reader/writer 80118, the CPU 80131 uses the player ID included in horse owner information 80501 (refer to FIG. 71 below) of the IC card 80119. In addition, the CPU 80131 links a character ID of a racehorse of the purchase object with its player ID.

In S80311, the sub control unit 80102 executes a character peculiar data random generation process. In this process, using random numbers, the CPU 80131 generates character peculiar data on characters of a racehorse of the purchase object.

Figures 70, 71:
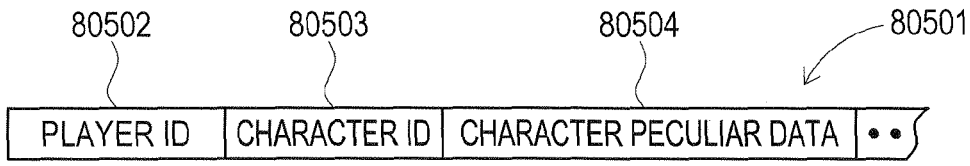
FIG. 70 is a view showing one example of a data table.
FIG. 71 is a view showing one example of horse owner information.

In S80312, the sub control unit 80102 executes a horse owner information generation process. In this process, the CPU 80131 generates horse owner information 80501 as shown in FIG. 71. In the horse owner information 80501, the character peculiar data generated in S80311 above is linked with the character ID and the player ID thereof that were linked to each other in S80310 above. In other words, the horse owner information 80501 includes the data 80502 on player ID generated in S80310 above, the data 80503 on the character ID of the racehorse of the purchase object, and the character peculiar data 80504 generated in S80311 above.

When the horse owner information 80501 is stored in the RAM 80132 by the CPU 80131, it is transmitted to the racing game unit 80011 at the same time. In the racing game unit 80011, the CPU 80041 stores the horse owner information 80501 in the RAM 80042 or the external memory device 80025, etc. In addition, in the racing game unit 80011, the CPU 80041 associates character IDs with player IDs based on the horse owner information 80501.

In S80313, the sub control unit 80102 executes an IC card issuing process. In this process, the CPU 80131 causes the IC card issuing device 80117 to issue an IC card 80119 storing the horse owner information 80501.

In S80314, the sub control unit 80102 determines whether or not to continue operation in the owner image of the sub monitor 80113. Now, if a player touches any part of the owner image within a predetermined period of time from when the IC card issuing device 80117 is caused to issue an IC card 80119, the CPU 80131 determines that the operation continues in the owner image of the sub monitor 80113. Therefore, in this determination, the CPU 80131 determines whether or not the player has touched any part of the owner image of the sub monitor 80113, based on a coordinate signal from the touch panel driving circuit 80122. Now, if the operation continues in the owner image of the sub monitor 80113 (S80314: YES), the process returns to S80302 above. In contrast, if the operation does not continue in the owner image of the sub monitor 80113 (S80314: NO), this owner process terminates.

Figure 66:
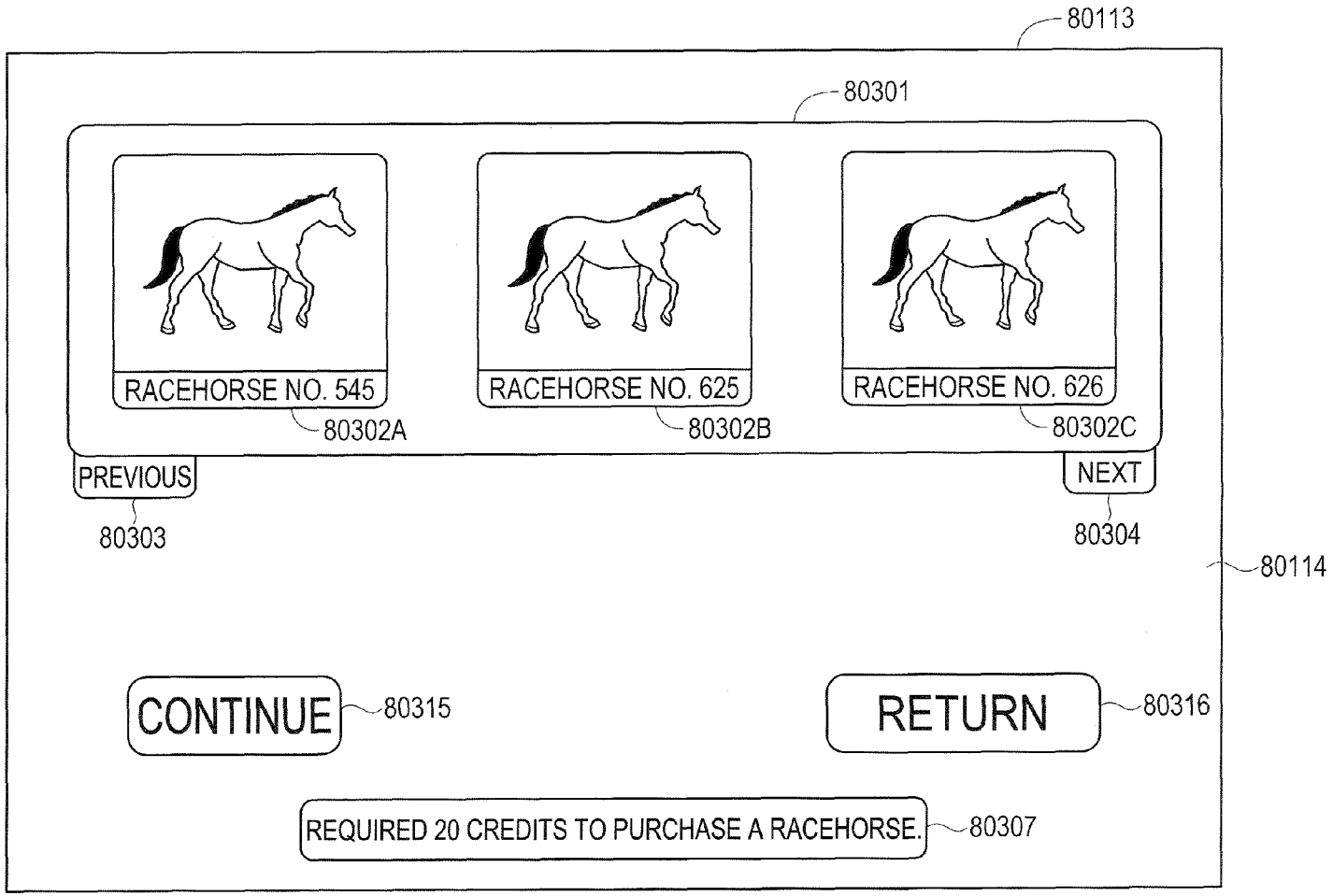
FIG. 66 is a front view showing one example of the owner image displayed on the sub monitor.

In this respect, the CPU 80131 may be such configured that the process of this S80314 is implemented, by providing a continue button 80315 or a return button 80316 in the owner image of the sub monitor 80113, as shown in FIG. 66.

When this owner process terminates, the sub monitor 80113 returns to the condition before this owner process starts. Therefore, the sub monitor 80113 displays the regular BET image above or the high BET image above.

3-7. Example of Operations for Making a Race Entry of a Player's Racehorse in a Racing Game (the Third Embodiment)

Figure 75:
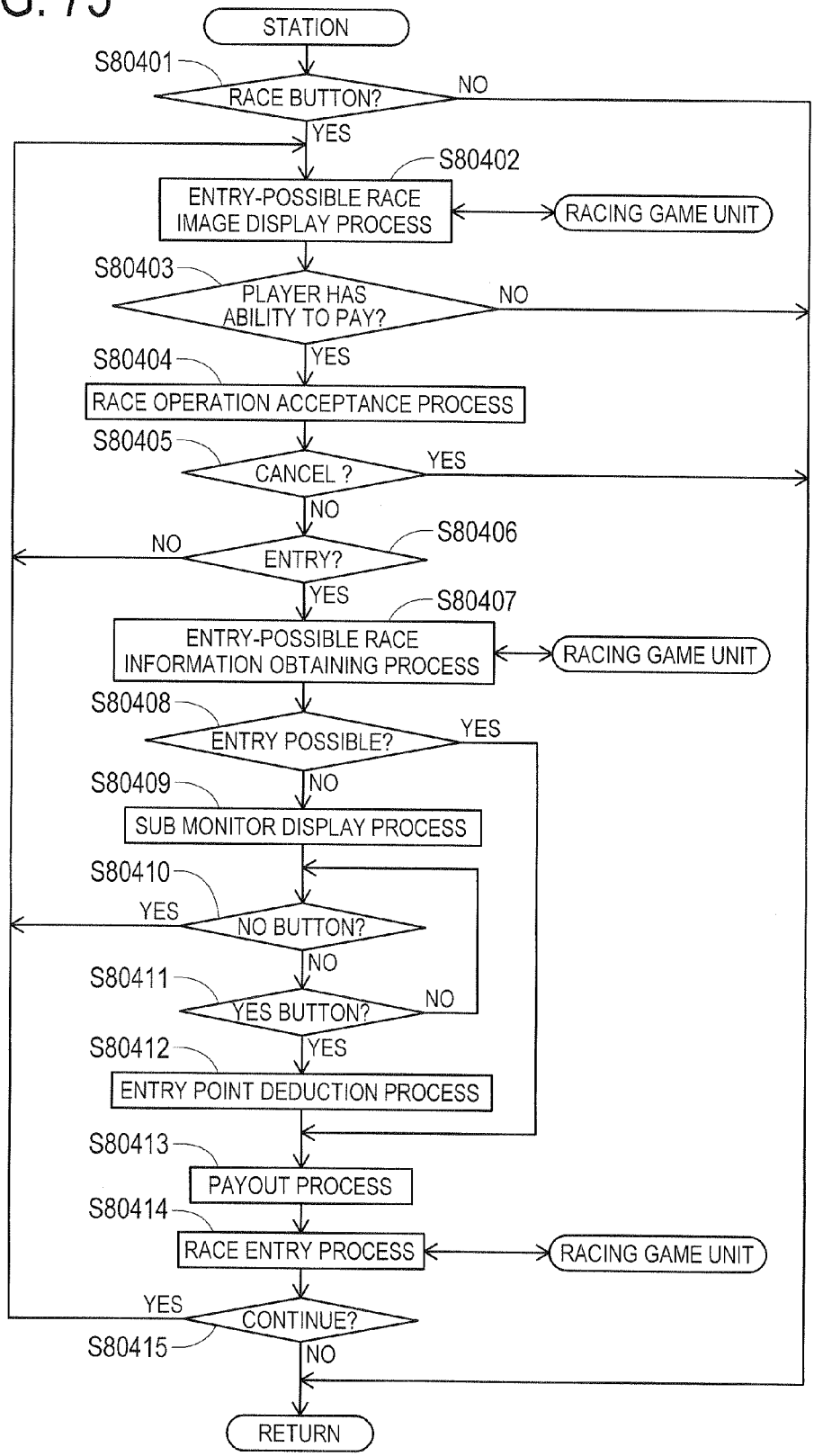
FIG. 75 is a flow chart diagram showing one example of an entry process.

In the following, the example of operations for making a race entry of a player's racehorse in a racing game in the horse race gaming machine 80001 according to this embodiment is described. FIG. 75 is a flow chart diagram showing one example of an entry process.

In the respective stations 80101, triggered by a player's touching the race button 80234 on the high BET image of the sub monitor 80113, the entry process is executed based on the flow chart of FIG. 75.

First, in S80401, the sub control unit 80102 determines whether or not a player has touched the race button 80234. In this determination, the CPU 80131 determines whether or not the player has touched the race button 80234 based on a coordinate signal from the touch panel driving circuit 80122. Now, if the player has not touched the race button 80234 (S80401: NO), this entry process terminates. In contrast, if the player has touched the race button 80234 (S80401: YES), the process proceeds to S80402.

Figure 67:
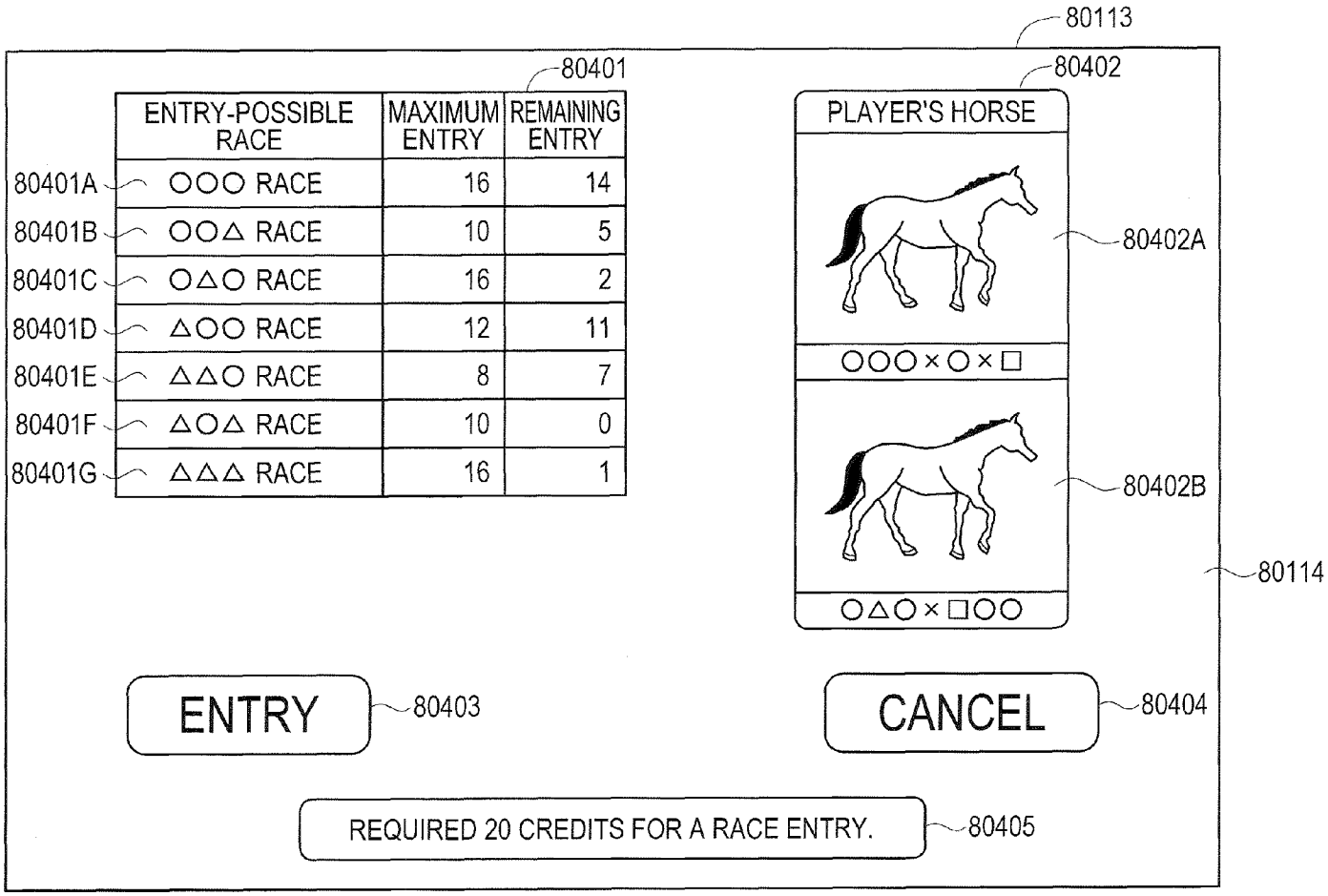
FIG. 67 is a front view showing one example of an entry-possible race image displayed on the sub monitor.
Figure 68:
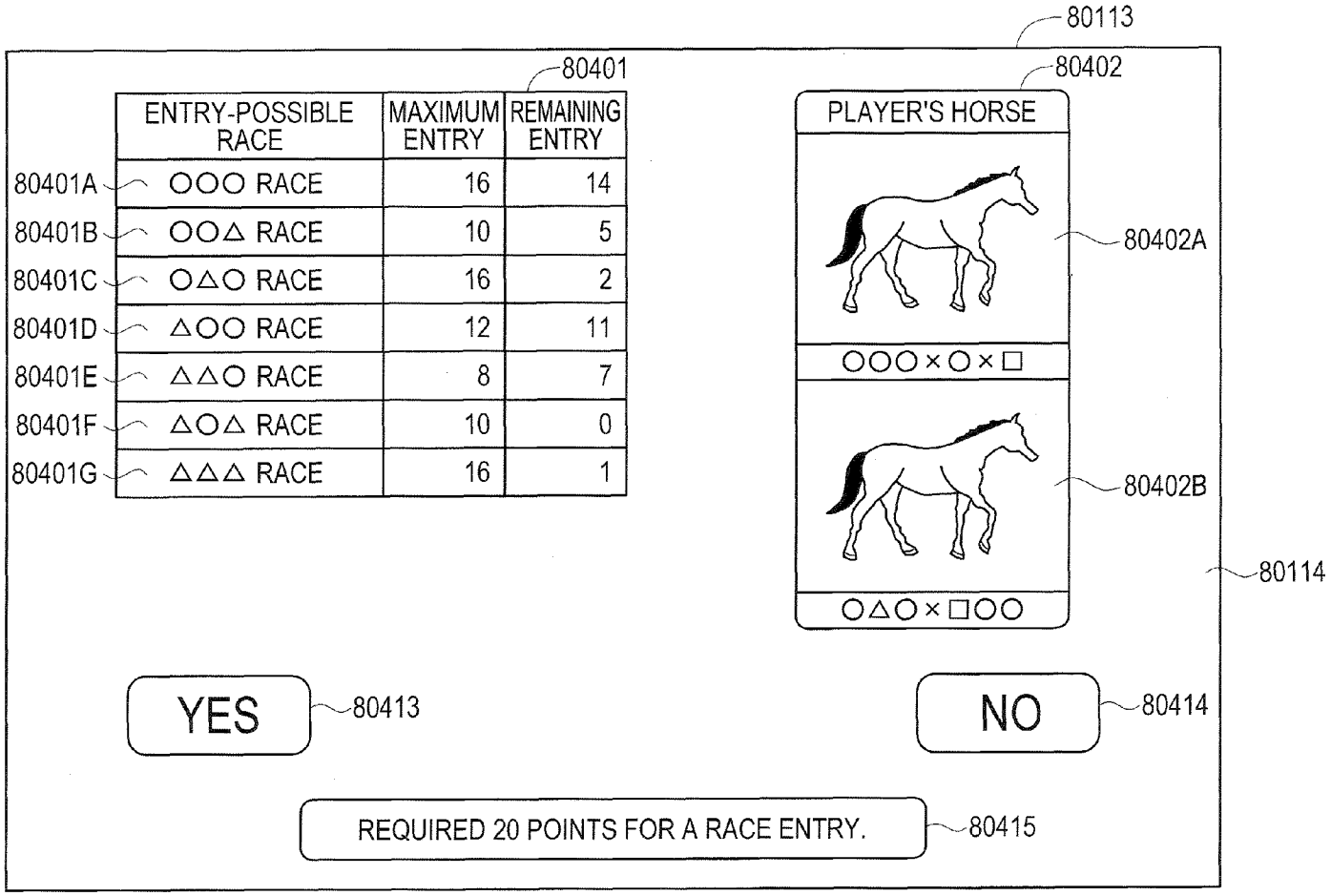
FIG. 68 is a front view showing one example of the entry-possible race image displayed on the sub monitor.

In S80402, the sub control unit 80102 executes an entry-possible race image display process. In this process, the CPU 80131 displays an entry-possible race image on the sub monitor 80113, based on the data on entry-possible race image information received through bidirectional communication with the racing game unit 80011. FIG. 67 and FIG. 68 show one example of the entry-possible race image displayed on the sub monitor 80113.

As shown in FIG. 67, in the entry-possible race image displayed on the sub monitor 80113 covered by the light transmissive colorless touch panel 80114 is provided an entry-possible race display area 80401, a player's horse display area 80402, an entry button 80403, a cancel button 80404 and a message display area 80405, etc.

In the entry-possible race display area 80401 is provided with respective columns for an entry possible race, a maximum entry, and a remaining entry. The entry possible race column displays a name of a racing game in which a race entry of a racehorse is possible. Parts where those names are displayed are used as designation buttons 80401A, 80401B, 80401C, 80401D, 80401E, 80401F, and 80401G for a player to designate a racing game. The maximum entry column displays the number of racehorses that run in a racing game.

The remaining entry column displays the number of racehorses that can make a race entry in a racing game.

The player's horse display area 80402 displays racehorses whose owner is a player. Parts in which those racehorses are displayed are used as designation buttons 80402A, 80402B for a player to designate a racehorse.

The data on the entry-possible race display area 80401 or the player's horse display area 80402 is included in the entry-possible race image information received through bidirectional communication with the racing game unit 80011 in S80402 above.

The entry button 80403 is a button that a player touches when he/she wishes to make a race entry of a designated racehorse in a designated racing game. The cancel button 80404 is a button that the player touches to stop race entry. The message display area 80405 displays a message "REQUIRED 20 CREDITS FOR A RACE ENTRY".

In S80403, the sub control unit 80102 determines whether or not the player has the ability to pay. As per the message displayed in the message display area 80405, in this embodiment, 20 credits are required to make a race entry of one racehorse. Therefore, in this determination, the CPU 80131 determines that the player has the ability to pay when the player's own credit amount stored in the RAM 80132 are not less than 20 credits. If the player has no ability to pay (S80403: NO), this entry process terminates. In contrast, if the player has the ability to pay (S80403: YES), the process proceeds to S80404.

In S80404, the sub control unit 80102 executes a race operation acceptance process. In this process, the CPU 80131 identifies the content of the player's operation in the entry-possible race image of the sub monitor 80113, based on a coordinate signal from the touch panel driving circuit 80122 and stores it in the RAM 80132. The CPU 80131 reflects the content of the player's operation in the display of the entry-possible race image of the sub monitor 80113.

In S80405, the sub control unit 80102 determines whether or not the player has touched the cancel button 80404. In this determination, the CPU 80131 determines whether or not the player has touched the cancel button 80404 based on a coordinate signal from the touch panel driving circuit 80122. Now, if the player has touched the cancel button 80404 (S80405: YES), this entry process terminates. In contrast, if the player has not touched the cancel button 80404 (S80405: NO), the process proceeds to S80406.

In S80406, the sub control unit 80102 determines whether or not the player has touched the entry button 80403. In this determination, the CPU 80131 determines whether or not the player has touched the entry button 80403 based on a coordinate signal from the touch panel driving circuit 80122. Now, if the player has not touched the entry button 80403 (S80406: NO), the process returns to S80402 above. In contrast, if the player has touched the entry button 80403 (S80406: YES), the process proceeds to S80407.

In S80407, the sub control unit 80102 executes an entry-possible race information obtaining process. In this process, the CPU 80131 receives entry-possible race information through bidirectional communication with the racing game unit 80011. This entry-possible race information includes data as a result of causing the racing game unit 80011 to check whether or not a racehorse designated by the player can make a race entry in a designated racing game. If the race entry is possible, the racing game unit 80011 puts that race entry into a reserved state.

In the racing game unit 80011, the CPU 80041 controls race entries of respective racing games by means of character IDs. For example, as per the data table shown in FIG. 72, a racing game and character IDs are associated. Such the data table is stored in the RAM 80042 or the external memory device 80025, etc.

In S80408, the sub control unit 80102 determines whether or not a racehorse designated by the player can make a race entry in a designated racing game. In this determination, the CPU 80131 makes a determination based on the data on the entry-possible race information received in S80407 above. Now, if the racehorse designated by the player can make a race entry in the designated racing game (S80408: YES), the process proceeds to S80413 below. In contrast, if the racehorse designated by the player cannot make a race entry in the designated racing game (S80408: NO), the process proceeds to S80409.

In this embodiment, it is possible to forcibly make a race entry in a racing game designated by a player (refer to S80414 below) on the condition that the player pays 20 points from the player's own entry points (refer to S80412 below), even though there is no longer any racehorse that can make a race entry in the racing game.

In S80409, the sub control unit 80102 executes a sub monitor display process. In this process, the CPU 80131 changes the entry-possible race image being displayed on the sub monitor 80113 to an entry-possible race image as shown in FIG. 68. In other words, instead of the entry button 80403, the cancel button 80404, and the message display area 80405 are provided a YES button 80413, a NO button 80414 and a message display area 80415.

The YES button 80413 is a button that the player touches to ensure race entry of a designated racehorse in a designated racing game. The NO button 80414 is a button that the player touches to stop race entry of a designated racehorse in a designated racing game. The message display area 80415 displays the message "REQUIRED 20 POINTS FOR A RACE ENTRY".

In S80410, the sub control unit 80102 determines whether or not the player has touched the NO button 80414. In this determination, the CPU 80131 determines whether or not the player has touched the NO button 80414 based on a coordinate signal from the touch panel driving circuit 80122. Now, if the player has touched the NO button 80414 (S80410: YES), the process returns to S80402 above. Then, the CPU 80131 causes the racing game unit 80011 to cancel the reservation of the race entry described above, by transmitting a control signal to the racing game unit 80011. In contrast, if the player has not touched the NO button 80414 (S80410: NO), the process proceeds to S80411.

In S80411, the sub control unit 80102 determines whether or not the player has touched the YES button 80413. In this determination, the CPU 80131 determines whether or not the player has touched the YES button 80413, based on a coordinate signal from the touch panel driving circuit 80122. Now, if the player has not touched the YES button 80413 (S80411: NO), the process returns to S80410 above. In contrast, if the player has touched the YES button 80413 (S80411: YES), the process proceeds to S80412.

In S80412, the sub control unit 80102 executes an entry point deduction process. In this process, by deducting from the player's own entry points the points necessary to make a race entry in a racing game, the CPU 80131 updates not only the player's own entry points stored in the RAM 80132 but also the display in the entry point display area 80231 on the high BET image of the sub monitor 80113.

In this respect, all of the player's own entry points may be deducted.

It is to be noted that the sub control unit 80102 skips a payout process of S80413 below, if this entry point deduction process is executed.

In S80413, the sub control unit 80102 executes the payout process. In this process, by deducting credit amounts necessary for making a race entry in a racing game from the player's own credit amount, the CPU 80131 updates not only the player's own credit amount stored in the RAM 80132 but also the display in the credit amount display area 80221 on the high BET image of the sub monitor 80113.

In S80414, the sub control unit 80102 executes a race entry process. In this process, when storing in the RAM 80132 race entry information including data on race entry determination, etc. (data showing player IDs or character IDs, or determinations), the CPU 80131 simultaneously transmits it to the racing game unit 80011. In the racing game unit 80011, the CPU 80041 associates a racing game with a character ID based on data on this information. In particular, if the player has paid 20 points from the player's own entry points, a race entry in the racing game is forcibly done. The racing game unit 80011 may enable this forcible race entry by increasing the number of racehorses to run the racing game, or by replacing any of the racehorses that have already been registered, with it.

In S80415, the sub control unit 80102 determines whether or not operation continues in the entry-possible race image of the sub monitor 80113. Now, if the player touches any part of the entry-possible race image of the sub monitor 80113 within a predetermined period of time from when the player touched the YES button 80413, the CPU 80131 determines that the operation continues in the entry-possible race image of the sub monitor 80113. Now, if the operation continues in the entry-possible race image of the sub monitor 80113 (S80415: YES), the process returns to S80402 above. In contrast, if the operation does not continue in the entry-possible race image of the sub monitor 80113 (S80415: NO), this entry process terminates.

When this entry process terminates, the sub monitor 80113 returns to the condition before the entry process starts. Therefore, the sub monitor 80113 displays the high BET image above.

3-8. A Right to be Able to Become a Racehorse Owner is Awarded (the Third Embodiment)

In the horse race gaming machine 80001 of this embodiment, if the racehorse whose owner is any one of players playing at the respective stations 80101 finishes in the first place in this racing game, a right to be able to become a racehorse owner is awarded to the player who is an owner of the racehorse which finishes in the first place in this racing game.

For that purpose, in each of the racing game unit 80011, the main control unit 80012 executes each of the processes described in the flow chart of FIG. 57 at the point P80001 that comes immediately after S81007 of FIG. 73 above.

Firstly, in S80501, the sub control unit 80102 determines whether or not the racehorse whose owner is a player who is playing at this station 80101 finishes in the first place in this racing game. In this determination, the CPU 80131 makes a determination based on the racing game payout information transmitted in S81006 above, the player ID of the player, etc. It is to be noted that the player ID of the player is identified through the processes of S80202, S80203, S80204, etc. of FIG. 76 above. Now, if the racehorse whose owner is the player has not finished in the first place in this racing game (S80501: NO), the game operations described in the flow chart of FIG. 57 is terminated to return to the game operations described in the flow chart of FIG. 73. In contrast, if the racehorse whose owner is the player has finished in the first place in this racing game (S80501: YES), the process proceeds to S80502.

In S80502, the sub control unit 80102 executes an owner image display process. In this process, the CPU 80131 displays an owner image on the sub monitor 80113 based on the data on owner image information received through bidirectional communication with the racing game unit 80011. FIG. 65 shows one example of the owner image displayed on the sub monitor 80113.

In S80503, the sub control unit 80102 executes an owner's operation acceptance process. In this process, the CPU 80131 identifies the content of the player's BET operation in the owner image of the sub monitor 80113, based on a coordinate signal from the touch panel driving circuit 80122, and stores it in the RAM 80132. The CPU 80131 reflects the content of the player's BET operation in the display of the owner image of the sub monitor 80113.

In S80504, the sub control unit 80102 determines whether or not the player has touched the cancel button 80306. In this determination, the CPU 80131 determines whether or not the player has touched the cancel button 80306 based on a coordinate signal from the touch panel driving circuit 80122. Now, if the player has touched the cancel button 80306 (S80504: YES), this owner process terminates. In contrast, if the player has not touched the cancel button 80306 (S80504: NO), the process proceeds to S80505.

In S80505, the sub control unit 80102 determines whether or not the player has touched the purchase button 80305. In this determination, the CPU 80131 determines whether or not the player has touched the purchase button 80305 based on a coordinate signal from the touch panel driving circuit 80122. Now, if the player has not touched the purchase button 80305 (S80505: NO), the process returns to S80502 above. In contrast, if the player has touched the purchase button 80305 (S80505: YES), the process proceeds to S80506.

In S80506, the sub control unit 80102 executes an owner information obtaining process. In this process, the CPU 80131 receives owner information through bidirectional communication with the racing game unit 80011. This owner information includes data obtained as a result of causing the racing game unit 80011 to check whether or not the racehorse designated by the player is purchasable. If the racehorse is purchasable, the racing game unit 80011 puts the racehorse into purchase reserved state to prevent other player from purchasing the racehorse.

In the purchase reserved state described above, in the data table as shown in FIG. 70, for example, the racing game unit 80011 controls so that the character ID of the racehorse to be reserved can only be associated with the player ID of the player of that particular reservation.

In S80507, the sub control unit 80102 determines whether or not the racehorse designated by the player is purchasable. In this determination, the CPU 80131 makes a determination based on the data on the owner information received in S80506 above. Now, if the racehorse designated by the player is not purchasable (S80507: NO), the process returns to S80502 above. In contrast, if the racehorse designated by the player is purchasable (S80507: YES), the process proceeds to S80508.

In S80508, the sub control unit 80102 executes an ownerships connections data generation process. In this process, the CPU 80131 generates a player ID according to predetermined rules. However, if an IC card 80119 is inserted into the reader/writer 80118, the CPU 80131 uses the player ID included in the horse owner information 80501 (refer to FIG. 71 above) of the IC card 80119. In addition, the CPU 80131 links a character ID of a racehorse of the purchase object with its player ID.

In S80509, the sub control unit 80102 executes a character peculiar data random generation process. In this process, using random numbers, the CPU 80131 generates character peculiar data on characters of a racehorse of the purchase object.

In S80510, the sub control unit 80102 executes a horse owner information generation process. In this process, the CPU 80131 generates horse owner information 80501 as shown in FIG. 71. In the horse owner information 80501, the character peculiar data generated in S80509 above is linked with the character ID and the player ID thereof that were linked to each other in S80508 above. In other words, the horse owner information 80501 includes the data 80502 on player ID generated in S80508 above, the data 80503 on the character ID of the racehorse of the purchase object, and the character peculiar data 80504 generated in S80509 above.

When the horse owner information 80501 is stored in the RAM 80132 by the CPU 80131, it is transmitted to the racing game unit 80011 at the same time. In the racing game unit 80011, the CPU 80041 stores the horse owner information 80501 in the RAM 80042 or the external memory device 80025, etc. In addition, in the racing game unit 80011, the CPU 80041 associates character IDs with player IDs based on the horse owner information 80501.

In S80511, the sub control unit 80102 executes an IC card issuing process. In this process, the CPU 80131 causes the IC card issuing device 80117 to issue an IC card 80119 storing the horse owner information 80501.

In S80512, the sub control unit 80102 determines whether or not to continue operation in the owner image of the sub monitor 80113. Now, if a player touches any part of the owner image within a predetermined period of time from when the IC card issuing device 80117 is caused to issue an IC card 80119, the CPU 80131 determines that the operation continues in the owner image of the sub monitor 80113. Therefore, in this determination, the CPU 80131 determines whether or not the player has touched any part of the owner image of the sub monitor 80113, based on a coordinate signal from the touch panel driving circuit 80122. Now, if the operation continues in the owner image of the sub monitor 80113 (S80512: YES), the process returns to S80502 above. In contrast, if the operation does not continue in the owner image of the sub monitor 80113 (S80512: NO), the game operations described in the flow chart of FIG. 57 is terminated to return to the game operations described in the flow chart of FIG. 73.

In this respect, the CPU 80131 may be such configured that the process of this S80512 is implemented, by providing a continue button 80315 or a return button 80316 in the owner image of the sub monitor 80113, as shown in FIG. 66.

When the game operations described in the flow chart of FIG. 57 is terminated to return to the game operations described in the flow chart of FIG. 3, the sub monitor 80113 returns to the condition before the game operations described in the flow chart of FIG. 57 starts. Therefore, the sub monitor 80113 displays the regular BET image above or the high BET image above.

3-9. The First Operation Example for Making a Race Entry of a Player's Racehorse in a Racing Game in which a Right to be Able to Become a Racehorse Owner is Awarded (the Third Embodiment)

In the horse race gaming machine 80001 of this embodiment, as was described earlier, a racing game in which a right to be able to become a racehorse owner is awarded is every time hold. However, it is possible to configure to hold recognizably from the beginning a racing game in which a right to be able to become a racehorse owner is awarded and a racing game in which the right is not awarded. For that purpose, in each of the racing game unit 80011, the main control unit 80012 performs the game operations described in the flow chart of FIG. 57 only in case that a racing game in which a right to be able to become a racehorse owner is awarded is held.

Furthermore, in case that a racing game in which a right to be able to become a racehorse owner is awarded and a racing game in which a right to be able to become a racehorse owner is not awarded are held recognizably from the beginning, a player can make a race entry of his/her racehorse in a racing game in which a right to be able to become a racehorse owner is awarded by conducting a first exemplary operation as will be described. FIG. 81 is a flow chart diagram showing one example of entry process.

Incidentally, at each of the stations 80101, as shown in FIG. 80, a race entry button 80241 is additionally displayed on the regular BET image of the sub monitor 80113. The race entry button 80241 includes a YES button and a NO button. This point is the same as on the high BET image of the sub monitor 80113, not shown in figures. This display control is executed in S80201 or S80208 of FIG. 76 above.

Figure 76:
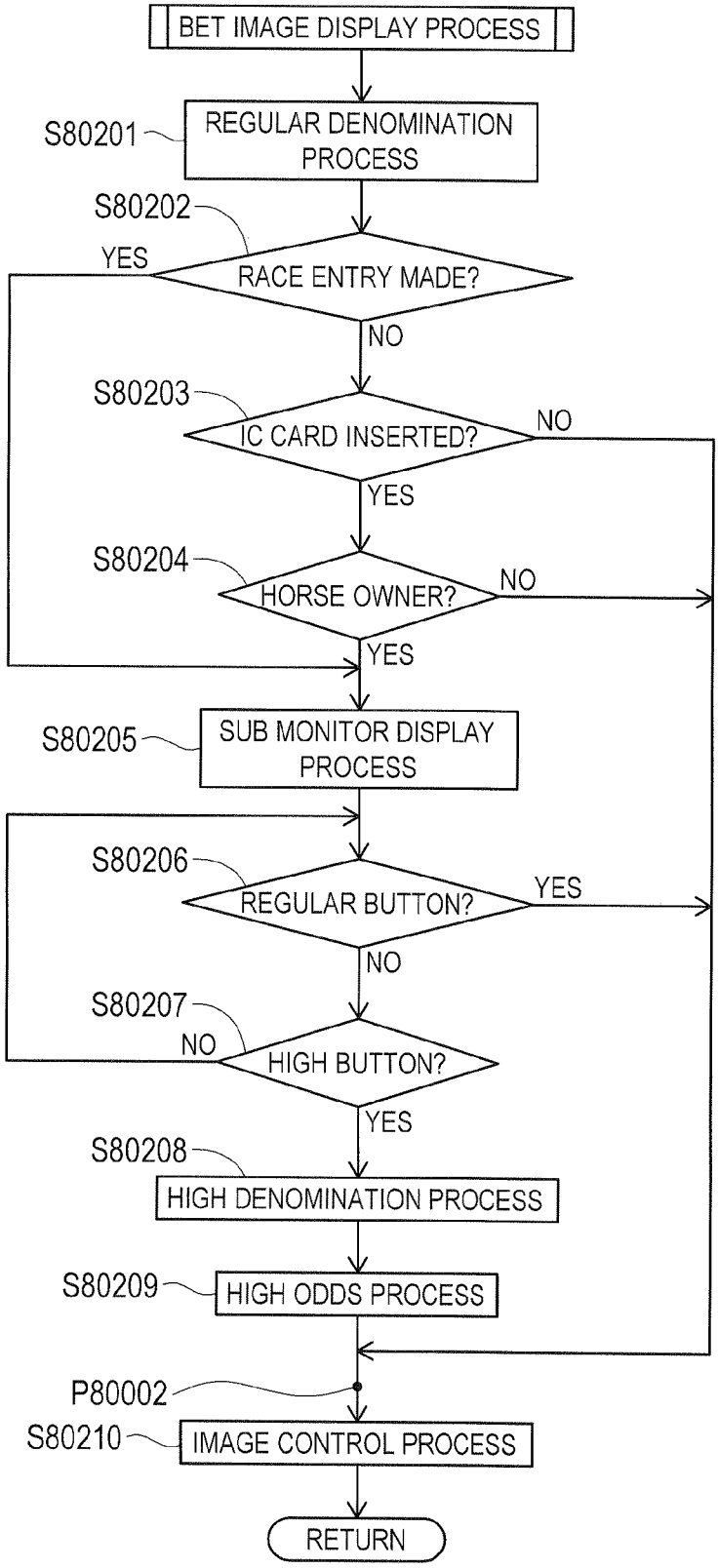
FIG. 76 is a flow chart diagram showing one example of game operations in the horse race gaming machine.
Figure 81:
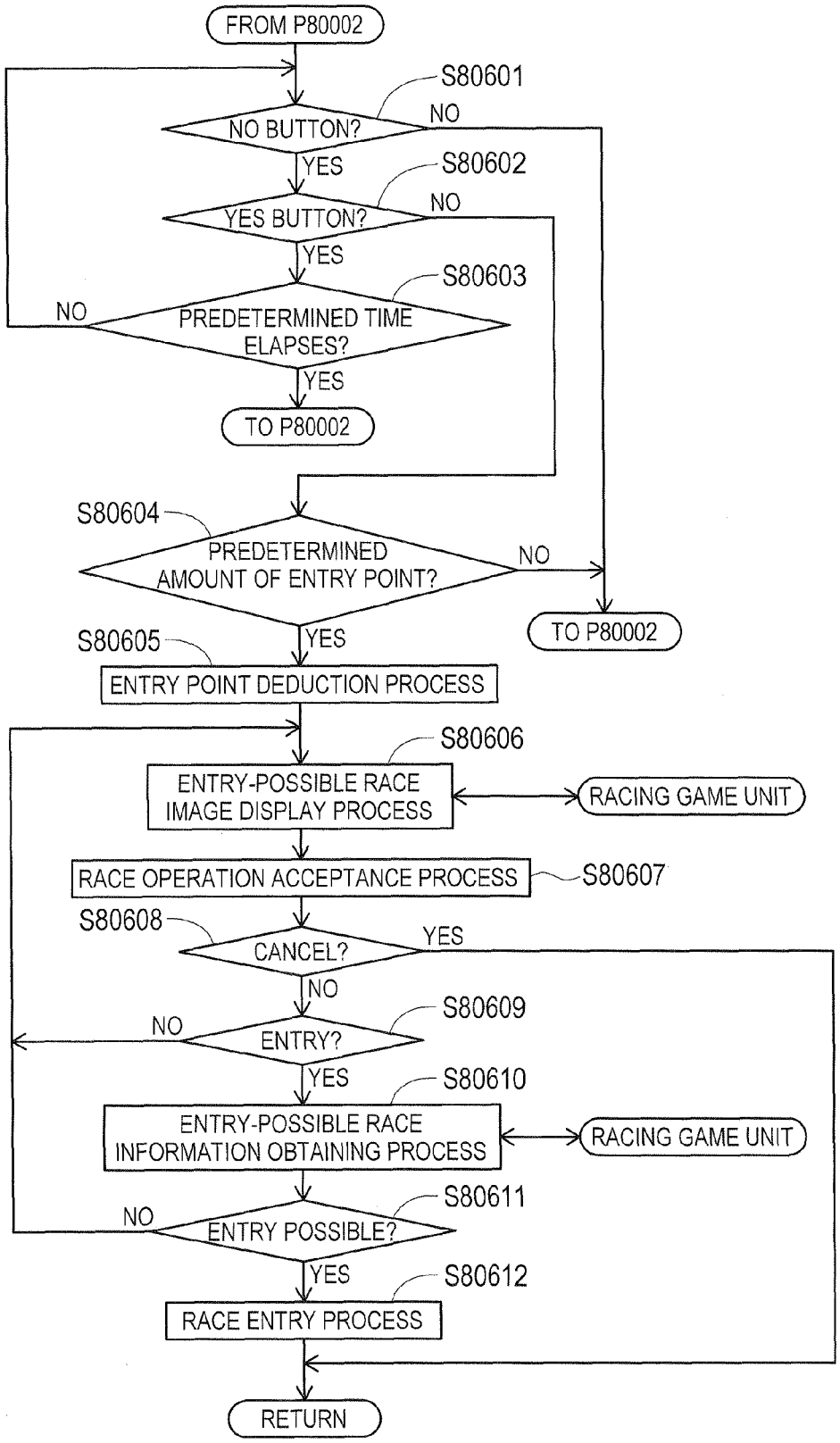
FIG. 81 is a flow chart diagram showing one example of an entry process.

First, at each of the stations 80101, the sub control unit 80102 executes respective processes described in the flow chart of FIG. 81, at the point P80002 just before S80210 of FIG. 76 above.

First, in S80601, the sub control unit 80102 determines whether or not the player has touched the NO button. In this determination, the CPU 80131 determines whether or not the player has touched the NO button included in the race entry button 800241, based on a coordinate signal from the touch panel driving circuit 80122. Now, if the player has touched the NO button (S80601: YES), this entry process is terminated to proceed to S80210 of FIG. 76 above. In contrast, if the player has not touched the NO button (S80601: NO), the process proceeds to S80602.

In S80602, the sub control unit 80102 determines whether or not the player has touched the YES button. In this determination, the CPU 80131 determines whether or not the player has touched the YES button included in the race entry button 800241, based on a coordinate signal from the touch panel driving circuit 80122. Now, if the player has touched the YES button (S80602: YES), the process proceeds to S80604 below. In contrast, if the player has not touched the YES button (S80602: NO), the process proceeds to S80603.

In S80603, the sub control unit 80102 determines whether or not a predetermined time from the point P80002 just before S80210 of FIG. 76 above has elapsed. In this determination, the CPU 80131 checks the clock until the predetermined time has elapsed. Now, if the predetermined time has elapsed (S80603: YES), this entry process is terminated to proceed to S80210 of FIG. 76 above. In contrast, if the predetermined time has not elapsed (S80603: NO), the process returns to S80601 above. Namely, until the predetermined time has elapsed (S80603: YES), each determination process of S80601 through S80603 above will be repeated before the player touches any one of the YES button and the NO button included in the race entry button 80241.

In S80604, the sub control unit 80102 determines whether or not the player's own entry points are at least a predetermined amount or not. In this embodiment, as described above, it requires 20 points to make a race entry of one racehorse (refer to FIG. 68 above, etc.). Accordingly, in this determination, the CPU 80131 determines whether or not at least 20 points are stored in the RAM 80132 as the player's own entry points. Now, if the player's own entry points are less than the predetermined amount (S80604: NO), this entry process is terminated to proceed to S80210 of FIG. 76 above. In contrast, if the player's own entry points are the predetermined amount or more (S80604: YES), the process proceeds to S80605.

In S80605, the sub control unit 80102 executes an entry point deduction process. In this process, by deducting from the player's own entry points the points necessary to make a race entry in a racing game, the CPU 80131 updates not only the player's own entry points stored in the RAM 80132 but also the display in the entry point display area 80231 on the high BET image of the sub monitor 80113.

In this respect, all of the player's own entry points may be deducted.

In S80606, the sub control unit 80102 executes an entry-possible race image display process. In this process, the CPU 80131 displays the entry-possible race image on the sub monitor 80113, based on the data on entry-possible race image information received through bidirectional communication with the racing game unit 80011. However, in the racing game unit 80011, the main control unit 80012 includes to the entry-possible race image information only the information of a racing game in which a right to be able to become a racehorse owner is awarded. FIG. 67 above and FIG. 68 above show one example of the entry-possible race image displayed on the sub monitor 80113.

In S80607, the sub control unit 80102 executes a race operation acceptance process. In this process, the CPU 80131 identifies the content of the player's operation in the entry-possible race image of the sub monitor 80113, based on a coordinate signal from the touch panel driving circuit 80122 and stores it in the RAM 80132. The CPU 80131 reflects the content of the player's operation in the display of the entry-possible race image of the sub monitor 80113.

In S80608, the sub control unit 80102 determines whether or not the player has touched the cancel button 80404. In this determination, the CPU 80131 determines whether or not the player has touched the cancel button 80404 based on a coordinate signal from the touch panel driving circuit 80122. Now, if the player has touched the cancel button 80404 (S80608: YES), this entry process is terminated to proceed to S80210 of FIG. 76 above. In contrast, if the player has not touched the cancel button 80404 (S80608: NO), the process proceeds to S80609.

In S80609, the sub control unit 80102 determines whether or not the player has touched the entry button 80403. In this determination, the CPU 80131 determines whether or not the player has touched the entry button 80403 based on a coordinate signal from the touch panel driving circuit 80122. Now, if the player has not touched the entry button 80403 (S80609: NO), the process returns to S80606 above. In contrast, if the player has touched the entry button 80403 (S80609: YES), the process proceeds to S80610.

In S80610, the sub control unit 80102 executes an entry-possible race information obtaining process. In this process, the CPU 80131 receives entry-possible race information through bidirectional communication with the racing game unit 80011. This entry-possible race information includes data as a result of causing the racing game unit 80011 to check whether or not a racehorse designated by the player can make a race entry in a designated racing game. If the race entry is possible, the racing game unit 80011 puts that race entry into a reserved state.

In S80611, the sub control unit 80102 determines whether or not a racehorse designated by the player can make a race entry in a designated racing game. In this determination, the CPU 80131 makes a determination based on the data on the entry-possible race information received in S80610 above. Now, if the racehorse designated by the player cannot make a race entry in the designated racing game (S80611: NO), the process returns to S80606 above. In contrast, if the racehorse designated by the player can make a race entry in the designated racing game (S80611: YES), the process proceeds to S80612.

In S80612, the sub control unit 80102 executes a race entry process. In this process, when storing in the RAM 80132 race entry information including data on race entry determination, etc. (data showing player IDs or character IDs, or determinations), the CPU 80131 simultaneously transmits it to the racing game unit 80011. In the racing game unit 80011, the CPU 80041 associates a racing game with a character ID based on data on this information.

As above mentioned, the player can make a race entry of the player's racehorse in a racing game in which a right to be able to become a racehorse owner is awarded, under the condition of payment of entry points.

After that, this entry process is terminated to proceed to S80210 of FIG. 76 above.

When this entry process terminates, the sub monitor 80113 returns to the condition before the entry process starts. Therefore, the sub monitor 80113 displays the regular BET image above or the high BET image above.

3-10. The Second Operation Example for Making a Race Entry of a Player's Racehorse in a Racing Game in which a Right to be Able to Become a Racehorse Owner is Awarded (the Third Embodiment)

Next, here will be described the second operation example for making a race entry of a player's racehorse in a racing game in which a right to be able to become a racehorse owner is awarded, in case that, similar to the first exemplary operation, a racing game in which a right to be able to become a racehorse owner is awarded and a racing game in which a right to be able to become a racehorse owner is not awarded are held recognizably from the beginning, in the horse race gaming machine 80001 of this embodiment. FIG. 83 is a flow chart diagram showing one example of entry process.

Figure 82:
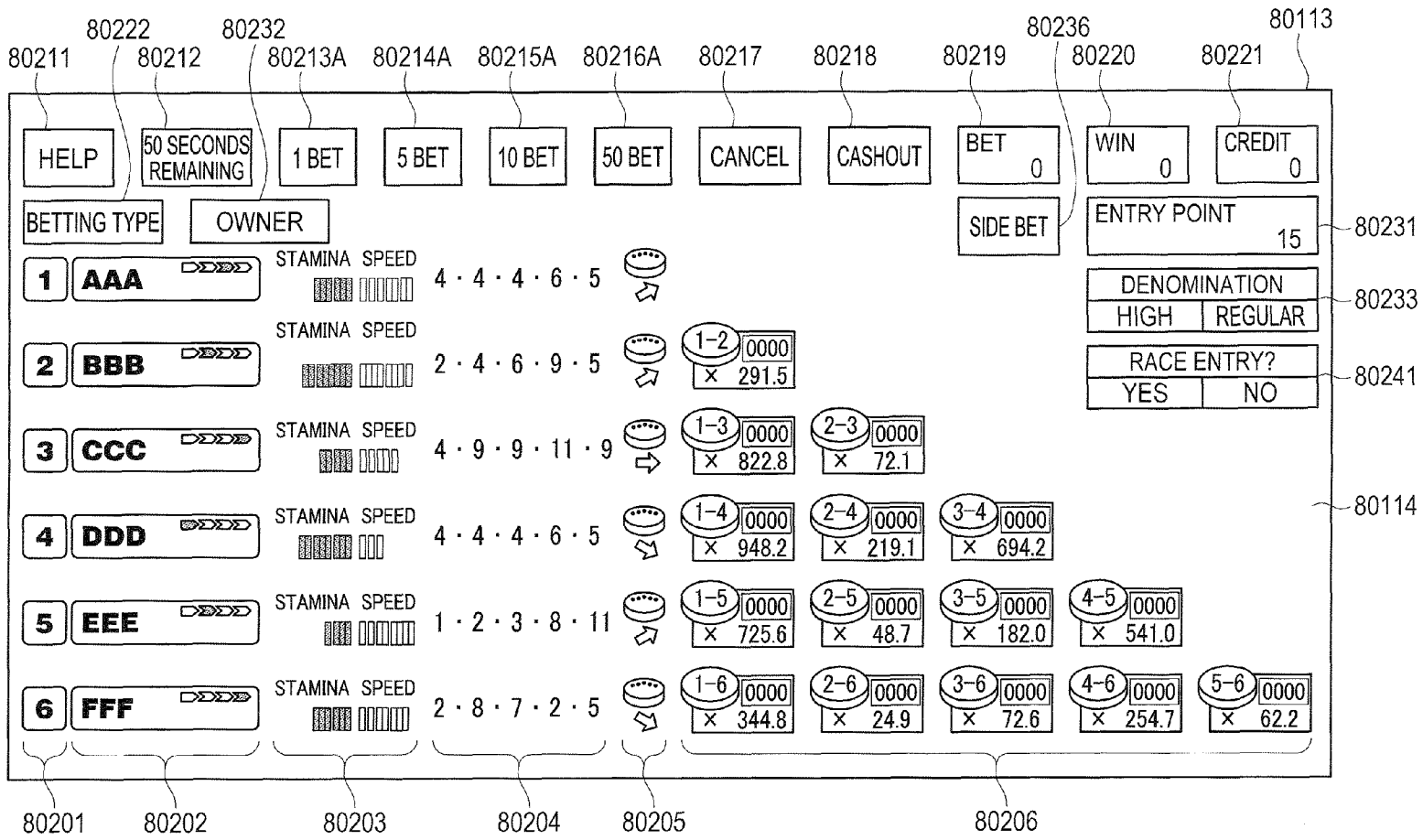
FIG. 82 is a front view showing one example of the regular BET image displayed on the sub monitor.

Incidentally, at each of the stations 80101, as shown in FIG. 82, a side bet button 80236 is additionally displayed on the regular BET image of the sub monitor 80113. This point is the same as on the high BET image of the sub monitor 80113, not shown in figures. This display control is executed in S80201 or S80208 of FIG. 76 above.

Figure 83:
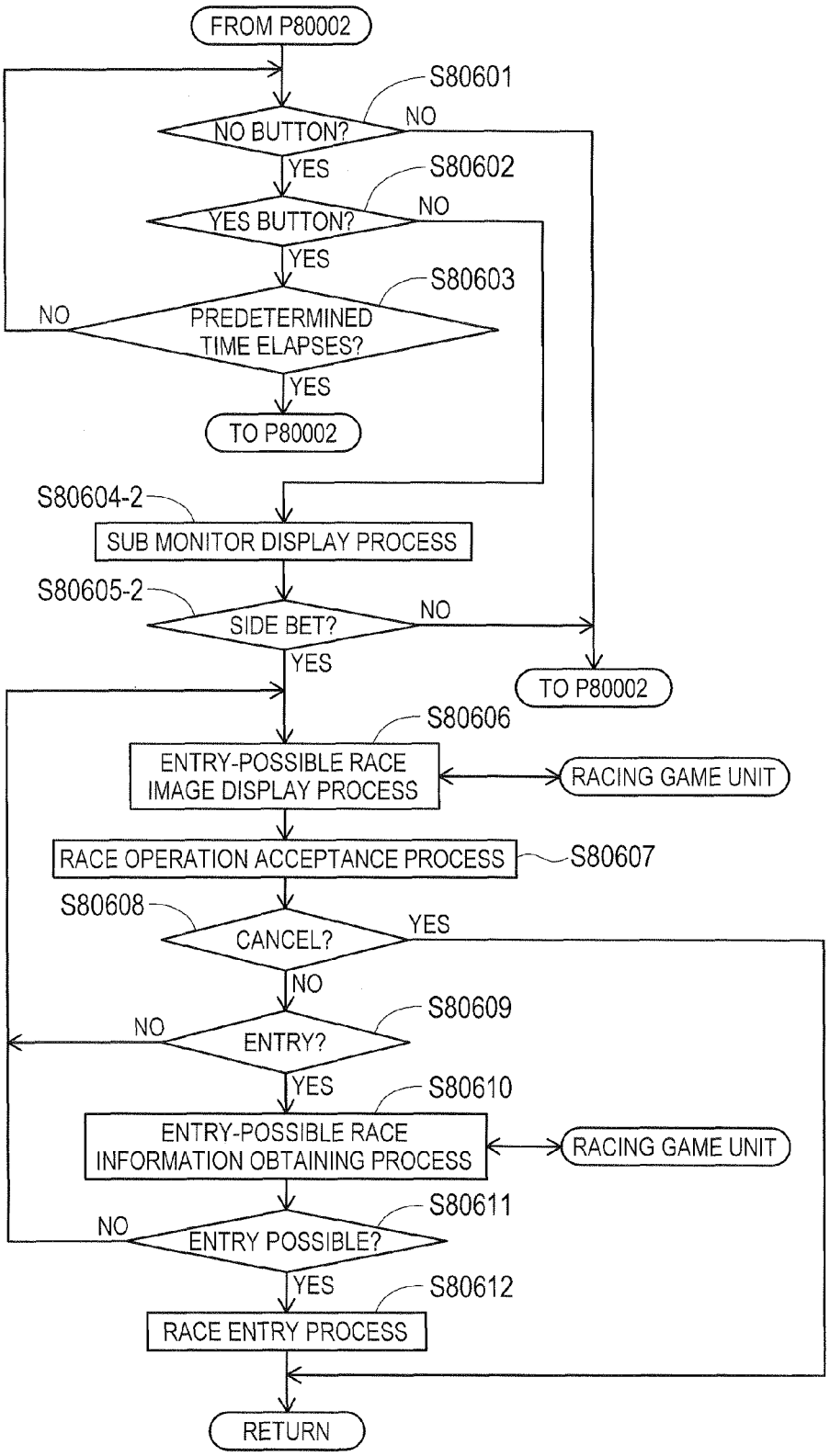
FIG. 83 is a flow chart diagram showing one example of an entry process.

First, at each of the stations 80101, the sub control unit 80102 executes respective processes described in the flow chart of FIG. 83, at the point P80002 just before S80210 of FIG. 76 above. However, respective processes described in the flow chart of FIG. 83 are the same as respective processes described in the flow chart of the above FIG. 81 except the following differences. Therefore, in FIG. 83, a process which is the same as a process described in the flow chart of FIG. 81 has the same reference numeral as the process described in the flow chart of FIG. 81. The differences only are described below.

Namely, in S80602 of FIG. 83, if the player has touched the YES button (S80602: YES), the process proceeds to S80604-2.

Figure 84:
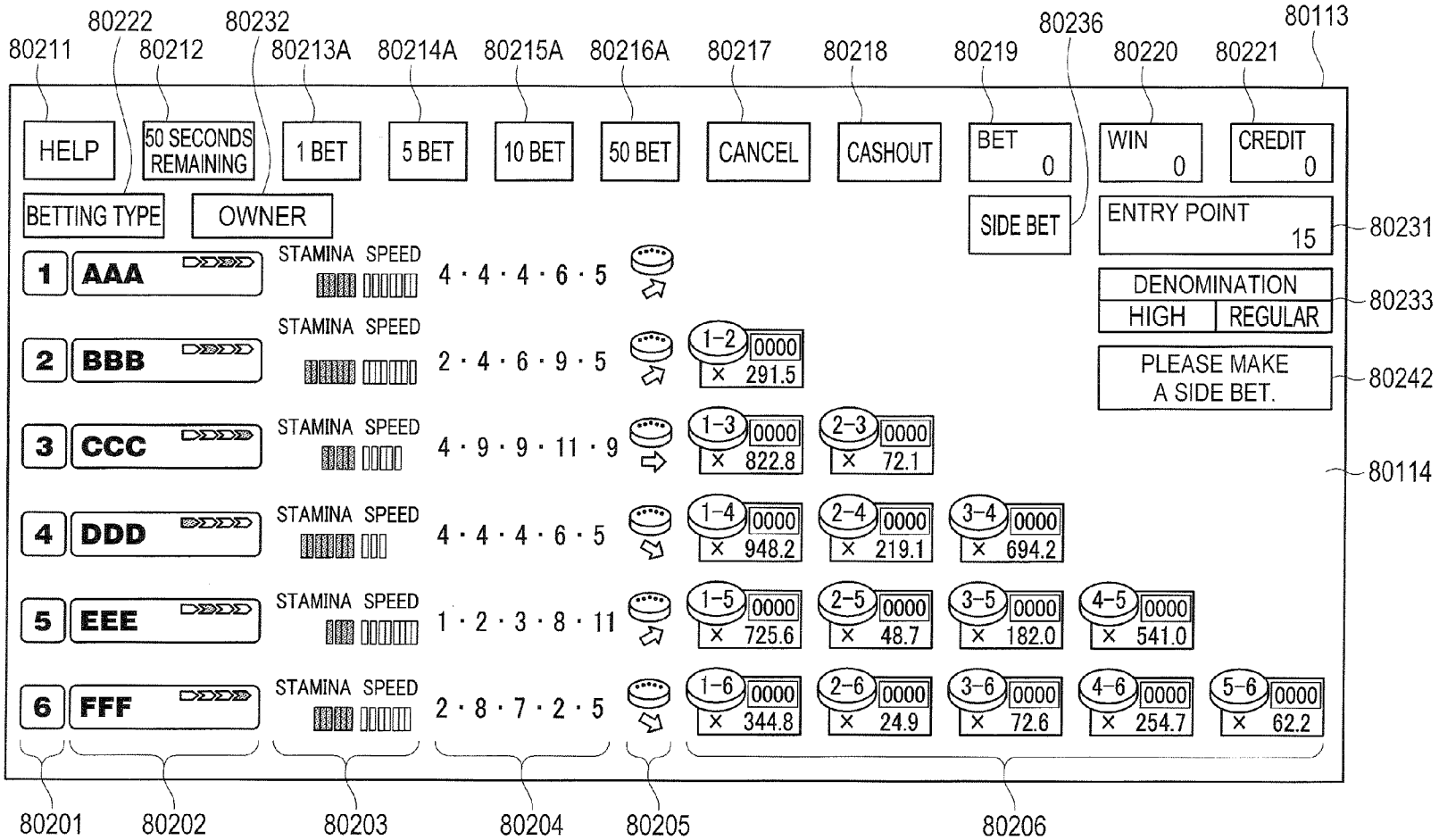
FIG. 84 is a front view showing one example of the regular BET image displayed on the sub monitor.

In S80604-2, the sub control unit 80102 executes a sub monitor display process. In this process, the CPU 80131 additionally displays a message display area 80242 as shown in FIG. 84 in the regular BET image displayed on the sub monitor 80113. The message "PLEASE MAKE A SIDE BET." is displayed in the message display area 80242. This display control is the same as in the high BET image displayed on the sub monitor 80113, not shown in figures.

In S80605-2, the sub control unit 80102 determines whether or not a side bet is made after the elapse of a predetermined time. In this determination, the CPU 80131 determines whether or not the player has touched the side bet button 80236 based on a coordinate signal from the touch panel driving circuit 80122. Now, if a side bet is not made (S80605-2: NO), this entry process is terminated to proceed to S80210 of FIG. 76 above. In contrast, if a side bet is made (S80605-2: YES), the process proceeds to S80606.

As above mentioned, the player can make a race entry of the player's racehorse in a racing game in which a right to be able to become a racehorse owner is awarded, under the condition of making a side bet.

Also, in S80606, in the racing game unit 80011, the main control unit 80012 includes to the entry-possible race image information only the information of a racing game in which a right to be able to become a racehorse owner is awarded, as above mentioned. Here, if the CPU 80041 is configured to limit the information of a racing game in which a right to be able to become a racehorse owner is awarded to the information of a racing game in which only a player who has made a side bet can make a race entry, it is possible to allow only racehorses which are owned by players who have made a side bet to run in a racing game in which a right to be able to become a racehorse owner is awarded. However, if the CPU 80131 of the station 80101 adds data showing that a player has made a side bet into the information transmitted in S80606 from each of the stations 80101 to the racing game unit 80011, it can be determined whether or not the player has made a side bet.

3-11. Others (the Third Embodiment)

In addition, the present invention is not limited to the above third embodiment, but various changes may be made without departing from its scope.

For example, the characteristics of the present invention can be implemented even when configuration is such that the BET operations on a racing game result are limited to those before the racing game.

Furthermore, in the horse race gaming machine 80001 of this embodiment, it is possible to configure to award a right to become a racehorse owner to a player who has won the highest payout in this racing game among the players who are playing at respective stations 80101.

Figure 87:
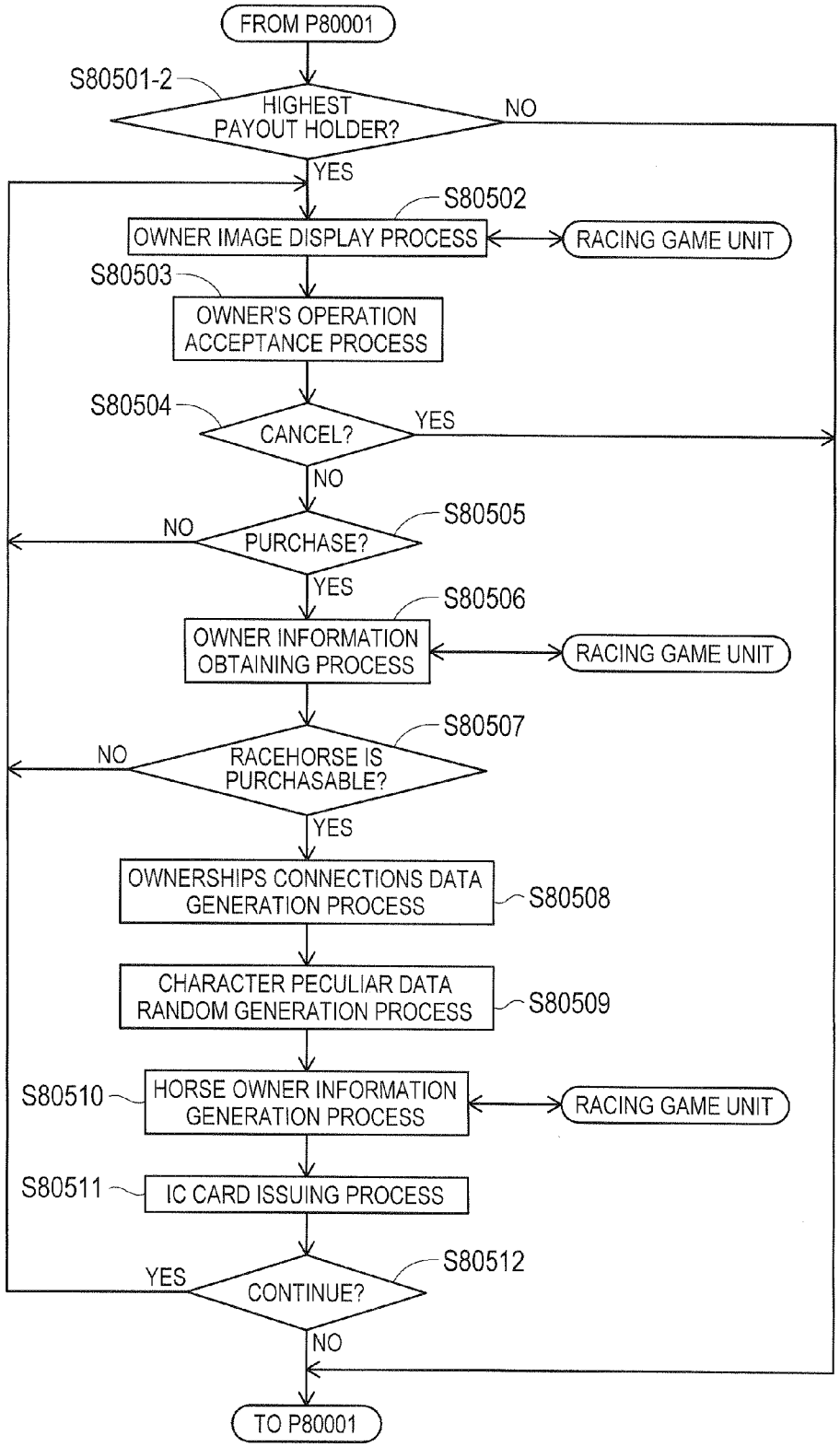
FIG. 87 is a flow chart diagram showing one example of game operations in the horse race gaming machine.

For that purpose, at each of the stations 80101, the sub control unit 80102 executes each of the processes described in the flow chart of FIG. 87 at the point P80001 that comes immediately after S81007 of FIG. 73 above. However, respective processes described in the flow chart of FIG. 87 are the same as respective processes described in the flow chart of the above FIG. 57 except the following differences. Therefore, in FIG. 87, a process which is the same as a process described in the flow chart of FIG. 57 has the same reference numeral as the process described in the flow chart of FIG. 57. The differences only are described below.

Namely, in S80501-2 of FIG. 87, the sub control unit 80102 determines whether or not the player has won the highest payout in this racing game. In this determination, the CPU 80131 makes the determination based on the racing game payout information transmitted in S81006 of FIG. 73 above, the player ID of the player, etc. It is to be noted that the player ID of the player is identified through the processes of S80202, S80203, S80204, etc. of FIG. 76 above. Now, if the player has not won the highest payout in this racing game (S80501-2: NO), the game operations described in the flow chart of FIG. 87 is terminated to return to the game operations described in the flow chart of FIG. 73. In contrast, if the player has won the highest payout in this racing game (S80501-2: YES), the process proceeds to S80502.

Figures 88, 89:
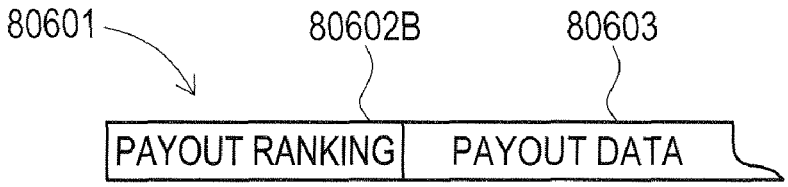
FIG. 88 is a view showing one example of a data table.
FIG. 89 is a view showing one example of racing game payout information.

In this time, in the racing game unit 80011, the CPU 80041 generates a data table as shown in FIG. 88 in S81005 of FIG. 73 above. In the data table shown in FIG. 88, each payout amount is stored corresponding to a station number. Such the data table is stored in the RAM 80042 or the external memory device 80025, etc.

Furthermore, in the racing game unit 80011, the CPU 80041 adds payout ranking to the racing game payout information which is transmitted to each of stations 80101.

It is to be noted that the CPU 80041 can calculate payout ranking by re-arranging each payout amount shown in the data table of FIG. 88 above, i.e., from highest to lowest order or from lowest to highest order. FIG. 89 shows one example of racing game payout information including payout ranking. The racing game payout information 80601 shown in FIG. 89 includes data 602B showing payout ranking of the station 80101, payout data 603, etc.

In the horse race gaming machine 80001 of this embodiment, it may be configured to randomly hold a racing game in which a right to be able to become a racehorse owner is awarded. For that purpose, at each of the stations 80101, the sub control unit 80102 executes each of the processes described in the flow chart of FIG. 85 at the point P80001 that comes immediately after S81007 of FIG. 73 above.

Here, a racing game in which a right to be able to become a racehorse owner is awarded is termed "special racing game" whereas other types of racing games are termed "normal racing game".

Firstly, in S80701, the sub control unit 80102 executes a random process. In this process, the CPU 80131 obtains a random number from a random number range between "0" and "255" by sampling random number in accordance with an operation program.

In S80702, the sub control unit 80102 determines whether or not to define this racing game as game special game. In this determination, the CPU 80131 determines whether or not to define this racing game as game special game by using the one random number obtained in S80701 above and a data table as shown in FIG. 86.

Figures 85, 86:
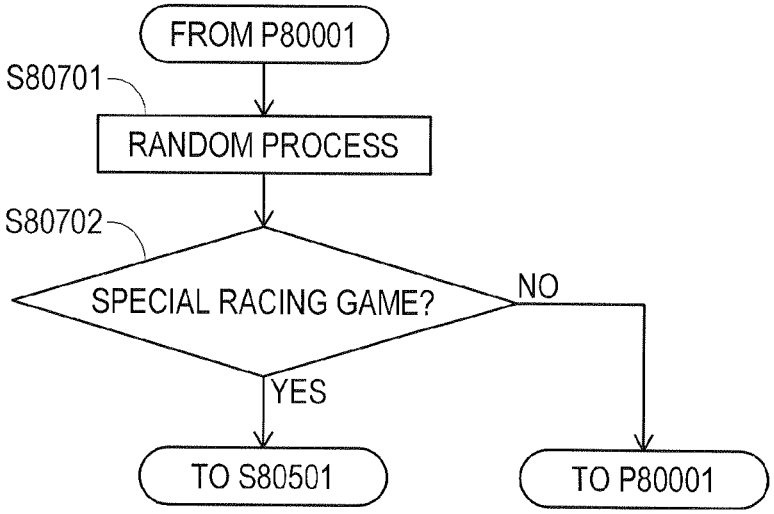
FIG. 85 is a flow chart diagram showing one example of game operations in the horse race gaming machine.
FIG. 86 is a view showing one example of a data table.

In the data table shown in FIG. 86, each of the random numbers in the range between "0" and "255" is associated with either special racing game or normal racing game. Such the data table is stored in the ROM 80133, etc.

Now, if the CPU 80131 determines to define this racing game as special racing game (S80702: YES), the process proceeds to S80501 of FIG. 57 above. In contrast, if the CPU 80131 determines to define this racing game as normal racing game (S80702: NO), the process returns to the game operations described in the flow chart of FIG. 73 without executing each of the processes described in the flow chart of FIG. 57.

With the above, a racing game to award a right to be able to become a racehorse owner is held randomly.

4-1. Characteristics of a Horse Race Gaming Machine (the Fourth Embodiment)

In the following, a description is made on the fourth embodiment of the present invention with reference to drawings.

Figure 91:
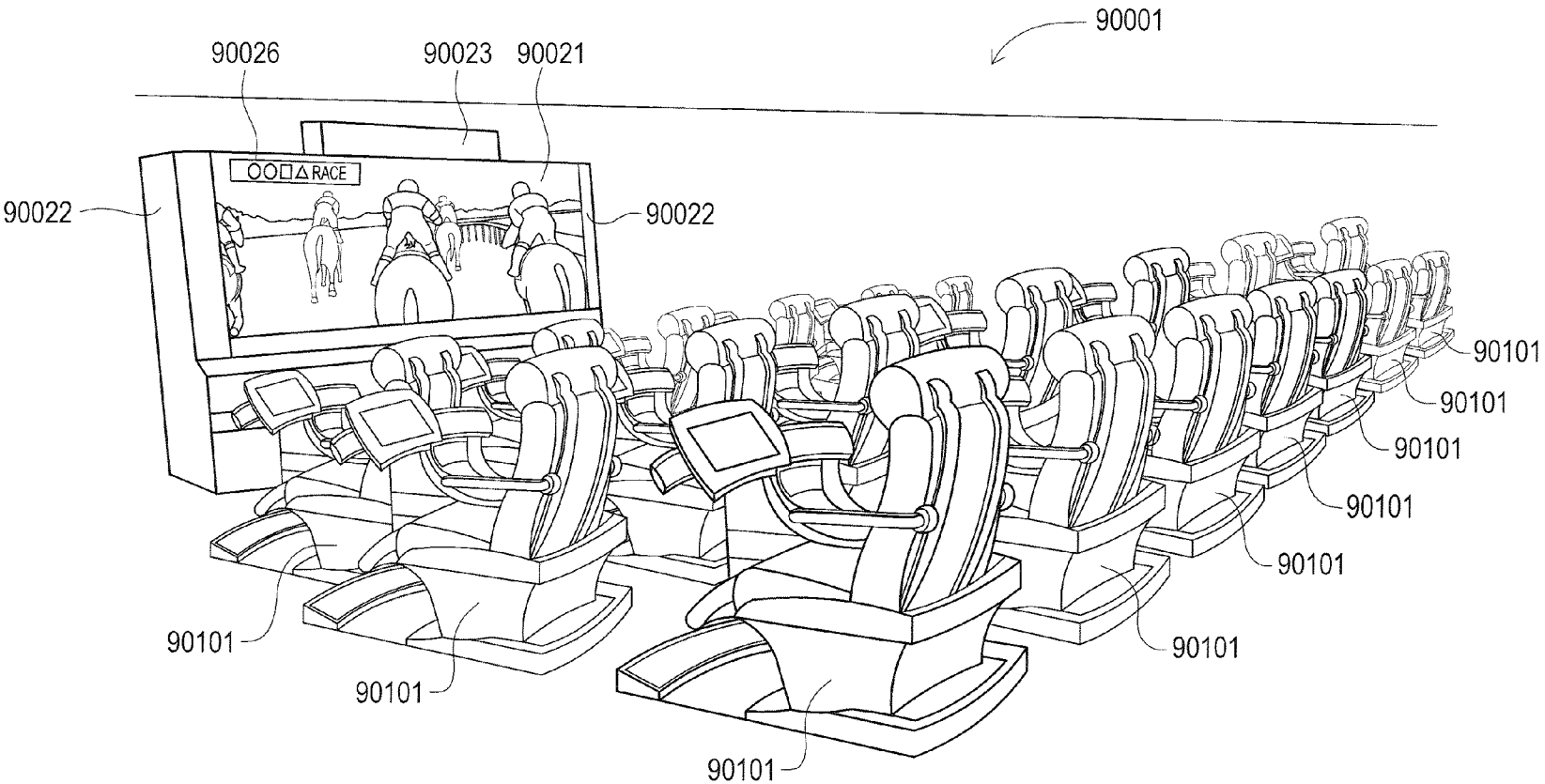
FIG. 91 is a perspective view of the horse race gaming machine.
Figure 92:
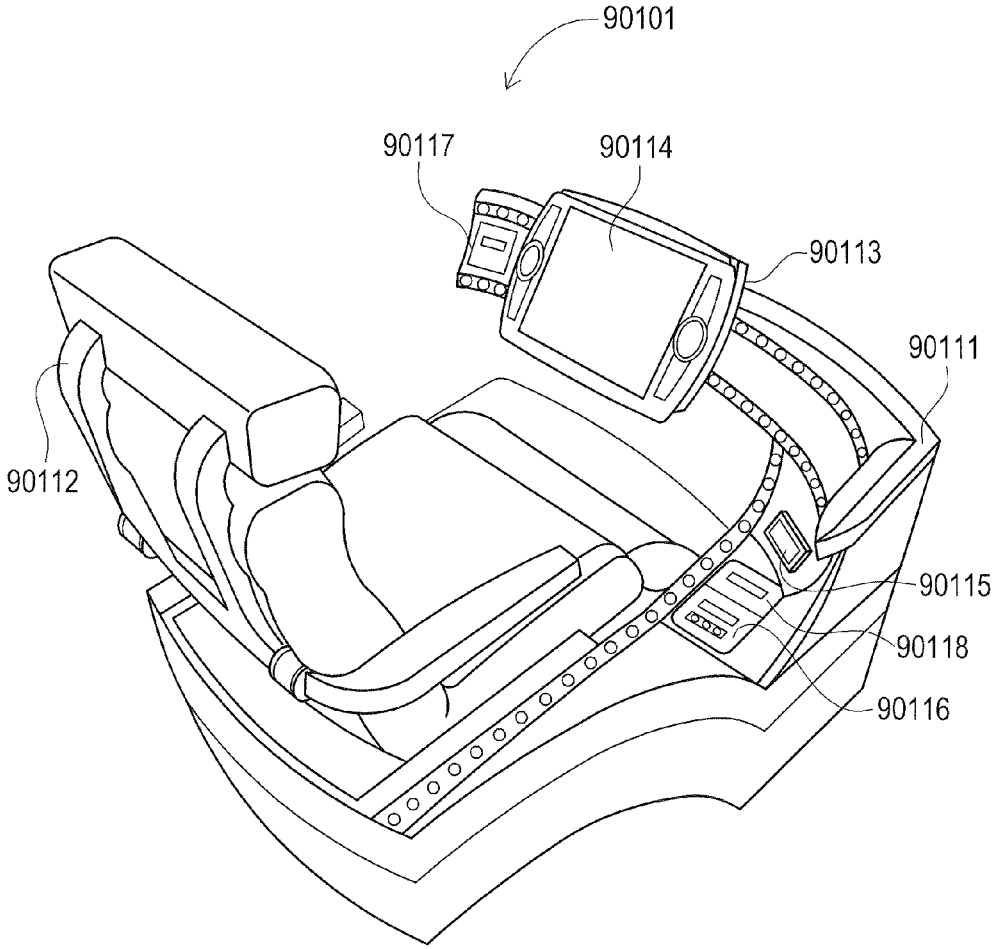
FIG. 92 is a perspective view of a station.

FIG. 91 is a perspective view of a horse race gaming machine 90001 that is one embodiment of the present invention. As shown in FIG. 91, the horse race gaming machine 90001 of this embodiment has a main monitor 90021 and a plurality of stations 90101. The main monitor 90021 displays images of a horse racing game. Players being seated at the respective stations 90101 can respectively participate in this horse racing game. The players being seated at the respective stations 90101 participate in this horse racing game by forecasting a result of each racing game of the horse racing game and performing BET operations. Namely, a horse racing game is constituted of a number of racing games that are intermittently executed in a sequential manner. FIG. 92 is a perspective view of the station 90101. A sub monitor 90113 or a touch panel 90114 that each station 90101 is provided with is used to perform BET operations.

In this respect, in the horse race gaming machine 90001 of this embodiment, BETting on racing game result can be performed before or during the racing game.

Figure 90:
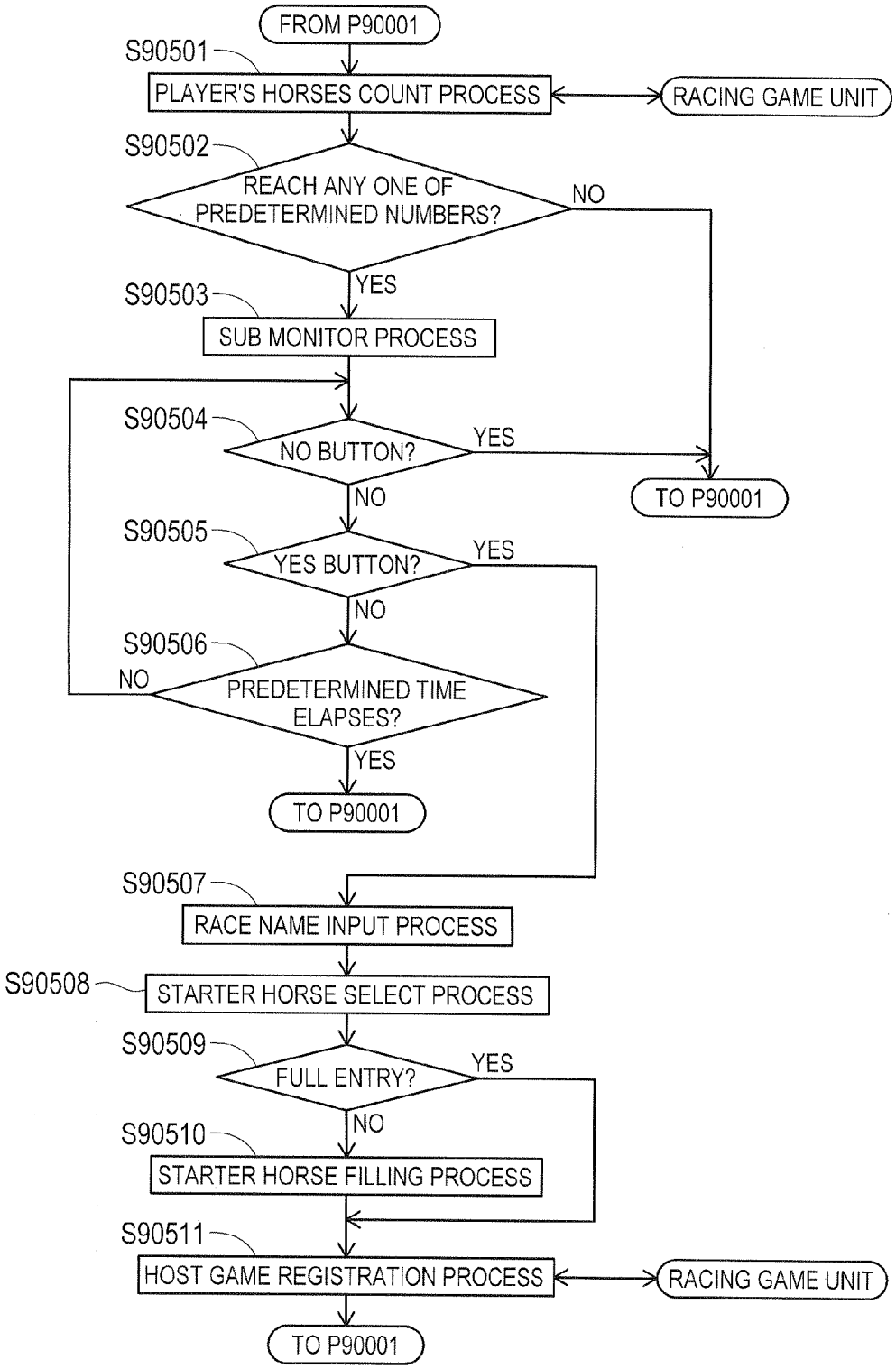
FIG. 90 is a view showing characteristics of a horse race gaming machine of the fourth embodiment of the present invention and a flow chart diagram showing one example of game operations in the horse race gaming machine.

FIG. 90 is a view showing characteristics of the horse race gaming machine 90001 of this embodiment and a flow chart diagram showing one example of game operations in the horse race gaming machine 90001. In the horse race gaming machine 90001 of this embodiment, every time the number of the racehorses whose owner is a player reaches any one of "10", "20", "30", "40" and "50" for the first time (S90502: YES), if the player wishes (S90505: YES), a racing game of which host is the player will be held (S90511).

Figure 117:
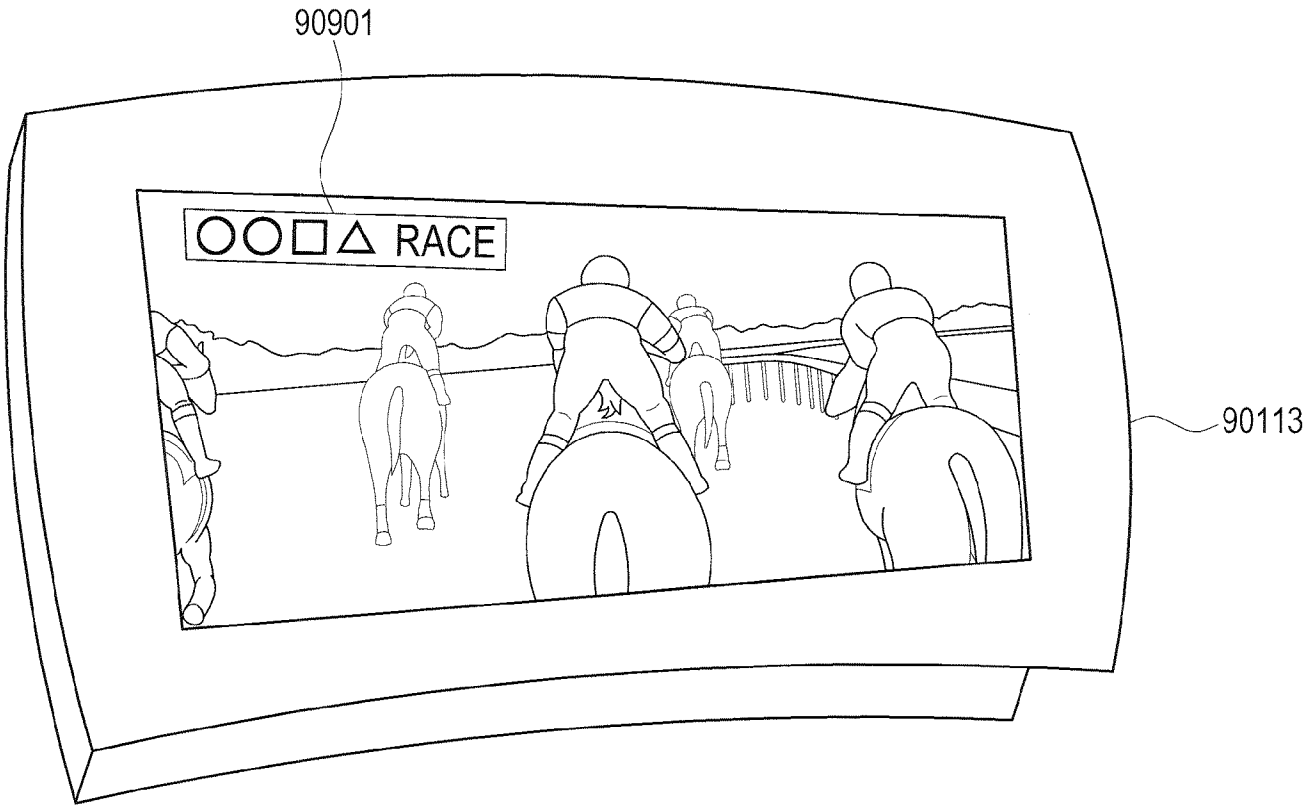
FIG. 117 is a front view showing one example of an image of a horse racing game displayed on a main monitor.

The player can designate a racehorse which runs in the racing game of which host is the player, from among the player's own racehorses (S90508). Also, the player can give a race name to the racing game of which host is the player (S90507). Incidentally, the given race name is displayed on the main monitor 90021 or the sub monitor 90113 while the racing game of which host is the player is being performed (see reference numeral 90026 in FIG. 91 above and reference numeral 90901 in FIG. 117 below).

4-2. Appearance of a Horse Race Gaming Machine (the Fourth Embodiment)

As shown in FIG. 91, the horse race gaming machine 90001 of this embodiment has the main monitor 90021, speakers 90022, a display device 90023, the plurality of stations 90101, etc. The main monitor 90021 displays images of a horse racing game, etc. The speakers 90022 output sound of a horse racing game, etc. The display device 90023 displays information about games in general.

As shown in FIG. 92, in each station 90101, a cabinet 90111 is provided with a chair 90112, the sub monitor 90113, the touch panel 90114, a bill identifying device 90115, a ticket printer 90116, an IC card issuing device 90117, a reader/writer 90118, etc. A player sits on the chair 90112. The sub monitor 90113 displays BET images described later, etc. The touch panel 90114 is provided on the screen of the sub monitor 90113. When the player performs the BET operations utilizing the regular BET image described later or the high BET image described later or the player performs specific operations utilizing an owner image described later or an entry-possible race image described later, the touch panel 90114 is used.

The bill identifying device 90115 not only identifies whether or not a bill is appropriate but also receives legitimate bills into the cabinet 90111. Then, bills inserted into the cabinet 90111 are converted into the number of coins, and the credit amount that corresponds to the converted number of coins is added as the player's own credit amount. The bill identifying device 90115 is also configured to be capable of reading bar coded tickets described later.

The ticket printer 90116 is a printer that prints on a ticket a bar code representative of coded data such as a player's own credit amount, date, identification number of the station 90101, etc. and outputs it as a bar coded ticket. A player can have the outputted bar coded ticket read by other station 90101 and play at this other station 90101, or use it for any procedure in predetermined places in a game arcade.

The IC card issuing device 90117 is a device that issues an IC card 90119 (refer to FIG. 94 below) on which horse owner information 90501 (refer to FIG. 104 below) is stored. The IC card 90119 (refer to FIG. 94 below) is inserted into the reader/writer 90118.

4-3. Example of Configuration of a Racing Game Unit (the Fourth Embodiment)

Figure 93:
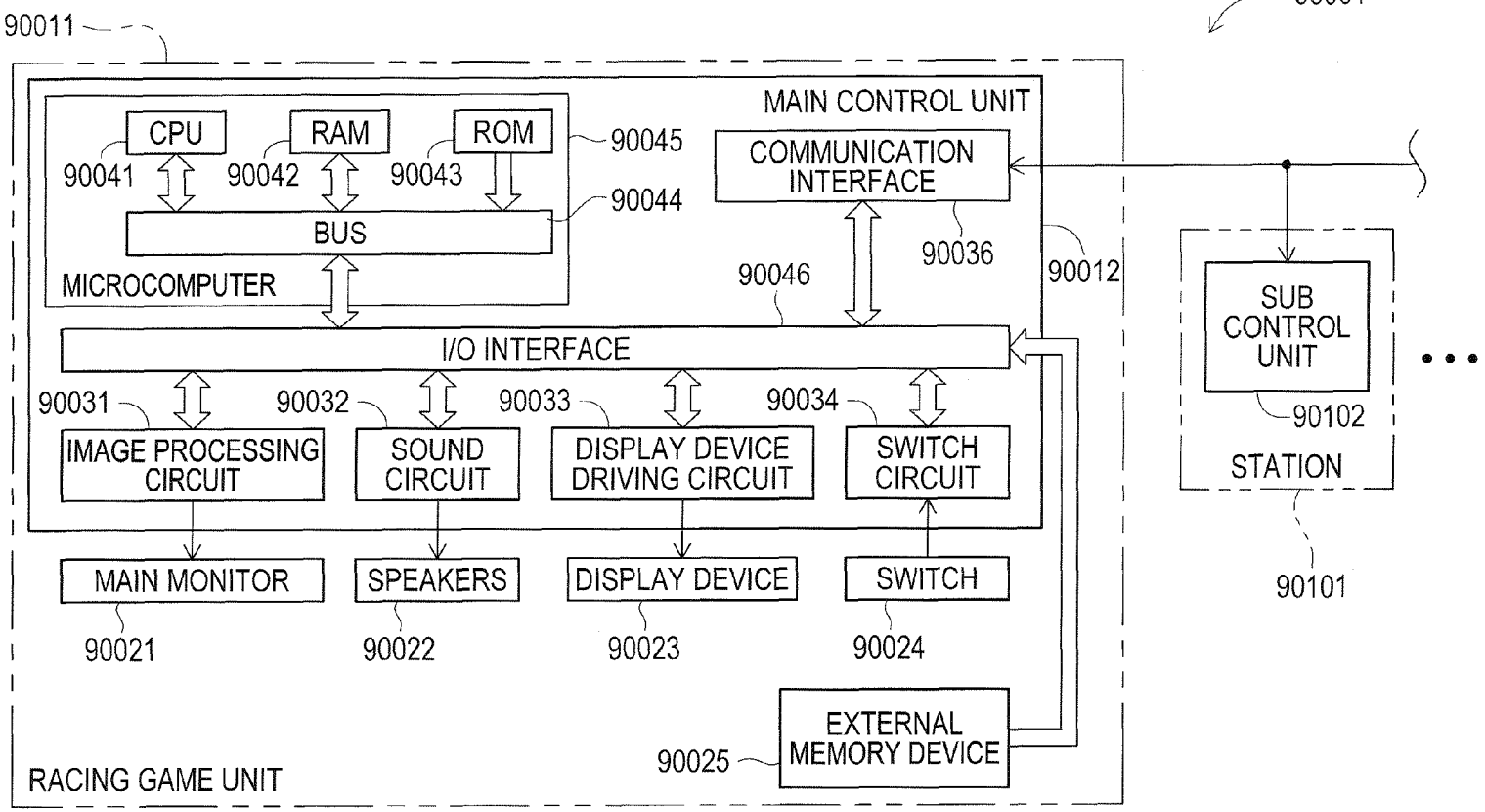
FIG. 93 is a block diagram of a racing game unit.

A racing game unit is an opposite concept of each station 90101 and constitutes a core of the horse race gaming machine 90001 of this embodiment. FIG. 93 is a block diagram of a racing game unit 90011. As shown in FIG. 93, the racing game unit 90011 is composed of a main control unit 90012, the main monitor 90021, the speakers 90022, the display device 90023, a switch 90024, an external memory device 90025, etc. The main control unit 90012 and external memory device 90025 are provided separately from the main monitor 90021, the speakers 90022, or the display device 90023. Although the switch 90024 is annexed to the main control unit 90021, it may be provided individually.

The main control unit 90012 is generally composed of a microcomputer 90045 as the kernel comprising a CPU 90041, a RAM 90042, a ROM 90043 and a bus 90044 for transferring data mutually between these elements. The RAM 90042 and the ROM 90043 are connected to the CPU 90041 via the bus 90044. The RAM 90042 is a memory for temporarily storing a variety of data which have been operated in the CPU 90041. The ROM 90043 stores various types of programs, data tables or the like for executing necessary processes to control the horse race gaming machine 90001.

An image processing circuit 90031 is connected to the microcomputer 90045 via an I/O interface 90046. The image processing circuit 90031 is connected to the main monitor 90021 and controls driving of the main monitor 90021.

The image processing circuit 90031 is composed of a program ROM, an image ROM, an image control CPU, a work RAM, a VDP (video display processor), and a video RAM, etc. And in the program ROM, an image control program related to display on the main monitor 90021, and various selection tables are stored. And, in the image ROM, dot data to form images and the like, for example dot data to form images displayed on the main monitor 90021, are stored. And, based on parameters set by the microcomputer 90045, the image control CPU determines the images displayed on the main monitor 90021 among the dot data stored beforehand in the image ROM, according to the image control program stored beforehand in the program ROM. And, the work RAM works as a temporary memory when the image control program is executed in the image control CPU. And the VDP forms image data corresponding to display contents determined by the image control CPU. And the VDP outputs the image data formed thereby to the main monitor 90021. And the video RAM works as a temporary memory when the images are formed by the VDP.

A sound circuit 90032 is connected to the microcomputer 90045 via the I/O interface 90046. The speakers 90022 are connected to the sound circuit 90032 and are arranged on both lateral sides of the main monitor 90021. The speakers 90022 output various types of effect sound, BGM, etc. when various types of effect are performed, by being subjected to output control by the sound circuit 90032 based on a drive signal from the CPU 90041.

A display device driving circuit 90033 is connected to the microcomputer 90045 via the I/O interface 90046. The display device 90023 is connected to the display device driving circuit 90033. The display device 90023 is disposed on the upper side of the main monitor 90021 and displays information about games in general, by being subjected to display control by the display device driving circuit 90033 based on a drive signal from the CPU 90041.

A switch circuit 90034 is connected to the microcomputer 90045 via the I/O interface 90046. The switch 90024 is connected to the switch circuit 90034 and is arranged in the lower part of the main monitor 90021. The switch 90024 inputs an instruction by an operator's setting operation into the CPU 90041 based on a switch signal from the switch circuit 90034.

The external memory device 90025 is connected to the microcomputer 90045 via the I/O interface 90046. The external memory device 90025 is arranged in the periphery of the main monitor 90021 and has capability similar to the image ROM in the image processing circuit 90031, by storing dot data for forming images, such as dot data for forming images on the main monitor 90021. Thus, when determining any image to be displayed on the main monitor 90021, the image control CPU in the image processing circuit 90031 adds the dot data stored in advance in the external memory device 90025 to a target of the determination.

A communication interface 90036 is connected to the microcomputer 90045 via the I/O interface 90046. A sub control unit 90102 of each station 90101 is connected to the communication interface 90036. This enables bidirectional communication between the CPU 90041 and each station 90101. The CPU 90041 can receive and transmit a command, request and data from/to each station 90101 via the communication interface 90036. Therefore, in the horse race gaming machine 90001, the main control unit 90012 controls progress of the horse racing game in cooperation with each station 90101.

4-4. Example of Configuration of a Station (the Fourth Embodiment)

Figure 94:
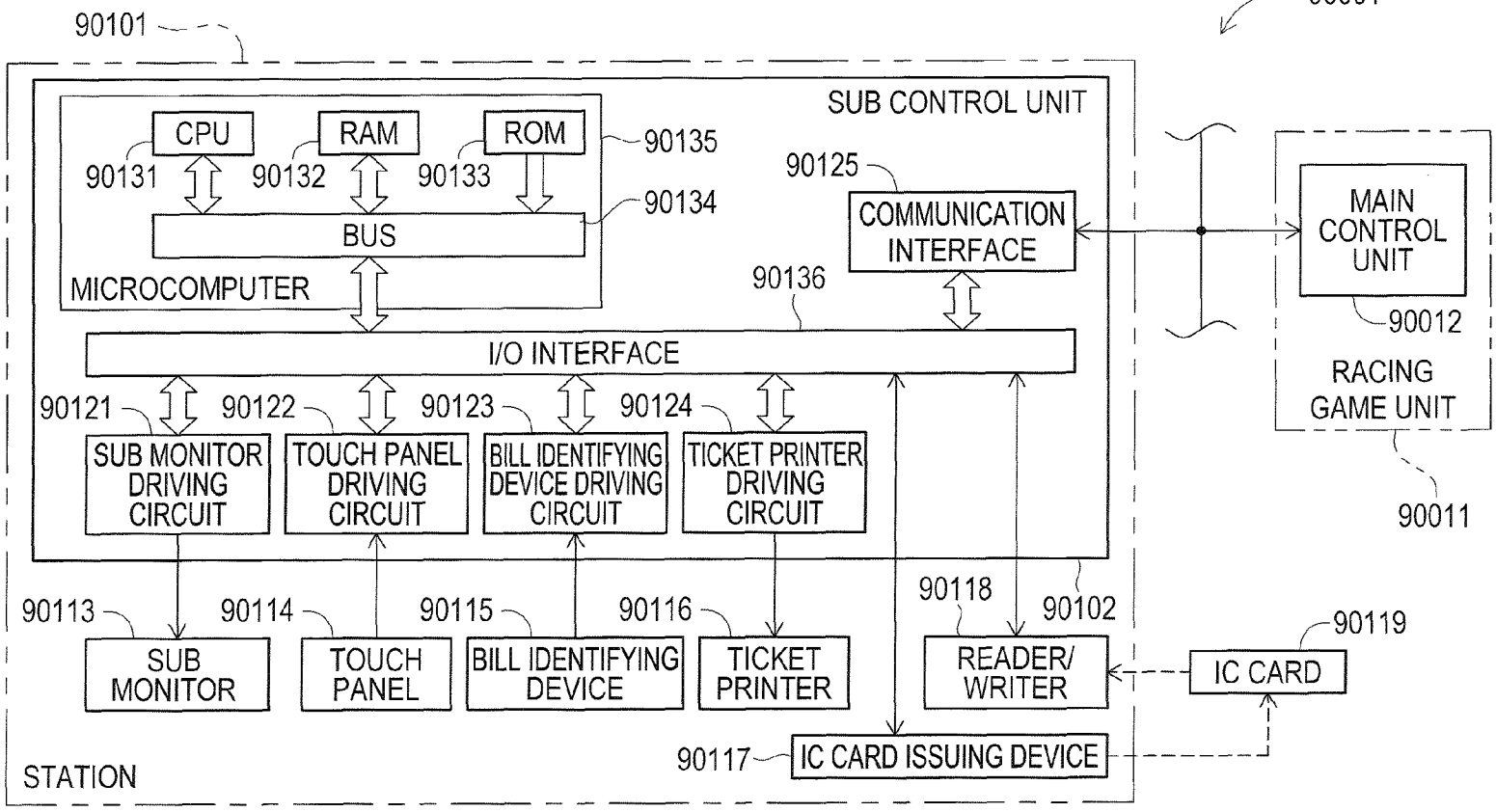
FIG. 94 is a block diagram of the station.

FIG. 94 is a block diagram of a station 90101. As shown in FIG. 94, the station 90101 is composed of the sub control unit 90102, the sub monitor 90113, the touch panel 90114, the bill identifying device 90115, the ticket printer 90116, the IC card issuing device 90117, the reader/writer 90118, etc.

The sub control unit 90102 is generally composed of a microcomputer 90135 as the kernel comprising a CPU 90131, a RAM 90132, a ROM 90133 and a bus 90134 for transferring data mutually between these elements. The RAM 90132 and the ROM 90133 are connected to the CPU 90131 via the bus 90134. The RAM 90132 is a memory for temporarily storing a variety of data which have been operated in the CPU 90131. The ROM 90133 stores various types of programs, data tables or the like for executing necessary processes to control the horse race gaming machine 90001.

A sub monitor driving circuit 90121 is connected to the microcomputer 90135 via an I/O interface 90136. The sub monitor 90113 is connected to the sub monitor driving circuit 90121. The sub monitor driving circuit 90121 controls driving of the sub monitor 90113 based on a drive signal from the aforementioned racing game unit 90011. The sub monitor driving circuit 90121 has also similar configuration and capabilities to the image processing circuit 90031 as shown in FIG. 93 above, and controls driving of the sub monitor 90113 so that the regular BET image, the high BET image, the owner image or the entry-possible race image described later are displayed.

A touch panel driving circuit 90122 is connected to the microcomputer 90135 via the I/O interface 90136. The touch panel 90114 is connected to the touch panel driving circuit 90122 and is arranged on the screen of the sub monitor 90113. The touch panel 90114 inputs an instruction into the CPU 90131 through touch operation of a player (touch position), based on a coordinate signal from the touch panel driving circuit 90122.

A bill identifying driving circuit 90123 is connected to the microcomputer 90135 via the I/O interface 90136. The bill identifying device 90115 is connected to the bill identifying driving circuit 90123. The bill identifying device 90115 identifies whether or not a bill or a bar coded ticket is appropriate. When receiving a legitimate bill, the bill identifying device 90115 inputs a value of the bill into the CPU 90131 based on an identification signal from the bill identifying driving circuit 90123. In addition, when receiving a legitimate bar coded ticket, the bill identifying device 90115 inputs a credit amount, etc. recorded on the bar coded ticket into the CPU 90131 based on an identification signal from the bill identifying driving circuit 90123.

A ticket printer driving circuit 90124 is connected to the microcomputer 90135 via the I/O interface 90136. The ticket printer 90116 is connected to the ticket printer driving circuit 90124. The ticket printer 90116 prints on a ticket a bar code representative of coded data such as owned credit amount, etc., stored in the RAM 90132, and outputs it as a bar coded ticket, by being subjected to output control by the ticket printer driving circuit 90124 based on a drive signal to be outputted from the CPU 90131.

The IC card issuing device 90117 is connected to the microcomputer 90135 via the I/O interface 90136. With an output controlled based on a drive signal to be outputted from a CPU 90131, the IC card issuing device 90117 issues an IC card 90119 that stores data such as horse owner information 90501 (refer to FIG. 104 below), etc.

The reader/writer 90118 is connected to the microcomputer 90135 via the I/O interface 90136. With a drive controlled based on a drive signal to be outputted from the CPU 90131, the reader/writer 90118 inputs information read from an IC card 90119 into CPU 90131 or stores various types of information such as horse owner information 90501 (refer to FIG. 104 below) into an IC card 90119.

A communication interface 90125 is connected to the microcomputer 90135 via the I/O interface 90136. The main control unit 90012 of the racing game unit 90011 is connected to the communication interface 90125. This enables bidirectional communication between the CPU 90131 and the racing game unit 90011. The CPU 90131 can receive and transmit a command, request and data from/to the racing game unit 90011 via the communication interface 90125. Therefore, in the horse race gaming machine 90001, the sub control unit 90102 controls progress of the horse racing game in cooperation with the racing game unit 90011.

4-5. Example of Game Operations of a Horse Race Gaming Machine (the Fourth Embodiment)

Figure 106:
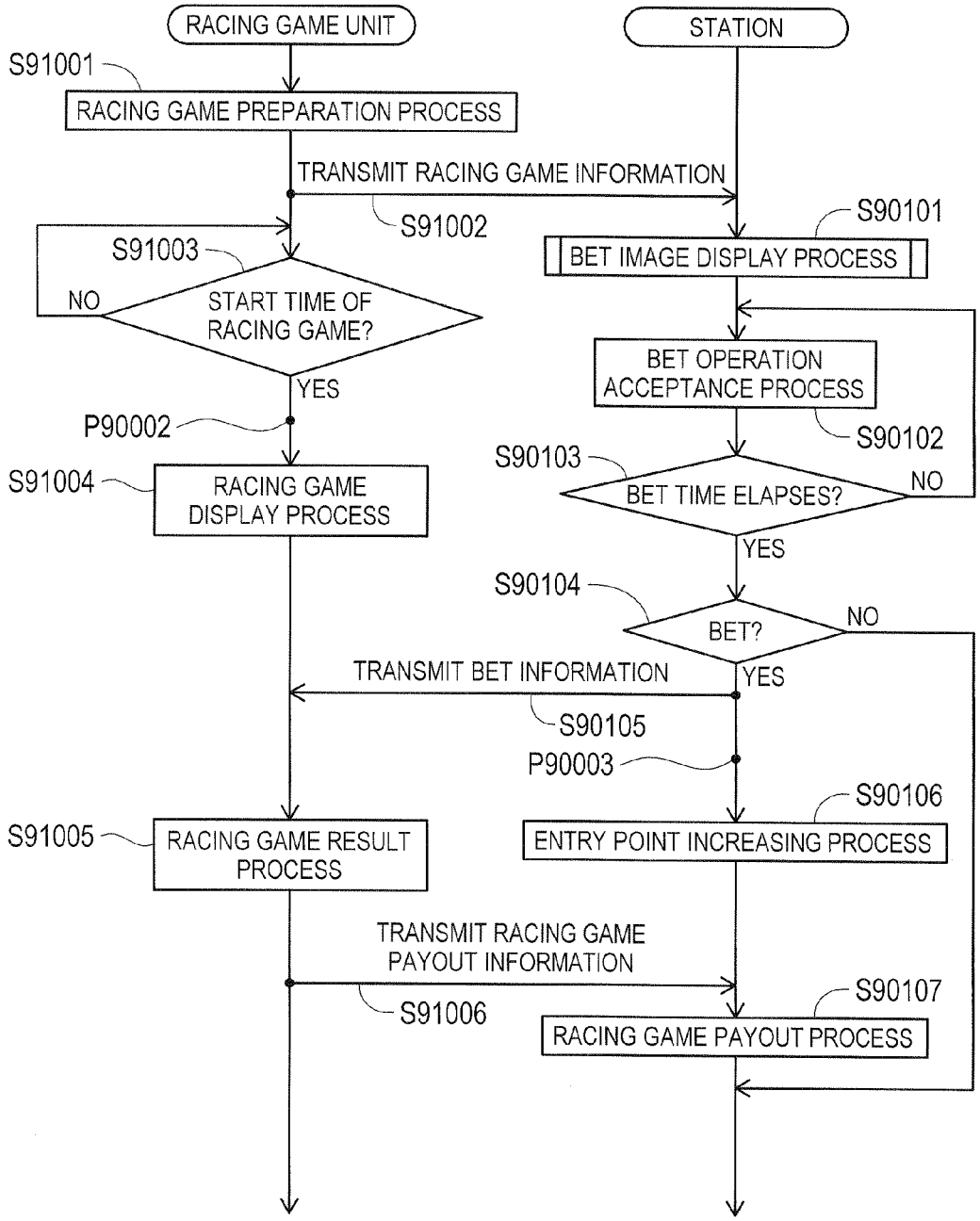
FIG. 106 is a flow chart diagram showing one example of game operations in the horse race gaming machine.

In the following, a description is made on an example of game operations of the horse race gaming machine 90001 of this embodiment. FIG. 106 is a flow chart diagram showing one example of game operations in the horse race gaming machine 90001 of this embodiment. It is to be noted that respective stations 90101 perform similar game operations respectively in cooperation with the racing game unit 90011. In order to avoid any complication, however, only one station 90101 is shown in FIG. 106.

The racing game unit 90011 performs respective operations from S91001 to S91006.

First, in S91001, the main control unit 90012 executes a racing game preparation process. In this process, for this racing game which constitutes a horse racing game, the CPU 90041 determines a track, starter horse, start time, etc, and reads data on them from the ROM 90043.

In S91002, the main control unit 90012 transmits racing game information. In this transmission, the CPU 90041 transmits respective data on the track, starter horse, start time, type (whether or not this racing game is a "player's host race" below), etc. of this racing game to each station 90101, as racing game information.

In S91003, the main control unit 90012 determines whether or not the present time is race start time of the racing game. In this determination, the CPU 90041 checks time until the time to start this racing game is reached (S91003: NO).

The CPU 90041 may also determine whether or not the present time is the time to start this racing game, by timing an interval from the last racing game.

When the time to start this racing game is reached (S91003: YES), the process proceeds to S91004 and the main control unit 90012 executes a racing game display process. In this process, based on the determination in S91001 above, the CPU 90041 not only displays race images of this racing game on the main monitor 90021 but also outputs sound of this racing game from the speakers 90022.

In S91005, the main control unit 90012 executes a racing game result process. In this process, the CPU 90041 calculates a payout amount of the respective stations 90101, based on the racing game result in S91004 above and BET information transmitted by the respective stations 90101 in S90105 below, etc.

In S91006, the main control unit 90012 transmits racing game payout information. In this transmission, the CPU 90041 transmits to the respective corresponding stations 90101 respective payout amounts, etc. in S91005 above, as racing game payout information.

Thereafter, similar processes are also repeated in the next racing game.

Meanwhile, in the respective stations 90101, respective operations of S90101 to S90107 are performed.

First, in S90101, the sub control unit 90102 executes a BET image display process. The respective stations 90101 execute the BET image display process based on the flow chart of FIG. 109.

Figure 95:
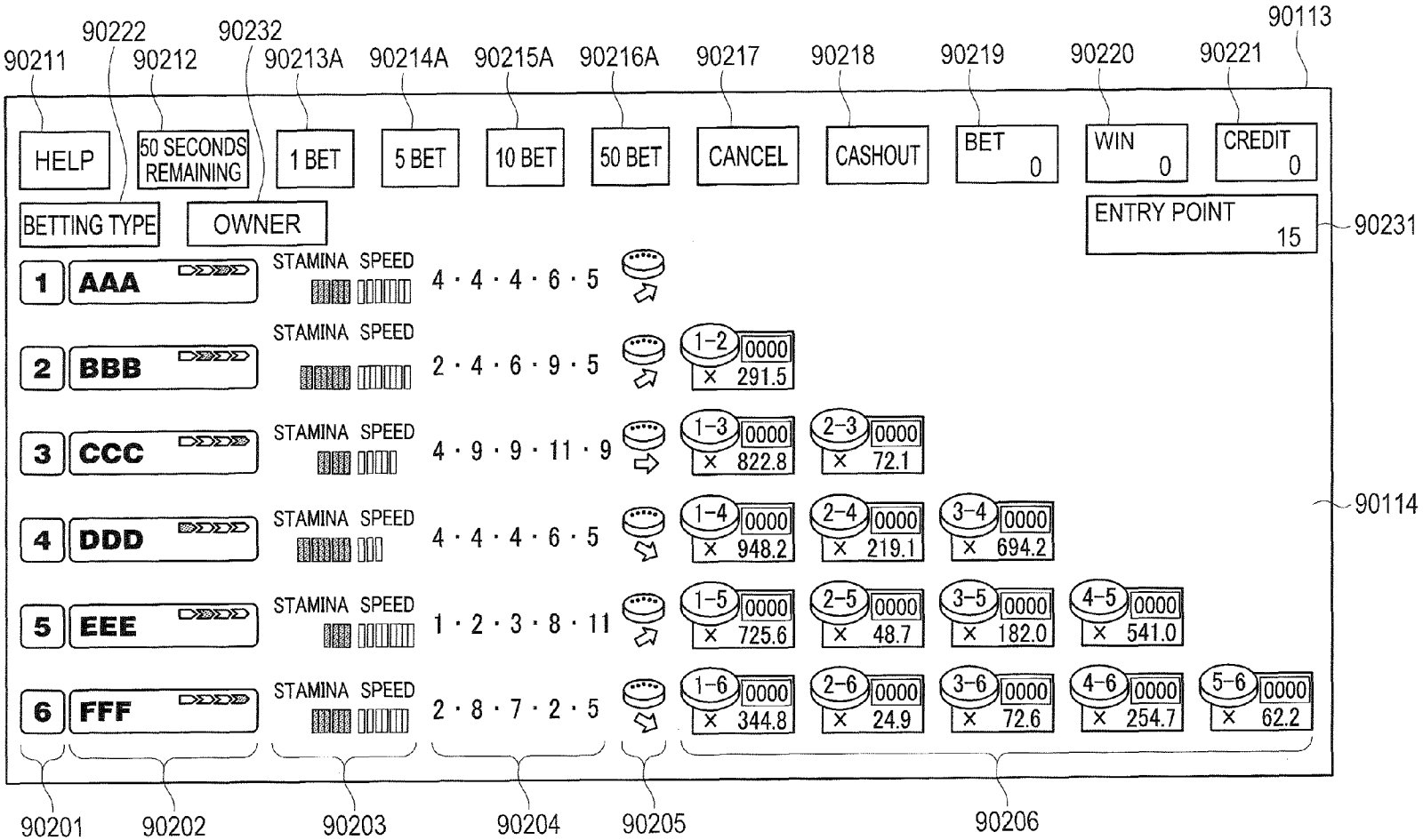
FIG. 95 is a front view showing one example of a regular BET image displayed on a sub monitor.

First, in S90201, the sub control unit 90102 executes a regular denomination process. In this process, the CPU 90131 displays a regular BET image of this racing game on the sub monitor 90113, based on the data related to the racing game information transmitted by the racing game unit 90011 in S91002 above. FIG. 95 shows one example of the regular BET image displayed on the sub monitor 90113.

As shown in FIG. 95, in a regular BET image displayed on the screen of the sub monitor 90113 covered by the light transmissive colorless touch panel 90114 are provided a horse number display area 90201, a horse name display area 90202, a basic power display area 90203 that displays speed and stamina by a bar graph, a performance display area 90204 that displays orders of arrival in last five races, a brief comment display area 90205 that displays the condition of this racing game by an arrow, a betting ticket purchase button display area 90206 where a betting ticket purchase button of a quinella-type bet in which a player randomly picks a combination of horse numbers that will finish in the first place and in the second place in order to win, odds or BET amounts are displayed together, etc.

In addition, in the regular BET image are provided a help button 90211, a time display area 90212, a 1 BET button 90213A, a 5 BET button 90214A, a 10 BET button 90215A, a 50 BET button 90216A, a cancel button 90217, a CASH-OUT button 90218, a BET amount display area 90219, a payout amount display area 90220, a credit amount display area 90221, a betting ticket type switch button 90222, an owner button 90232, an entry point display area 90231, etc.

The help button 90211 is a button that a player touches to display a method of BET operation, etc. on the sub monitor 90113. The time display area 90212 displays BET time in terms of the remaining time. The 1 BET button 90213A is a button that a player touches to set so that "1" is added to the present BET amount. The 5 BET button 90214A is a button that a player touches to set so that "5" is added to the present BET amount. The 10 BET button 90215A is a button that a player touches to set so that "10" is added to the present BET amount. The 50 BET button 90216A is a button that a player touches to set so that "50" is added to the present BET amount. Accordingly, the denomination of the regular BET image is "1". In other words, the minimum bet amount that a player can specify in the regular BET image is "1".

The cancel button 90217 is a button that a player touches to cancel the setting of addition to the BET amount. The CASH-OUT button 90218 is a button that a player touches to be paid out the number of coins corresponding to a player's own credit amount in bar coded tickets printed by the ticket printer 90116. The BET amount display area 90219 displays the total BET amount that a player sets for this racing game. The payout amount display area 90220 displays a payout amount of this racing game. The credit amount display area 90221 displays a player's own credit amount.

Touching any of the betting ticket purchase buttons within the betting ticket purchase button display area 90206 after touching any of the respective BET buttons 90213A, 90214A, 90215A, and 90216A, a player can perform the BET operation of the quinella-type bet. For example, if a player touches the betting ticket purchase button for "1-2" in the betting ticket purchase button display area 90206 after touching the 10 BET button 90215A, the player can set addition of "10" to the present BET amount for a combination of No. 1 and No. 2, as a combination of horse numbers that the player forecasts will finish in the first or second places in no particular order. The present BET amount for respective combinations of horse numbers are displayed next to the betting ticket purchase buttons corresponding to the respective combinations.

Although the regular BET image shown in FIG. 95 is for the quinella-type bet, such respective types of betting as win, place, bracket quinella, quinella place, exacta, trio, trifecta, etc. are also available, and every time a player touches the betting ticket type switch button 90222, the regular BET image changes to a regular BET image of a different type.

Various data in the regular BET image such as horse names and odds, etc. is included in data on the racing game information transmitted by the racing game unit 90011 in S91002 above.

The owner button 90232 is a button that a player touches when he/she wants to purchase a racehorse. The entry point display area 90231 displays entry points owned by a player.

Returning to FIG. 109, in S90202, the sub control unit 90102 determines whether or not a race entry has been made. In this determination, the CPU 90131 makes a determination based on the data related to race entry information stored in the RAM 90132, etc. described later. Then, if the race entry has been made (S90202: YES), the process proceeds to S90205 below. In this case (S90202: YES), the player is an owner of any racehorse. The player has also made the race entry of his/her own racehorse in any racing game. In contrast, if the race entry has not been made (S90202: NO), the process proceeds to S90203.

In S90203, the sub control unit 90102 determines whether or not an IC card 90119 is inserted into the reader/writer 90118. In this determination, the CPU 90131 makes a determination based on the data on whether or not there is an IC card 90119 transmitted by the reader/writer 90118, etc. Now if an IC card 90119 is not inserted into the reader/writer 90118 (S90203: NO), the process proceeds to S90210 below. In contrast, if an IC card 90119 is inserted into the reader/writer 90118 (S90203: YES), the process proceeds to S90204.

In S90204, the sub control unit 90102 determines whether or not a player is an owner of any racehorse. In this determination, the CPU 90131 makes a determination based on the data on horse owner information 90501 (refer to FIG. 104 below) stored in the RAM 90132 or an IC card 90119, etc. The horse owner information 90501 (refer to FIG. 104 below) stored in an IC card 90119 is read out by the reader/writer 90118 and inputted into the CPU 90131. Now, if a player is not an owner of any racehorse (S90204: NO), the process proceeds to S90210 below. In contrast, if the player is an owner of any racehorse (S90204: YES), the process proceeds to S90205.

Figure 96:
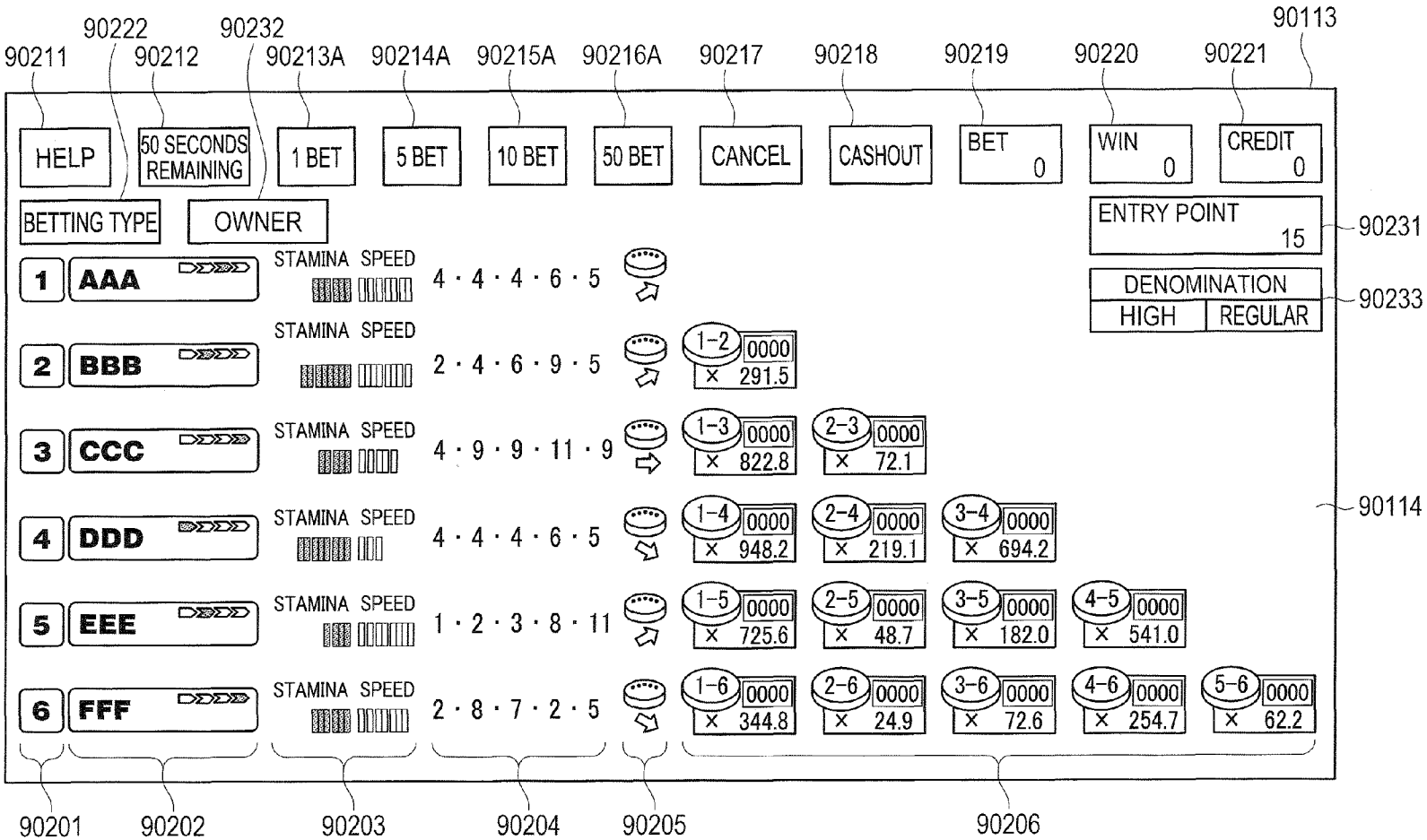
FIG. 96 is a front view showing one example of the regular BET image displayed on the sub monitor.

In S90205, the sub control unit 90102 executes a sub monitor display process. In this process, the CPU 90131 changes the regular BET image being displayed on the sub monitor 90113 to a regular BET image as shown in FIG. 96. In other words, a denomination button 90233 is synthesized and displayed on the regular BET image as shown in FIG. 95. The denomination button 90233 includes a regular button and a high button.

In S90206, the sub control unit 90102 determines whether or not a player has touched the regular button. In this determination, based on a coordinate signal from the touch panel driving circuit 90122, the CPU 90131 determines whether or not the player has touched the regular button included in the denomination button 90233. Now, if the player has touched the regular button (S90206: YES), the process proceeds to S90210 below. In contrast, if the player has not touched the regular button (S90206: NO), the process proceeds to S90207.

In S90207, the sub control unit 90102 determines whether or not the player has touched the high button. In this determination, based on a coordinate signal from the touch panel driving circuit 90122, the CPU 90131 determines whether or not the player has touched the high button included in the denomination button 90233. Now, if the player has not touched the high button (S90207: NO), the process returns to S90206 above. In contrast, if the player has touched the high button (S90207: YES), the process proceeds to S90208.

In other words, the respective determination processes of S90206 and S90207 above are repeated until the player touches either the regular button or the high button included in the denomination button 90233. However, similar to the determination process in S90103 below, the sub control unit 90102 determines whether or not the BET time has elapsed even while the respective determination processes of S90206 and S90207 above are being repeated. If the sub control unit 90102 determines that the BET time has elapsed before the player touches either the regular button or the high button included in the denomination button 90233, the process is forced to proceed to S90210 below.

Figure 97:
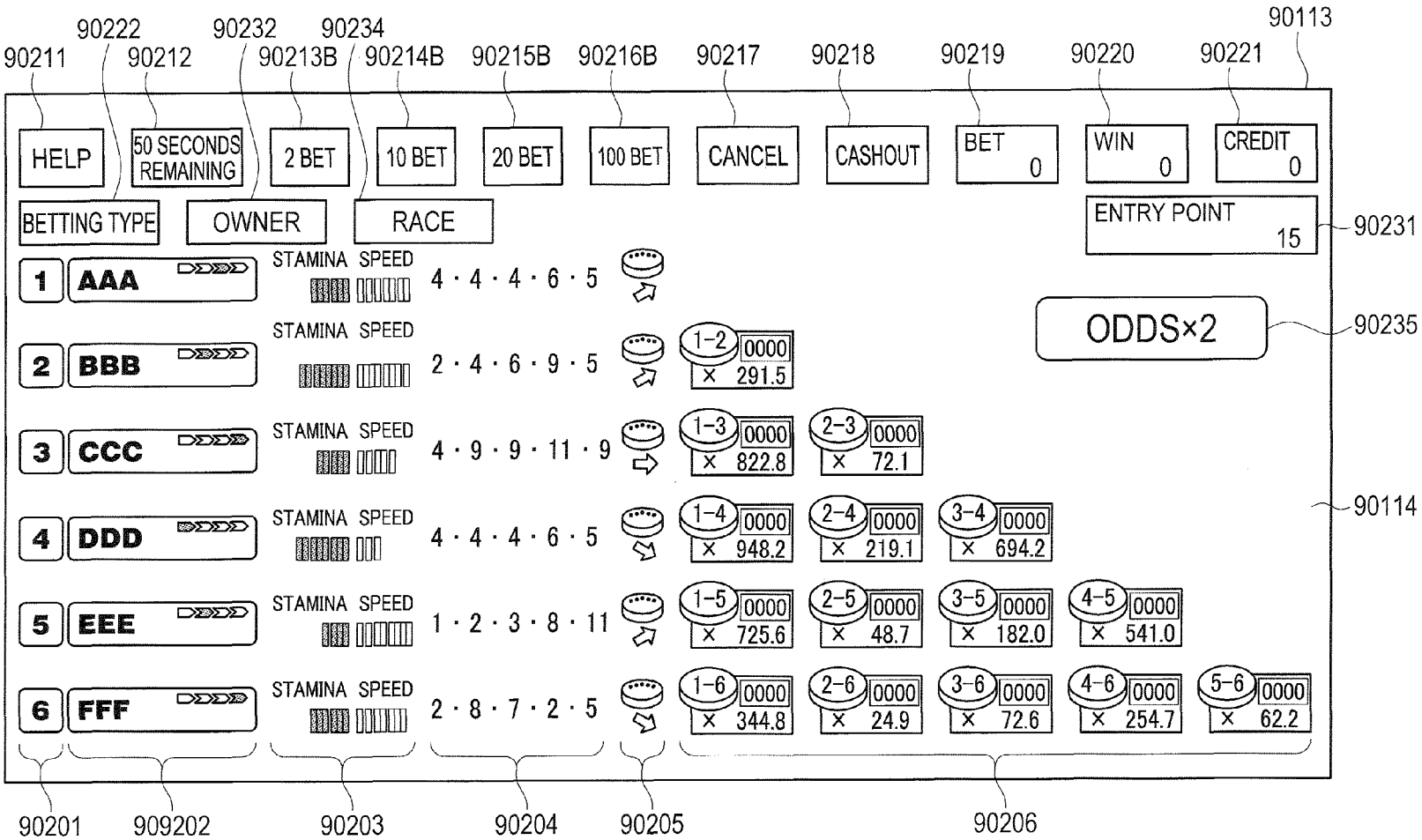
FIG. 97 is a front view showing one example of a high BET image displayed on the sub monitor.

In S90208, the sub control unit 90102 executes a high denomination process. In this process, the CPU 90131 displays a high BET image of this racing game on the sub monitor 90113. FIG. 97 shows one example of the high BET image displayed on the sub monitor 90113.

In the high BET image are provided a 2 BET button 90213B, a 10 BET button 90214B, a 20 BET button 90215B, and a 100 BET button 90216B. Thus, in the high BET image, the bet amounts of the respective BET buttons are twice as large as those in the regular BET image (refer to FIG. 95 and FIG. 96 above). Accordingly, the denomination of the high BET image is "2". In other words, the minimum bet amount that a player can specify in the high BET image is "2". In contrast, the minimum bet amount that a player can specify in the regular BET image (refer to FIG. 95 and FIG. 96 above) is "1". Accordingly, the denomination of the high BET image is twice the denomination of the regular BET image (refer to FIG. 95 and FIG. 96 above).

In addition, in the high BET image are provided a race button 90234 or a message display area 90235. The race button 90234 is a button that a player touches when he/she wishes to make a race entry of his/her own racehorse in a racing game. The message display area 90235 displays a message ("ODDS×2") indicating that odds will be twice as large as those in the regular BET image (refer to FIG. 95 and FIG. 96 above).

Except for these points, the high BET image is same as the regular BET image (refer to FIG. 95 above), and thus details thereof are omitted.

In S90209, the sub control unit 90102 executes a high odds process. In this process, the CPU 90131 stores in the RAM 90132 the data showing that the odds are doubled, in order to have it included in BET information to be transmitted to the racing game unit 90011 in S90105 below.

In S90210, the sub control unit 90102 executes an image control process. In this process, the CPU 90131 performs necessary other display controls over the regular BET image or the high BET image displayed on the sub monitor 90113. Thereafter, the process proceeds to S90102 of FIG. 95.

Returning to FIG. 106, in S90102, the sub control unit 90102 executes a BET operation acceptance process. In this process, based on a coordinate signal from the touch panel driving circuit 90122, the CPU 90131 identifies the content of the player's BET operation for this racing game and stores it in the RAM 90132. The CPU 90131 also checks time when each BET operation is performed and stores it in the RAM 90132. The CPU 90131 reflects the content of the player's BET operation in the display of the BET images of the sub monitor 90113.

In S90103, the sub control unit 90102 determines whether or not the BET time has elapsed. In this determination, the CPU 90131 checks time until the BET time has elapsed. The BET time is computed by the CPU 90131 based on the data on the racing game information transmitted by the racing game unit 90011 in S91002 above, and begins before this racing game starts and ends at predetermined timing while this racing game is in progress.

In addition, the sub control unit 90102 may determine that the BET time has elapsed, when the remaining time displayed in the time display area 90212 on the regular BET image or the high BET image of the sub monitor 90113 runs out.

Till the BET time elapses (S90103: NO), the sub control unit 90102 returns to S90102 above, and continues with the BET operation acceptance process. When the BET time has elapsed (S90103: YES), the process proceeds to S90104 and the sub control unit 90102 determines whether or not there is a BET. In this determination, the CPU 90131 determines whether or not there is a BET setting for this racing game based on what is stored in S90102 above.

Only when the sub control unit 90102 determines that there is a BET (S90104: YES), the process proceeds to S90105 and the sub control unit 90102 transmits BET information. In this transmission, the CPU 90131 transmits to the racing game unit 90011 the data on the memory content in S90209 or S90102 above, as BET information.

In S90106, the sub control unit 90102 executes an entry point increasing process. In this process, the CPU 90131 updates the player's own entry points stored in the RAM 90132, by adding points corresponding to the content of the player's BET operation on this racing game to the player's own entry points. The added entry points are equal to a certain proportion of the total BET amount the player sets for this racing game. The CPU 90131 displays the entry points after the addition in the entry point display area 90231 on the regular BET image or the high BET image of the sub monitor 90113.

In S90107, the sub control unit 90102 executes a racing game payout process. In this process, based on the data on the racing game payout information transmitted by the racing game unit 90011 in S91006 above, the CPU 90131 updates not only the player's own credit amount stored in the RAM 90132, but also the display in the payout amount display area 90220 or the credit amount display area 90221 on the regular BET image or the high BET image of the sub monitor 90113.

4-6. Example of Operations for Becoming a Racehorse Owner (the Fourth Embodiment)

Figure 107:
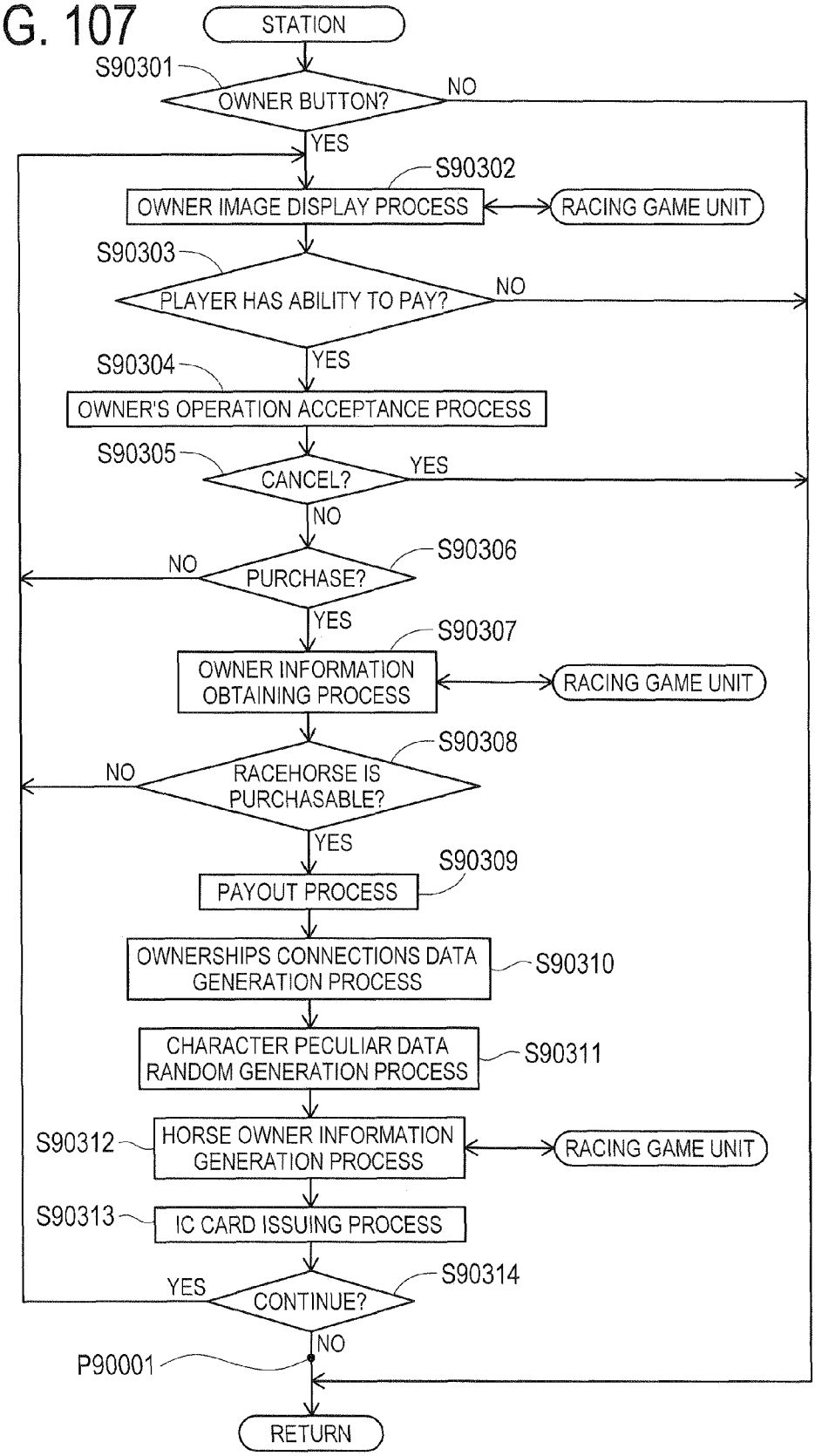
FIG. 107 is a flow chart diagram showing one example of an owner process.

In the following, an example of operations for becoming a racehorse owner in the horse race gaming machine 90001 of this embodiment is described. FIG. 107 is a flow chart diagram showing one example of an owner process.

In the respective stations 90101, triggered by a player's touching the owner button 90232 on the regular BET image or the high BET image of the sub monitor 90113, the owner process is executed based on the flow chart of FIG. 107.

First, in S90301, the sub control unit 90102 determines whether or not the player has touched the owner button 90232. In this determination, the CPU 90131 determines whether or not the player has touched the owner button 90232, based on a coordinate signal from the touch panel driving circuit 90122. Now, if the player has not touched the owner button 90232 (S90301: NO), this owner process terminates. In contrast, if the player has touched the owner button 90232 (S90301: YES), the process proceeds to S90302.

Figure 98:
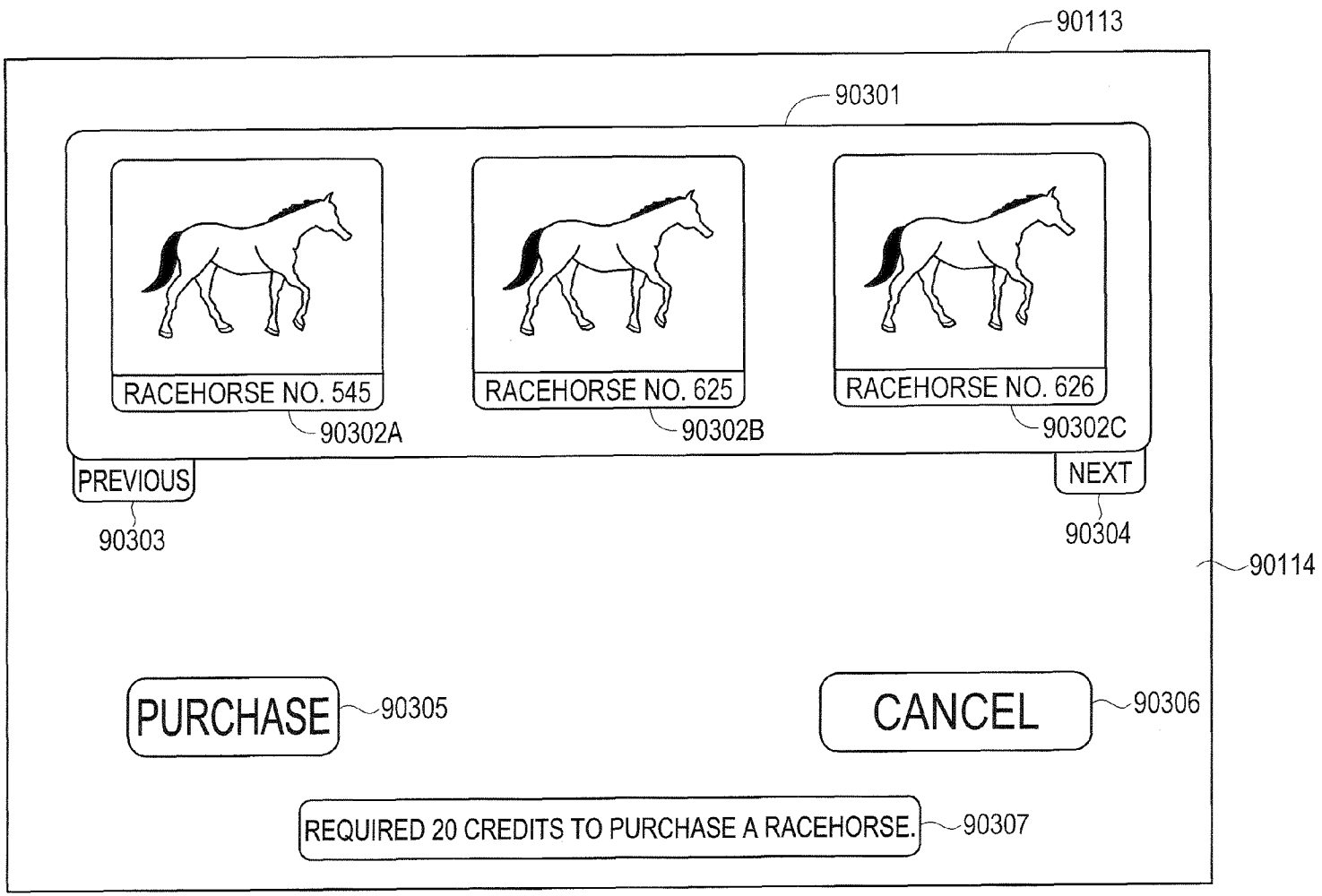
FIG. 98 is a front view showing one example of an owner image displayed on the sub monitor.

In S90302, the sub control unit 90102 executes an owner image display process. In this process, the CPU 90131 displays an owner image on the sub monitor 90113 based on the data on owner image information received through bidirectional communication with the racing game unit 90011. FIG. 98 shows one example of the owner image displayed on the sub monitor 90113.

As shown in FIG. 98, in the owner image displayed on the sub monitor 90113 covered by the light transmissive colorless touch panel 90114 are provided a racehorse page display area 90301, a previous page button 90303, a next page button 90304, a purchase button 90305, a cancel button 90306 and a message display area 90307, etc.

Three racehorse designation buttons 90302A, 90302B, and 90302C are provided in the racehorse page display area 90301. The respective racehorse designation buttons 90302A, 90302B, and 90302C display videos of racehorses that a player can purchase and their respective designation numbers. A player can designate a racehorse that he/she wishes to purchase, by touching each racehorse designation button 90302A, 90302B and 90302C.

In the racehorse page display area 90301, video of the 3 racehorses that a player can purchase is displayed. If the number of racehorses that a player can purchase is more than 3, a plurality of the racehorse page display areas 90301 will be generated. By touching the previous page button 90303 or the next page button 90304, a player can display any of the plurality of racehorse display areas 90301 on the owner image of the sub monitor 90113.

It is to be noted that the data on racehorses that a player can purchase is included in the owner image information received through bidirectional communication with the racing game unit 90011 in S90302 above.

The purchase button 90305 is a button that a player touches when determining a purchase of the designated racehorse. The cancel button 90306 is a button that a player touches when aborting a purchase of a racehorse. The message display area 90307 displays the message "REQUIRED 20 CREDITS TO PURCHASE A RACEHORSE".

In S90303, the sub control unit 90102 determines whether or not the player has the ability to pay. As shown in the message displayed in the message display area 90307, in this embodiment, 20 credits are required to purchase a racehorse. Therefore, in this determination, the CPU 90131 determines that the player has the ability to pay if the player's own credit amount stored in the RAM 90132 is not less than 20 credits. If the player has no ability to pay (S90303: NO), this owner process terminates. In contrast, if the player has the ability to pay (S90303: YES), the process proceeds to S90304.

In S90304, the sub control unit 90102 executes an owner's operation acceptance process. In this process, the CPU 90131 identifies the content of the player's BET operation in the owner image of the sub monitor 90113, based on a coordinate signal from the touch panel driving circuit 90122, and stores it in the RAM 90132. The CPU 90131 reflects the content of the player's BET operation in the display of the owner image of the sub monitor 90113.

In S90305, the sub control unit 90102 determines whether or not the player has touched the cancel button 90306. In this determination, the CPU 90131 determines whether or not the player has touched the cancel button 90306 based on a coordinate signal from the touch panel driving circuit 90122. Now, if the player has touched the cancel button 90306 (S90305: YES), this owner process terminates. In contrast, if the player has not touched the cancel button 90306 (S90305: NO), the process proceeds to S90306.

In S90306, the sub control unit 90102 determines whether or not the player has touched the purchase button 90305. In this determination, the CPU 90131 determines whether or not the player has touched the purchase button 90305 based on a coordinate signal from the touch panel driving circuit 90122. Now, if the player has not touched the purchase button 90305 (S90306: NO), the process returns to S90302 above. In contrast, if the player has touched the purchase button 90305 (S90306: YES), the process proceeds to S90307.

In S90307, the sub control unit 90102 executes an owner information obtaining process. In this process, the CPU 90131 receives owner information through bidirectional communication with the racing game unit 90011. This owner information includes data obtained as a result of causing the racing game unit 90011 to check whether or not the racehorse designated by the player is purchasable. If the racehorse is purchasable, the racing game unit 90011 puts the racehorse into purchase reserved state to prevent other player from purchasing the racehorse.

Figure 102:
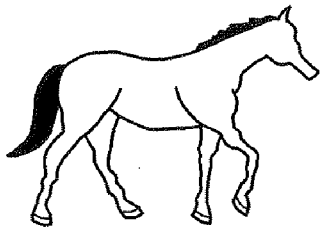
FIG. 102 is a view showing one example of a data table.
Figure 102:
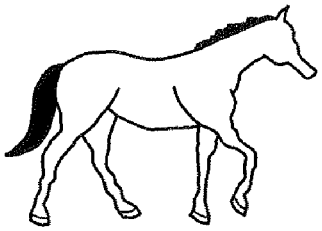
Figure 102:
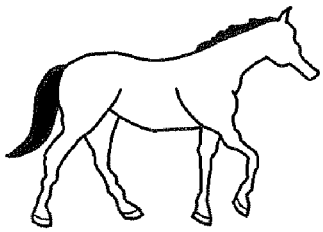

In the racing game unit 90011, the CPU 90041 controls respective racehorses by means of a character ID. For example, as per the data table shown in FIG. 102, the racehorses are associated with the character IDs. Such the table is stored in the RAM 90042 or the external memory device 90025, etc.

In addition, by associating the character IDs with player IDs, the racing game unit 90011 determines whether or not a racehorse is purchasable. For example, as per the data table shown in FIG. 103, the character IDs are associated with the player IDs. Such the table is stored in the RAM 90042 or the external storage device 90025, etc.

By referring to an association between the character IDs and the player IDs, the racing game unit 90011 can also determine whether or not a player identified by the player ID is an owner of any racehorse. In addition, in the purchase reserved state described above, in the data table as shown in FIG. 103, for example, the racing game unit 90011 controls so that the character ID of the racehorse to be reserved can only be associated with the player ID of the player of that particular reservation.

In S90308, the sub control unit 90102 determines whether or not the racehorse designated by the player is purchasable. In this determination, the CPU 90131 makes a determination based on the data on the owner information received in S90307 above. Now, if the racehorse designated by the player is not purchasable (S90308: NO), the process returns to S90302 above. In contrast, if the racehorse designated by the player is purchasable (S90308: YES), the process proceeds to S90309.

In S90309, the sub control unit 90102 executes a payout process. In this process, by deducting credit amounts necessary for purchasing a racehorse from the player's own credit amount, the CPU 90131 updates not only the player's own credit amount stored in the RAM 90132 but also the display in the credit amount display area 90221 on the regular BET image or high BET image of the sub monitor 90113.

In S90310, the sub control unit 90102 executes an ownerships connections data generation process. In this process, the CPU 90131 generates a player ID according to predetermined rules. However, if an IC card 90119 is inserted into the reader/writer 90118, the CPU 90131 uses the player ID included in horse owner information 90501 (refer to FIG. 104 below) of the IC card 90119. In addition, the CPU 90131 links a character ID of a racehorse of the purchase object with its player ID.

In S90311, the sub control unit 90102 executes a character peculiar data random generation process. In this process, using random numbers, the CPU 90131 generates character peculiar data on characters of a racehorse of the purchase object.

Figures 103, 104:
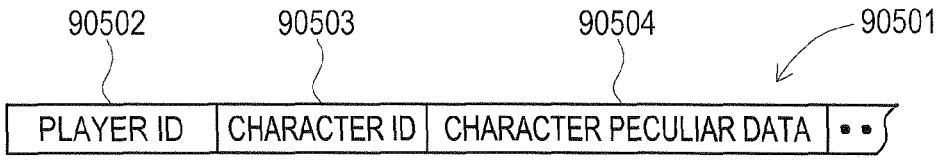
FIG. 103 is a view showing one example of a data table.
FIG. 104 is a view showing one example of horse owner information.

In S90312, the sub control unit 90102 executes a horse owner information generation process. In this process, the CPU 90131 generates horse owner information 90501 as shown in FIG. 104. In the horse owner information 90501, the character peculiar data generated in S90311 above is linked with the character ID and the player ID thereof that were linked to each other in S90310 above. In other words, the horse owner information 90501 includes the data 90502 on player ID generated in S90310 above, the data 90503 on the character ID of the racehorse of the purchase object, and the character peculiar data 90504 generated in S90311 above.

When the horse owner information 90501 is stored in the RAM 90132 by the CPU 90131, it is transmitted to the racing game unit 90011 at the same time. In the racing game unit 90011, the CPU 90041 stores the horse owner information 90501 in the RAM 90042 or the external memory device 90025, etc. In addition, in the racing game unit 90011, the CPU 90041 associates character IDs with player IDs based on the horse owner information 90501.

In S90313, the sub control unit 90102 executes an IC card issuing process. In this process, the CPU 90131 causes the IC card issuing device 90117 to issue an IC card 90119 storing the horse owner information 90501.

In S90314, the sub control unit 90102 determines whether or not to continue operation in the owner image of the sub monitor 90113. Now, if a player touches any part of the owner image within a predetermined period of time from when the IC card issuing device 90117 is caused to issue an IC card 90119, the CPU 90131 determines that the operation continues in the owner image of the sub monitor 90113. Therefore, in this determination, the CPU 90131 determines whether or not the player has touched any part of the owner image of the sub monitor 90113, based on a coordinate signal from the touch panel driving circuit 90122. Now, if the operation continues in the owner image of the sub monitor 90113 (S90314: YES), the process returns to S90302 above. In contrast, if the operation does not continue in the owner image of the sub monitor 90113 (S90314: NO), this owner process terminates.

Figure 99:
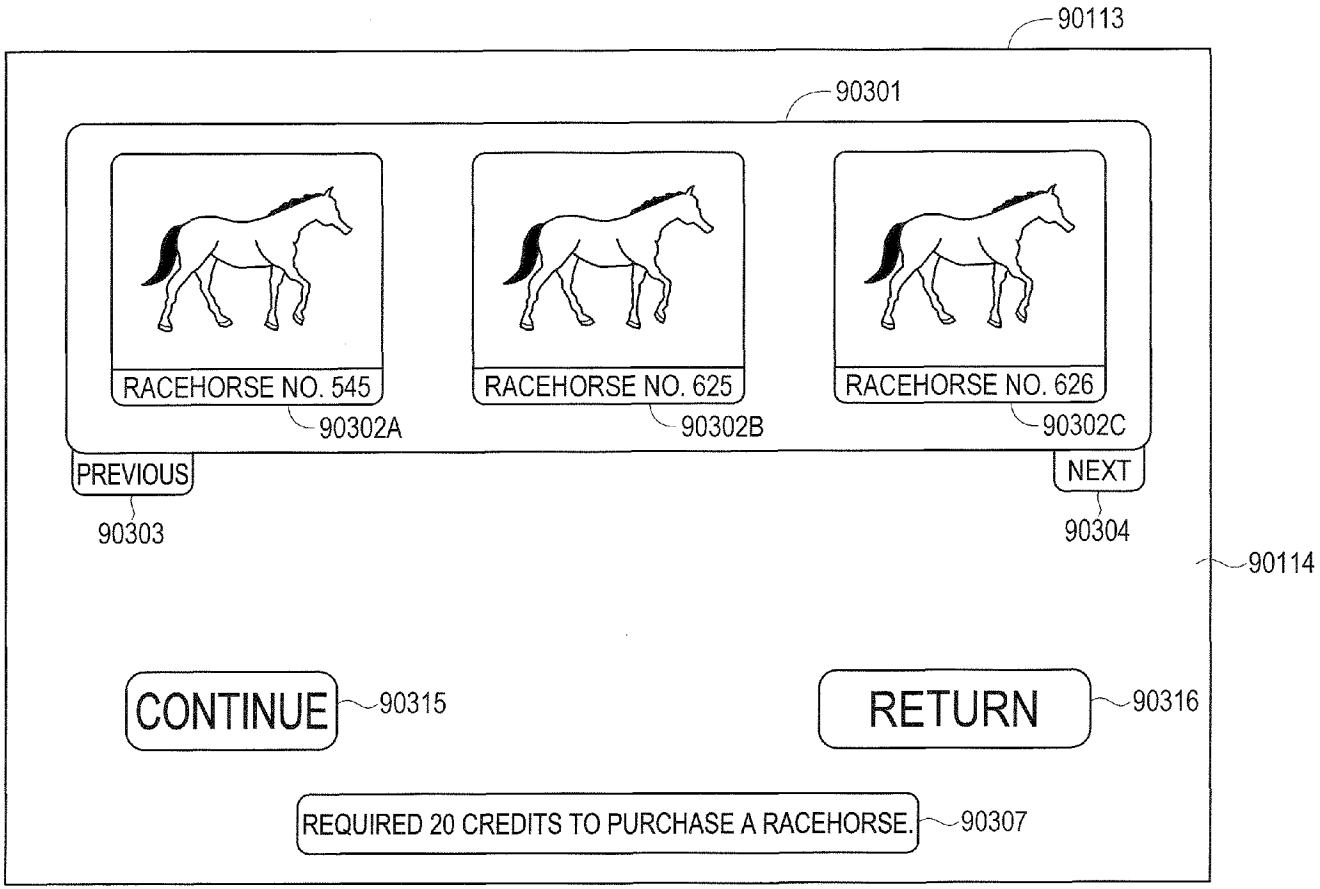
FIG. 99 is a front view showing one example of the owner image displayed on the sub monitor.

In this respect, the CPU 90131 may be such configured that the process of this S90314 is implemented, by providing a continue button 90315 or a return button 90316 in the owner image of the sub monitor 90113, as shown in FIG. 99.

When this owner process terminates, the sub monitor 90113 returns to the condition before this owner process starts. Therefore, the sub monitor 90113 displays the regular BET image above or the high BET image above.

4-7. Example of Operations for Making a Race Entry of a Player's Racehorse in a Racing Game (the Fourth Embodiment)

Figure 108:
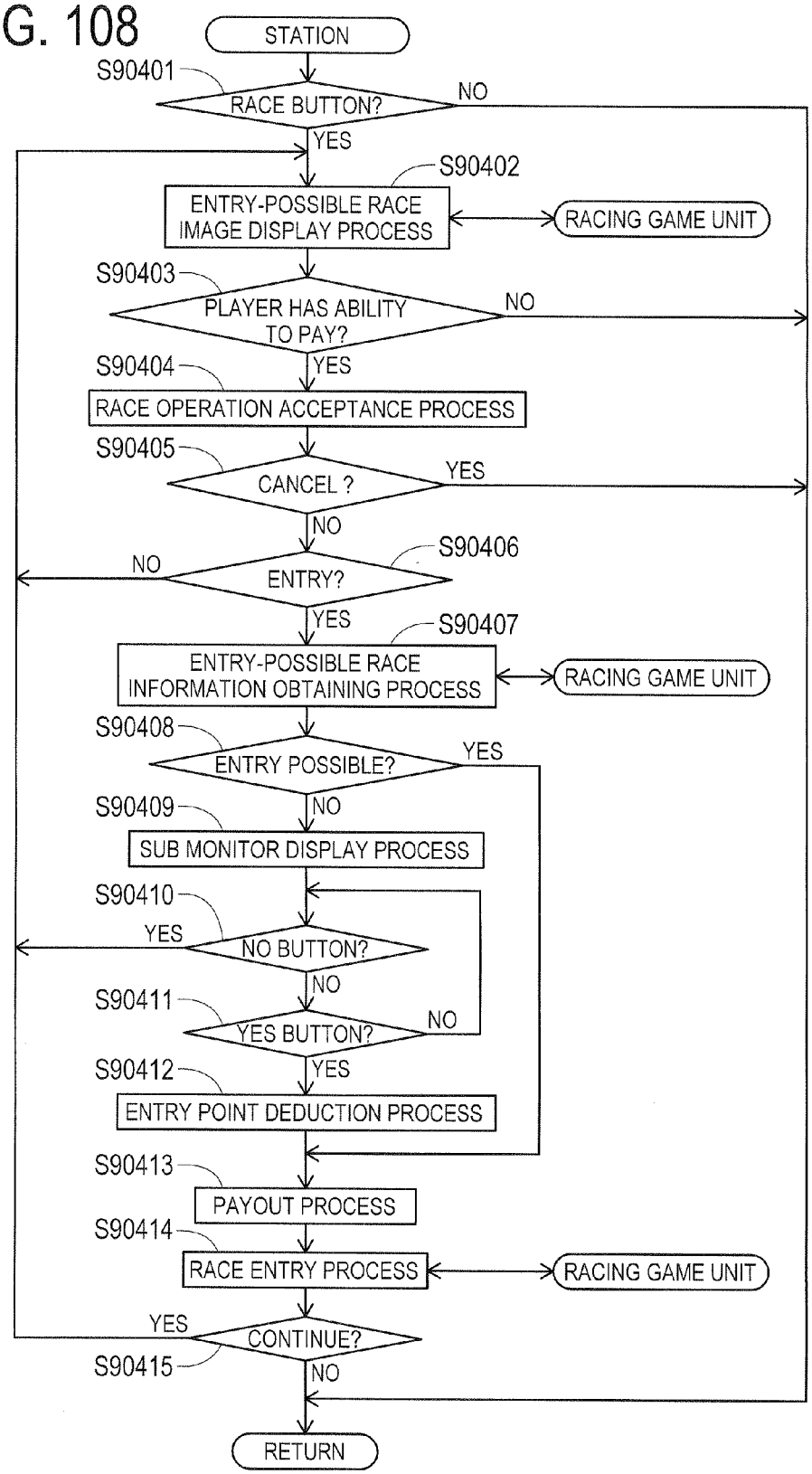
FIG. 108 is a flow chart diagram showing one example of an entry process.

In the following, the example of operations for making a race entry of a player's racehorse in a racing game in the horse race gaming machine 90001 according to this embodiment is described. FIG. 108 is a flow chart diagram showing one example of an entry process.

In the respective stations 90101, triggered by a player's touching the race button 90234 on the high BET image of the sub monitor 90113, the entry process is executed based on the flow chart of FIG. 108.

First, in S90401, the sub control unit 90102 determines whether or not a player has touched the race button 90234. In this determination, the CPU 90131 determines whether or not the player has touched the race button 90234 based on a coordinate signal from the touch panel driving circuit 90122. Now, if the player has not touched the race button 90234 (S90401: NO), this entry process terminates. In contrast, if the player has touched the race button 90234 (S90401: YES), the process proceeds to S90402.

Figure 100:
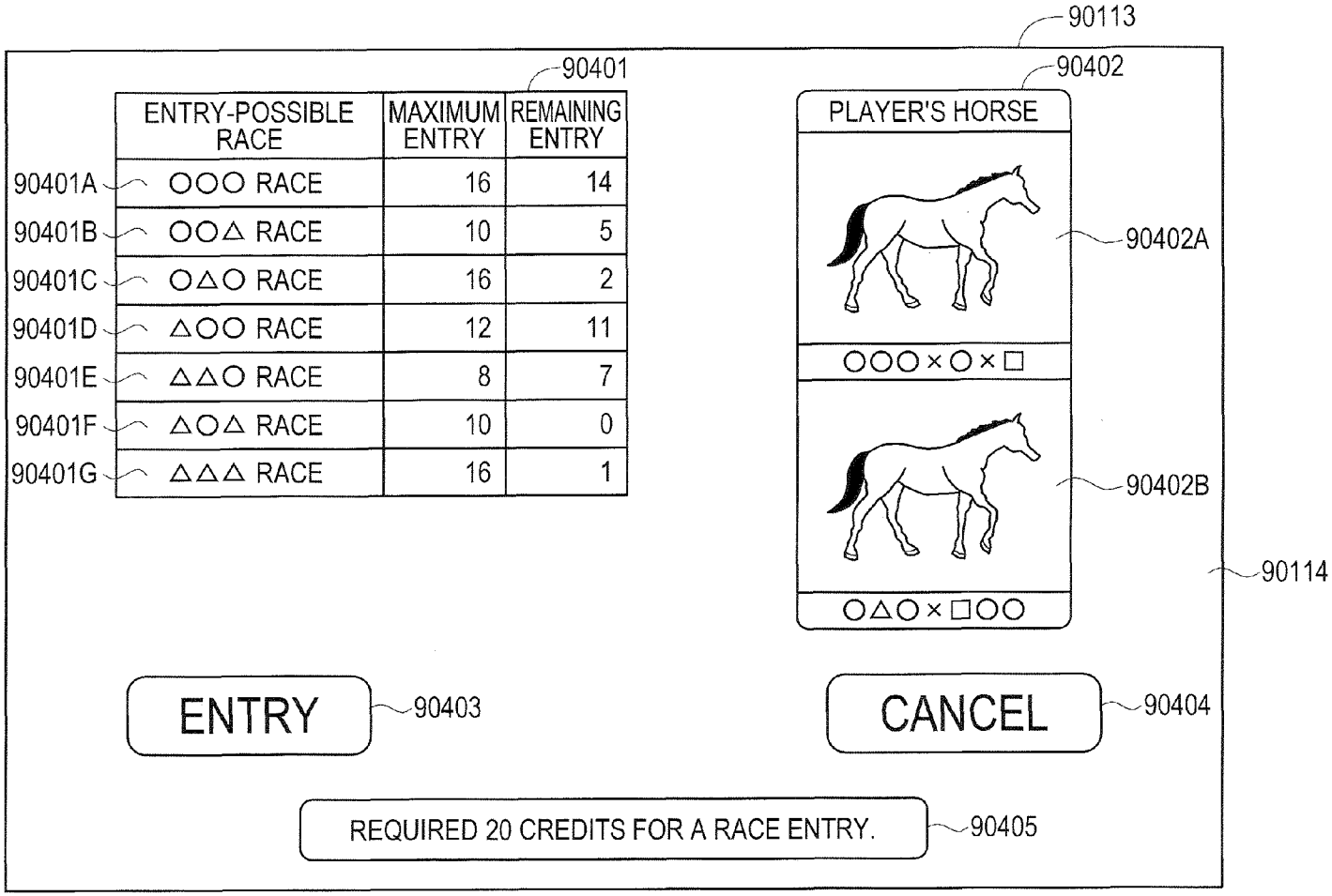
FIG. 100 is a front view showing one example of an entry-possible race image displayed on the sub monitor.
Figure 101:
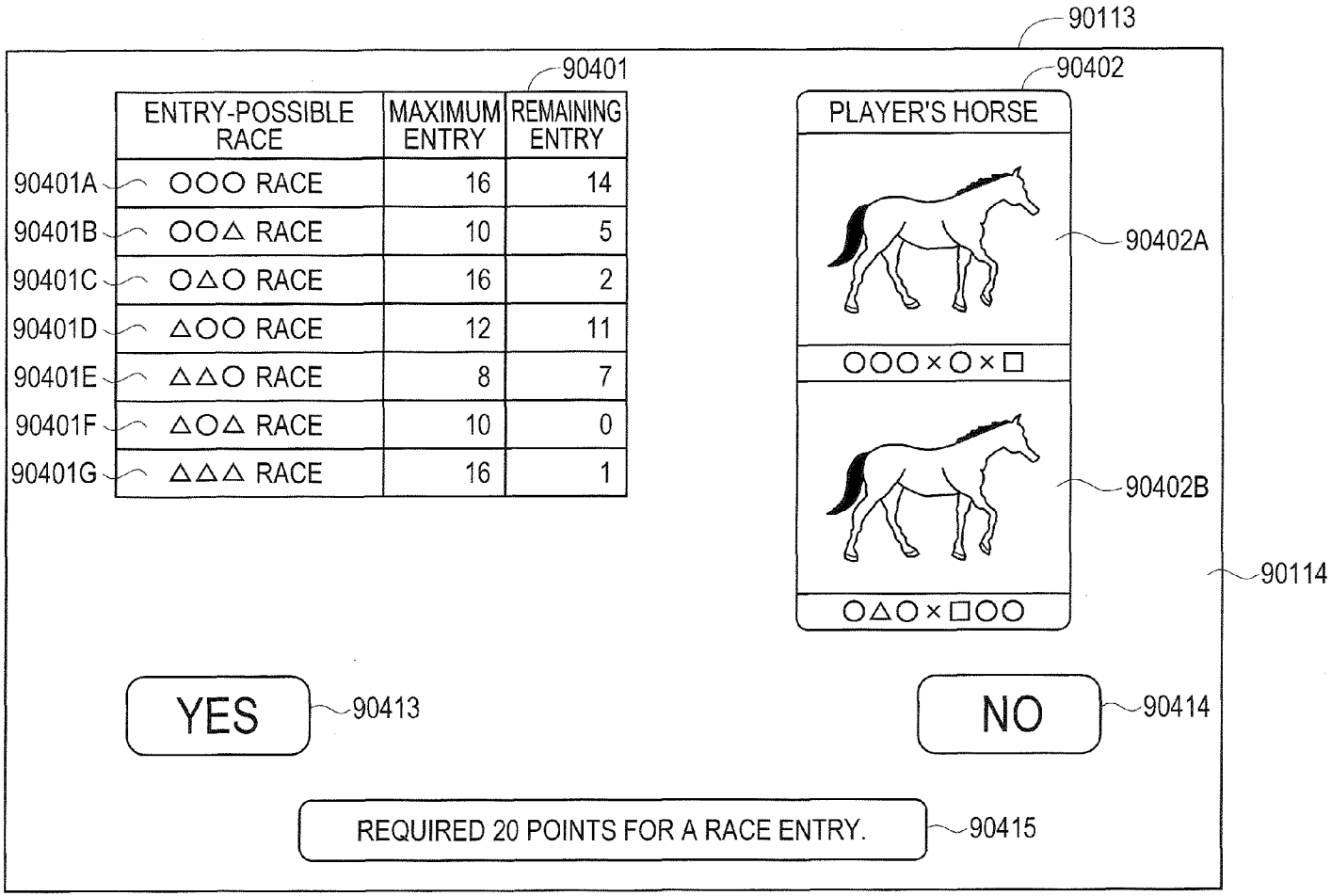
FIG. 101 is a front view showing one example of the entry-possible race image displayed on the sub monitor.

In S90402, the sub control unit 90102 executes an entry-possible race image display process. In this process, the CPU 90131 displays an entry-possible race image on the sub monitor 90113, based on the data on entry-possible race image information received through bidirectional communication with the racing game unit 90011. FIG. 100 and FIG. 101 show one example of the entry-possible race image displayed on the sub monitor 90113.

As shown in FIG. 100, in the entry-possible race image displayed on the sub monitor 90113 covered by the light transmissive colorless touch panel 90114 is provided an entry-possible race display area 90401, a player's horse display area 90402, an entry button 90403, a cancel button 90404 and a message display area 90405, etc.

In the entry-possible race display area 90401 is provided with respective columns for an entry possible race, a maximum entry, and a remaining entry. The entry possible race column displays a name of a racing game in which a race entry of a racehorse is possible. Parts where those names are displayed are used as designation buttons 90401A, 90401B, 90401C, 90401D, 90401E, 90401F, and 90401G for a player to designate a racing game. The maximum entry column displays the number of racehorses that run in a racing game. The remaining entry column displays the number of racehorses that can make a race entry in a racing game.

The player's horse display area 90402 displays racehorses whose owner is a player. Parts in which those racehorses are displayed are used as designation buttons 90402A, 90402B for a player to designate a racehorse.

The data on the entry-possible race display area 90401 or the player's horse display area 90402 is included in the entry-possible race image information received through bidirectional communication with the racing game unit 90011 in S90402 above.

The entry button 90403 is a button that a player touches when he/she wishes to make a race entry of a designated racehorse in a designated racing game. The cancel button 90404 is a button that the player touches to stop race entry. The message display area 90405 displays a message "REQUIRED 20 CREDITS FOR A RACE ENTRY".

In S90403, the sub control unit 90102 determines whether or not the player has the ability to pay. As per the message displayed in the message display area 90405, in this embodiment, 20 credits are required to make a race entry of one racehorse. Therefore, in this determination, the CPU 90131 determines that the player has the ability to pay when the player's own credit amount stored in the RAM 90132 are not less than 20 credits. If the player has no ability to pay (S90403: NO), this entry process terminates. In contrast, if the player has the ability to pay (S90403: YES), the process proceeds to S90404.

In S90404, the sub control unit 90102 executes a race operation acceptance process. In this process, the CPU 90131 identifies the content of the player's operation in the entry-possible race image of the sub monitor 90113, based on a coordinate signal from the touch panel driving circuit 90122 and stores it in the RAM 90132. The CPU 90131 reflects the content of the player's operation in the display of the entry-possible race image of the sub monitor 90113.

In S90405, the sub control unit 90102 determines whether or not the player has touched the cancel button 90404. In this determination, the CPU 90131 determines whether or not the player has touched the cancel button 90404 based on a coordinate signal from the touch panel driving circuit 90122. Now, if the player has touched the cancel button 90404 (S90405: YES), this entry process terminates. In contrast, if the player has not touched the cancel button 90404 (S90405: NO), the process proceeds to S90406.

In S90406, the sub control unit 90102 determines whether or not the player has touched the entry button 90403. In this determination, the CPU 90131 determines whether or not the player has touched the entry button 90403 based on a coordinate signal from the touch panel driving circuit 90122. Now, if the player has not touched the entry button 90403 (S90406: NO), the process returns to S90402 above. In contrast, if the player has touched the entry button 90403 (S90406: YES), the process proceeds to S90407.

In S90407, the sub control unit 90102 executes an entry-possible race information obtaining process. In this process, the CPU 90131 receives entry-possible race information through bidirectional communication with the racing game unit 90011. This entry-possible race information includes data as a result of causing the racing game unit 90011 to check whether or not a racehorse designated by the player can make a race entry in a designated racing game. If the race entry is possible, the racing game unit 90011 puts that race entry into a reserved state.

In the racing game unit 90011, the CPU 90041 controls race entries of respective racing games by means of character IDs. For example, as per the data table shown in FIG. 105, a racing game and character IDs are associated. Such the data table is stored in the RAM 90042 or the external memory device 90025, etc.

In S90408, the sub control unit 90102 determines whether or not a racehorse designated by the player can make a race entry in a designated racing game. In this determination, the CPU 90131 makes a determination based on the data on the entry-possible race information received in S90407 above. Now, if the racehorse designated by the player can make a race entry in the designated racing game (S90408: YES), the process proceeds to S90413 below. In contrast, if the racehorse designated by the player cannot make a race entry in the designated racing game (S90408: NO), the process proceeds to S90409.

In this embodiment, it is possible to forcibly make a race entry in a racing game designated by a player (refer to S90414 below) on the condition that the player pays 20 points from the player's own entry points (refer to S90412 below), even though there is no longer any racehorse that can make a race entry in the racing game.

In S90409, the sub control unit 90102 executes a sub monitor display process. In this process, the CPU 90131 changes the entry-possible race image being displayed on the sub monitor 90113 to an entry-possible race image as shown in FIG. 101. In other words, instead of the entry button 90403, the cancel button 90404, and the message display area 90405 are provided a YES button 90413, a NO button 90414 and a message display area 90415.

The YES button 90413 is a button that the player touches to ensure race entry of a designated racehorse in a designated racing game. The NO button 90414 is a button that the player touches to stop race entry of a designated racehorse in a designated racing game. The message display area 90415 displays the message "REQUIRED 20 POINTS FOR A RACE ENTRY".

In S90410, the sub control unit 90102 determines whether or not the player has touched the NO button 90414. In this determination, the CPU 90131 determines whether or not the player has touched the NO button 90414 based on a coordinate signal from the touch panel driving circuit 90122. Now, if the player has touched the NO button 90414 (S90410: YES), the process returns to S90402 above. Then, the CPU 90131 causes the racing game unit 90011 to cancel the reservation of the race entry described above, by transmitting a control signal to the racing game unit 90011. In contrast, if the player has not touched the NO button 90414 (S90410: NO), the process proceeds to S90411.

In S90411, the sub control unit 90102 determines whether or not the player has touched the YES button 90413. In this determination, the CPU 90131 determines whether or not the player has touched the YES button 90413, based on a coordinate signal from the touch panel driving circuit 90122. Now, if the player has not touched the YES button 90413 (S90411: NO), the process returns to S90410 above. In contrast, if the player has touched the YES button 90413 (S90411: YES), the process proceeds to S90412.

In S90412, the sub control unit 90102 executes an entry point deduction process. In this process, by deducting from the player's own entry points the points necessary to make a race entry in a racing game, the CPU 90131 updates not only the player's own entry points stored in the RAM 90132 but also the display in the entry point display area 90231 on the high BET image of the sub monitor 90113.

In this respect, all of the player's own entry points may be deducted.

It is to be noted that the sub control unit 90102 skips a payout process of S90413 below, if this entry point deduction process is executed.

In S90413, the sub control unit 90102 executes the payout process. In this process, by deducting credit amounts necessary for making a race entry in a racing game from the player's own credit amount, the CPU 90131 updates not only the player's own credit amount stored in the RAM 90132 but also the display in the credit amount display area 90221 on the high BET image of the sub monitor 90113.

In S90414, the sub control unit 90102 executes a race entry process. In this process, when storing in the RAM 90132 race entry information including data on race entry determination, etc. (data showing player IDs or character IDs, or determinations), the CPU 90131 simultaneously transmits it to the racing game unit 90011. In the racing game unit 90011, the CPU 90041 associates a racing game with a character ID based on data on this information. In particular, if the player has paid 20 points from the player's own entry points, a race entry in the racing game is forcibly done. The racing game unit 90011 may enable this forcible race entry by increasing the number of racehorses to run the racing game, or by replacing any of the racehorses that have already been registered, with it.

In S90415, the sub control unit 90102 determines whether or not operation continues in the entry-possible race image of the sub monitor 90113. Now, if the player touches any part of the entry-possible race image of the sub monitor 90113 within a predetermined period of time from when the player touched the YES button 90413, the CPU 90131 determines that the operation continues in the entry-possible race image of the sub monitor 90113. Thus, if the operation continues in the entry-possible race image of the sub monitor 90113 (S90415: YES), the process returns to S90402 above. In contrast, if the operation does not continue in the entry-possible race image of the sub monitor 90113 (S90415: NO), this entry process terminates.

When this entry process terminates, the sub monitor 90113 returns to the condition before the entry process starts. Therefore, the sub monitor 90113 displays the high BET image above.

4-8. A Racing Game Hosted by a Player (the Fourth Embodiment)

In the horse race gaming machine 90001 of this embodiment, when a player playing at the station 90101 becomes an owner of a predetermined number of racehorses, a racing game which is hosted by the player will be held, if the player wishes. Hereinafter, such a racing game which is hosted by the player is referred to as a "player's host race".

For that purpose, in the respective stations 90101, the sub control unit 90102 executes each of the processes described in the flow chart of FIG. 90 at the point P90001 immediately after when it is determined that the player does not wish to continue its operation in the owner image of the sub monitor 90113 (S90314: NO in FIG. 107 above).

First, in S90501, the sub control unit 90102 executes a player's horses count process. In this process, the CPU 90131 counts the number of racehorses whose owner is the player playing at the station 90101 based on the data on player's horse information received through bidirectional communication with the racing game unit 90011.

In this time, in the racing game unit 90011, the CPU 90041 counts the number of the racehorses whose owner is the player based on the player IDs transmitted from each of the stations 90101 and the data table of FIG. 103 above, etc. The CPU 90041 includes the counted values in the players' horse information.

Figure 109:
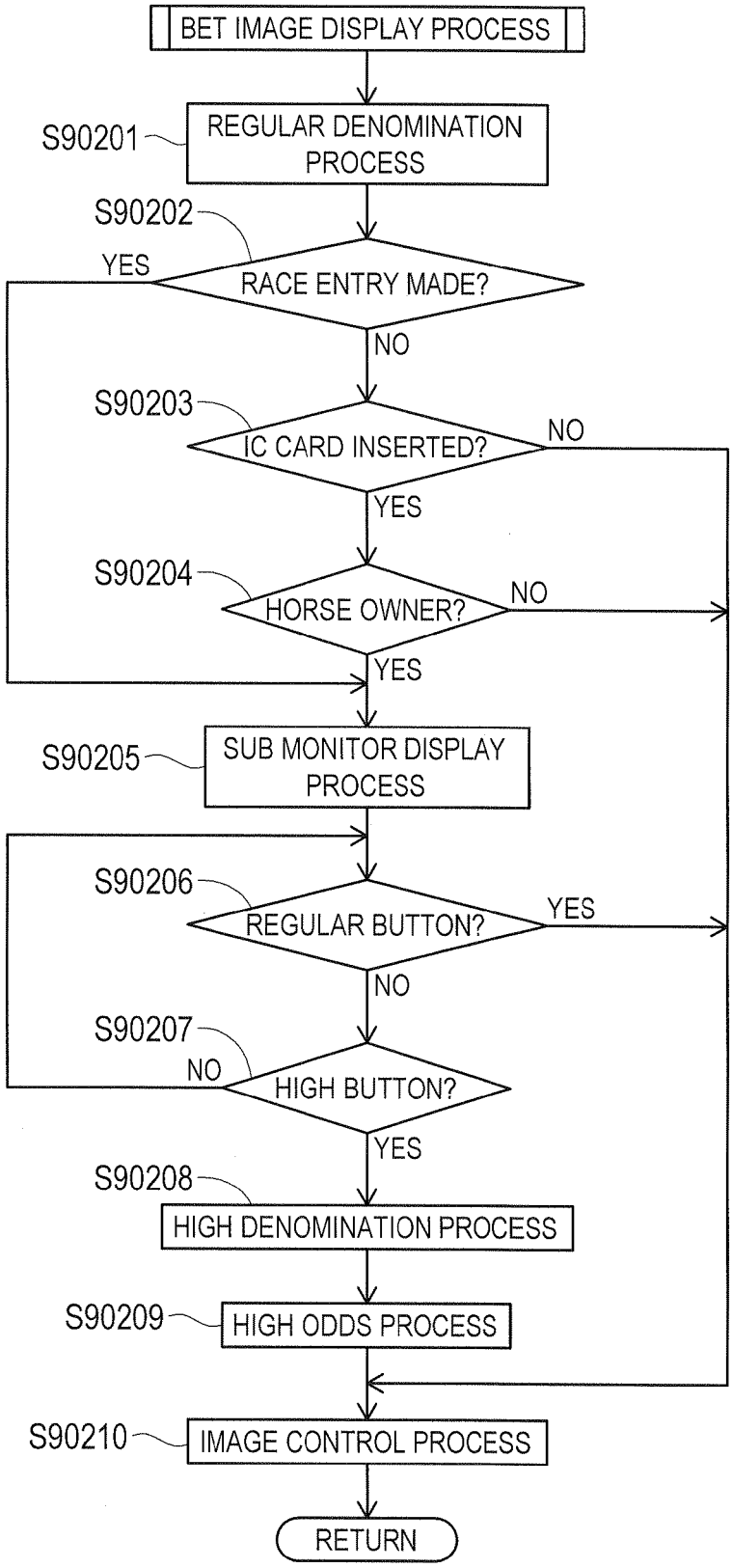
FIG. 109 is a flow chart diagram showing one example of game operations in the horse race gaming machine.

Thus, in carrying out bidirectional communication with the racing game unit 90011, the CPU 90131 transmits the player ID identified through S90202, S90203, S90204, etc. of FIG. 109 above.

In S90502, the sub control unit 90102 determines whether or not the number of the racehorses whose owner is the player reaches any one of predetermined numbers. In this determination, the CPU 90131 makes a determination by using a data table as shown in FIG. 110 and the counted values of S90501 above. Such the data table is stored in the RAM 90132, etc. In the data table of FIG. 110, predetermined numbers of "10", "20", "30", "40" and "50" are stored. That is, in this process, every time the number of the racehorses whose owner is the player reaches any one of the predetermined numbers "10", "20", "30", "40" and "50", it will be determined that the number of the racehorses whose owner is the player reaches the predetermined number.

If the number of the racehorses whose owner is the player reaches any one of the predetermined numbers for the first time, the CPU 90131 stores "done" in the field of the holding column corresponding to the predetermined number reached for the first time in the data table of FIG. 110. Then, in this process, the predetermined number of which the field of the holding column is stored "done" will be excluded from the determination. Accordingly, when the number of the racehorses whose owner is the player reaches the same predetermined number more than once, it will be not determined that the number of the racehorses whose owner is the player reaches the predetermined number.

Now, if the number of the racehorses whose owner is the player does not reach any of the predetermined numbers (S90502: NO), the game operations described in the flow chart of FIG. 90 is terminated to return to the point P1 in the game operations described in the flow chart of FIG. 107. In contrast, if the number of the racehorses whose owner is the player reaches any of the predetermined numbers (S90502: YES), the process proceeds to S90503.

Figure 112:
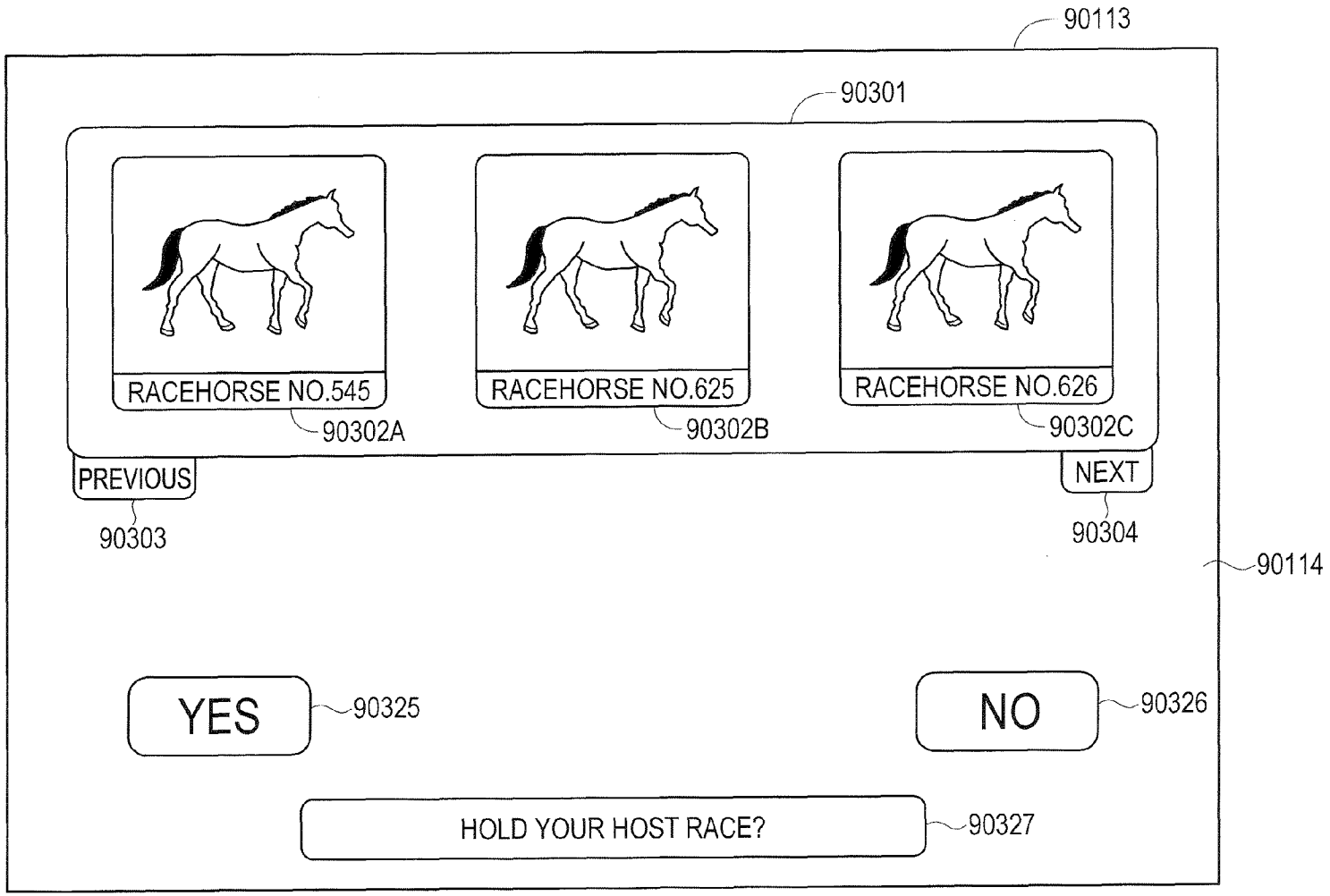
FIG. 112 is a front view showing one example of the owner image displayed on the sub monitor.

In S90503, the sub control unit 90102 executes a sub monitor process. In this process, as shown in FIG. 112, in the owner image being displayed on the sub monitor 90113, the CPU 90131 provides a YES button 90325, a NO button 90326 and a message display area 90327 instead of the purchase button 90305, the cancel button 90306 and the message display area 90307 (refer to FIG. 98 above).

The YES button 90325 is the button which a player touches if the player wishes to hold a "player's host race". The NO button 90326 is the button which a player touches if the player does not wish to hold a "player's host race". The message display area 90327 displays the message "HOLD YOUR HOST RACE?".

In S90504, the sub control unit 90102 determines whether or not the player has touched the NO button 90326. In this determination, the CPU 90131 determines whether or not the player has touched the NO button 90326 based on a coordinate signal from the touch panel driving circuit 90122. Now, if the player has touched the NO button 90326 (S90504: YES), the game operations described in the flow chart of FIG. 90 is terminated to return to the point P90001 in the game operations described in the flow chart of FIG. 107. In contrast, if the player has not touched the NO button 90326 (S90504: NO), the process proceeds to S90505.

In S90505, the sub control unit 90102 determines whether or not the player has touched the YES button 90325. In this determination, the CPU 90131 determines whether or not the player has touched the YES button 90325 based on a coordinate signal from the touch panel driving circuit 90122. Now, if the player has touched the YES button 90325 (S90505: YES), the process proceeds to S90507 below. In contrast, if the player has not touched the YES button 90325 (S90505: NO), the process proceeds to S90506.

In S90506, the sub control unit 90102 determines whether or not a predetermined time has elapsed from the point P90001 in the game operations described in the flow chart of FIG. 107. In this determination, the CPU 90131 checks the clock until the predetermined time has elapsed. Now, if the predetermined time has elapsed (S90506: YES), the game operations described in the flow chart of FIG. 90 is terminated to return to the point P90001 in the game operations described in the flow chart of FIG. 107. In contrast, if the predetermined time has not elapsed (S90506: NO), the process returns to S90504 above. That is, until the predetermined time has elapsed (S90506: YES), the determination processes of S90504 through S90506 as described above are repeated before a player touches either one of the YES button 90325 or the NO button 90326.

Figure 113:
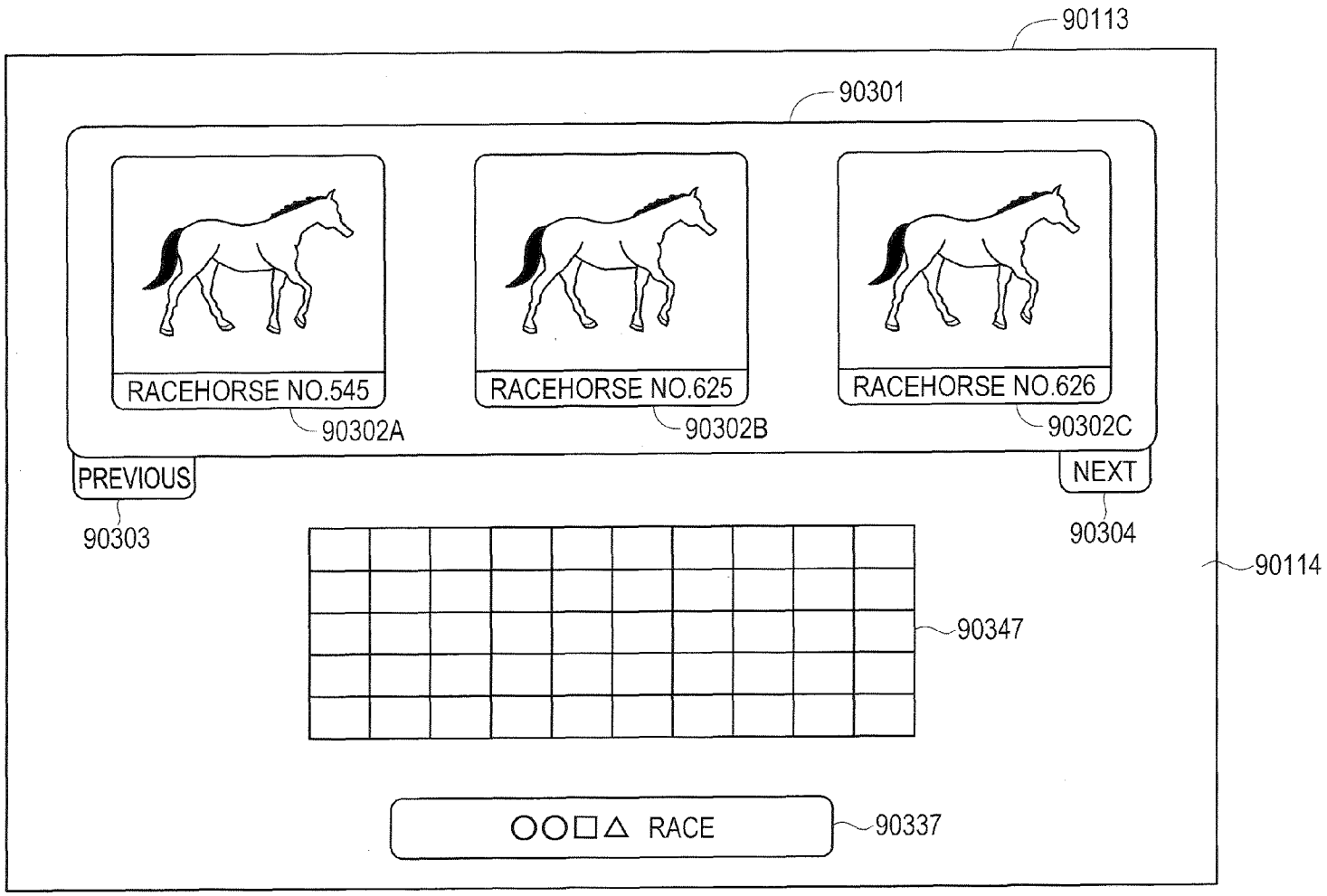
FIG. 113 is a front view showing one example of the owner image displayed on the sub monitor.

In S90507, the sub control unit 90102 executes a race name input process. In this process, as shown in FIG. 113, in the owner image being displayed on the sub monitor 90113, the CPU 90131 provides a letter input display area 90337 and a letter input area 90347 instead of the YES button 90325, the NO button 90326 and the message display area 90327.

Letters and the like are displayed in the letter input area 90347 for inputting a race name of a "player's host race". The content (a race name of a "player's host race") input by the player using the letter input area 90347 is displayed in the letter input display area 90337. Therefore, here, a player inputs a race name of a "player's host race". The CPU 90131 identifies each of the player's touch to the letters and the like in the letter input area 90347 based on a coordinate signal from the touch panel driving circuit 90122. And the CPU 90131 displays the letters and the like corresponding to the identified touch in the letter input display area 90337.

Figure 114:
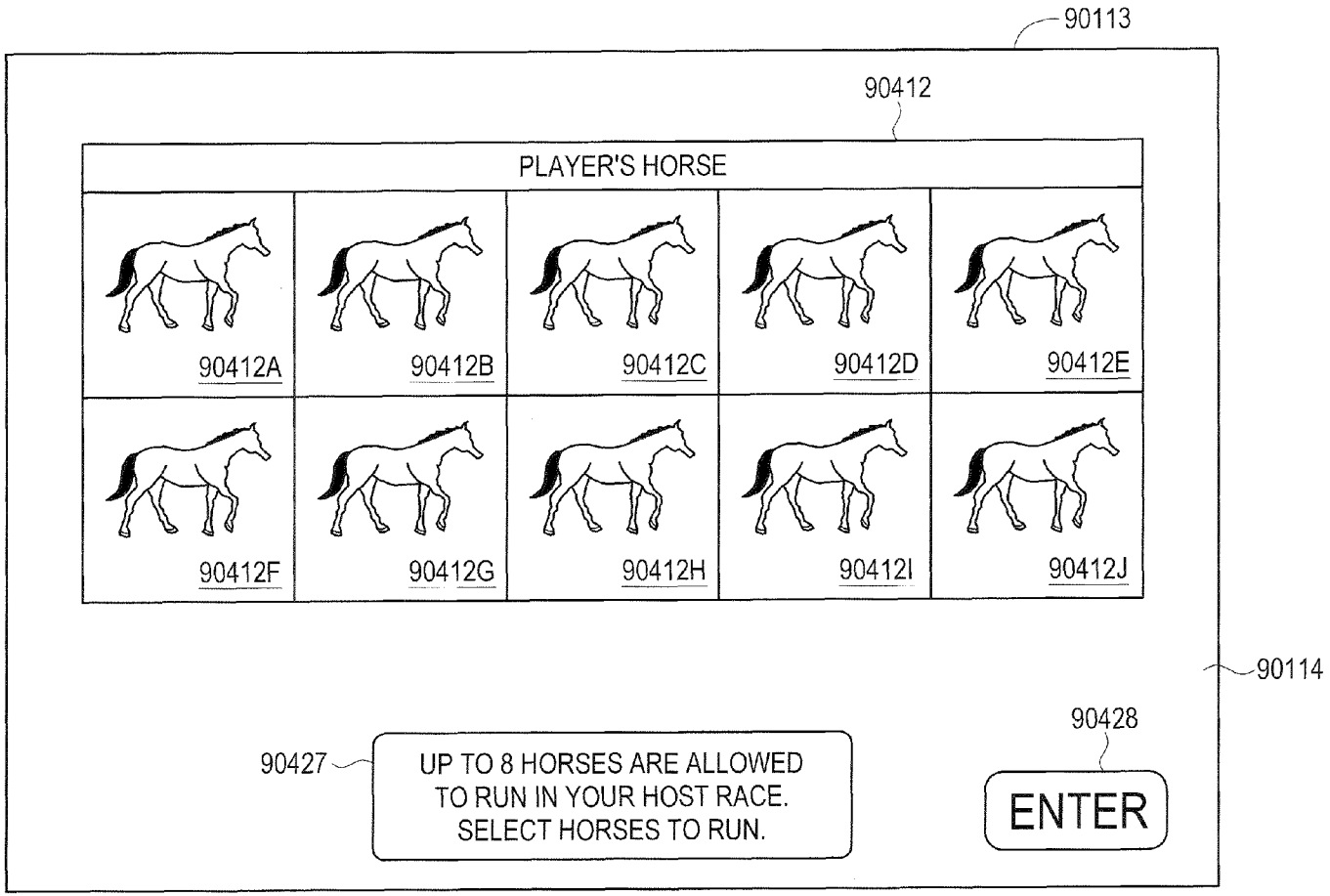
FIG. 114 is a front view showing one example of the owner image displayed on the sub monitor.

In S90508, the sub control unit 90102 executes a starter horse select process. In this process, as shown in FIG. 114, in the owner image being displayed on the sub monitor 90113, the CPU 90131 provides a player's horse display area 90412, a message display area 90427, an enter button 90428, etc.

In the player's horse display area 90412, all of the racehorses whose owner is the player are displayed. The parts in which such racehorses are displayed are used as designation buttons 90412A through 90412J with which a player designates each of the racehorses. The message display area 90427 displays the message "UP TO 8 HORSES ARE ALLOWED TO RUN IN YOUR HOST RACE. SELECT HORSES TO RUN." The enter button 90428 is the button which the player touches for deciding a racehorse which runs in the "player's host race".

Accordingly, after the player designates a racehorse which runs in the "player's host race" by touching any of the designation-buttons 90412A through 90412J, the player is able to decide to have the designated racehorse run in the "player's host race" by touching the enter button 90428. In this time, the CPU 90131 generates a data table which are similar to the data table as shown in above FIG. 105 concerning the "player's host race". And the CPU 90131 associates the racing game with the character ID. Such the data table is stored in the RAM 90132, etc. This designation and decision are repeated while the player wishes so.

In S90509, the sub control unit 90102 determines whether or not an entry limit is full. In this determination, if the number of the racehorses which run in the "player's host race" decided in S90508 above reaches the maximum number (eight in the example of above FIG. 114) of racehorses which are able to make a race entry in the "player's host race", the CPU 90131 determines that the entry limit is full. In this time, the CPU 90131 makes the determination based on the data table generated in S90508 above. Now, if the entry limit is full (S90509: YES), the process proceeds to S90511 below. In contrast, if the entry limit is not full (S90509: NO), the process proceeds to S90510.

In S90510, the sub control unit 90102 executes a starter horse filling process. In this process, the CPU 90131 fills a character ID of a racehorse which is not owned by any of the players in the data table generated in S90508 above so that the data table is filled up with the character ID of the racehorse which runs in the "player's host race".

In S90511, the sub control unit 90102 executes a host game registration process. In this process, when storing in the RAM 90132 entry information including data concerning the decided race entry in the "player's host race", etc. (data such as the race name of the "player's host race", the character ID of the racehorse which runs in the "player's host race", and the player ID), the CPU 90131 simultaneously transmits it to the racing game unit 90011. After that, the game operations described in the flow chart of FIG. 90 is terminated to return to the point P90001 in the game operations described in the flow chart of FIG. 107.

Meanwhile, in the racing game unit 90011, the CPU 90041 associates the racing game corresponding to the "player's host race" with the character ID based on the data concerning the information. Specifically, the CPU 90041 determines whether or not each of the racing games is the "player's host race", by generating a data table as shown in FIG. 111. In the data table of FIG. 111, an existing race name of each of the racing games is stored. The CPU 90041 stores the racing name of the "player's host race" by associating the racing name to the player ID based on the entry information. Such the data table is stored in the RAM 90042 or the external memory device 90025, etc. Incidentally, when the "player's host race" is performed, the CPU 90041 executes the process of S91006 in FIG. 106 above, so as to award a special payout to the player who is a host to the "player's host race".

As described above, in the horse race gaming machine 90001 of this embodiment, when the "player's host race" is performed, the racehorse designated by the player who is a host to the "player's host race" from among the racehorses which are owned by the player runs.

4-9. Display of a Race Name of "Player's Host Race" (the Fourth Embodiment)

In the horse race gaming machine 90001 of this embodiment, when the "player's host race" is performed, a race name which is given by the player who is a host to the "player's host race" is displayed on the main monitor 90021 and the sub monitor 90113.

Figure 115:
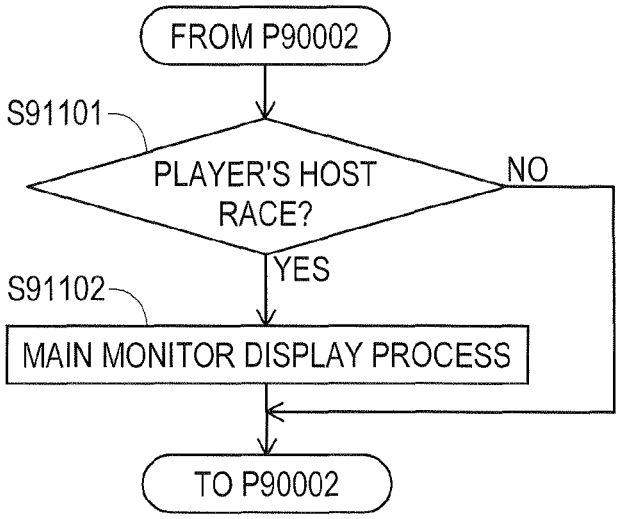
FIG. 115 is a flow chart diagram showing one example of game operations in the horse race gaming machine.

For this purpose, in the racing game unit 90011, the main control unit 90012 executes each of the processes described in the flow chart of FIG. 115 at the point P90002 in between S91003 and S91004 described in the flow chart of FIG. 106.

First, in S91101, the main control unit 90012 determines whether or not this racing game is the "player's host race". In this determination, the CPU 90041 makes the determination by using the data table of FIG. 111 above, etc. Now, if this racing game is not the "player's host race" (S91101: NO), the game operations described in the flow chart of FIG. 115 is terminated to return to the point P90002 in the game operations described in the flow chart of FIG. 106. In contrast, if this racing game is the "player's host race" (S91101: YES), the process proceeds to S91102.

In S91102, the main control unit 90012 executes a main monitor display process. In this process, the CPU 90041 overlays and displays a race name display area 90026, in which the race name of the "player's host race" is displayed, on the horse racing game image of the main monitor 90021 as shown in FIG. 91. The CPU 90041 controls so that this composite image is displayed until the "player's host race" ends. After that, the game operations described in the flow chart of FIG. 115 is terminated to return to the point P90002 in the game operations described in the flow chart of FIG. 106.

Figure 116:
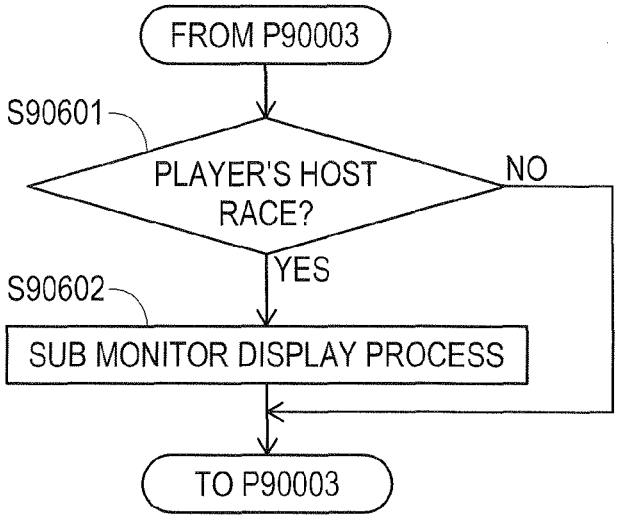
FIG. 116 is a flow chart diagram showing one example of game operations in the horse race gaming machine.

Meanwhile, in each of the stations 90101, the sub control unit 90102 executes each of the processes described in the flow chart of FIG. 116 at the point P90003 in between S90105 and S90106 described in the flow chart of above FIG. 106.

First, in S90601, the sub control unit 90102 determines whether or not this racing game is the "player's host race". In this determination, the CPU 90131 makes the determination based on the racing game information transmitted by the racing game unit 90011 in S91002 of FIG. 106 above. Now, if this racing game is not the "player's host race" (S90601: NO), the game operations described in the flow chart of FIG. 116 is terminated to return to the point P90003 in the game operations described in the flow chart of FIG. 106. In contrast, if this racing game is the "player's host race" (S90601: YES), the process proceeds to S90602.

In S90602, the sub control unit 90102 executes a sub monitor display process. In this process, the CPU 90131 overlays and displays a race name display area 90901, in which the race name of the "player's host race" is displayed, on the sub monitor 90113. The CPU 90131 controls so that this composite image is displayed until the "player's host race" ends. After that, the game operations described in the flow chart of FIG. 116 is terminated to return to the point P90003 in the game operations described in the flow chart of FIG. 106.

4-10. Others (the Fourth Embodiment)

In addition, the present invention is not limited to the above fourth embodiment, but various changes may be made without departing from its scope.

For example, the characteristics of the present invention can be implemented even when configuration is such that the BET operations on a racing game result are limited to those before the racing game.

Alternatively in the horse race gaming machine 90001 of the this embodiment, all of the racehorses which run in a "player's host race" may be only the racehorses owned by the player who is a host to the "player's host race".

Figure 118:
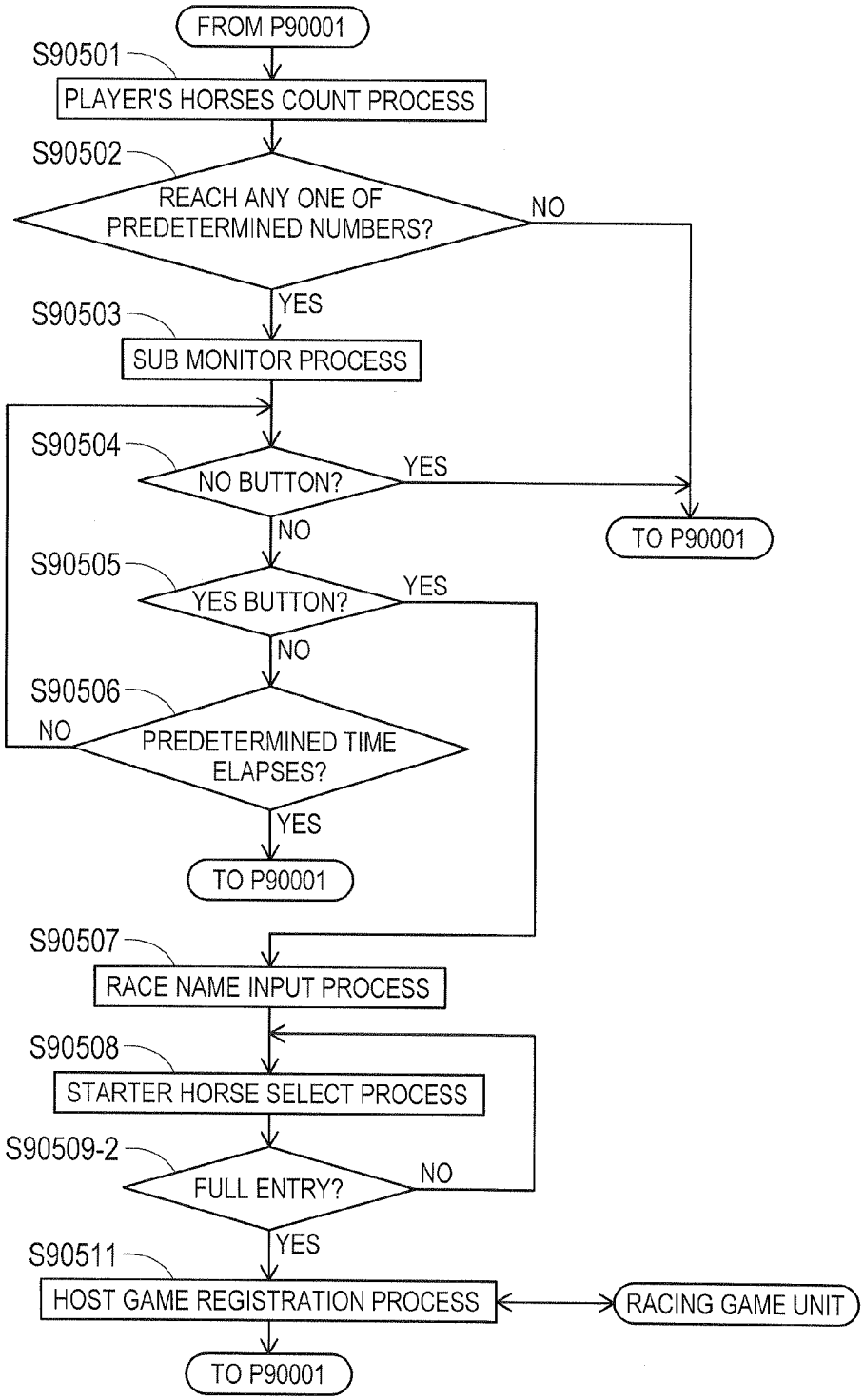
FIG. 118 is a flow chart diagram showing one example of game operations in the horse race gaming machine.

In that case, in each of the stations 90101, the sub control unit 90102 executes each of the processes described in the flow chart of FIG. 118 at the point P90001 immediately after when it is determined that the player does not wish to continue its operation in the owner image of the sub monitor 90113 (S90314: NO in FIG. 107 above). However, respective processes described in the flow chart of FIG. 118 are the same as respective processes described in the flow chart of the above FIG. 90 except the following differences. Therefore, in FIG. 118, a process which is the same as a process described in the flow chart of FIG. 90 has the same reference numeral as the process described in the flow chart of FIG. 90. The differences only are described below.

Namely, after the starter horse select process is executed in S90508, the sub control unit 90102 determines in S90509-2 whether or not an entry limit is full, similarly to S90509 of FIG. 90 above. Now, if the entry limit is full (S90509-2: YES), the process proceeds to S90511 above. In contrast, if the entry limit is not full (S90509-2: NO), the process returns to S90508 above.

With this, unless the number of racehorses which run in the "player's host race" decided in S90508 above reaches the maximum number of racehorses which are able to make a race entry in the "player's host race", the starter horse select process of S90508 above will be repeated. Thus, all of the racehorses which run in the "player's host race" can be only the racehorses owned by the player who is a host to the "player's host race". However, if the number of the racehorses owned by the player is smaller than the maximum number of racehorses which are able to make a race entry in the "player's host race", the sub control unit 90102 controls to execute the starter horse filling process of S90510 in the flow chart of FIG. 90 above.

5-1. Characteristics of a Horse Race Gaming Machine (the Fifth Embodiment)

In the following, a description is made on the fifth embodiment of the present invention with reference to drawings.

Figure 120:
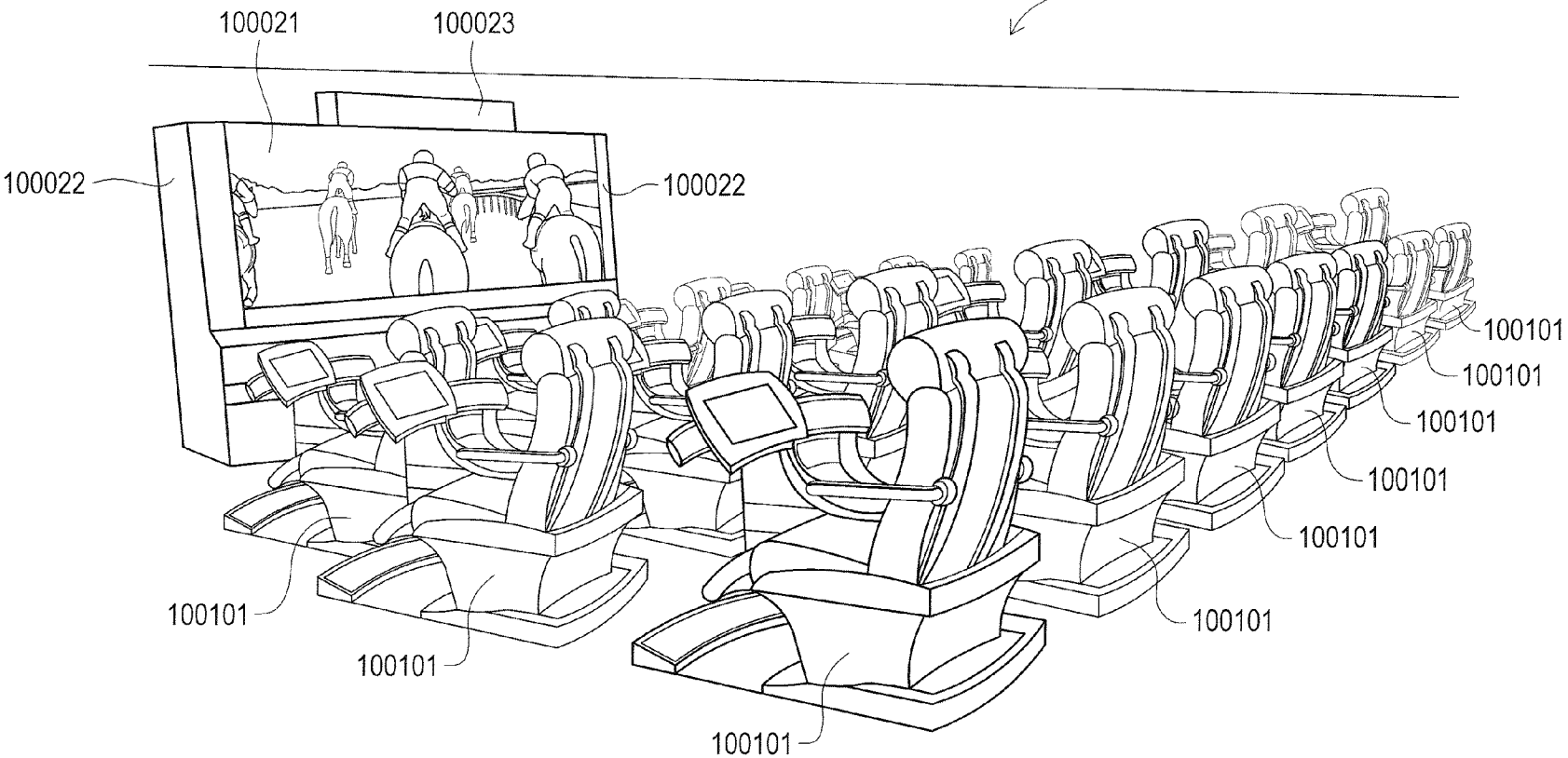
Figure 121:
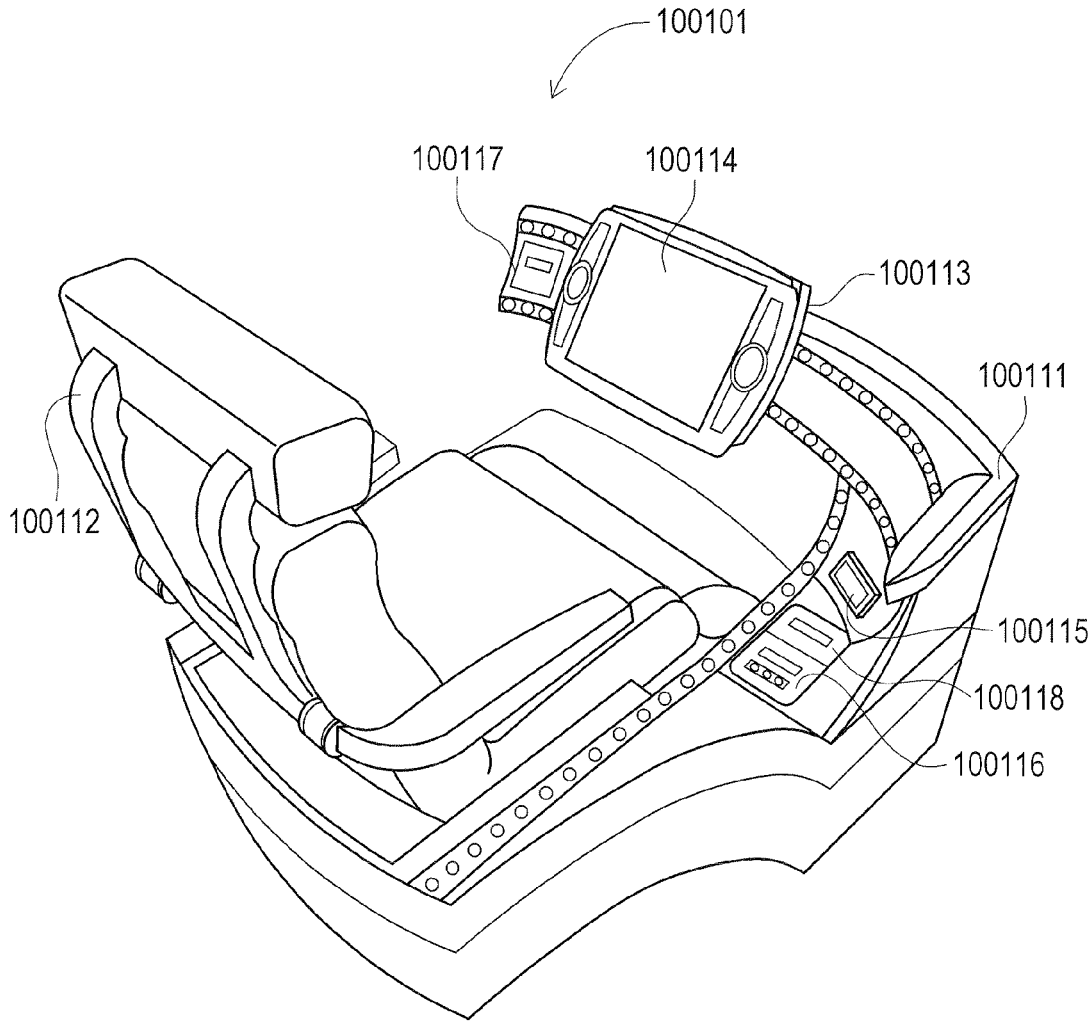

FIG. 120 is a perspective view of a horse race gaming machine 100001 that is one embodiment of the present invention. As shown in FIG. 120, the horse race gaming machine 100001 of this embodiment has a main monitor 100021 and a plurality of stations 100101. The main monitor 100021 displays images of a horse racing game. Players being seated at the respective stations 100101 can respectively participate in this horse racing game. The players being seated at the respective stations 100101 participate in this horse racing game by forecasting a result of each racing game of the horse racing game and performing BET operations. Namely, a horse racing game is constituted of a number of racing games that are intermittently executed in a sequential manner. FIG. 121 is a perspective view of the station 100101. A sub monitor 100113 or a touch panel 100114 that each station 100101 is provided with is used to perform BET operations.

In this respect, in the horse race gaming machine 100001 of this embodiment, BETting on racing game result can be performed before or during the racing game.

Figure 119:
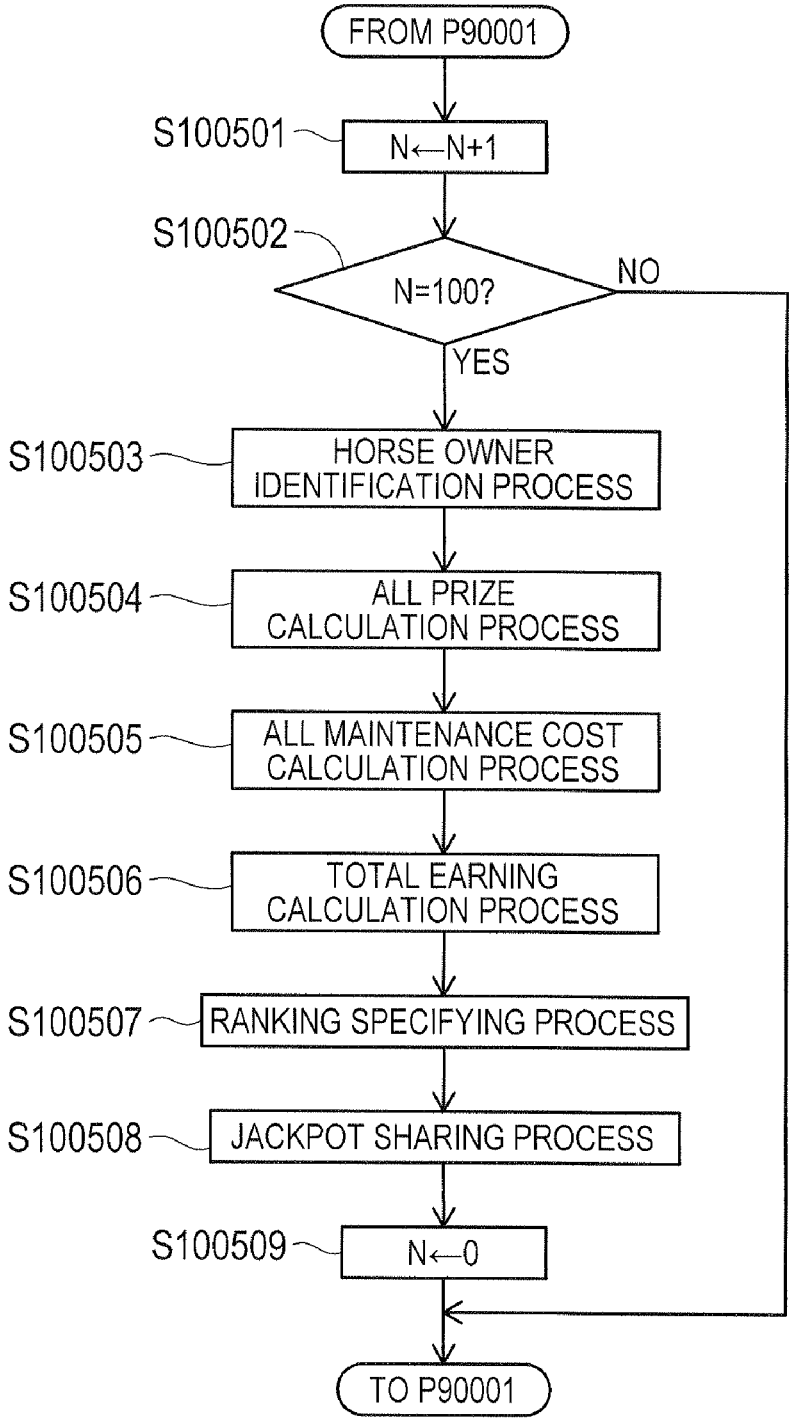
FIG. 119 is a view showing characteristics of a horse race gaming machine of the fifth embodiment of the present invention and a flow chart diagram showing one example of game operations in the horse race gaming machine.

FIG. 119 is a view showing characteristics of the horse race gaming machine 100001 of this embodiment and a flow chart diagram showing one example of game operations in the horse race gaming machine 100001. In the horse race gaming machine 100001 of this embodiment, whenever a racing game is executed 100 times (S100502: YES), a total prize amount earned by a player who is a racehorse owner is calculated (S100506, refer to FIG. 141 below). According to a rank corresponding to the calculated total prize amount (S100507, refer to FIG. 142 below), the player who is the racehorse owner is awarded a part of jackpot prize (S100508).

In addition, a racehorse whose owner is any player may get ill (S101006-2 of FIG. 139 below). When a racehorse gets ill, a player who is its owner selects whether to treat or sell the racehorse (S100601, S100604 of FIG. 144 below). When the player selects to treat (S100601 of FIG. 144 below: YES), medical expense thereof is recorded as a maintenance cost (S100603 of FIG. 144 below and S101009 of FIG. 139 below). In contrast, when the player selects to sell (S100604 of FIG. 144 below: YES), the proceeds from the sale are recorded as a prize (S100605 of FIG. 144 below and S101009 of FIG. 139 below). These are considered in the calculation of the total prize amount earned by the player who is the racehorse owner (S100506, refer to FIG. 141 below).

5-2. Appearance of a Horse Race Gaming Machine (the Fifth Embodiment)

As shown in FIG. 120, the horse race gaming machine 100001 of this embodiment has the main monitor 100021, speakers 100022, a display device 100023, the plurality of stations 100101, etc. The main monitor 100021 displays images of a horse racing game, etc. The speakers 100022 output sound of a horse racing game, etc. The display device 100023 displays information about games in general.

As shown in FIG. 121, in each station 100101, a cabinet 100111 is provided with a chair 100112, the sub monitor 100113, the touch panel 100114, a bill identifying device 100115, a ticket printer 100116, an IC card issuing device 100117, a reader/writer 100118, etc. A player sits on the chair 100112. The sub monitor 100113 displays BET images described later, etc. The touch panel 100114 is provided on the screen of the sub monitor 100113. When the player performs the BET operations utilizing a regular BET image described later or a high BET image described later or the player performs specific operations utilizing an owner image described later or an entry-possible race image described later, the touch panel 100114 is used.

The bill identifying device 100115 not only identifies whether or not a bill is appropriate but also receives legitimate bills into the cabinet 100111. Then, bills inserted into the cabinet 100111 are converted into the number of coins, and the credit amount that corresponds to the converted number of coins is added as the player's own credit amount. The bill identifying device 100115 is also configured to be capable of reading bar coded tickets described later.

The ticket printer 100116 is a printer that prints on a ticket a bar code representative of coded data such as a player's own credit amount, date, identification number of the station 100101, etc. and outputs it as a bar coded ticket. A player can have the outputted bar coded ticket read by other station 100101 and play at this other station 100101, or use it for any procedure in predetermined places in a game arcade.

The IC card issuing device 100117 is a device that issues an IC card 100119 (refer to FIG. 123 below) on which horse owner information 100501 (refer to FIG. 133 below) is stored. The IC card 100119 (refer to FIG. 123 below) is inserted into the reader/writer 100118.

5-3. Example of Configuration of a Racing Game Unit (the Fifth Embodiment)

Figure 122:
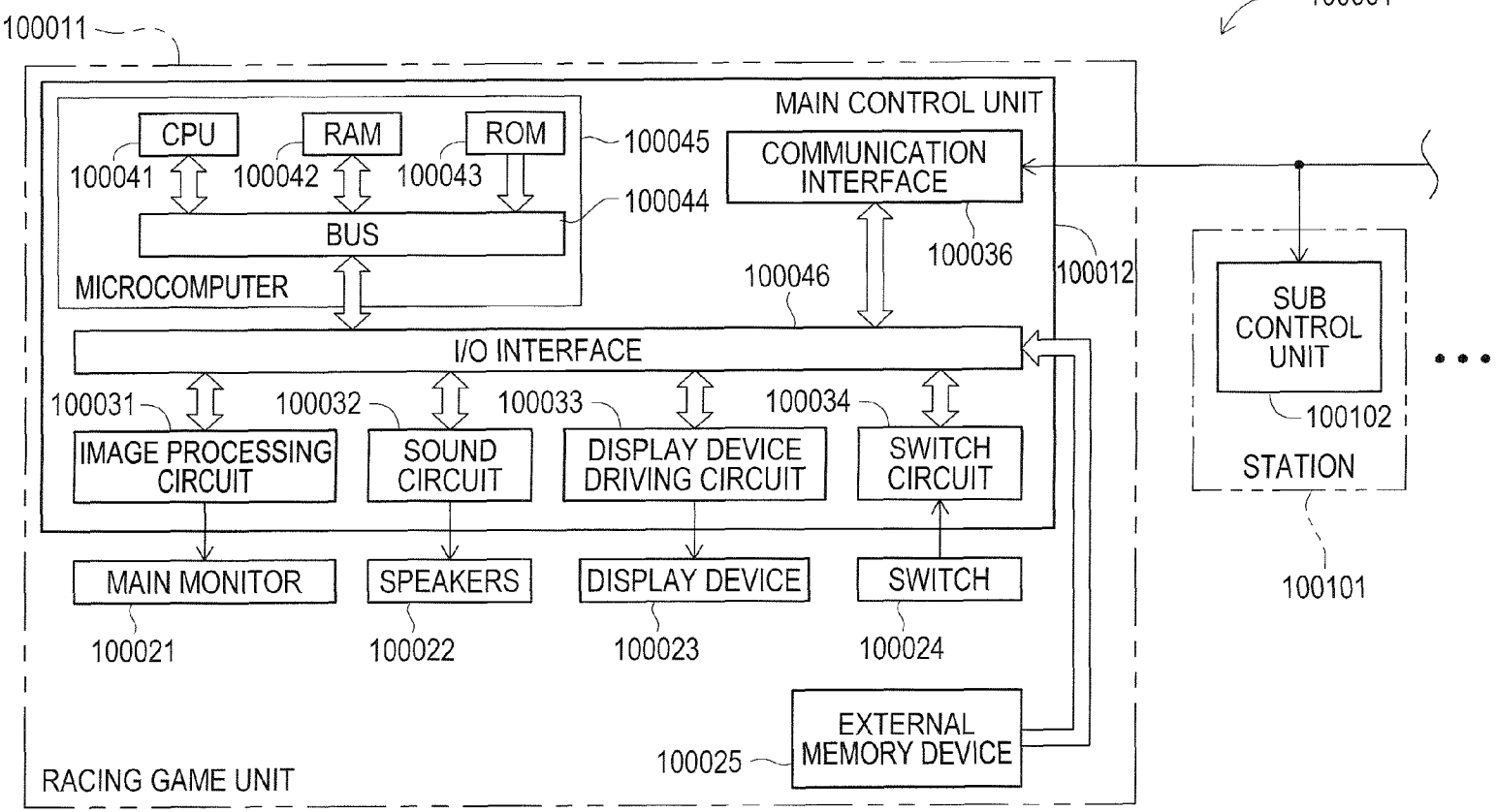

A racing game unit is an opposite concept of each station 100101 and constitutes a core of the horse race gaming machine 100001 of this embodiment. FIG. 122 is a block diagram of a racing game unit 100011. As shown in FIG. 122, the racing game unit 100011 is composed of a main control unit 100012, the main monitor 100021, the speakers 100022, the display device 100023, a switch 100024, an external memory device 100025, etc. The main control unit 100012 and external memory device 100025 are provided separately from the main monitor 100021, the speakers 100022, or the display device 100023. Although the switch 100024 is annexed to the main control unit 100021, it may be provided individually.

The main control unit 100012 is generally composed of a microcomputer 100045 as the kernel comprising a CPU 100041, a RAM 100042, a ROM 100043 and a bus 100044 for transferring data mutually between these elements. The RAM 100042 and the ROM 100043 are connected to the CPU 100041 via the bus 100044. The RAM 100042 is a memory for temporarily storing a variety of data which have been operated in the CPU 100041. The ROM 100043 stores various types of programs, data tables or the like for executing necessary processes to control the horse race gaming machine 100001.

An image processing circuit 100031 is connected to the microcomputer 100045 via an I/O interface 100046. The image processing circuit 100031 is connected to the main monitor 100021 and controls driving of the main monitor 100021.

The image processing circuit 100031 is composed of a program ROM, an image ROM, an image control CPU, a work RAM, a VDP (video display processor), and a video RAM, etc. And in the program ROM, an image control program related to display on the main monitor 100021, and various selection tables are stored. And, in the image ROM, dot data to form images and the like, for example dot data to form images displayed on the main monitor 100021, are stored. And, based on parameters set by the microcomputer 100045, the image control CPU determines the images displayed on the main monitor 100021 among the dot data stored beforehand in the image ROM, according to the image control program stored beforehand in the program ROM. And, the work RAM works as a temporary memory when the image control program is executed in the image control CPU. And the VDP forms image data corresponding to display contents determined by the image control CPU. And the VDP outputs the image data formed thereby to the main monitor 100021. And the video RAM works as a temporary memory when the images are formed by the VDP.

A sound circuit 100032 is connected to the microcomputer 100045 via the I/O interface 100046. The speakers 100022 are connected to the sound circuit 100032 and are arranged on both lateral sides of the main monitor 100021. The speakers 100022 output various types of effect sound, BGM, etc. when various types of effect are performed, by being subjected to output control by the sound circuit 100032 based on a drive signal from the CPU 100041.

A display device driving circuit 100033 is connected to the microcomputer 100045 via the I/O interface 100046. The display device 100023 is connected to the display device driving circuit 100033. The display device 100023 is disposed on the upper side of the main monitor 100021 and displays information about games in general, by being subjected to display control by the display device driving circuit 100033 based on a drive signal from the CPU 100041.

A switch circuit 100034 is connected to the microcomputer 100045 via the I/O interface 100046. The switch 100024 is connected to the switch circuit 100034 and is arranged in the lower part of the main monitor 100021. The switch 100024 inputs an instruction by an operator's setting operation into the CPU 100041 based on a switch signal from the switch circuit 100034.

The external memory device 100025 is connected to the microcomputer 100045 via the I/O interface 100046. The external memory device 100025 is arranged in the periphery of the main monitor 100021 and has capability similar to the image ROM in the image processing circuit 100031, by storing dot data for forming images, such as dot data for forming images on the main monitor 100021. Thus, when determining any image to be displayed on the main monitor 100021, the image control CPU in the image processing circuit 100031 adds the dot data stored in advance in the external memory device 100025 to a target of the determination.

A communication interface 100036 is connected to the microcomputer 100045 via the I/O interface 100046. A sub control unit 100102 of each station 100101 is connected to the communication interface 100036. This enables bidirectional communication between the CPU 100041 and each station 100101. The CPU 100041 can receive and transmit a command, request and data from/to each station 100101 via the communication interface 100036. Therefore, in the horse race gaming machine 100001, the main control unit 100012 controls progress of the horse racing game in cooperation with each station 100101.

5-4. Example of Configuration of a Station (the Fifth Embodiment)

Figure 123:
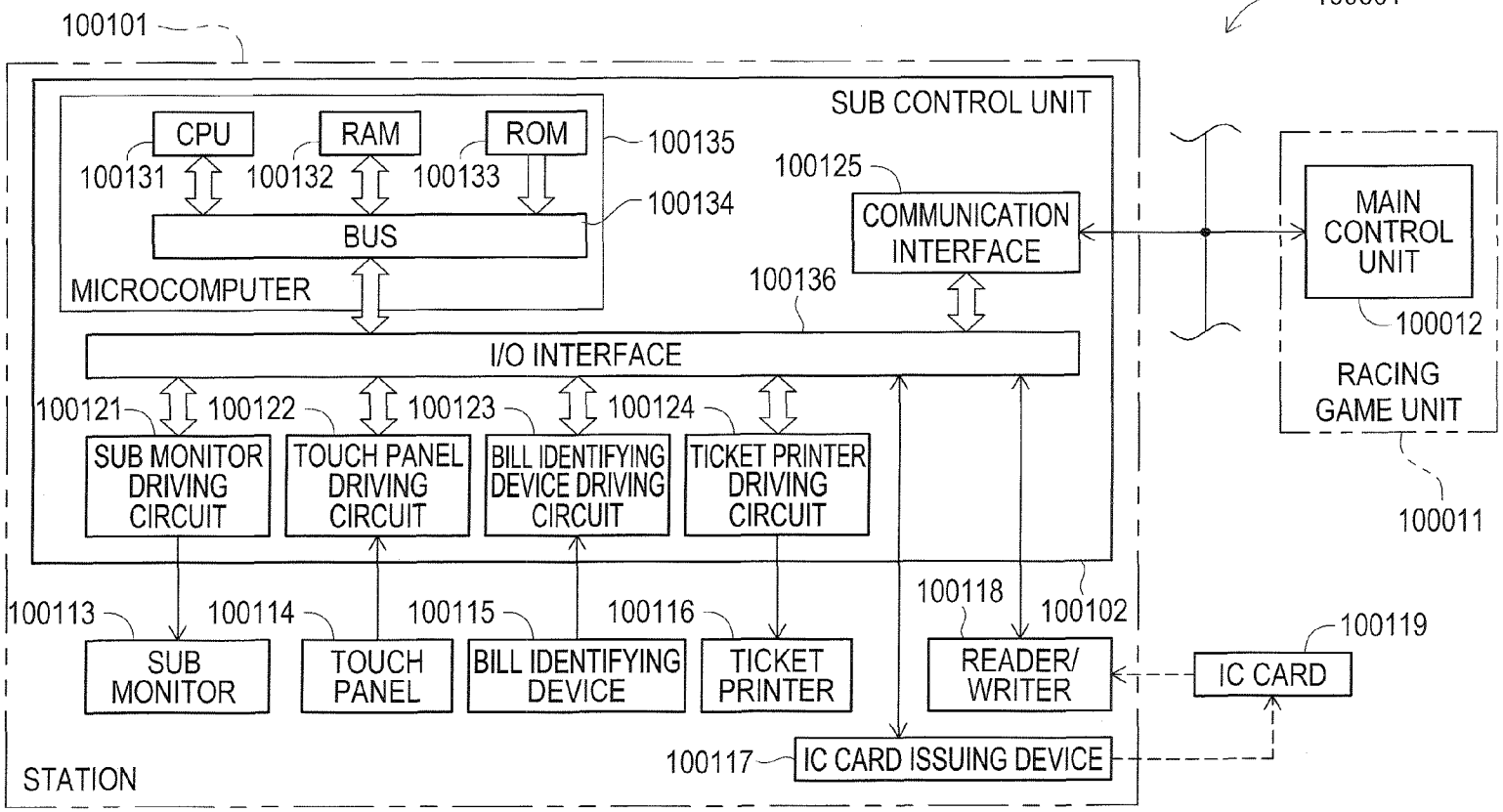

FIG. 123 is a block diagram of a station 100101. As shown in FIG. 123, the station 100101 is composed of the sub control unit 100102, the sub monitor 100113, the touch panel 100114, the bill identifying device 100115, the ticket printer 100116, the IC card issuing device 100117, the reader/writer 100118, etc.

The sub control unit 100102 is generally composed of a microcomputer 100135 as the kernel comprising a CPU 100131, a RAM 100132, a ROM 100133 and a bus 100134 for transferring data mutually between these elements. The RAM 100132 and the ROM 100133 are connected to the CPU 100131 via the bus 100134. The RAM 100132 is a memory for temporarily storing a variety of data which have been operated in the CPU 100131. The ROM 100133 stores various types of programs, data tables or the like for executing necessary processes to control the horse race gaming machine 100001.

A sub monitor driving circuit 100121 is connected to the microcomputer 100135 via an I/O interface 100136. The sub monitor 100113 is connected to the sub monitor driving circuit 100121. The sub monitor driving circuit 100121 controls driving of the sub monitor 100113 based on a drive signal from the aforementioned racing game unit 100011. The sub monitor driving circuit 100121 has also similar configuration and capabilities to the image processing circuit 100031 as shown in FIG. 122 above, and controls driving of the sub monitor 100113 so that the regular BET image, the high BET image, the owner image or the entry-possible race image described later are displayed.

A touch panel driving circuit 100122 is connected to the microcomputer 100135 via the I/O interface 100136. The touch panel 100114 is connected to the touch panel driving circuit 100122 and is arranged on the screen of the sub monitor 100113. The touch panel 100114 inputs an instruction into the CPU 100131 through touch operation of a player (touch position), based on a coordinate signal from the touch panel driving circuit 100122.

A bill identifying driving circuit 100123 is connected to the microcomputer 100135 via the I/O interface 100136. The bill identifying device 100115 is connected to the bill identifying driving circuit 100123. The bill identifying device 100115 identifies whether or not a bill or a bar coded ticket is appropriate. When receiving a legitimate bill, the bill identifying device 100115 inputs a value of the bill into the CPU 100131 based on an identification signal from the bill identifying driving circuit 100123. In addition, when receiving a legitimate bar coded ticket, the bill identifying device 100115 inputs a credit amount, etc. recorded on the bar coded ticket into the CPU 100131 based on an identification signal from the bill identifying driving circuit 100123.

A ticket printer driving circuit 100124 is connected to the microcomputer 100135 via the I/O interface 100136. The ticket printer 100116 is connected to the ticket printer driving circuit 100124. The ticket printer 100116 prints on a ticket a bar code representative of coded data such as owned credit amount, etc., stored in the RAM 100132, and outputs it as a bar coded ticket, by being subjected to output control by the ticket printer driving circuit 100124 based on a drive signal to be outputted from the CPU 100131.

The IC card issuing device 100117 is connected to the microcomputer 100135 via the I/O interface 100136. With an output controlled based on a drive signal to be outputted from a CPU 100131, the IC card issuing device 100117 issues an IC card 100119 that stores data such as horse owner information 100501 (refer to FIG. 133 below), etc.

The reader/writer 100118 is connected to the microcomputer 100135 via the I/O interface 100136. With a drive controlled based on a drive signal to be outputted from the CPU 100131, the reader/writer 100118 inputs information read from an IC card 100119 into CPU 100131 or stores various types of information such as horse owner information 100501 (refer to FIG. 133 below) into an IC card 100119.

A communication interface 100125 is connected to the microcomputer 100135 via the I/O interface 100136. The main control unit 100012 of the racing game unit 100011 is connected to the communication interface 100125. This enables bidirectional communication between the CPU 100131 and the racing game unit 100011. The CPU 100131 can receive and transmit a command, request and data from/to the racing game unit 100011 via the communication interface 100125. Therefore, in the horse race gaming machine 100001, the sub control unit 100102 controls progress of the horse racing game in cooperation with the racing game unit 100011.

5-5. Example of Game Operations of a Horse Race Gaming Machine (the Fifth Embodiment)

In the following, a description is made on an example of game operations of the horse race gaming machine 100001 of this embodiment. FIG. 135 is a flow chart diagram showing one example of game operations in the horse race gaming machine 100001 of this embodiment. It is to be noted that respective stations 100101 perform similar game operations respectively in cooperation with the racing game unit 100011. In order to avoid any complication, however, only one station 100101 is shown in FIG. 135.

The racing game unit 100011 performs respective operations from S101001 to S101006.

First, in S101001, the main control unit 100012 executes a racing game preparation process. In this process, for this racing game which constitutes a horse racing game, the CPU 100041 determines a track, starter horse, start time, etc, and reads data on them from the ROM 100043.

In S101002, the main control unit 100012 transmits racing game information. In this transmission, the CPU 100041 transmits respective data on the track, starter horse, start time, etc. of this racing game to each station 100101, as racing game information.

In S101003, the main control unit 100012 determines whether or not the present time is race start time of the racing game. In this determination, the CPU 100041 checks time until the time to start this racing game is reached (S101003: NO).

The CPU 100041 may also determine whether or not the present time is the time to start this racing game, by timing an interval from the last racing game.

When the time to start this racing game is reached (S101003: YES), the process proceeds to S101004 and the main control unit 100012 executes a racing game display process. In this process, based on the determination in S101001 above, the CPU 100041 not only displays race images of this racing game on the main monitor 100021 but also outputs sound of this racing game from the speakers 100022.

In S101004-2, the main control unit 100012 executes a jackpot prize inclusion process. In this process, the CPU 100041 includes a part of total BET amount set for this racing game into a jackpot prize amount, based on the data on BET information transmitted by the respective stations 100101 in S100105 below. The jackpot prize amount is stored in the RAM 100042.

In S101005, the main control unit 100012 executes a racing game result process. In this process, the CPU 100041 calculates a payout amount of the respective stations 100101, based on the racing game result in S101004 above and the BET information transmitted by the respective stations 100101 in S100105 below, etc.

In addition, the CPU 100041 identifies a player who plays at the respective station 100101. The identification is executed based on the BET information transmitted by the respective stations 100101 to the racing game unit 100011 in S100105 below. Then, the CPU 100041 generates a data table as shown in FIG. 140. In the data table shown in FIG. 140, player IDs are stored so that they correspond to station Nos. The player IDs are included in the BET information transmitted by the respective stations 100101 to the racing game unit 100011 in S100105 below. Thus, in this process, the CPU 100041 reflects in the data table of FIG. 140 a correspondence between the station Nos. and the player IDs included in the BET information in this racing game. Such the data table is stored in the RAM 100042 or the external memory device 100025, etc.

In S101006, the main control unit 100012 transmits racing game payout information. In this transmission, the CPU 100041 transmits to the respective corresponding stations 100101 respective payout amounts, etc. in S101005 above, as racing game payout information.

In addition, when transmitting the racing game payout information, the CPU 100041 includes data showing the jackpot prize amount at this time into the racing game payout information.

Thereafter, similar processes are also repeated in the next racing game.

Meanwhile, in the respective stations 100101, respective operations of S100101 to S100107 are performed.

First, in S100101, the sub control unit 100102 executes a BET image display process. The respective stations 100101 execute the BET image display process based on a flow chart of FIG. 138.

Figure 124:
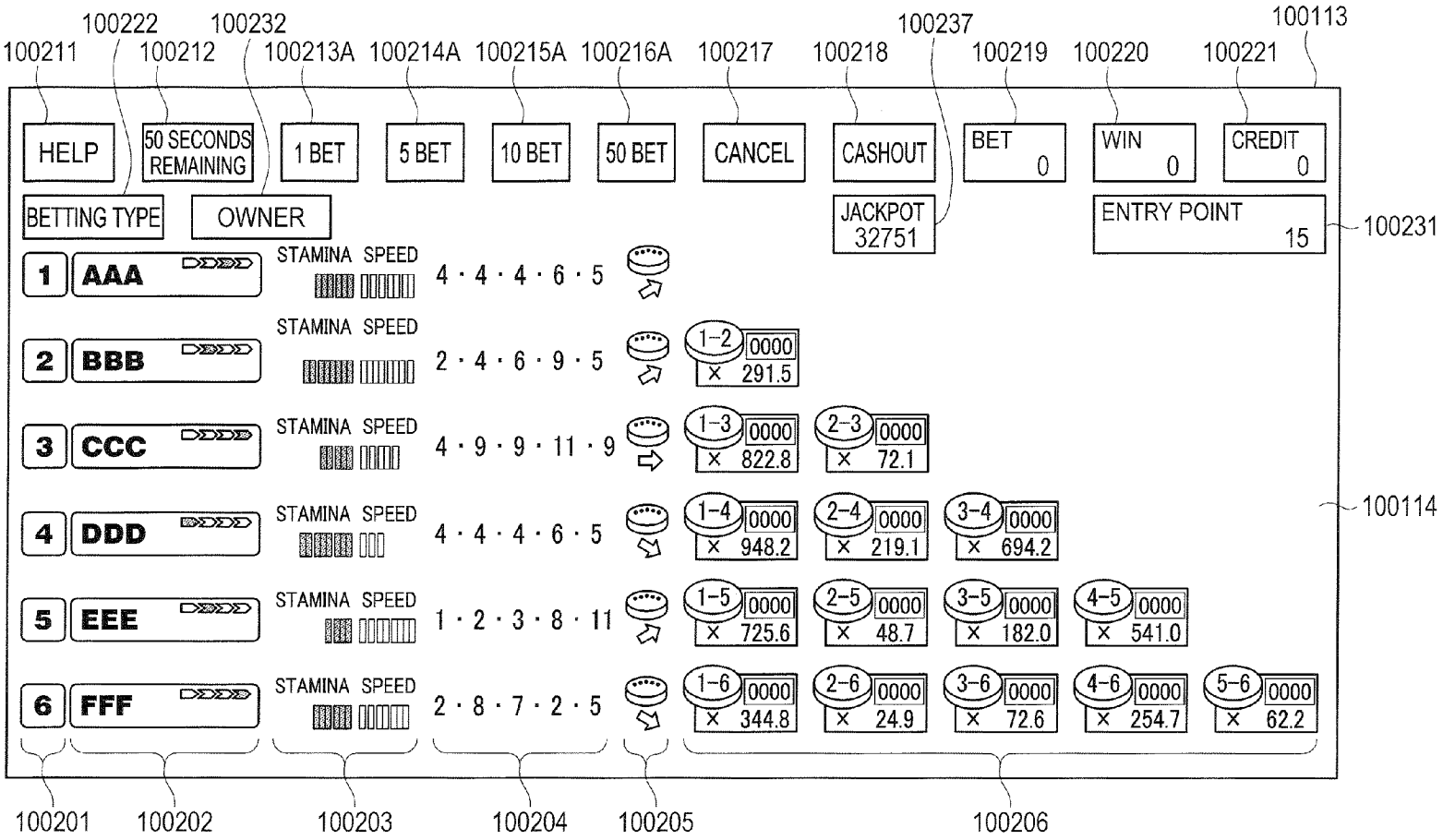

First, in S100201, the sub control unit 100102 executes a regular denomination process. In this process, the CPU 100131 displays a regular BET image of this racing game on the sub monitor 100113, based on the data related to the racing game information transmitted by the racing game unit 100011 in S101002 above. FIG. 124 shows one example of the regular BET image displayed on the sub monitor 100113.

As shown in FIG. 124, in a regular BET image displayed on the screen of the sub monitor 100113 covered by the light transmissive colorless touch panel 100114 are provided a horse number display area 100201, a horse name display area 100202, a basic power display area 100203 that displays speed and stamina by a bar graph, a performance display area 100204 that displays orders of arrival in last five races, a brief comment display area 100205 that displays the condition of this racing game by an arrow, a betting ticket purchase button display area 100206 where a betting ticket purchase button of a quinella-type bet in which a player randomly picks a combination of horse numbers that will finish in the first place and in the second place in order to win, odds or BET amounts are displayed together, etc.

In addition, in the regular BET image are provided a help button 100211, a time display area 100212, a 1 BET button 100213A, a 5 BET button 100214A, a 10 BET button 100215A, a 50 BET button 100216A, a cancel button 100217, a CASHOUT button 100218, a BET amount display area 100219, a payout amount display area 100220, a credit amount display area 100221, a betting ticket type switch button 100222, an owner button 100232, an entry point display area 100231, a jackpot display area 100237, etc.

The help button 100211 is a button that a player touches to display a method of BET operation, etc. on the sub monitor 100113. The time display area 100212 displays BET time in terms of the remaining time. The 1 BET button 100213A is a button that a player touches to set so that "1" is added to the present BET amount. The 5 BET button 100214A is a button that a player touches to set so that "5" is added to the present BET amount. The 10 BET button 100215A is a button that a player touches to set so that "10" is added to the present BET amount. The 50 BET button 100216A is a button that a player touches to set so that "50" is added to the present BET amount. Accordingly, the denomination of the regular BET image is "1". In other words, the minimum bet amount that a player can specify in the regular BET image is "1".

The cancel button 100217 is a button that a player touches to cancel the setting of addition to the BET amount. The CASHOUT button 100218 is a button that a player touches to be paid out the number of coins corresponding to a player's own credit amount in bar coded tickets printed by the ticket printer 100116. The BET amount display area 100219 displays the total BET amount that a player sets for this racing game. The payout amount display area 100220 displays a payout amount of this racing game. The credit amount display area 100221 displays a player's own credit amount.

Touching any of the betting ticket purchase buttons within the betting ticket purchase button display area 100206 after touching any of the respective BET buttons 100213A, 100214A, 100215A, and 100216A, a player can perform the BET operation of the quinella-type bet. For example, if a player touches the betting ticket purchase button for "1-2" in the betting ticket purchase button display area 100206 after touching the 10 BET button 100215A, the player can set addition of "10" to the present BET amount for a combination of No. 1 and No. 2, as a combination of horse numbers that the player forecasts will finish in the first or second places in no particular order. The present BET amount for respective combinations of horse numbers are displayed next to the betting ticket purchase buttons corresponding to the respective combinations.

Although the regular BET image shown in FIG. 124 is for the quinella-type bet, such respective types of betting as win, place, bracket quinella, quinella place, exacta, trio, trifecta, etc. are also available, and every time a player touches the betting ticket type switch button 100222, the regular BET image changes to a regular BET image of a different type.

Various data in the regular BET image such as horse names and odds, etc. is included in data on the racing game information transmitted by the racing game unit 100011 in S101002 above.

The owner button 100232 is a button that a player touches when he/she wants to purchase a racehorse. The entry point display area 100231 displays entry points owned by a player. The jackpot display area 100237 displays the jackpot prize amount.

Returning to FIG. 138, in S100202, the sub control unit 100102 determines whether or not a race entry has been made. In this determination, the CPU 100131 makes a determination based on the data related to race entry information stored in the RAM 100132, etc. described later. Then, if the race entry has been made (S100202: YES), the process proceeds to S100205 below. In this case (S100202: YES), the player is an owner of any racehorse. The player has also made the race entry of his/her own racehorse in any racing game. In contrast, if the race entry has not been made (S100202: NO), the process proceeds to S100203.

In S100203, the sub control unit 100102 determines whether or not an IC card 100119 is inserted into the reader/writer 100118. In this determination, the CPU 100131 makes a determination based on the data on whether or not there is an IC card 100119 transmitted by the reader/writer 100118, etc. Now if an IC card 100119 is not inserted into the reader/writer 100118 (S100203: NO), the process proceeds to S100210 below. In contrast, if an IC card 100119 is inserted into the reader/writer 100118 (S100203: YES), the process proceeds to S100204.

In S100204, the sub control unit 100102 determines whether or not a player is an owner of any racehorse. In this determination, the CPU 100131 makes a determination based on the data on horse owner information 100501 (refer to FIG. 133 below) stored in the RAM 100132 or an IC card 100119, etc. The horse owner information 100501 (refer to FIG. 133 below) stored in an IC card 100119 is read out by the reader/writer 100118 and inputted into the CPU 100131. Now, if a player is not an owner of any racehorse (S100204: NO), the process proceeds to S100210 below. In contrast, if the player is an owner of any racehorse (S100204: YES), the process proceeds to S100205.

Figure 125:
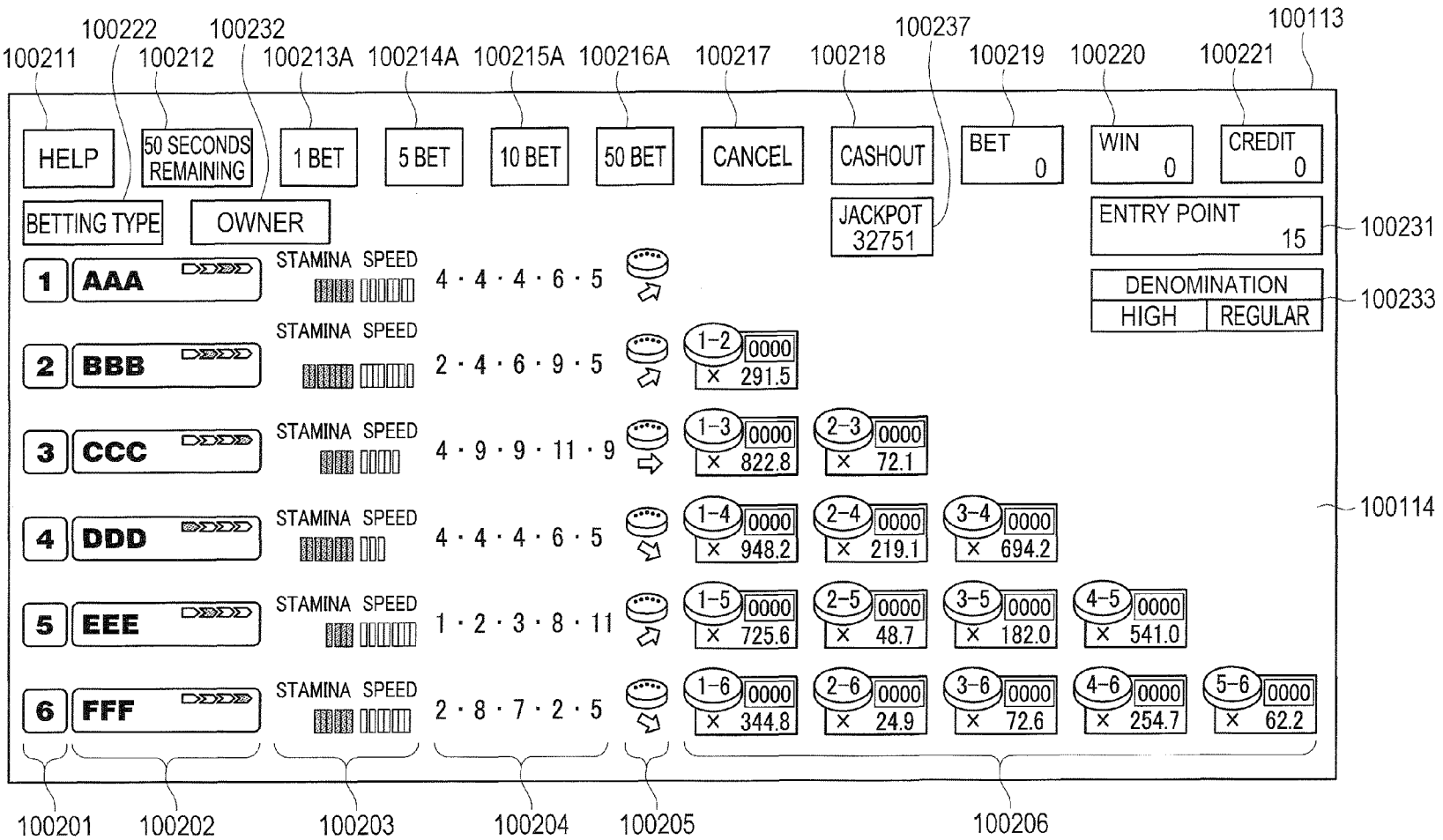

In S100205, the sub control unit 100102 executes a sub monitor display process. In this process, the CPU 100131 changes the regular BET image being displayed on the sub monitor 100113 to a regular BET image as shown in FIG. 125. In other words, a denomination button 100233 is synthesized and displayed on the regular BET image as shown in FIG. 124. The denomination button 100233 includes a regular button and a high button.

In S100206, the sub control unit 100102 determines whether or not a player has touched the regular button. In this determination, based on a coordinate signal from the touch panel driving circuit 100122, the CPU 100131 determines whether or not the player has touched the regular button included in the denomination button 100233. Now, if the player has touched the regular button (S100206: YES), the process proceeds to S100210 below. In contrast, if the player has not touched the regular button (S100206: NO), the process proceeds to S100207.

In S100207, the sub control unit 100102 determines whether or not the player has touched the high button. In this determination, based on a coordinate signal from the touch panel driving circuit 100122, the CPU 100131 determines whether or not the player has touched the high button included in the denomination button 100233. Now, if the player has not touched the high button (S100207: NO), the process returns to S100206 above. In contrast, if the player has touched the high button (S100207: YES), the process proceeds to S100208.

In other words, the respective determination processes of S100206 and S100207 above are repeated until the player touches either the regular button or the high button included in the denomination button 100233. However, similar to the determination process in S100103 below, the sub control unit 100102 determines whether or not the BET time has elapsed even while the respective determination processes of S100206 and S100207 above are being repeated. If the sub control unit 100102 determines that the BET time has elapsed before the player touches either the regular button or the high button included in the denomination button 100233, the process is forced to proceed to S100210 below.

Figure 126:
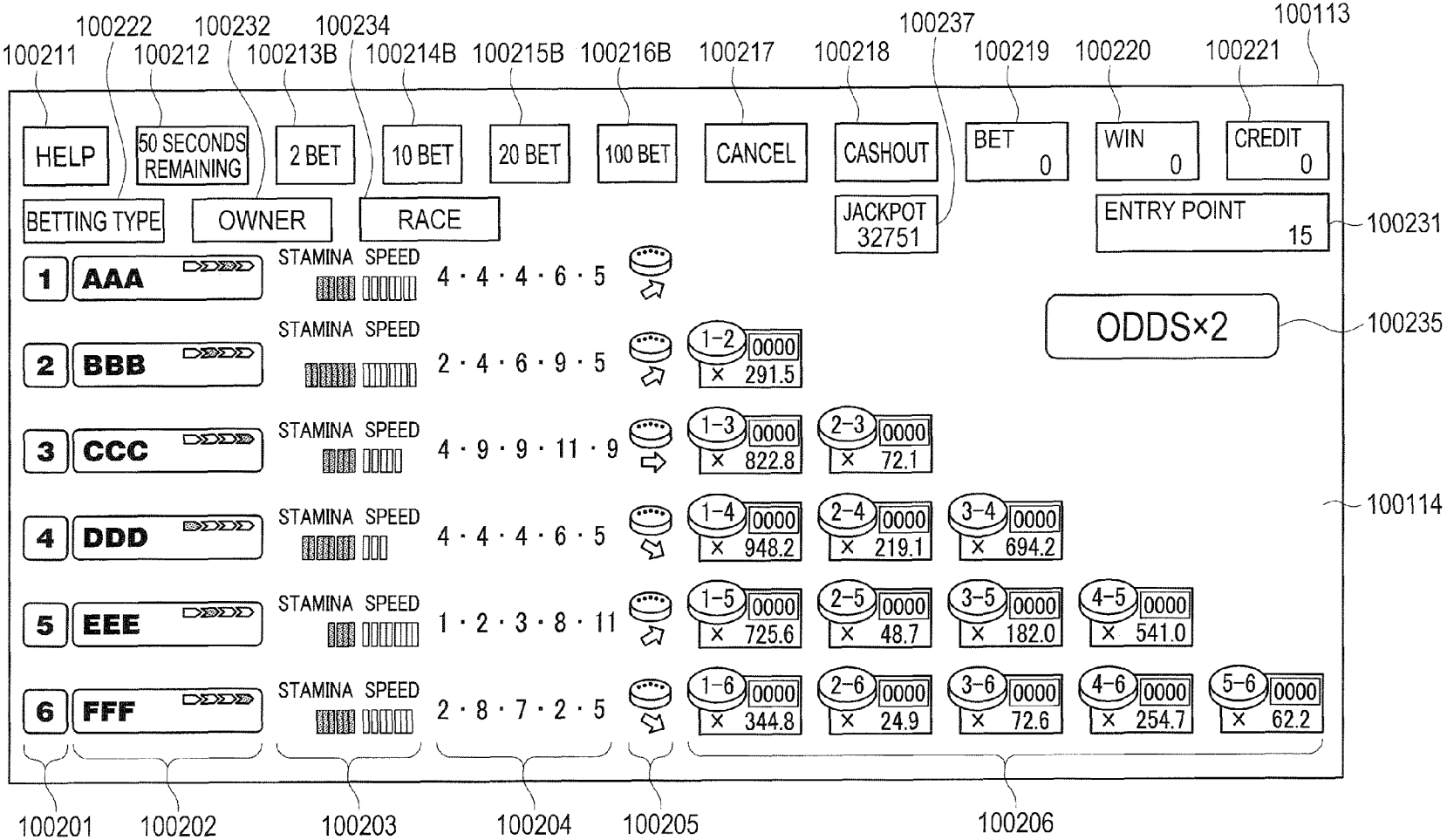

In S100208, the sub control unit 100102 executes a high denomination process. In this process, the CPU 100131 displays a high BET image of this racing game on the sub monitor 100113. FIG. 126 shows one example of the high BET image displayed on the sub monitor 100113.

In the high BET image are provided a 2 BET button 100213B, a 10 BET button 100214B, a 20 BET button 100215B, and a 100 BET button 100216B. Thus, in the high BET image, the bet amounts of the respective BET buttons are twice as large as those in the regular BET image (refer to FIG. 124 and FIG. 125 above). Accordingly, the denomination of the high BET image is "2". In other words, the minimum bet amount that a player can specify in the high BET image is "2". In contrast, the minimum bet amount that a player can specify in the regular BET image (refer to FIG. 124 and FIG. 125 above) is "1". Accordingly, the denomination of the high BET image is twice the denomination of the regular BET image (refer to FIG. 124 and FIG. 125 above).

In addition, in the high BET image are provided a race button 100234 or a message display area 100235. The race button 100234 is a button that a player touches when he/she wishes to make a race entry of his/her own racehorse in a racing game. The message display area 100235 displays a message ("ODDS×2") indicating that odds will be twice as large as those in the regular BET image (refer to FIG. 124 and FIG. 125 above).

Except for these points, the high BET image is same as the regular BET image (refer to FIG. 124 above), and thus details thereof are omitted.

In S100209, the sub control unit 100102 executes a high odds process. In this process, the CPU 100131 stores in the RAM 100132 the data showing that the odds are doubled, in order to have it included in BET information to be transmitted to the racing game unit 100011 in S100105 below.

In S100210, the sub control unit 100102 executes an image control process. In this process, the CPU 100131 performs necessary other display controls over the regular BET image or the high BET image displayed on the sub monitor 100113. Thereafter, the process proceeds to S100102 of FIG. 124.

Returning to FIG. 135, in S100102, the sub control unit 100102 executes a BET operation acceptance process. In this process, based on a coordinate signal from the touch panel driving circuit 100122, the CPU 100131 identifies the content of the player's BET operation for this racing game and stores it in the RAM 100132. The CPU 100131 also checks time when each BET operation is performed and stores it in the RAM 100132. The CPU 100131 reflects the content of the player's BET operation in the display of the BET images of the sub monitor 100113.

In S100103, the sub control unit 100102 determines whether or not the BET time has elapsed. In this determination, the CPU 100131 checks time until the BET time has elapsed. The BET time is computed by the CPU 100131 based on the data on the racing game information transmitted by the racing game unit 100011 in S101002 above, and begins before this racing game starts and ends at predetermined timing while this racing game is in progress.

In addition, the sub control unit 100102 may determine that the BET time has elapsed, when the remaining time displayed in the time display area 100212 on the regular BET image or the high BET image of the sub monitor 100113 runs out.

Till the BET time elapses (S100103: NO), the sub control unit 100102 returns to S100102 above, and continues with the BET operation acceptance process. When the BET time has elapsed (S100103: YES), the process proceeds to S100104 and the sub control unit 100102 determines whether or not there is a BET. In this determination, the CPU 100131 determines whether or not there is a BET setting for this racing game based on what is stored in S100102 above.

Only when the sub control unit 100102 determines that there is a BET (S100104: YES), the process proceeds to S100105 and the sub control unit 100102 transmits BET information. In this transmission, the CPU 100131 transmits to the racing game unit 100011 the data on the memory content in S100209 or S100102 above, as BET information. Then, when transmitting the BET information to the racing game unit 100011, the CPU 100131 combines a player ID identified through S100202, S100203, S100204, etc. of FIG. 138 above with a No. of the station 100101 and includes them in the BET information thereof. In this respect, if the player uses more than one IC card 100119, the number of player IDs included in the BET information may also be more than one.

In S100106, the sub control unit 100102 executes an entry point increasing process. In this process, the CPU 100131 updates the player's own entry points stored in the RAM 100132, by adding points corresponding to the content of the player's BET operation on this racing game to the player's own entry points. The added entry points are equal to a certain proportion of the total BET amount the player sets for this racing game. The CPU 100131 displays the entry points after the addition in the entry point display area 100231 on the regular BET image or the high BET image of the sub monitor 100113.

In S100107, the sub control unit 100102 executes a racing game payout process. In this process, based on the data on the racing game payout information transmitted by the racing game unit 100011 in S101006 above, the CPU 100131 updates not only the player's own credit amount stored in the RAM 100132, but also the display in the payout amount display area 100220 or the credit amount display area 100221 on the regular BET image or the high BET image of the sub monitor 100113.

In addition, in the sub control unit 100102, the CPU 100131 updates the display in the jackpot display area 100237 on the regular BET image or the high BET image of the sub monitor 100113, based on the data showing the jackpot prize amount included in the racing game payout information.

5-6. Example of Operations for Becoming a Racehorse Owner (the Fifth Embodiment)

In the following, an example of operations for becoming a racehorse owner in the horse race gaming machine 100001 of this embodiment is described. FIG. 136 is a flow chart diagram showing one example of an owner process.

In the respective stations 100101, triggered by a player's touching the owner button 100232 on the regular BET image or the high BET image of the sub monitor 100113, the owner process is executed based on the flow chart of FIG. 136.

First, in S100301, the sub control unit 100102 determines whether or not the player has touched the owner button 100232. In this determination, the CPU 100131 determines whether or not the player has touched the owner button 100232, based on a coordinate signal from the touch panel driving circuit 100122. Now, if the player has not touched the owner button 100232 (S100301: NO), this owner process terminates. In contrast, if the player has touched the owner button 100232 (S100301: YES), the process proceeds to S100302.

Figure 127:
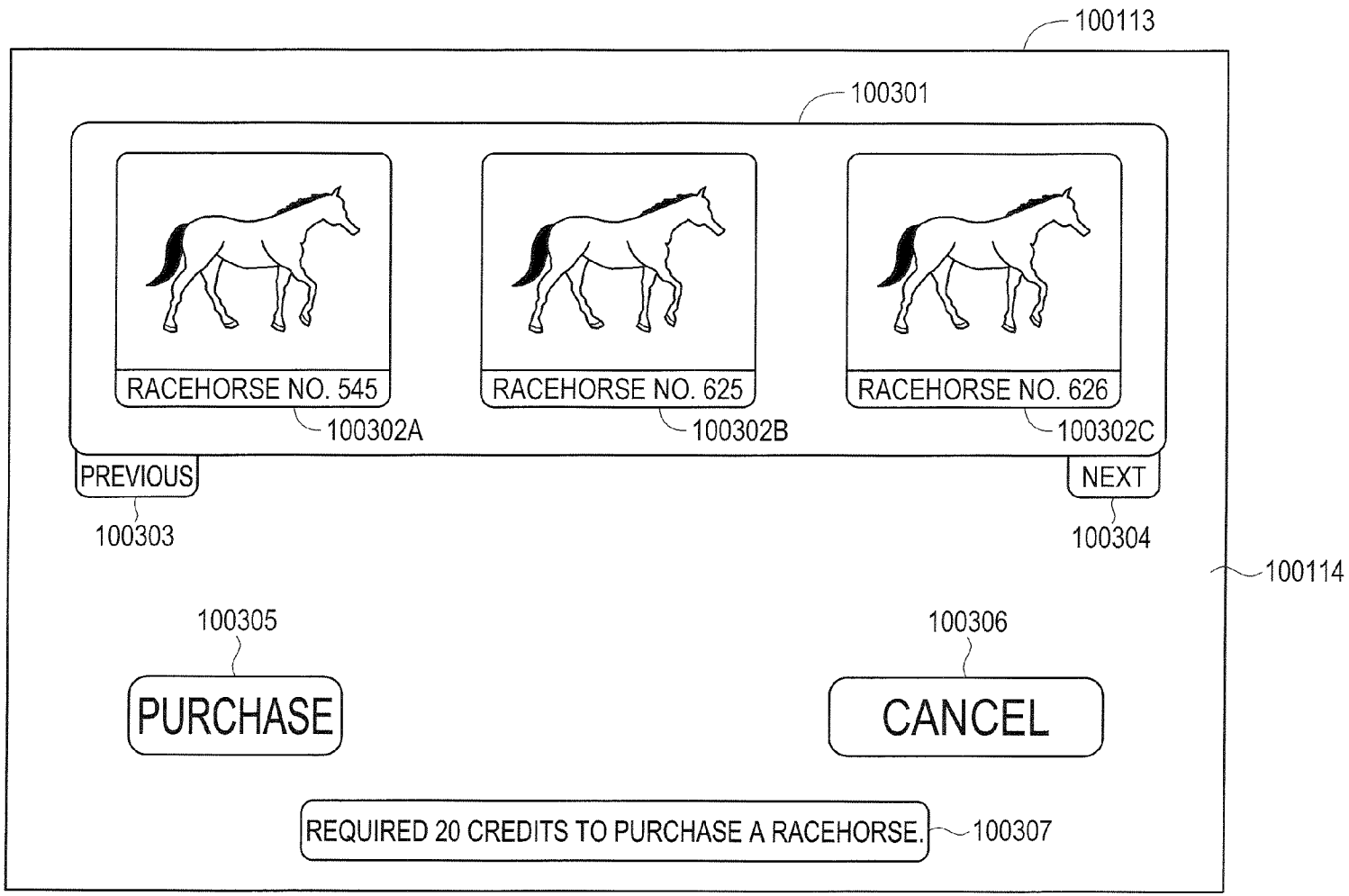

In S100302, the sub control unit 100102 executes an owner image display process. In this process, the CPU 100131 displays an owner image on the sub monitor 100113 based on the data on owner image information received through bidirectional communication with the racing game unit 100011. FIG. 127 shows one example of the owner image displayed on the sub monitor 100113.

As shown in FIG. 127, in the owner image displayed on the sub monitor 100113 covered by the light transmissive colorless touch panel 100114 are provided a racehorse page display area 100301, a previous page button 100303, a next page button 100304, a purchase button 100305, a cancel button 100306 and a message display area 100307, etc.

Three racehorse designation buttons 100302A, 100302B, and 100302C are provided in the racehorse page display area 100301. The respective racehorse designation buttons 100302A, 100302B, and 100302C display videos of racehorses that a player can purchase and their respective designation numbers. A player can designate a racehorse that he/she wishes to purchase, by touching each racehorse designation button 100302A, 100302B and 100302C.

In the racehorse page display area 100301, video of the 3 racehorses that a player can purchase is displayed. If the number of racehorses that a player can purchase is more than 3, a plurality of the racehorse page display areas 100301 will be generated. By touching the previous page button 100303 or the next page button 100304, a player can display any of the plurality of racehorse display areas 100301 on the owner image of the sub monitor 100113.

It is to be noted that the data on racehorses that a player can purchase is included in the owner image information received through bidirectional communication with the racing game unit 100011 in S100302 above.

The purchase button 100305 is a button that a player touches when determining a purchase of the designated racehorse. The cancel button 100306 is a button that a player touches when aborting a purchase of a racehorse. The message display area 100307 displays the message "REQUIRED 20 CREDITS TO PURCHASE A RACEHORSE".

In S100303, the sub control unit 100102 determines whether or not the player has the ability to pay. As shown in the message displayed in the message display area 100307, in this embodiment, 20 credits are required to purchase a racehorse. Therefore, in this determination, the CPU 100131 determines that the player has the ability to pay if the player's own credit amount stored in the RAM 100132 is not less than 20 credits. If the player has no ability to pay (S100303: NO), this owner process terminates. In contrast, if the player has the ability to pay (S100303: YES), the process proceeds to S100304.

In S100304, the sub control unit 100102 executes an owner's operation acceptance process. In this process, the CPU 100131 identifies the content of the player's BET operation in the owner image of the sub monitor 100113, based on a coordinate signal from the touch panel driving circuit 100122, and stores it in the RAM 100132. The CPU 100131 reflects the content of the player's BET operation in the display of the owner image of the sub monitor 100113.

In S100305, the sub control unit 100102 determines whether or not the player has touched the cancel button 100306. In this determination, the CPU 100131 determines whether or not the player has touched the cancel button 100306 based on a coordinate signal from the touch panel driving circuit 100122. Now, if the player has touched the cancel button 100306 (S100305: YES), this owner process terminates. In contrast, if the player has not touched the cancel button 100306 (S100305: NO), the process proceeds to S100306.

In S100306, the sub control unit 100102 determines whether or not the player has touched the purchase button 100305. In this determination, the CPU 100131 determines whether or not the player has touched the purchase button 100305 based on a coordinate signal from the touch panel driving circuit 100122. Now, if the player has not touched the purchase button 100305 (S100306: NO), the process returns to S100302 above. In contrast, if the player has touched the purchase button 100305 (S100306: YES), the process proceeds to S100307.

In S100307, the sub control unit 100102 executes an owner information obtaining process. In this process, the CPU 100131 receives owner information through bidirectional communication with the racing game unit 100011. This owner information includes data obtained as a result of causing the racing game unit 100011 to check whether or not the racehorse designated by the player is purchasable. If the racehorse is purchasable, the racing game unit 100011 puts the racehorse into purchase reserved state to prevent other player from purchasing the racehorse.

Figure 131:
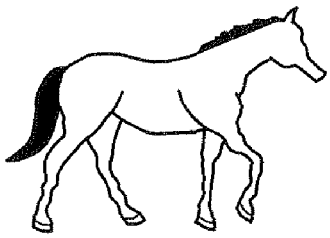
Figure 131:
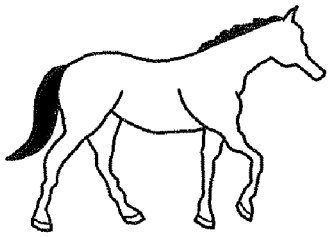
Figure 131:
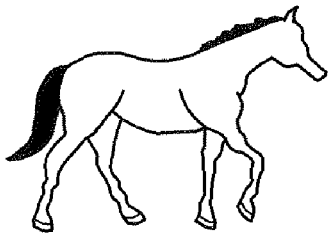

In the racing game unit 100011, the CPU 100041 controls respective racehorses by means of a character ID. For example, as per the data table shown in FIG. 131, the racehorses are associated with the character IDs. Such the table is stored in the RAM 100042 or the external memory device 100025, etc.

In addition, by associating the character IDs with player IDs, the racing game unit 100011 determines whether or not a racehorse is purchasable. For example, as per the data table shown in FIG. 132, the character IDs are associated with the player IDs. Such the data table is stored in the RAM 100042 or the external storage device 100025, etc.

By referring to an association between the character IDs and the player IDs, the racing game unit 100011 can also determine whether or not a player identified by the player ID is an owner of any racehorse. In addition, in the purchase reserved state described above, in the data table as shown in FIG. 132, for example, the racing game unit 100011 controls so that the character ID of the racehorse to be reserved can only be associated with the player ID of the player of that particular reservation.

In S100308, the sub control unit 100102 determines whether or not the racehorse designated by the player is purchasable. In this determination, the CPU 100131 makes a determination based on the data on the owner information received in S100307 above. Now, if the racehorse designated by the player is not purchasable (S100308: NO), the process returns to S100302 above. In contrast, if the racehorse designated by the player is purchasable (S100308: YES), the process proceeds to S100309.

In S100309, the sub control unit 100102 executes a payout process. In this process, by deducting credit amounts necessary for purchasing a racehorse from the player's own credit amount, the CPU 100131 updates not only the player's own credit amount stored in the RAM 100132 but also the display in the credit amount display area 100221 on the regular BET image or high BET image of the sub monitor 100113.

In S100310, the sub control unit 100102 executes an ownerships connections data generation process. In this process, the CPU 100131 generates a player ID according to predetermined rules. However, if an IC card 100119 is inserted into the reader/writer 100118, the CPU 100131 uses the player ID included in horse owner information 100501 (refer to FIG. 133 below) of the IC card 100119. In addition, the CPU 100131 links a character ID of a racehorse of the purchase object with its player ID.

In S100311, the sub control unit 100102 executes a character peculiar data random generation process. In this process, using random numbers, the CPU 100131 generates character peculiar data on characters of a racehorse of the purchase object.

In S100312, the sub control unit 100102 executes a horse owner information generation process. In this process, the CPU 100131 generates horse owner information 100501 as shown in FIG. 133. In the horse owner information 100501, the character peculiar data generated in S100311 above is linked with the character ID and the player ID thereof that were linked to each other in S100310 above. In other words, the horse owner information 100501 includes the data 100502 on player ID generated in S100310 above, the data 100503 on the character ID of the racehorse of the purchase object, and the character peculiar data 100504 generated in S100311 above.

When the horse owner information 100501 is stored in the RAM 100132 by the CPU 100131, it is transmitted to the racing game unit 100011 at the same time. In the racing game unit 100011, the CPU 100041 stores the horse owner information 100501 in the RAM 100042 or the external memory device 100025, etc. In addition, in the racing game unit 100011, the CPU 100041 associates character IDs with player IDs based on the horse owner information 100501.

In S100313, the sub control unit 100102 executes an IC card issuing process. In this process, the CPU 100131 causes the IC card issuing device 100117 to issue an IC card 100119 storing the horse owner information 100501.

In S100314, the sub control unit 100102 determines whether or not to continue operation in the owner image of the sub monitor 100113. Now, if a player touches any part of the owner image within a predetermined period of time from when the IC card issuing device 100117 is caused to issue an IC card 100119, the CPU 100131 determines that the operation continues in the owner image of the sub monitor 100113. Therefore, in this determination, the CPU 100131 determines whether or not the player has touched any part of the owner image of the sub monitor 100113, based on a coordinate signal from the touch panel driving circuit 100122. Now, if the operation continues in the owner image of the sub monitor 100113 (S100314: YES), the process returns to S100302 above. In contrast, if the operation does not continue in the owner image of the sub monitor 100113 (S100314: NO), this owner process terminates.

Figure 128:
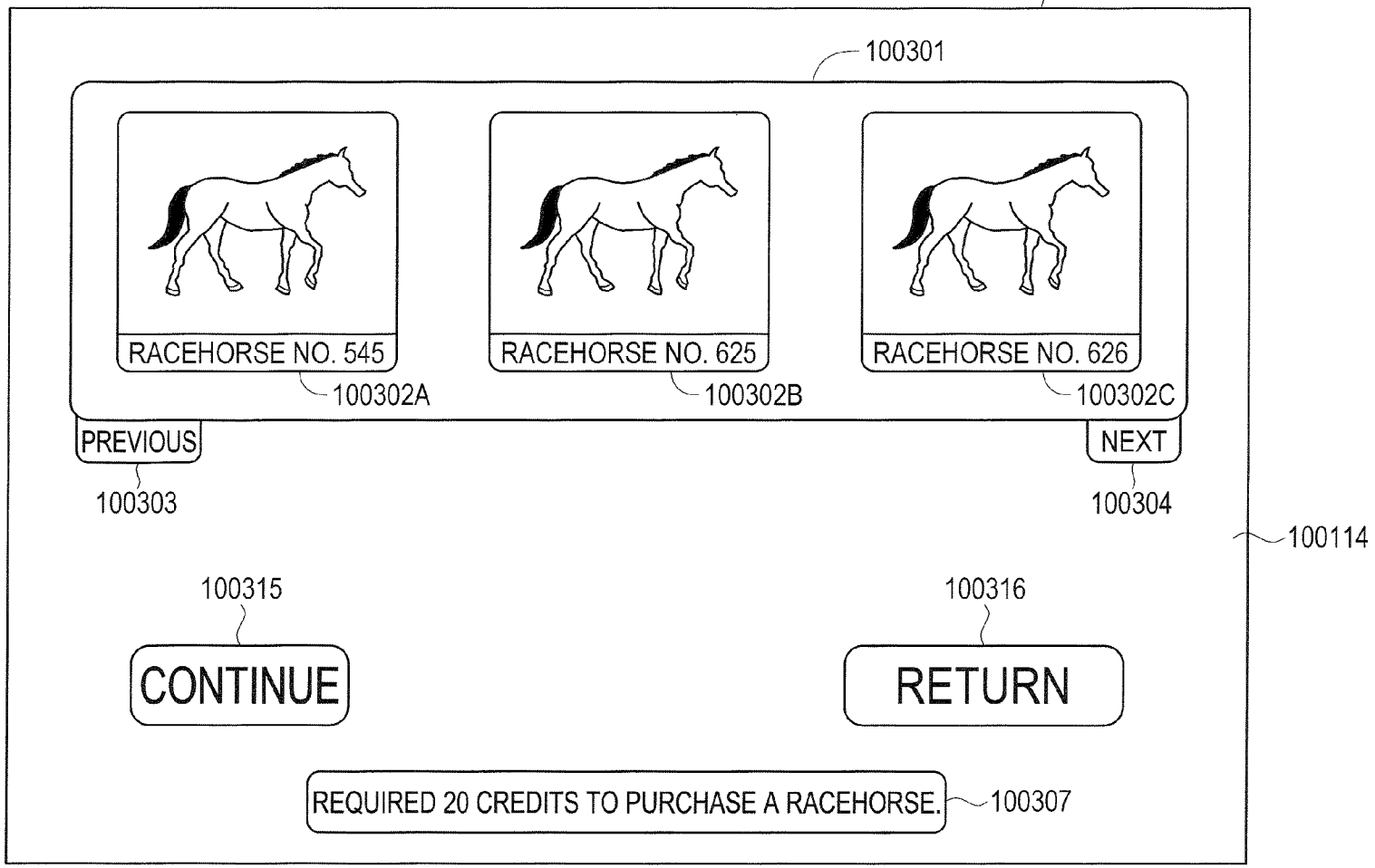

In this respect, the CPU 100131 may be such configured that the process of this S100314 is implemented, by providing a continue button 100315 or a return button 100316 in the owner image of the sub monitor 100113, as shown in FIG. 128.

When this owner process terminates, the sub monitor 100113 returns to the condition before this owner process starts. Therefore, the sub monitor 100113 displays the regular BET image above or the high BET image above.

5-7. Example of Operations for Making a Race Entry of a Player's Racehorse in a Racing Game (the Fifth Embodiment)

In the following, the example of operations for making a race entry of a player's racehorse in a racing game in the horse race gaming machine 100001 according to this embodiment is described. FIG. 137 is a flow chart diagram showing one example of an entry process.

In the respective stations 100101, triggered by a player's touching the race button 100234 on the high BET image of the sub monitor 100113, the entry process is executed based on the flow chart of FIG. 137.

First, in S100401, the sub control unit 100102 determines whether or not a player has touched the race button 100234. In this determination, the CPU 100131 determines whether or not the player has touched the race button 100234 based on a coordinate signal from the touch panel driving circuit 100122. Now, if the player has not touched the race button 100234 (S100401: NO), this entry process terminates. In contrast, if the player has touched the race button 100234 (S100401: YES), the process proceeds to S100402.

Figure 129:
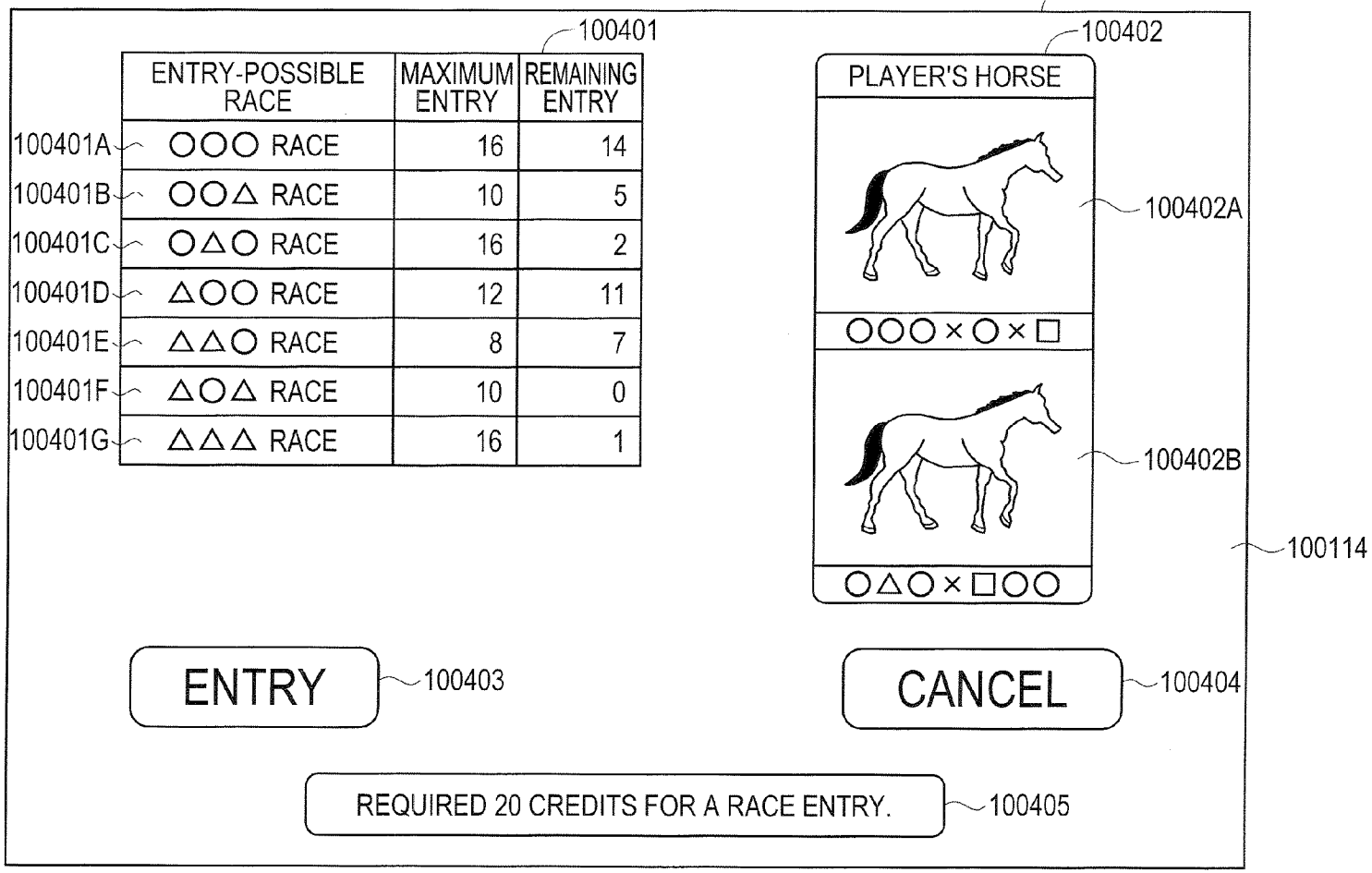
Figure 130:
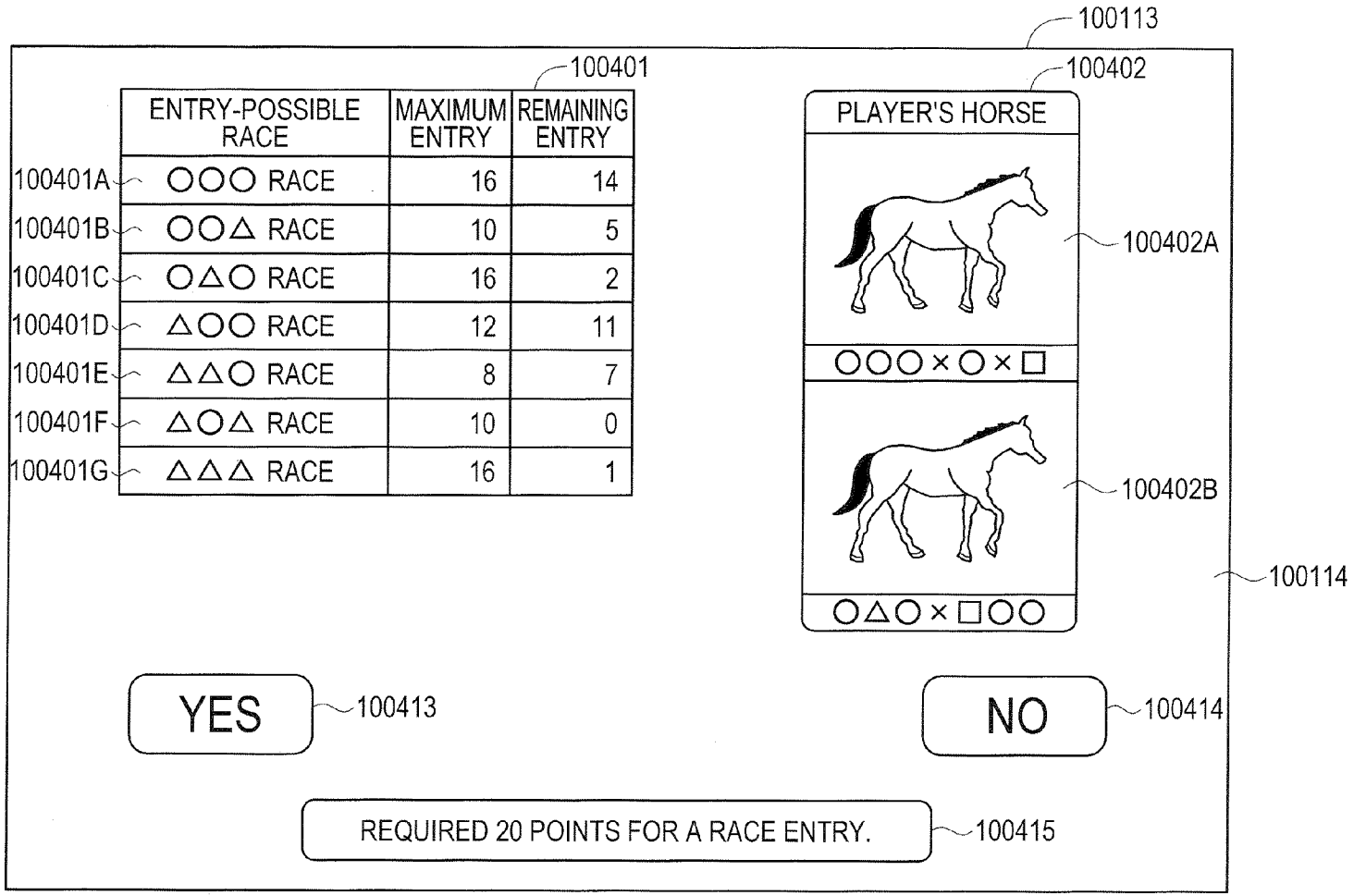

In S100402, the sub control unit 100102 executes an entry-possible race image display process. In this process, the CPU 100131 displays an entry-possible race image on the sub monitor 100113, based on the data on entry-possible race image information received through bidirectional communication with the racing game unit 100011. FIG. 129 and FIG. 130 show one example of the entry-possible race image displayed on the sub monitor 100113.

As shown in FIG. 129, in the entry-possible race image displayed on the sub monitor 100113 covered by the light transmissive colorless touch panel 100114 is provided an entry-possible race display area 100401, a player's horse display area 100402, an entry button 100403, a cancel button 100404 and a message display area 100405, etc.

In the entry-possible race display area 100401 is provided with respective columns for an entry possible race, a maximum entry, and a remaining entry. The entry possible race column displays a name of a racing game in which a race entry of a racehorse is possible. Parts where those names are displayed are used as designation buttons 100401A, 100401B, 100401C, 100401D, 100401E, 100401F, and 100401G for a player to designate a racing game. The maximum entry column displays the number of racehorses that run in a racing game. The remaining entry column displays the number of racehorses that can make a race entry in a racing game.

The player's horse display area 100402 displays racehorses whose owner is a player. Parts in which those racehorses are displayed are used as designation buttons 100402A, 100402B for a player to designate a racehorse.

The data on the entry-possible race display area 100401 or the player's horse display area 100402 is included in the entry-possible race image information received through bidirectional communication with the racing game unit 100011 in S100402 above.

The entry button 100403 is a button that a player touches when he/she wishes to make a race entry of a designated racehorse in a designated racing game. The cancel button 100404 is a button that the player touches to stop race entry. The message display area 100405 displays a message "REQUIRED 20 CREDITS FOR A RACE ENTRY".

In S100403, the sub control unit 100102 determines whether or not the player has the ability to pay. As per the message displayed in the message display area 100405, in this embodiment, 20 credits are required to make a race entry of one racehorse. Therefore, in this determination, the CPU 100131 determines that the player has the ability to pay when the player's own credit amount stored in the RAM 100132 are not less than 20 credits. If the player has no ability to pay (S100403: NO), this entry process terminates. In contrast, if the player has the ability to pay (S100403: YES), the process proceeds to S100404.

In S100404, the sub control unit 100102 executes a race operation acceptance process. In this process, the CPU 100131 identifies the content of the player's operation in the entry-possible race image of the sub monitor 100113, based on a coordinate signal from the touch panel driving circuit 100122 and stores it in the RAM 100132. The CPU 100131 reflects the content of the player's operation in the display of the entry-possible race image of the sub monitor 100113.

In S100405, the sub control unit 100102 determines whether or not the player has touched the cancel button 100404. In this determination, the CPU 100131 determines whether or not the player has touched the cancel button 100404 based on a coordinate signal from the touch panel driving circuit 100122. Now, if the player has touched the cancel button 100404 (S100405: YES), this entry process terminates. In contrast, if the player has not touched the cancel button 100404 (S100405: NO), the process proceeds to S100406.

In S100406, the sub control unit 100102 determines whether or not the player has touched the entry button 100403. In this determination, the CPU 100131 determines whether or not the player has touched the entry button 100403 based on a coordinate signal from the touch panel driving circuit 100122. Now, if the player has not touched the entry button 100403 (S100406: NO), the process returns to S100402 above. In contrast, if the player has touched the entry button 100403 (S100406: YES), the process proceeds to S100407.

In S100407, the sub control unit 100102 executes an entry-possible race information obtaining process. In this process, the CPU 100131 receives entry-possible race information through bidirectional communication with the racing game unit 100011. This entry-possible race information includes data as a result of causing the racing game unit 100011 to check whether or not a racehorse designated by the player can make a race entry in a designated racing game. If the race entry is possible, the racing game unit 100011 puts that race entry into a reserved state.

In the racing game unit 100011, the CPU 100041 controls race entries of respective racing games by means of character IDs. For example, as per the data table shown in FIG. 134, a racing game and character IDs are associated. Such the data table is stored in the RAM 100042 or the external memory device 100025, etc.

In S100408, the sub control unit 100102 determines whether or not a racehorse designated by the player can make a race entry in a designated racing game. In this determination, the CPU 100131 makes a determination based on the data on the entry-possible race information received in S100407 above. Now, if the racehorse designated by the player can make a race entry in the designated racing game (S100408: YES), the process proceeds to S100413 below. In contrast, if the racehorse designated by the player cannot make a race entry in the designated racing game (S100408: NO), the process proceeds to S100409.

In this embodiment, it is possible to forcibly make a race entry in a racing game designated by a player (refer to S100414 below) on the condition that the player pays 20 points from the player's own entry points (refer to S100412 below), even though there is no longer any racehorse that can make a race entry in the racing game.

In S100409, the sub control unit 100102 executes a sub monitor display process. In this process, the CPU 100131 changes the entry-possible race image being displayed on the sub monitor 100113 to an entry-possible race image as shown in FIG. 130. In other words, instead of the entry button 100403, the cancel button 100404, and the message display area 100405 are provided a YES button 100413, a NO button 100414 and a message display area 100415.

The YES button 100413 is a button that the player touches to ensure race entry of a designated racehorse in a designated racing game. The NO button 100414 is a button that the player touches to stop race entry of a designated racehorse in a designated racing game. The message display area 100415 displays the message "REQUIRED 20 POINTS FOR A RACE ENTRY".

In S100410, the sub control unit 100102 determines whether or not the player has touched the NO button 100414. In this determination, the CPU 100131 determines whether or not the player has touched the NO button 100414 based on a coordinate signal from the touch panel driving circuit 100122. Now, if the player has touched the NO button 100414 (S100410: YES), the process returns to S100402 above. Then, the CPU 100131 causes the racing game unit 100011 to cancel the reservation of the race entry described above, by transmitting a control signal to the racing game unit 100011. In contrast, if the player has not touched the NO button 100414 (S100410: NO), the process proceeds to S100411.

In S100411, the sub control unit 100102 determines whether or not the player has touched the YES button 100413. In this determination, the CPU 100131 determines whether or not the player has touched the YES button 100413, based on a coordinate signal from the touch panel driving circuit 100122. Now, if the player has not touched the YES button 100413 (S100411: NO), the process returns to S100410 above. In contrast, if the player has touched the YES button 100413 (S100411: YES), the process proceeds to S100412.

In S100412, the sub control unit 100102 executes an entry point deduction process. In this process, by deducting from the player's own entry points the points necessary to make a race entry in a racing game, the CPU 100131 updates not only the player's own entry points stored in the RAM 100132 but also the display in the entry point display area 100231 on the high BET image of the sub monitor 100113.

In this respect, all of the player's own entry points may be deducted.

It is to be noted that the sub control unit 100102 skips a payout process of S100413 below, if this entry point deduction process is executed.

In S100413, the sub control unit 100102 executes the payout process. In this process, by deducting credit amounts necessary for making a race entry in a racing game from the player's own credit amount, the CPU 100131 updates not only the player's own credit amount stored in the RAM 100132 but also the display in the credit amount display area 100221 on the high BET image of the sub monitor 100113.

In S100414, the sub control unit 100102 executes a race entry process. In this process, when storing in the RAM 100132 race entry information including data on race entry determination, etc. (data showing player IDs or character IDs, or determinations), the CPU 100131 simultaneously transmits it to the racing game unit 100011. In the racing game unit 100011, the CPU 100041 associates a racing game with a character ID based on data on this information. In particular, if the player has paid 20 points from the player's own entry points, a race entry in the racing game is forcibly done. The racing game unit 100011 may enable this forcible race entry by increasing the number of racehorses to run the racing game, or by replacing any of the racehorses that have already been registered, with it.

In S100415, the sub control unit 100102 determines whether or not operation continues in the entry-possible race image of the sub monitor 100113. Now, if the player touches any part of the entry-possible race image of the sub monitor 100113 within a predetermined period of time from when the player touched the YES button 100413, the CPU 100131 determines that the operation continues in the entry-possible race image of the sub monitor 100113. Thus, if the operation continues in the entry-possible race image of the sub monitor 100113 (S100415: YES), the process returns to S100402 above. In contrast, if the operation does not continue in the entry-possible race image of the sub monitor 100113 (S100415: NO), this entry process terminates.

When this entry process terminates, the sub monitor 100113 returns to the condition before the entry process starts. Therefore, the sub monitor 100113 displays the high BET image above.

5-8. Maintenance of Racehorses (the Fifth Embodiment)

In the horse race gaming machine 100001 of this embodiment, a racehorse whose owner is any player may get ill. If a racehorse gets ill, a player who is the owner selects whether to treat or sell the racehorse. If the player selects to treat, 10 credits will be deducted from the player's own credit amount as a medical expense. In contrast, if the player selects to sell, 10 credits will be added to the player's own credit amount as proceeds from the sale.

For this reason, in the horse race gaming machine 100001 of this embodiment, following the flow chart of FIG. 135, game operations of a flow chart of FIG. 139 are performed.

In the racing game unit 100011, every time each racing game ends, respective operations from S101006-2 to S101009 are performed.

First, in S101006-2, the main control unit 100012 executes a sickly horse determination process. In this process, the CPU 100041 randomly selects a character ID of a racehorse that gets ill.

In S101007, the main control unit 100012 executes a player identification process. In this process, the CPU 100041 identifies a player ID associated with the character ID selected in S101006-2 above by the data table in FIG. 132 above. In addition, the CPU 100041 identifies the station 100101 at which the player with the identified player ID plays, by the identified player ID and the data table shown in FIG. 140 above.

In S101008, the main control unit 100012 transmits sickly horse information. In this transmission, the CPU 100041 transmits data on racehorses that get ill, as the sickly horse information, to the station 100101 identified in S101007 above.

In S101007 above, some character IDs selected in S101006-2 above may have no corresponding player IDs. In this case, there is no owner of a racehorse that gets ill. In some cases, the identified player ID may not be in the data table of FIG. 140 above. In this case, the player who is the owner of the racehorse that gets ill is not playing at any station 100101. In such cases, no sickly horse information is transmitted in this process of S101008.

In S101009, the main control unit 100012 executes a recording process. In this process, the CPU 100041 stores in a database a prize and a maintenance cost of each player who is a horse owner, based on the respective payment amounts in S101005 above or data on handling information transmitted by the station 100101 in S100110 below. As shown in FIG. 141, the database stores the prize and the maintenance cost associated with respective racing game numbers, on a calculation table generated for every player ID.

If the handling information transmitted by the station 100101 in S100110 below includes data to the extent that the player treats the racehorse that has got ill, 10 credits considered as its medical expense is stored in the database as a maintenance cost for the player ID of the player. In contrast, the prize the player is awarded in racing games is stored as a prize for the player ID of the player, in the database. In addition, if the handling information transmitted by the station 100101 in S100110 below includes the data to the extent that the player sells the racehorse that has got ill, 10 credits considered as its proceeds from the sale is stored in the database as a prize for the player ID of the player. Such the database is stored in the RAM 100042 or the external memory device 100025, etc.

In contrast, at the respective stations 100101, every time each racing game ends, respective operations of S100108 and S100109 are performed.

First, in S100108, the sub control unit 100102 executes a sub monitor display process. In this process, the CPU 100131 displays the handling image as shown in FIG. 143 on the sub monitor 100113, provided that the sickly horse information in S101008 above was received. As shown in FIG. 143, in the handling image displayed on the screen of the sub monitor 100113 covered by the light transmissive colorless touch panel 100114 are provided a sickly horse display area 100701, a sickly horse information message display area 100702, a treatment button 100703, and a sell button 100704.

In the sickly horse display area 100701, racehorses that are considered to get ill are displayed. Those displayed racehorses are identified based on the data on the racehorses that get ill, included in the sickly horse information of S101008 above. The sickly horse information message display area 100702 of S100108 above displays the message "YOUR RACE HORSE HAS GOT ILL. HOW WOULD YOU HANDLE THIS? REQUIRED 10 CREDITS FOR A MEDICAL TREATMENT.". The treatment button 100703 is a button that the player touches when wishing to have a racehorse, considered to get ill, treated. The sell button 100704 is a button that the player touches when wishing to sell a racehorse considered to get ill.

Returning to FIG. 139, the sub control unit 100102 executes a handling process in S100109. In the station 100101, this handling process is executed based on a flow chart of FIG. 144.

First, in S100601, the sub control unit 100102 determines whether or not the player has touched the treatment button 100703. In this determination, the CPU 100131 determines whether or not the player has touched the treatment button 100703, based on a coordinate signal from the touch panel driving circuit 100122. Now, if the player has not touched the treatment button 100703 (S100601: NO), the process proceeds to S100604 below. In contrast, if the player has touched the treatment button 100703 (S100601: YES), the process proceeds to S100602.

In S100602, the sub control unit 100102 determines whether or not the player satisfies a predetermined condition. As per the message displayed in the sickly horse information message display area 100702, in this embodiment, 10 credits are required to treat one racehorse. Then, in this determination, the CPU 100131 determines that the player satisfies the predetermined condition when the player's own credit amount stored in the RAM 100132 is not less than 10 credits. Now, if the player has not satisfied the predetermined condition (S100602: NO), the process proceeds to S100110 in FIG. 139 above. In contrast, if the player satisfies the predetermined condition (S100602: YES), the process proceeds to S100603.

In S100603, the sub control unit 100102 executes a maintenance determination process. In this process, the CPU 100131 causes handling information to be transmitted in S100110 below to include data to the extent that the player treats a racehorse that has got ill. In addition, the CPU 100131 updates the player's own credit amount stored in the RAM 100132, accompanying a deduction of 10 credits necessary as a medical expense from the player's own credit amount. In addition, the CPU 100131 updates the display in the payout amount display area 100220 or the credit amount display area 100221 on the regular BET image or the high BET image, when the regular BET image or the high BET image is displayed on the sub monitor 100113. Thereafter, the process proceeds to S100110 of FIG. 139 above.

In contrast, in S100604, the sub control unit 100102 determines whether or not the player has touched the sell button 100704. In this determination, the CPU 100131 determines whether or not the player has touched the sell button 100704 based on a coordinate signal from the touch panel driving circuit 100122. Now, if the player has not touched the sell button 100704 (S100604: NO), the process returns to S100601 above. In contrast, if the player has touched the sell button 100704 (S100604: YES), the process proceeds to S100605.

In S100605, the sub control unit 100102 executes a prize determination process. In this process, the CPU 100131 causes the handling information to be transmitted in S100110 below to include data to the extent that the player sells the racehorse that has got ill. In addition, the CPU 100131 updates the player's own credit amount stored in the RAM 100132, accompanying an inclusion of 10 credits to be paid as proceeds from the sale into the player's credit own amount. In addition, the CPU 100131 updates the display in the payout amount display area 100220 or the credit amount display area 100221 on the regular BET image or the high BET image when the regular BET image or the high BET image is displayed on the sub monitor 100113. Thereafter, the process proceeds to S100110 of FIG. 139 above.

Returning to FIG. 139, in S100110, the sub control unit 100102 transmits the handling information. In this transmission, the CPU 100131 transmits the handling information including the data on handling of the player on the racehorse that has got ill.

With the above, in the horse race gaming machine 100001 of this embodiment, every time a racing game ends, a racehorse that gets ill is determined. Then, depending on selection of the player who is the owner of the racehorse that has got ill, 10 credits are included in either the player's maintenance cost or prize.

5-9. Privilege Depending on a Total Prize Amount of a Horse Owner (the Fifth Embodiment)

In the horse race gaming machine 100001 of this embodiment, whenever a racing game is played 100 times, a total prize amount of a player who is an owner of a racehorse is calculated. A part of the jackpot prize is awarded to the player who is the owner of the racehorse, depending on a rank corresponding to the calculated total prize amount.

For this reason, in the race gaming unit 100011, at the time point P100001 located midway between S101005 and S101006 described in the flow chart of FIG. 135 above, the main control unit 100012 executes respective processes described in the flow chart of FIG. 119.

First, in S100501, the main control unit 100012 increments a variable N. This variable N is retained in the RAM 100042.

In S100502, the main control unit 100012 determines whether or not the variable N is "100". Now, if the variable N is not "100" (S100502: NO), the process proceeds to S101006 of FIG. 135 above. In contrast, if the variable N is "100" (S100502: YES), the process proceeds to S100503. With this, a control is exercised that the following respective processes are executed, whenever a racing game is played 100 times.

In S100503, the main control unit 100012 executes a horse owner identification process. In this process, the CPU 100041 identifies a player ID of a player who is an owner of any racehorse, among players playing at the respective stations 100101. The data table in FIG. 132 above and the data table in FIG. 140 above are used in that identification.

In S100504, the main control unit 100012 executes an all prize calculation process. In this process, for every player identified in S100503 above, the CPU 100041 calculates an all prize amount that the player has earned, respectively. For this calculation, the player ID identified in S100503 above and the database of FIG. 141 above are used.

In S100505, the main control unit 100012 executes an all maintenance cost calculation process. In this process, for every player identified in S100503 above, the CPU 100041 calculates an all maintenance cost the player has paid, respectively. For this calculation, the player ID identified in S100503 above and the database of FIG. 141 above are used.

In S100506, the main control unit 100012 executes a total earning calculation process. In this process, for every player identified in S100503 above, the CPU 100041 calculates a total earning of the player, respectively. For this calculation, the all prize amount calculated in S100504 above and the all maintenance cost calculated in S100505 above are used.

In S100507, the main control unit 100012 executes a ranking specifying process. In this process, for every player identified in S100503 above, the CPU 100041 specifies a rank corresponding to the player's total earning. For this, the data table as shown in FIG. 142 is used.

In the data table of FIG. 142, the proportion of the total earning to the jackpot prize is associated with the 3 ranks. To be specific, the total earning of "1000" or more and the proportion of the jackpot prize of 20% are associated with the rank "S". The total earning of "500 to 999" and the proportion of the jackpot prize of "5%" are associated with the rank "A". The total earning of "100 to 499" and the proportion of the jackpot prize of "1%" are associated with the rank "B". In addition, such data table is stored in the RAM 100042 or the external storage device 100025, etc.

In S100508, the main control unit 100012 executes a jackpot sharing process. In this process, for every player identified in S100503 above, the CPU 100041 determines a jackpot prize amount to be awarded to the player. For this determination, the data table of FIG. 142 above is used. In other words, with reference to then the jackpot prize amount, the jackpot prize amount to be awarded to the player is determined based on the proportion of the jackpot prize associated with the rank identified in S100507 above.

In addition, the CPU 100041 causes the racing game payout information to be transmitted in S101006 of FIG. 135 above to include the determined amount in this process.

In S100509, the main control unit 100012 assigns "0" to the variable N. Thereafter, the process proceeds to S101006 of FIG. 135 above.

What is claimed is:

1. A horse race gaming machine comprising:

a plurality of racing games constituting a horse racing game;

a plurality of stations each provided with:

a bet amount specifying device with which a player specifies a bet amount for any of a plurality of racehorses which are run in a current racing game; and an input device with which a player inputs information used for progressing the horse racing game; and a processor which is programmed, for progressing the horse racing game by controlling the plurality of stations, to execute processes of:

(1) determining whether or not a player has become an owner of any one of the racehorses based on an input made by the player using the input device; and (2) in the station at which the player who is determined to have become an owner of any one of the racehorses is playing:

(2-1) determining whether or not the racehorses whose owner is the player, in consecutive racing games equal to or more than a predetermined number of times including the current racing game, have finished consecutively in a place equal to or lower than a predetermined place; and (2-2) refunding, from a credit amount corresponding to total bet amount for the current racing game specified by the player with the bet amount specifying device, to the player, a credit amount corresponding to the number of times of consecutive racing games in which the racehorses whose owner is the player have finished consecutively in a place equal to or lower than the predetermined place, if it is determined that the racehorses whose owner is the player, in consecutive racing games equal to or more than the predetermined number of times including the current racing game, have finished consecutively in a place equal to or lower than the predetermined place.

2. The horse race gaming machine of claim 1, further comprising:

entry points which is given to each player playing at one of the plurality of stations and is accumulated according to a bet amount specified by the player through an input with the bet amount specifying device, wherein the processor is programmed to execute processes of:

in the station at which the player who is determined to have become an owner of any one of the racehorses is playing:

(a) having the racehorse, whose owner is the player, run in the current racing game, on condition that, before the current racing game is started, the player pays all or part of the entry points, which is given to the player who is determined to have become an owner of any one of the racehorses, through the input with the input device.

3. The horse race gaming machine of claim 1, further comprising:

a side bet amount specifying device which is a device provided for each of the plurality of stations, the side bet amount specifying device with which a player specifies a side bet amount for a current racing game, wherein the processor is programmed to execute processes of:

in the station at which the player who is determined to have become an owner of any one of the racehorses is playing:

(a) having the racehorse, whose owner is the player, run in the current racing game, on condition that, before the current racing game is started, the player has specified a side bet amount for the current racing game with the side bet amount specifying device.

4. The horse race gaming machine of claim 1, further comprising:

a plurality of character IDs which are respectively applied to the respective racehorses;

a plurality of player IDs which are respectively applied to players who play at the plurality of stations; and a memory storing data related the plurality of character IDs, wherein the processor is programmed to execute processes of:

(a) applying the player ID to a player based on an input made by the player using the input device;

(b) generating ownerships connections data linking the character ID of the racehorse whose owner is the player to the player ID applied;

(c) storing the ownerships connections data in the memory device; and (d) identifying the racehorse whose owner is the player based on the respective ownerships connections data stored in the memory.

5. A horse race gaming machine comprising:

a plurality of racing games constituting a horse racing game;

a plurality of stations each provided with:

a bet amount specifying device with which a player specifies a bet amount for any of a plurality of racehorses which are run in a current racing game; and an input device with which a player inputs information used for progress of the horse racing game; and a processor which is programmed, for executing a side game, with which a racing game in which a payout is awarded to a player is accompanied, based on a bet amount specified by the player through an input with the bet amount specifying device and a racing game result of the racehorse for which the bet amount is specified, to execute processes of:

(1) identifying the racehorse whose owner is a player based on an input made by the player using the input device;

(2) calculating number of the racehorses whose owner is a player playing at any one of the plurality of stations among the racehorses which are going to run in the current racing game, based on a result of the identification;

(3) ranking the player who is an owner of one of the racehorses in accordance with an order of arrival of the respective racehorses in the current racing game if it is determined that the calculated number of the racehorses is equal to or more than a predetermined number; and (4) awarding respective payout which depended on the respective ranks which are set at the ranking to each of the players.

6. The horse race gaming machine of claim 5, further comprising:

entry points which is given to each player playing at one of the plurality of stations and is accumulated according to a bet amount specified by the player through an input with the bet amount specifying device; and a sub monitor which is a monitor provided for each of the plurality of stations, the sub monitor which displays gaming information concerning the horse racing game, wherein the processor is programmed to execute processes of:

(a) determining whether or not a player has become an owner of any one of the racehorses based on an input made by the player using the input device; and (b) in the station at which the player who is determined to have become an owner of any one of the racehorses is playing:

(b-1) displaying on the sub monitor a message asking whether to have the racehorse, whose owner is the player, run in the current racing game; and (b-2) having the racehorse, whose owner is the player, run in the current racing game, on condition that, before the current racing game is started, the player pays all or part of the entry points, which is given to the player who is determined to have become an owner of any one of the racehorses, through the input with the input device.

7. The horse race gaming machine of claim 5, further comprising:

a side bet amount specifying device which is a device provided for each of the plurality of stations, the side bet amount specifying device with which a player specifies a side bet amount for a current racing game; and a sub monitor which is a monitor provided for each of the plurality of stations, the sub monitor which displays gaming information concerning the horse racing game, wherein the processor is programmed to execute processes of:

(a) determining whether or not a player has become an owner of any one of the racehorses based on an input made by the player using the input device; and (b) in the station at which the player who is determined to have become an owner of any one of the racehorses is playing:

(b-1) displaying on the sub monitor a message asking whether to have the racehorse, whose owner is the player, run in the current racing game; and (b-2) having the racehorse, whose owner is the player, run in the current racing game, on condition that, before the current racing game is started, the player has specified a side bet amount for the current racing game with the side bet amount specifying device.

8. The horse race gaming machine of claim 5, further comprising:

a plurality of character IDs which are respectively applied to the respective racehorses;

a plurality of player IDs which are respectively applied to players who play at the plurality of stations; and a memory storing data related the plurality of character IDs, wherein the processor is programmed to execute processes of:

(a) applying the player ID to a player based on an input made by the player using the input device;

(b) generating ownerships connections data linking the character ID of the racehorse whose owner is the player to the player ID applied;

(c) storing the ownerships connections data in the memory device; and (d) identifying the racehorse whose owner is the player based on the respective ownerships connections data stored in the memory.

* * * * *